US008736533B2

(12) United States Patent
Lee

(10) Patent No.: US 8,736,533 B2
(45) Date of Patent: May 27, 2014

(54) COST-EFFECTIVE DISPLAY METHODS AND APPARATUSES

(71) Applicant: Sang Tae Lee, San Jose, CA (US)

(72) Inventor: Sang Tae Lee, San Jose, CA (US)

( * ) Notice: Subject to any disclaimer, the term of this patent is extended or adjusted under 35 U.S.C. 154(b) by 0 days.

(21) Appl. No.: 13/904,017

(22) Filed: May 29, 2013

(65) Prior Publication Data

US 2013/0300781 A1 Nov. 14, 2013

Related U.S. Application Data

(62) Division of application No. 12/983,880, filed on Jan. 3, 2011, now abandoned.

(51) Int. Cl.
*G09G 3/36* (2006.01)

(52) U.S. Cl.
USPC ..... 345/96; 345/54; 345/209

(58) Field of Classification Search
USPC ..... 345/54, 87–104, 204–215, 690–699
See application file for complete search history.

(56) References Cited

U.S. PATENT DOCUMENTS 5,926,161 A * 7/1999 Furuhashi et al. ..... 345/100
6,327,008 B1 * 12/2001 Fujiyoshi ..... 349/106
7,205,969 B2 * 4/2007 Song ..... 345/87
7,796,108 B2 * 9/2010 Hirakata ..... 345/96
7,821,512 B2 * 10/2010 Yi ..... 345/211
8,471,793 B2 * 6/2013 Irie et al. ..... 345/87
2001/0041376 A1 * 11/2001 Watanabe et al. ..... 438/4
2001/0048764 A1 * 12/2001 Betrisey et al. ..... 382/162
2002/0101415 A1 * 8/2002 Song ..... 345/211
2004/0239655 A1 * 12/2004 Tani et al. ..... 345/204
2006/0197728 A1 * 9/2006 Miyai et al. ..... 345/92
2007/0070024 A1 * 3/2007 Araki et al. ..... 345/102
2007/0115237 A1 * 5/2007 Hirakata ..... 345/96
2008/0180371 A1 * 7/2008 Shie ..... 345/87
2009/0002301 A1 * 1/2009 Koo et al. ..... 345/89
2009/0102991 A1 * 4/2009 Chen et al. ..... 349/33
2009/0262061 A1 * 10/2009 Chung et al. ..... 345/100
2009/0310077 A1 * 12/2009 Kim et al. ..... 349/151
2010/0097366 A1 * 4/2010 Kitayama et al. ..... 345/213
2010/0118013 A1 * 5/2010 Kitayama et al. ..... 345/211
2010/0182292 A1 * 7/2010 Kouno ..... 345/205
2010/0231564 A1 * 9/2010 Min et al. ..... 345/209
2011/0096050 A1 * 4/2011 Lee et al. ..... 345/209
2011/0170014 A1 * 7/2011 Irie et al. ..... 348/731
2014/0002431 A1 * 1/2014 Shibata et al. ..... 345/208

* cited by examiner

*Primary Examiner* — Dmitriy Bolotin
(74) *Attorney, Agent, or Firm* — Invent Capture, LLC.; Samuel S. Cho

(57) ABSTRACT

In first aspect of the invention, driving methods of gate interlaced scanning for color LCD are disclosed. This interlaced scanning involves powering odd gate lines sequentially first and then powering even gate lines sequentially, which can minimize the voltage polarity swing to reduce power consumption in source output block. In second aspect of the invention, driving methods of FSCLCD having an RGB LED backlight unit scanning with an increased LED lamp turn on time and reduced potential non-uniformity near modular light guid panel are disclosed. Novel driving methods of variabnt sub-color frame periods are also disclosed with various color sub-frames. In third aspect of the invention, a dual common electrode color LCD with a source driver IC block with lower driving voltage and lower power consumption in the display panel is disclosed, wherein each common electrode voltage has opposite voltage phase to reduce the source driving voltage.

18 Claims, 107 Drawing Sheets

Pixel polarity at invented interlaced gate vertical scanning when 2H dot (sub-pixel) inversion in CF TFT LCD

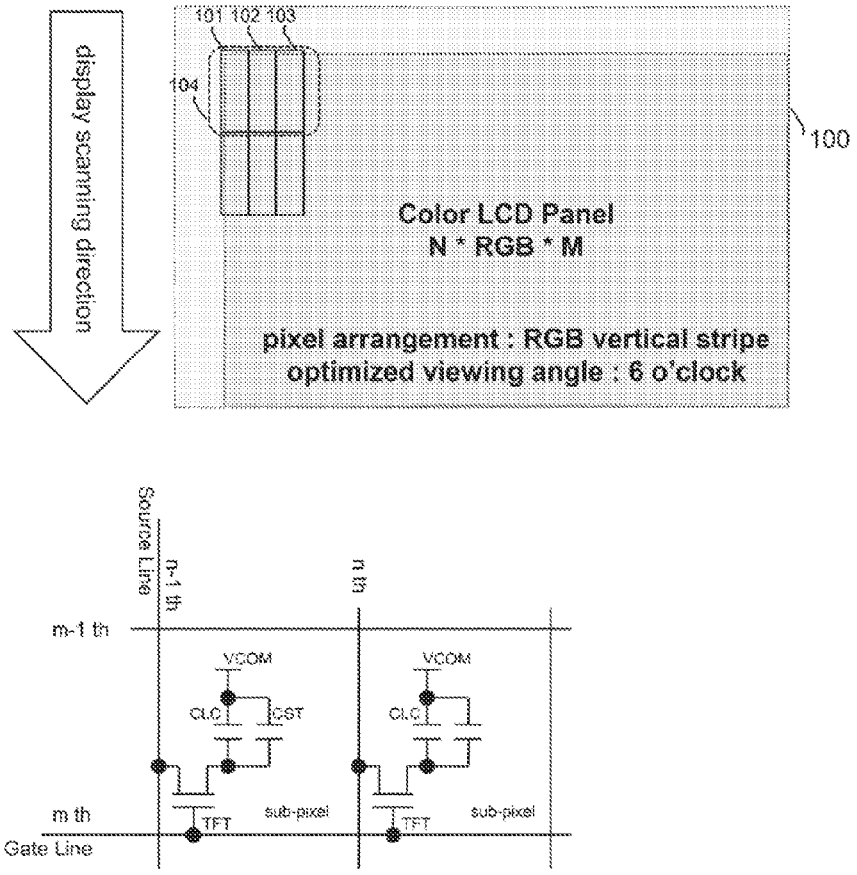
Figure 1A Pixel structure of conventional CF TFT LCD
having RGB vertical stripe pixel arrangement for gate vertical scanning

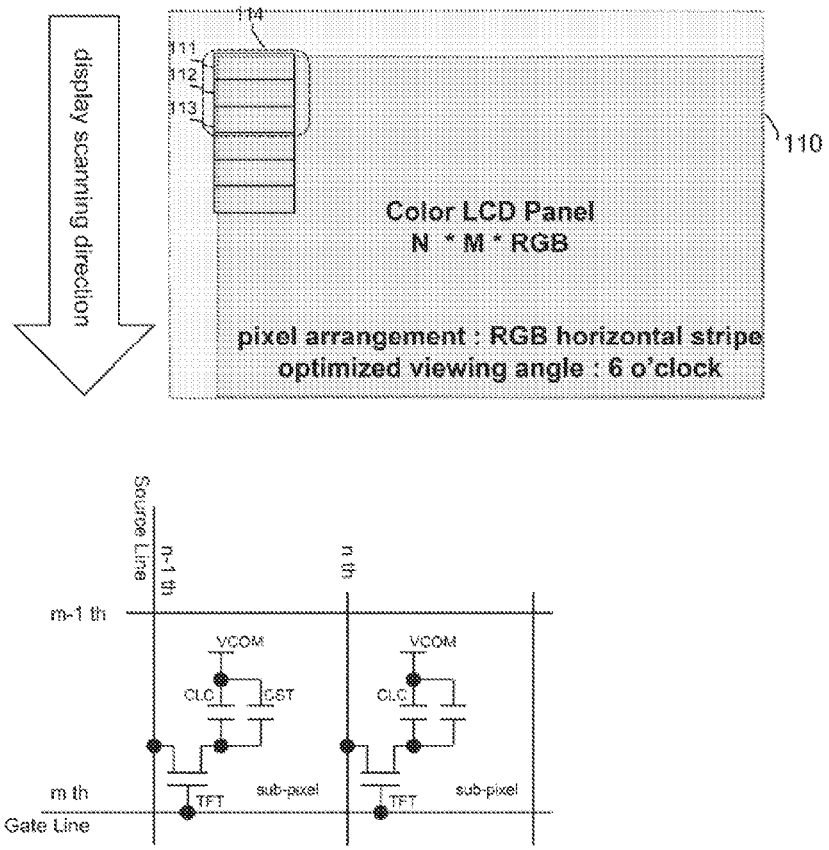
Figure 1B Pixel structure of conventional CF TFT LCD
having RGB Horizontal stripe pixel arrangement for gate vertical scanning

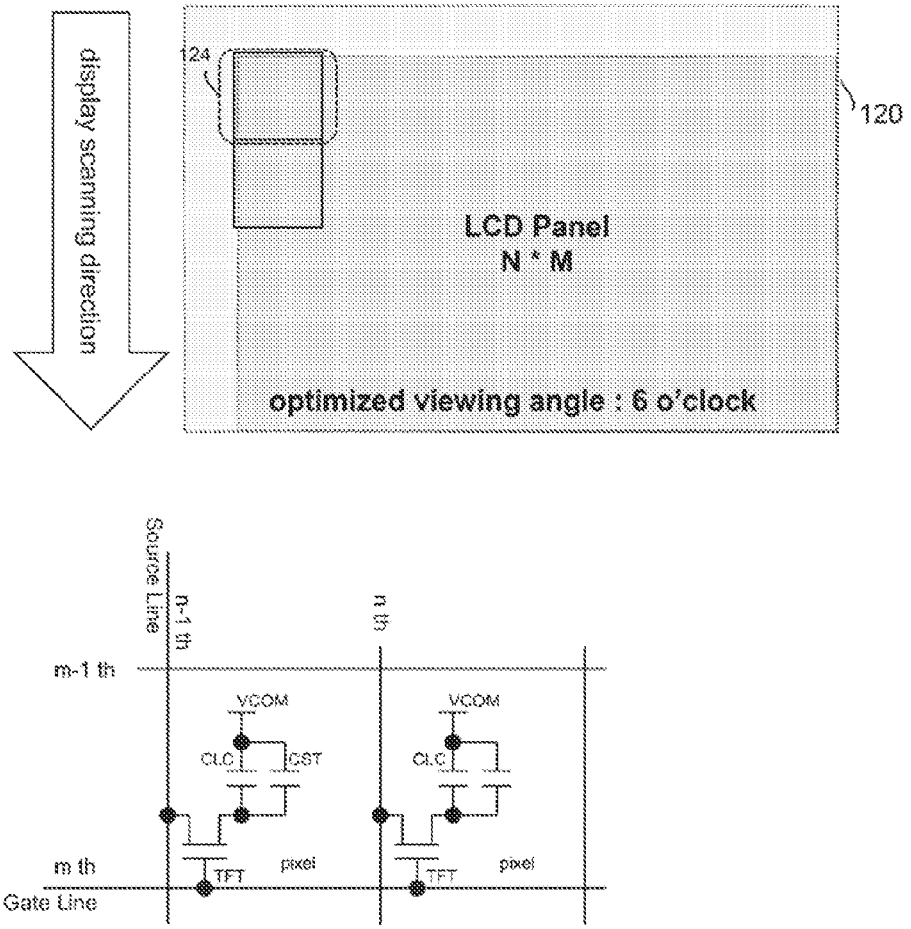
Figure 1C Pixel structure of FSC LCD
having no color filter for gate vertical scanning

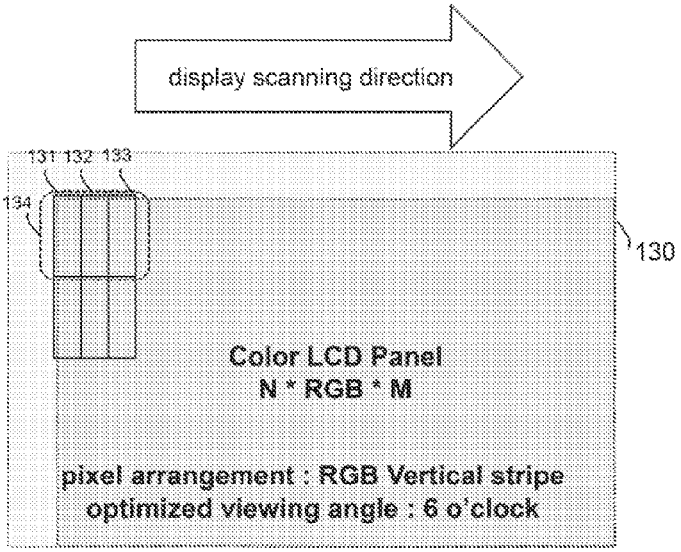
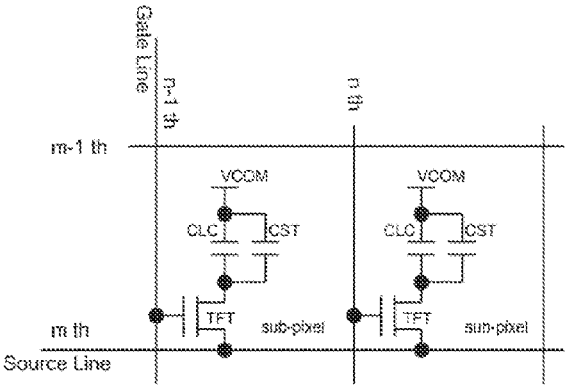
Figure 1D Pixel structure of CF TFT LCD
having RGB Vertical stripe pixel arrangement for gate horizontal scanning

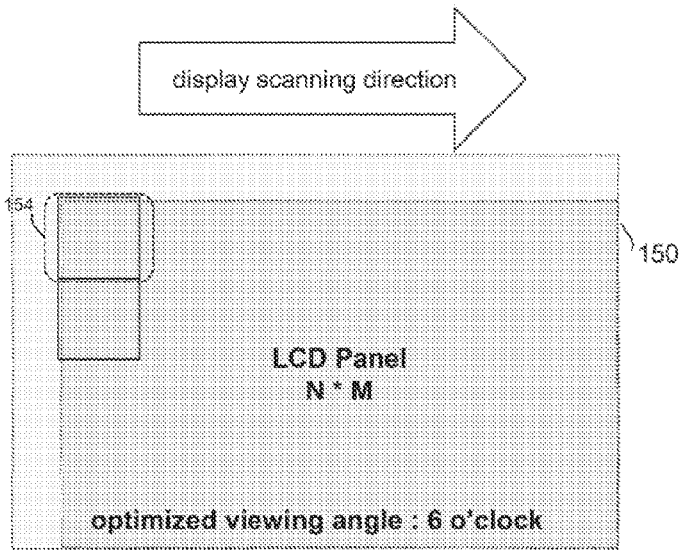
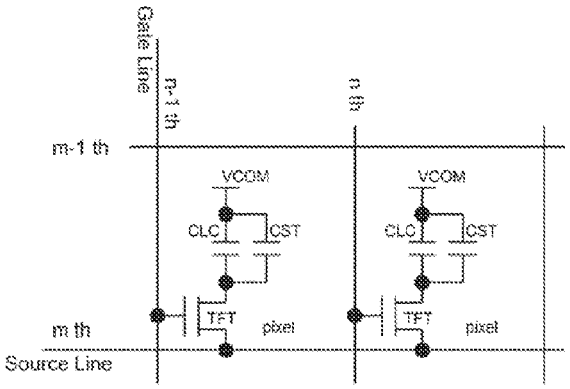
Figure 1E Pixel structure of FSC LCD
having no color filter for gate horizontal scanning

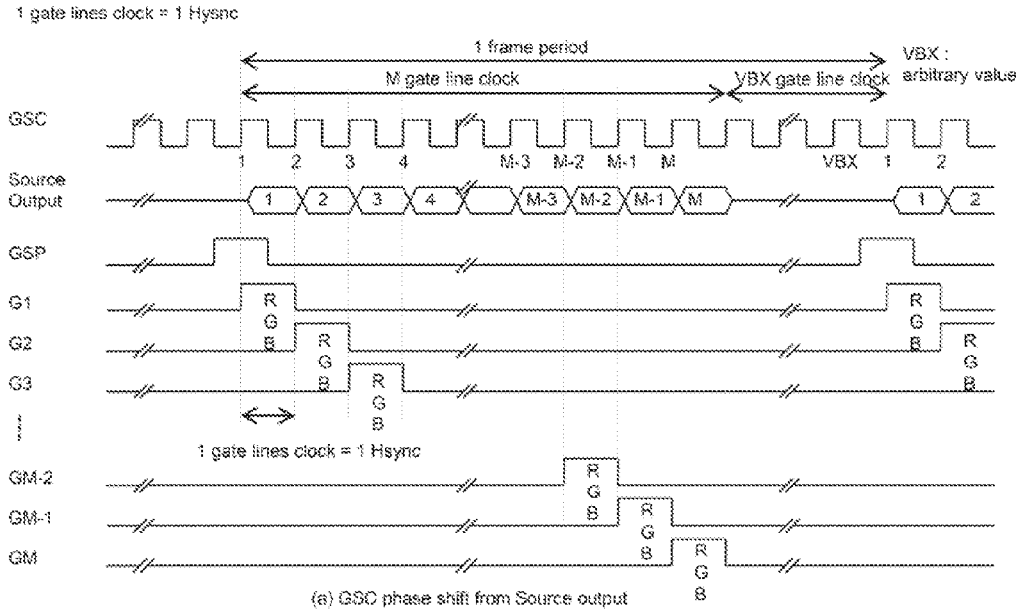
(a) GSC phase shift from Source output
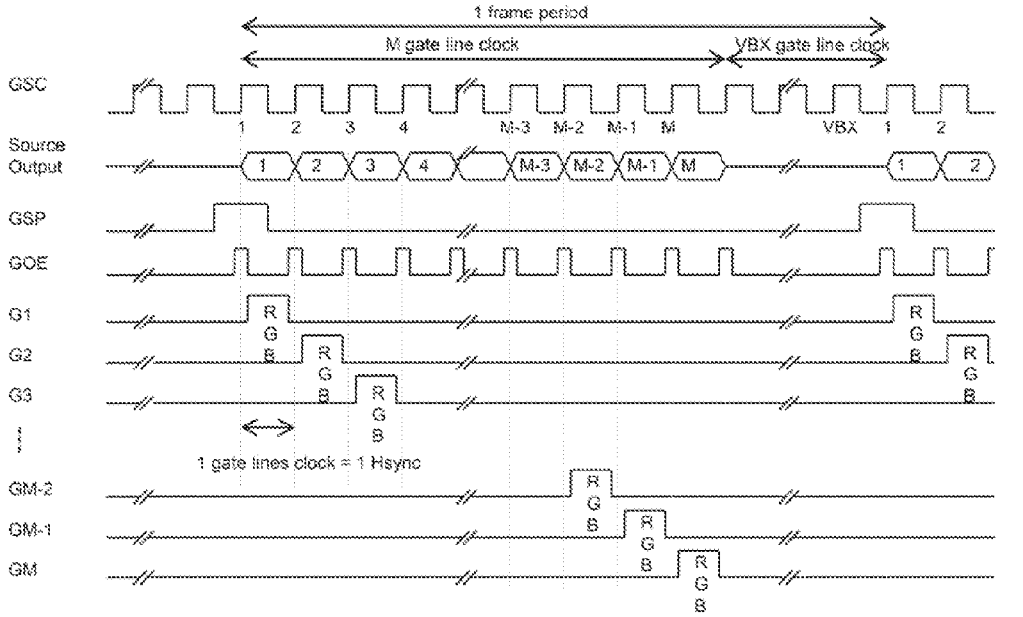
(b) GOE with same phase on both GSC and Source output
Figure 2A Conventional non-interlaced gate on timing when gate vertical scanning in CF TFT LCD with RGB vertical stripe pixel arrangement

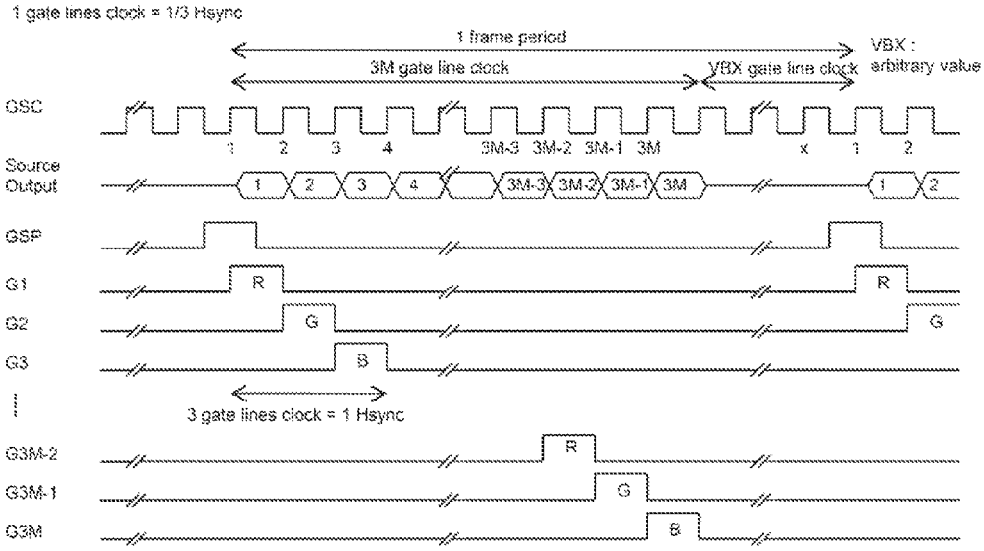
Figure 2B Conventional non-interlaced Gate on timing when gate vertical scanning in CF TFT LCD with RGB horizontal stripe pixel arrangement

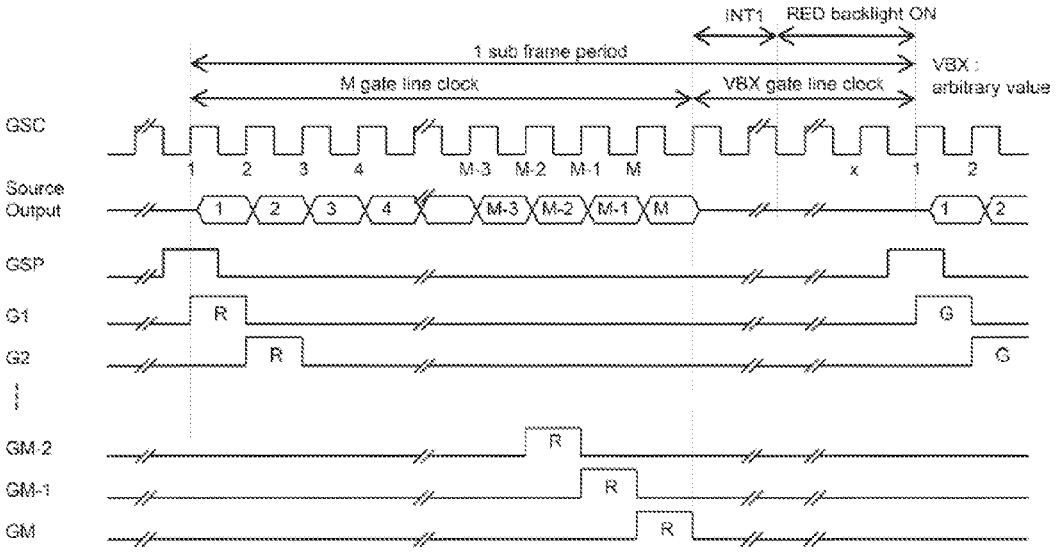
Figure 2C Non-interlaced Gate on timing during red color sub frame when gate vertical scanning at FSC LCD
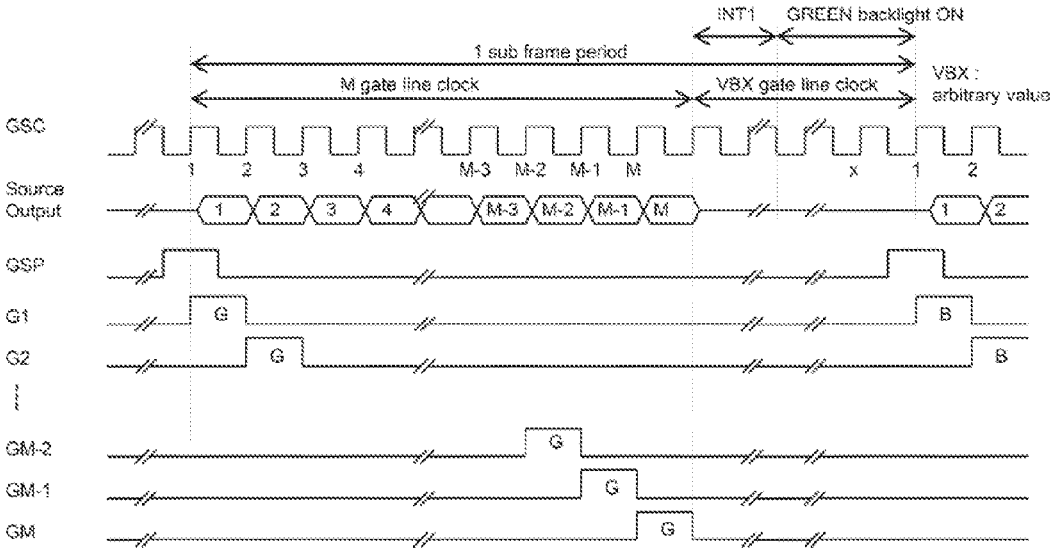
Figure 2D Non-interlaced Gate on timing during green color sub frame when gate vertical scanning at FSC LCD

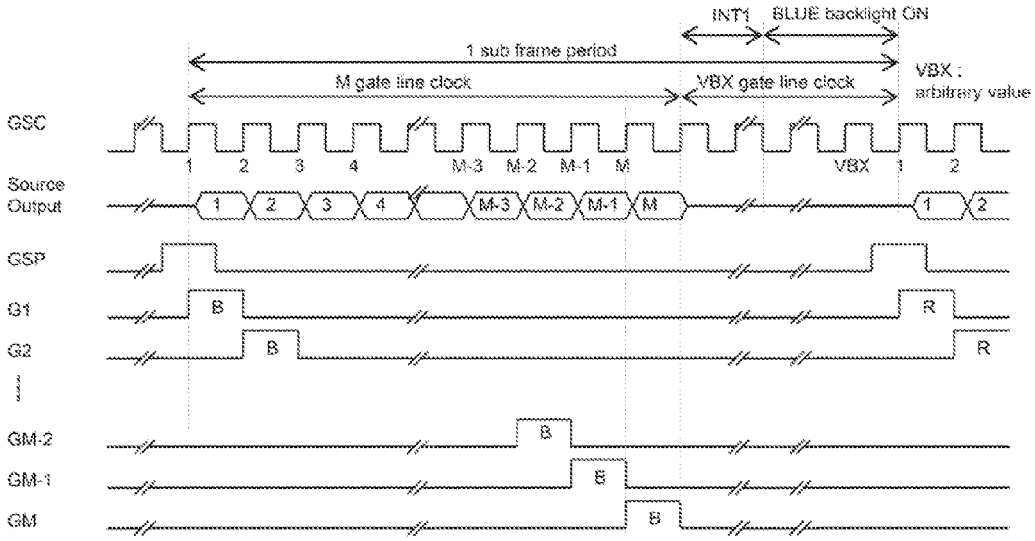
Figure 2E Non-interlaced Gate on timing during blue color sub frame when vertical gate scanning at FSC LCD
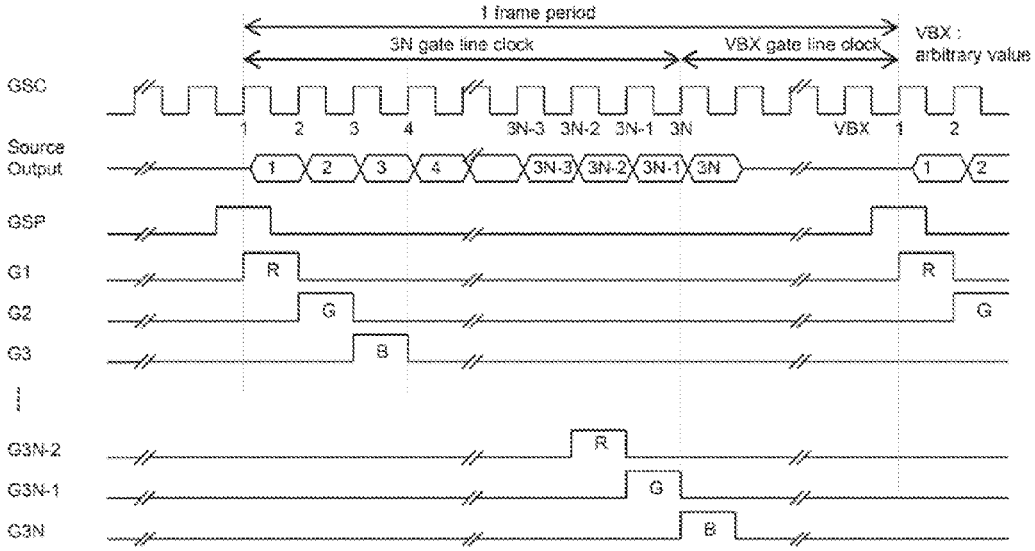
Figure 2F Non-interlaced Gate on timing when gate horizontal scanning in CF TFT LCD with RGB vertical stripe pixel arrangement

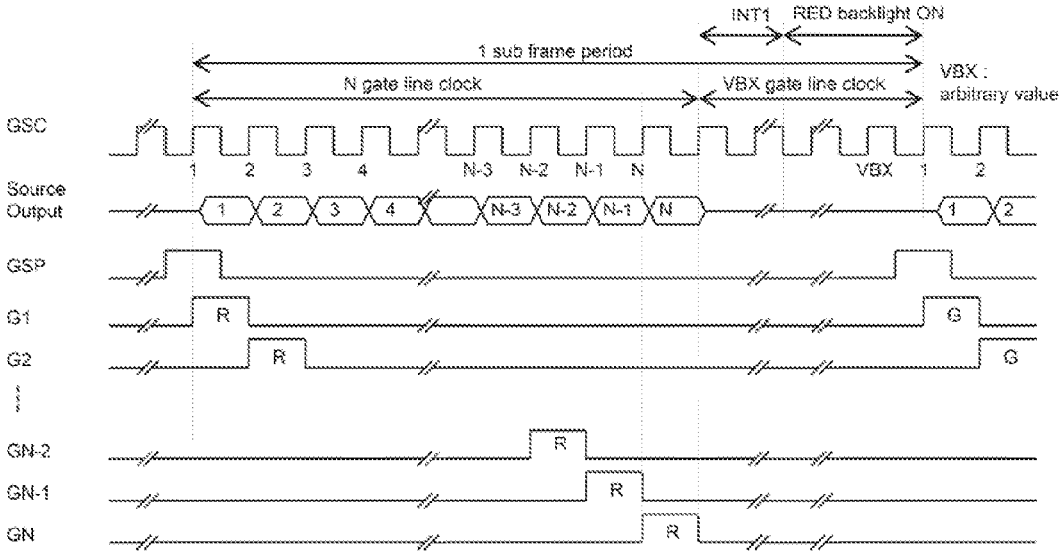
Figure 2G Non-interlaced Gate on timing during red color sub frame when gate horizontal scanning at FSC LCD
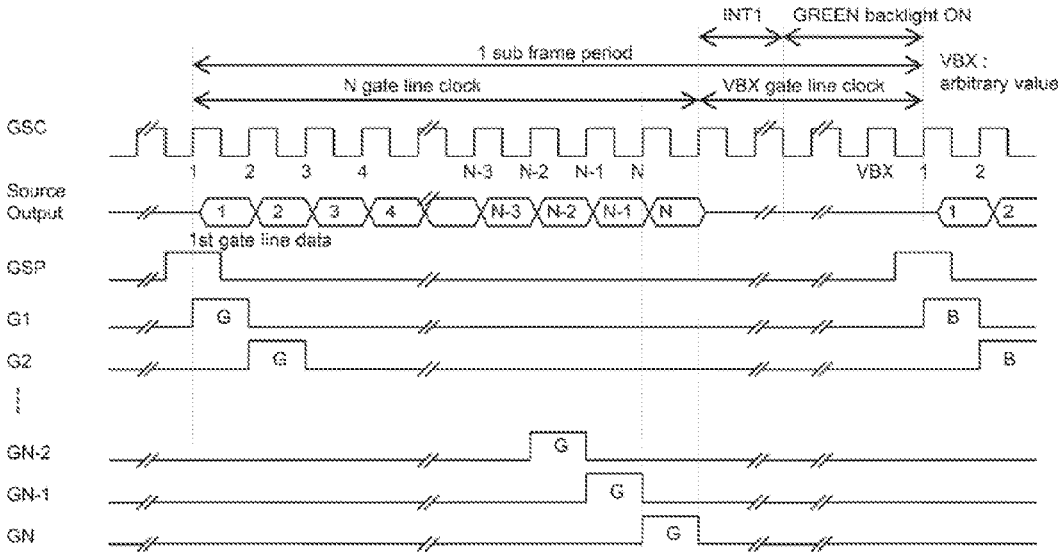
Figure 2H Non-interlaced Gate on timing during green color sub frame when gate horizontal scanning at FSC LCD

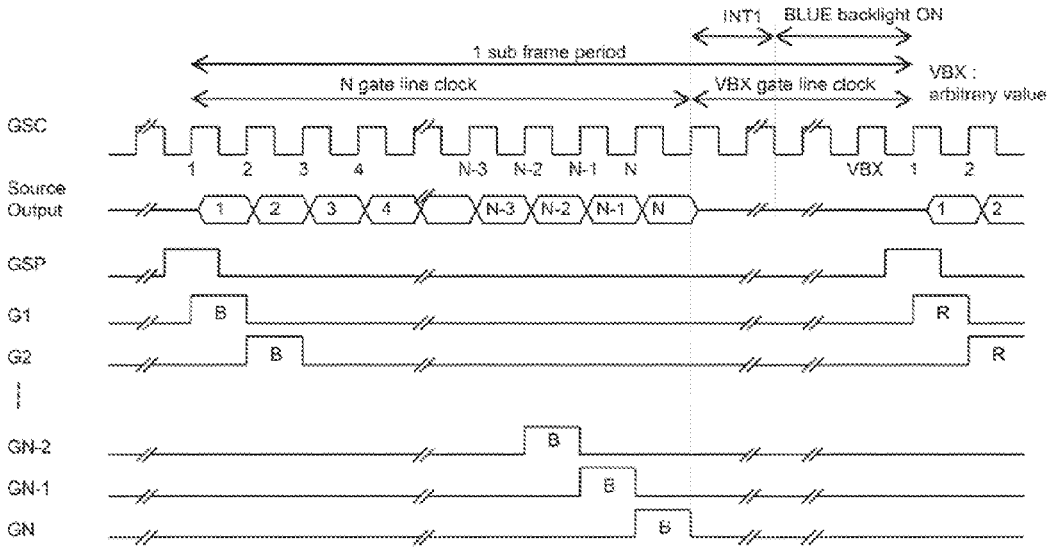
Figure 2J Non-interlaced Gate on timing during blue color sub frame when gate horizontal scanning at FSC LCD

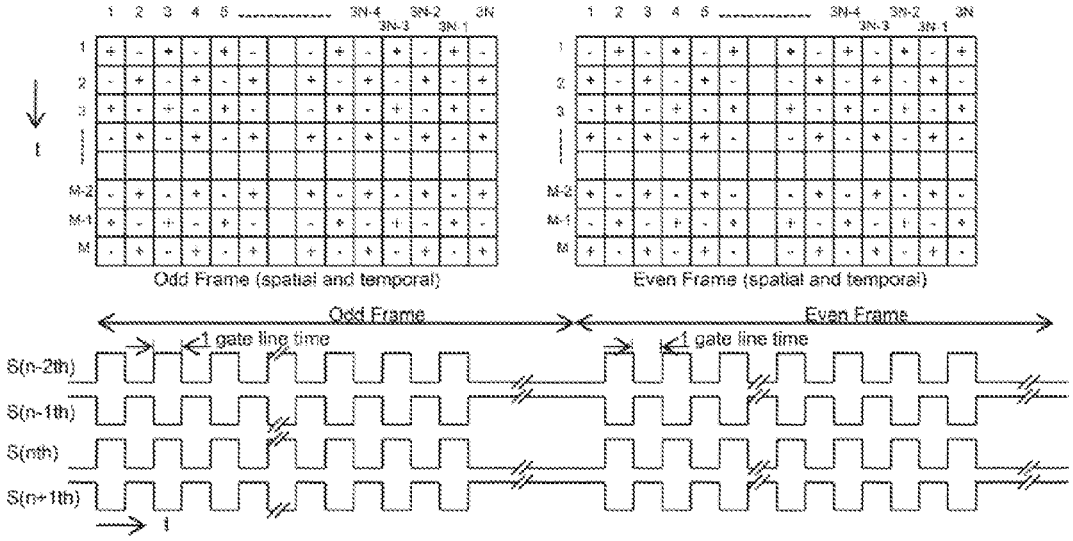
Figure 3A Pixel polarity at non-interlaced gate vertical scanning when dot (sub-pixel) inversion in CF TFT LCD
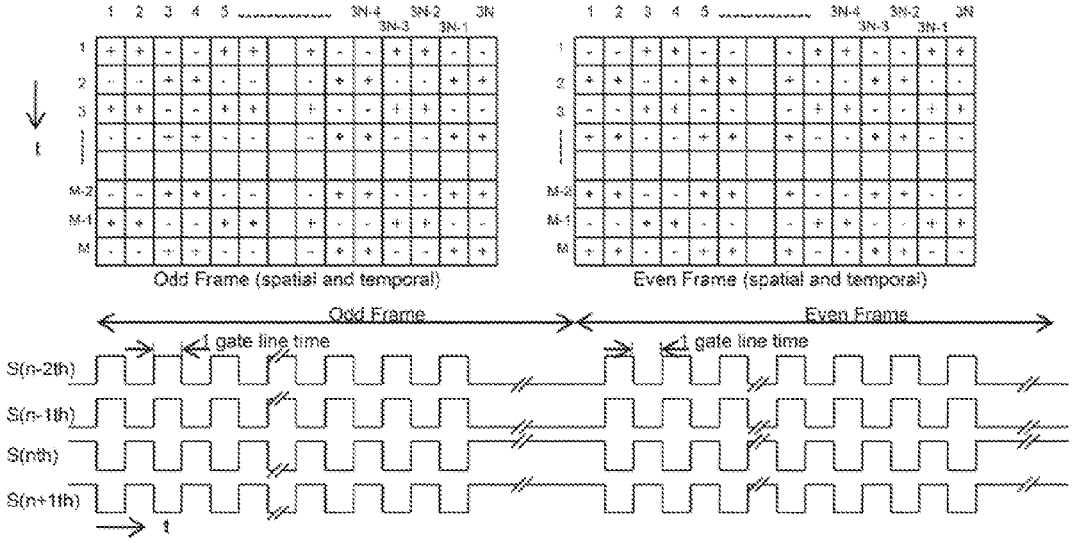
Figure 3B Pixel polarity at non-interlaced gate vertical scanning when 2H dot(sub-pixel) inversion in CF TFT LCD

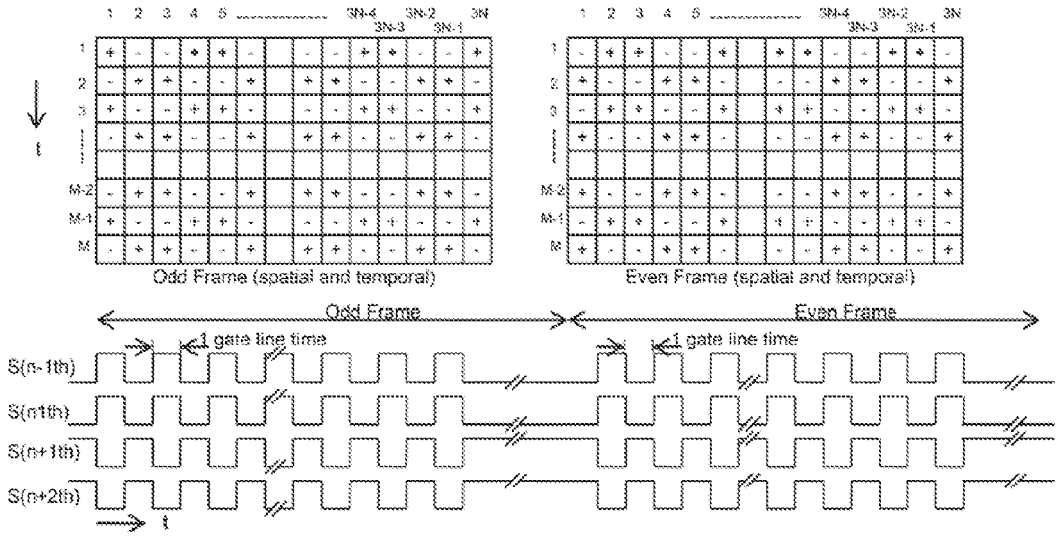
Figure 3C Pixel polarity at non-interlaced gate vertical scanning when 1+2H dot(sub-pixel) inversion in CF TFT LCD
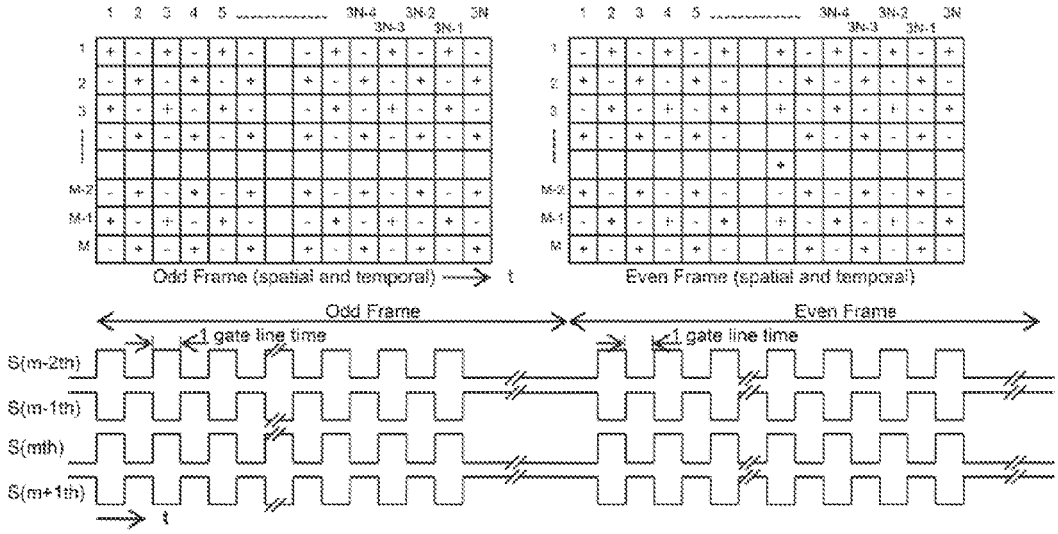
Figure 3D Pixel polarity at non-interlaced gate horizontal scanning when dot(sub-pixel) inversion in CF TFT LCD

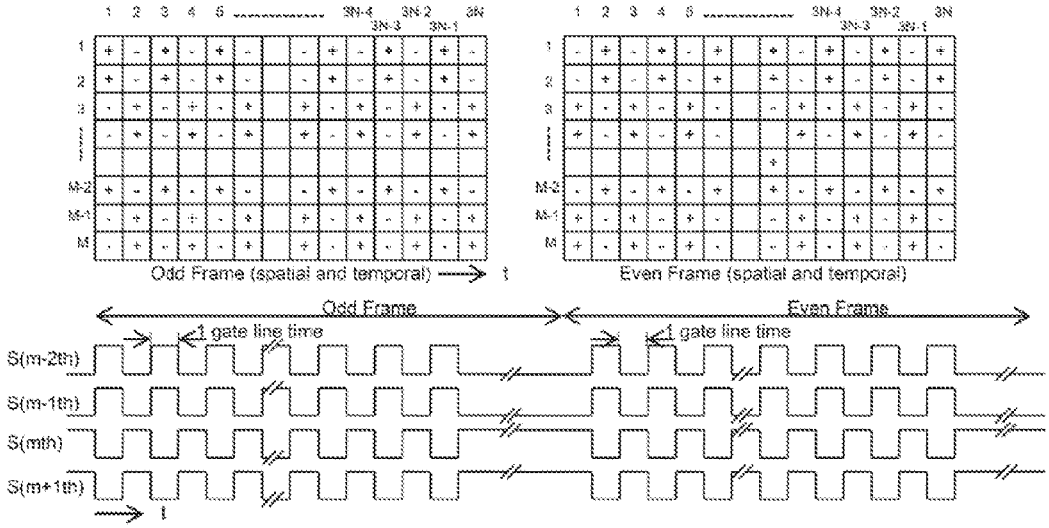
Figure 3E Pixel polarity at non-interlaced gate horizontal scanning when 2V dot (sub-pixel) inversion in CF TFT LCD
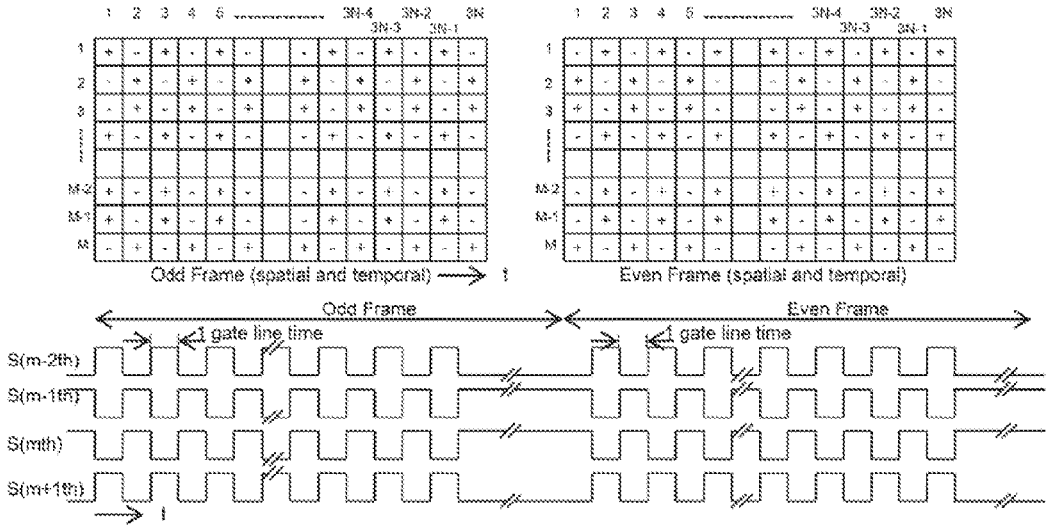
Figure 3F Pixel polarity at non-interlaced gate horizontal scanning when 1+2V dot(sub-pixel) inversion in CF TFT LCD

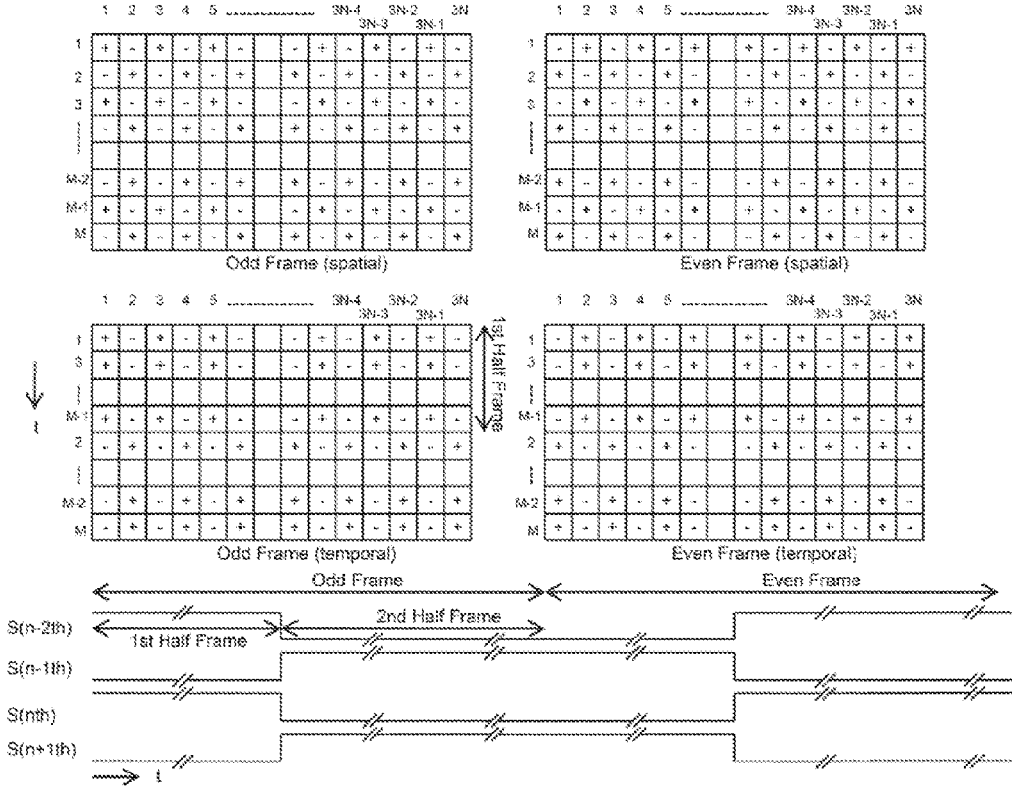
Figure 4A Pixel polarity at invented interlaced gate vertical scanning when dot (sub-pixel) inversion in CF TFT LCD

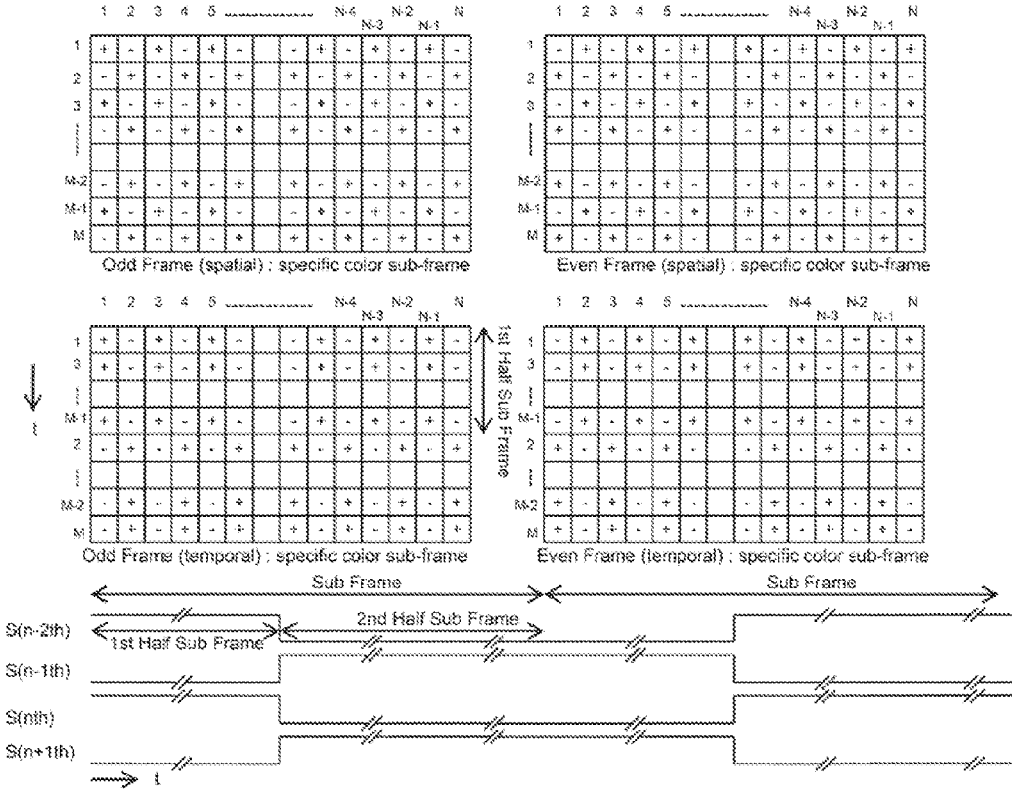
Figure 4B Pixel polarity at invented interlaced gate vertical scanning when dot (sub-pixel) inversion in FSC LCD

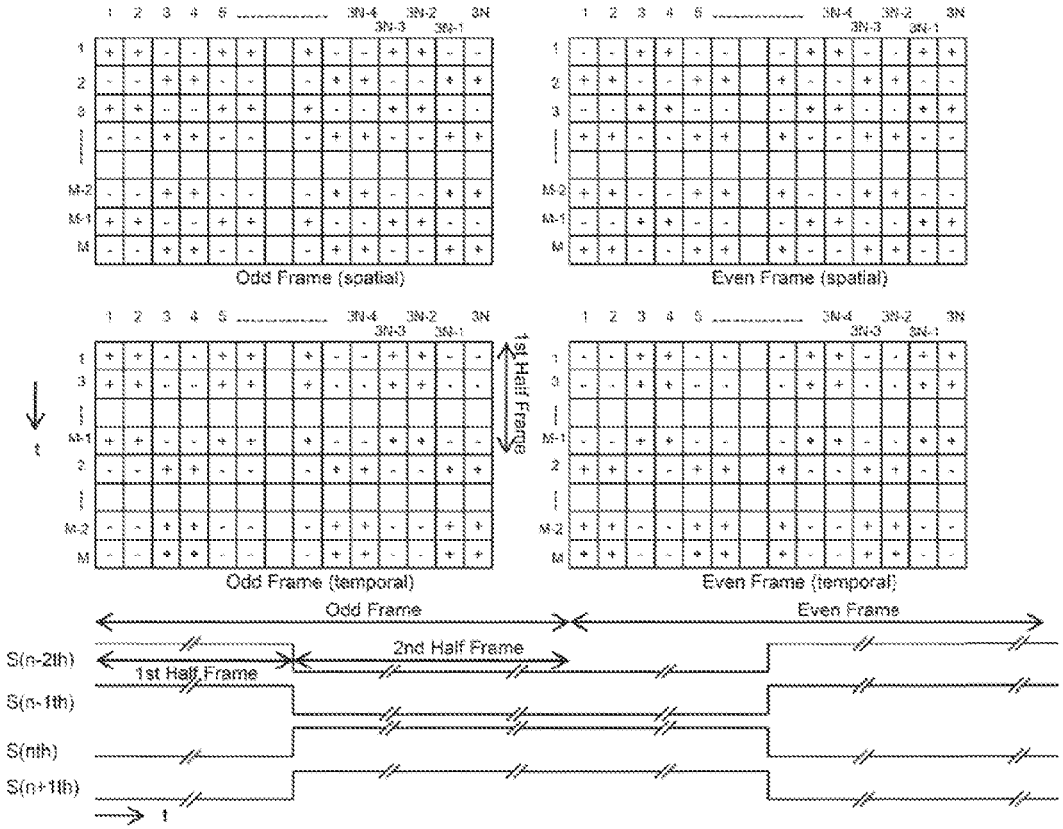
Figure 4C Pixel polarity at invented interlaced gate vertical scanning when 2H dot (sub-pixel) inversion in CF TFT LCD

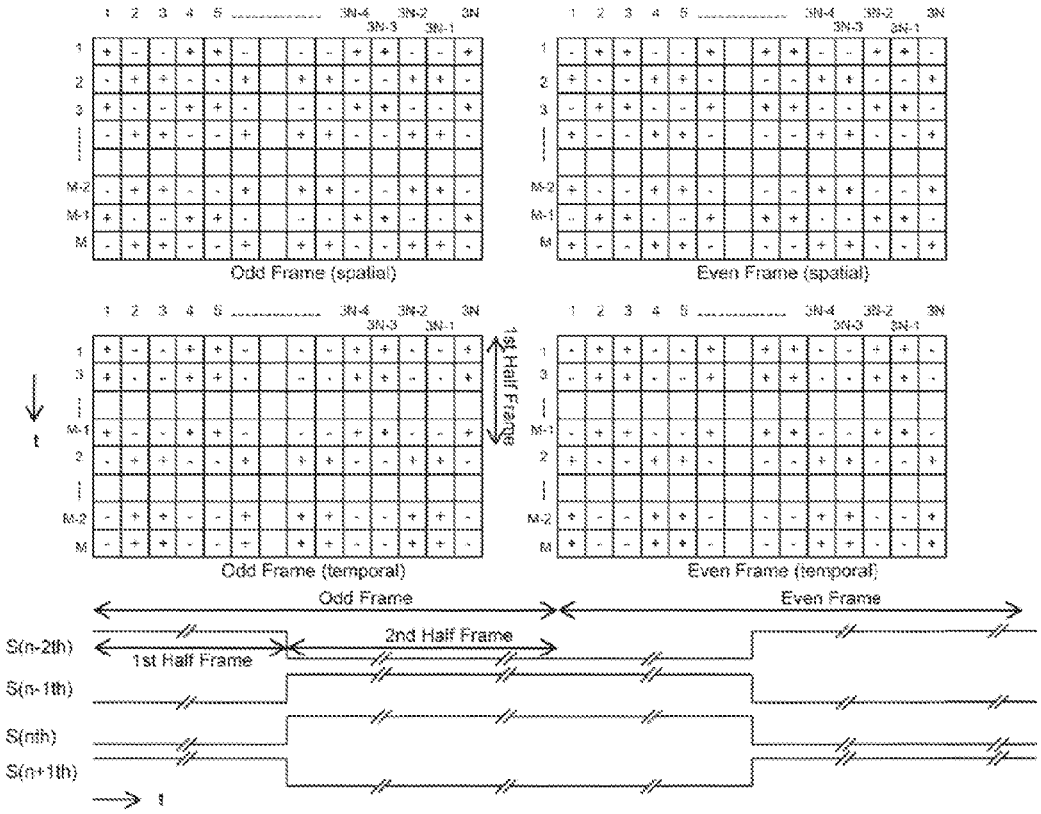
Figure 4D Pixel polarity at invented interlaced gate vertical scanning when 1+2H dot(sub-pixel) inversion in CF TFT LCD

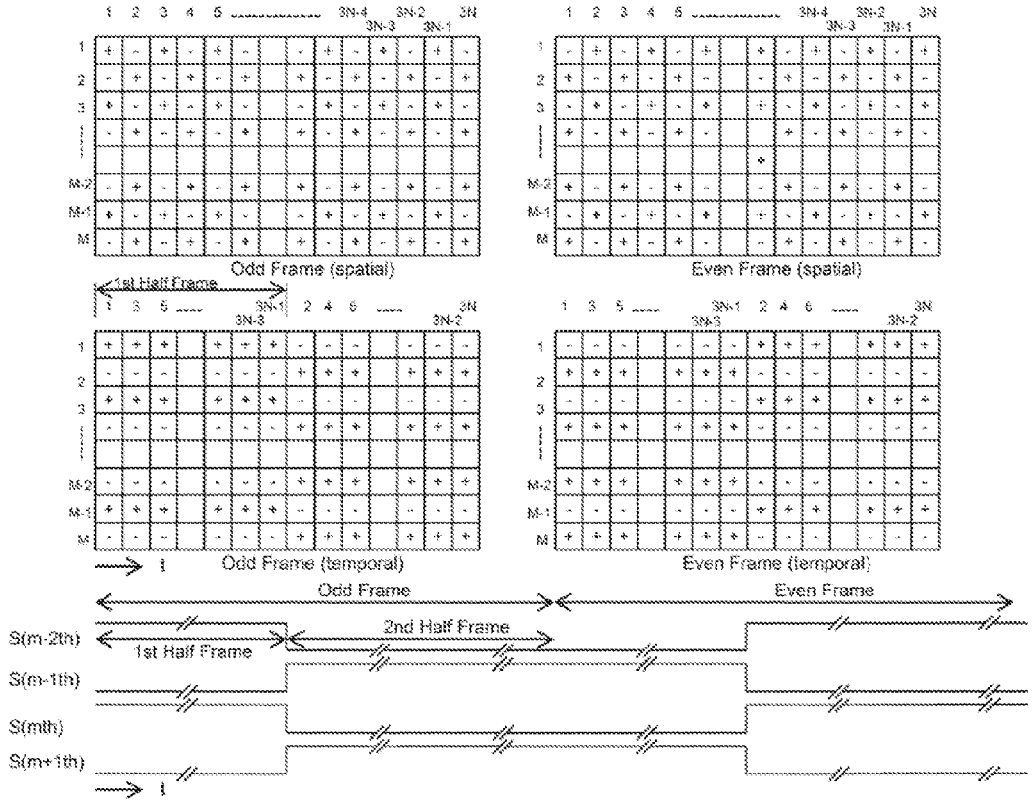
Figure 4E Pixel polarity at invented interlaced gate horizontal scanning when dot (sub-pixel) inversion in CF TFT LCD

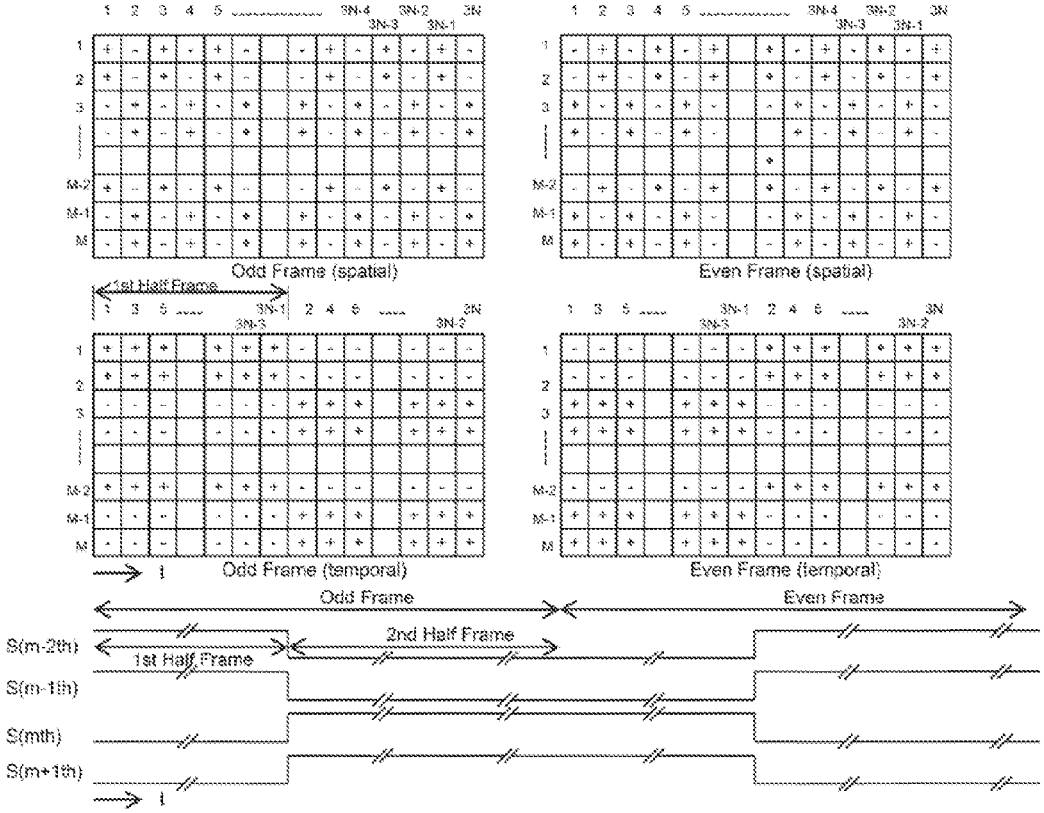
Figure 4F Pixel polarity at invented interlaced gate horizontal scanning when 2V dot (sub-pixel) inversion in CF TFT LCD

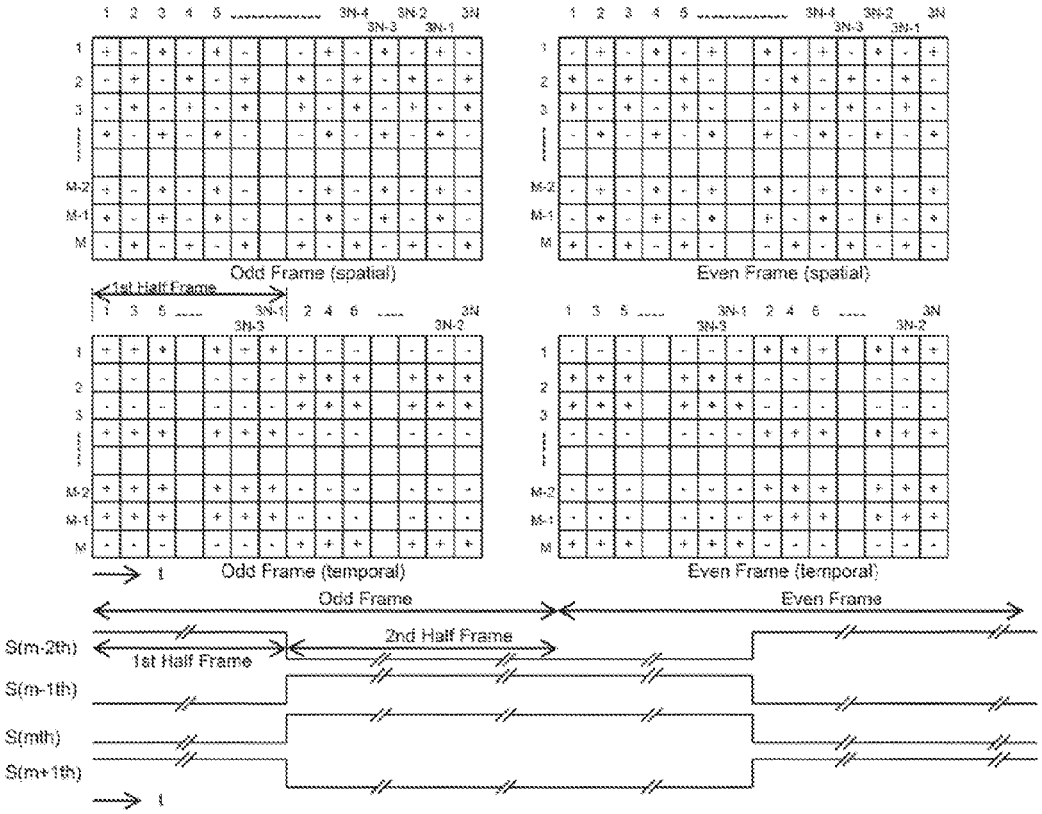
Figure 4G Pixel polarity at invented interlaced gate horizontal scanning when 1+2V dot (sub-pixel) inversion in CF TFT LCD

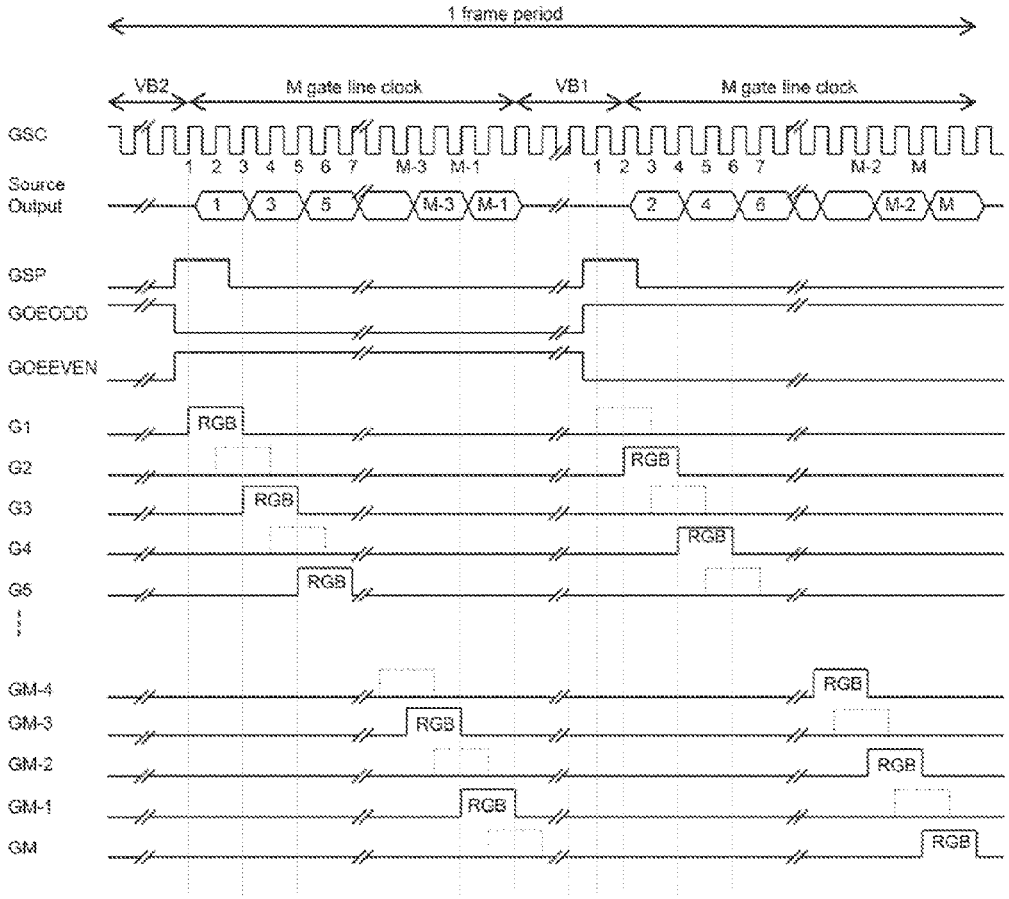
Figure 5A Invented interlaced gate on timing when gate vertical scanning with single GSP line at CF TFT LCD having RGB vertical stripe pixel color filter

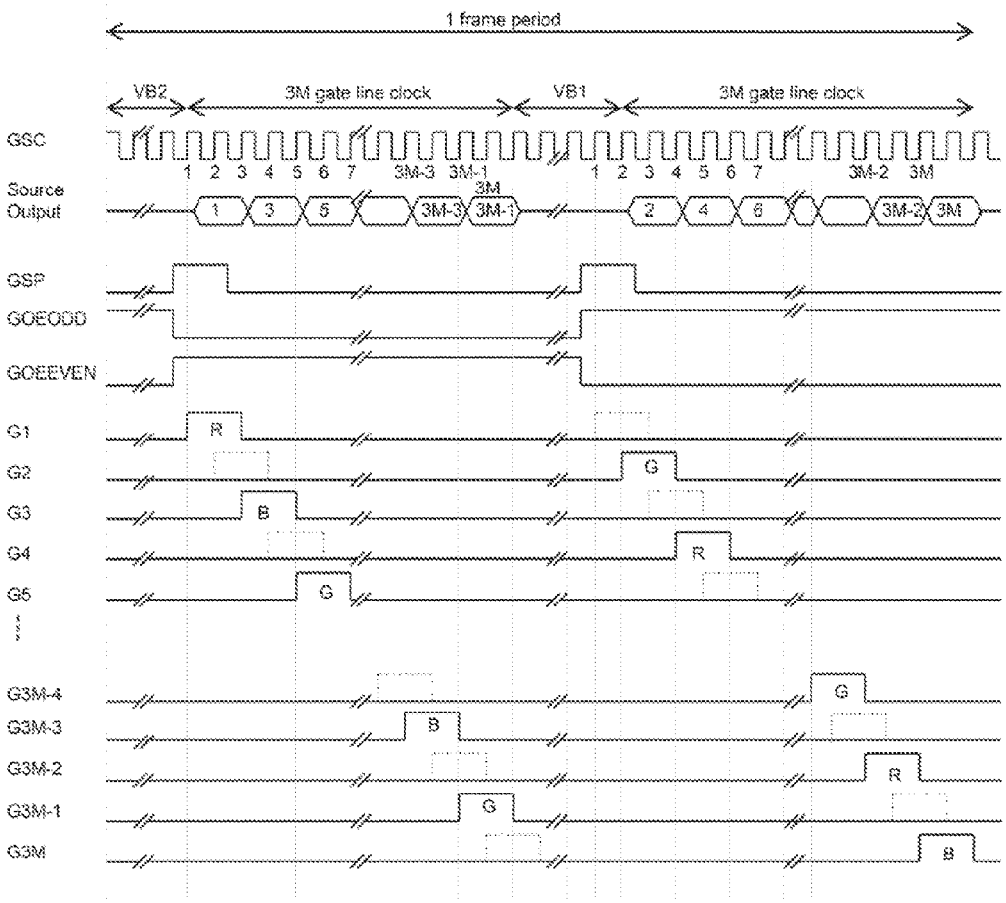
Figure 5B Invented interlaced gate on timing when gate vertical scanning with single GSP line at CF TFT LCD having RGB horizontal stripe pixel color filter

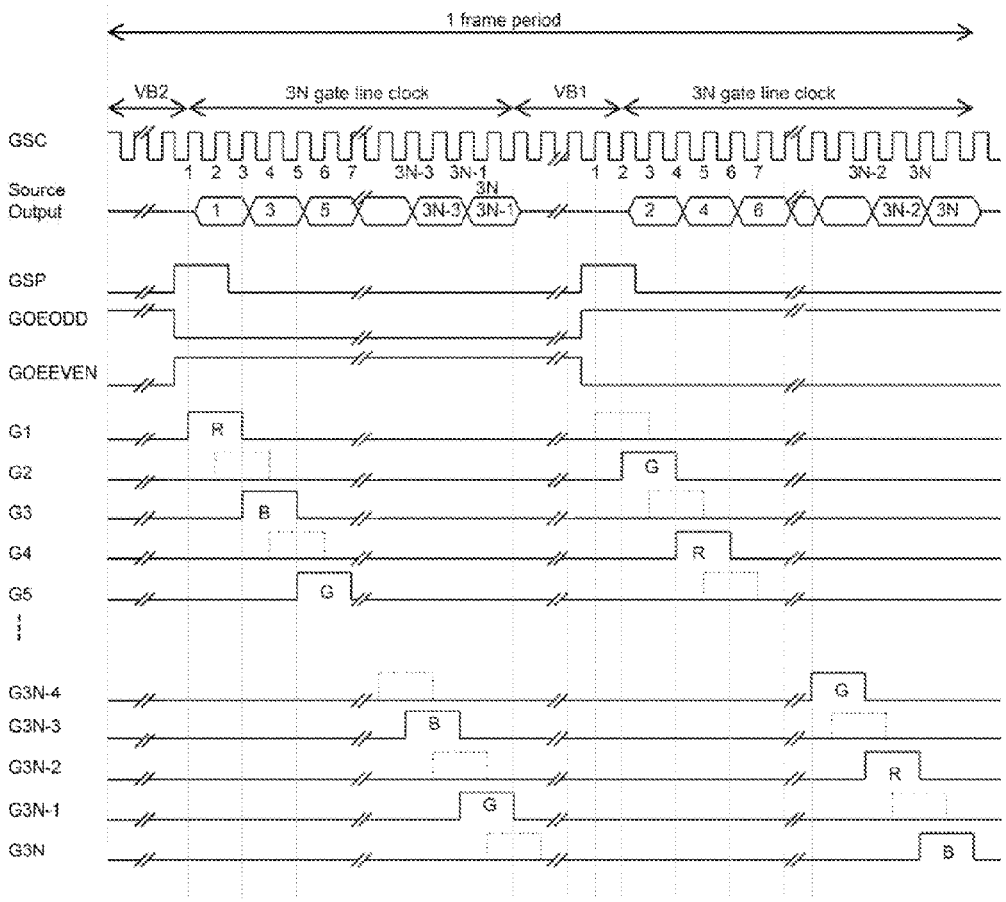
Figure 5C Invented interlaced gate on timing when gate horizontal scanning with single GSP line at CF TFT LCD having RGB vertical stripe pixel color filter

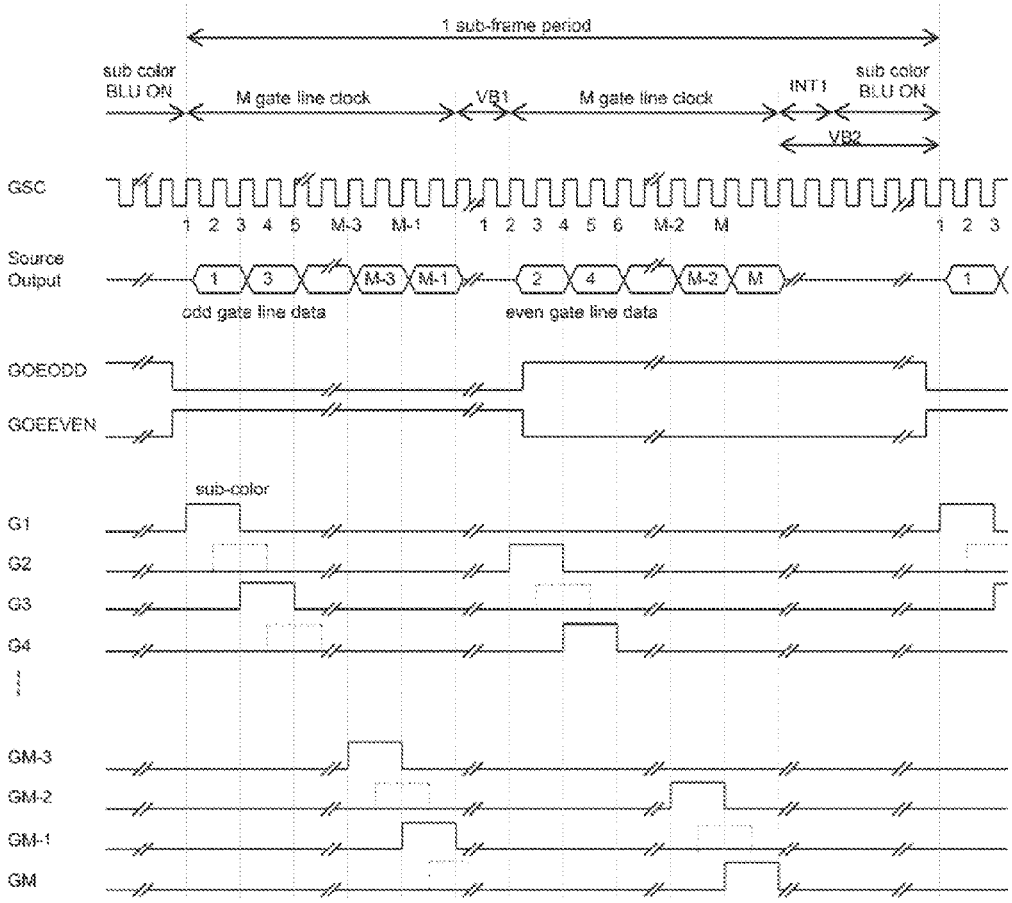
Figure 5D Invented interlaced gate on timing when gate vertical scanning with single GSP line at FSC-LCD having no color filter

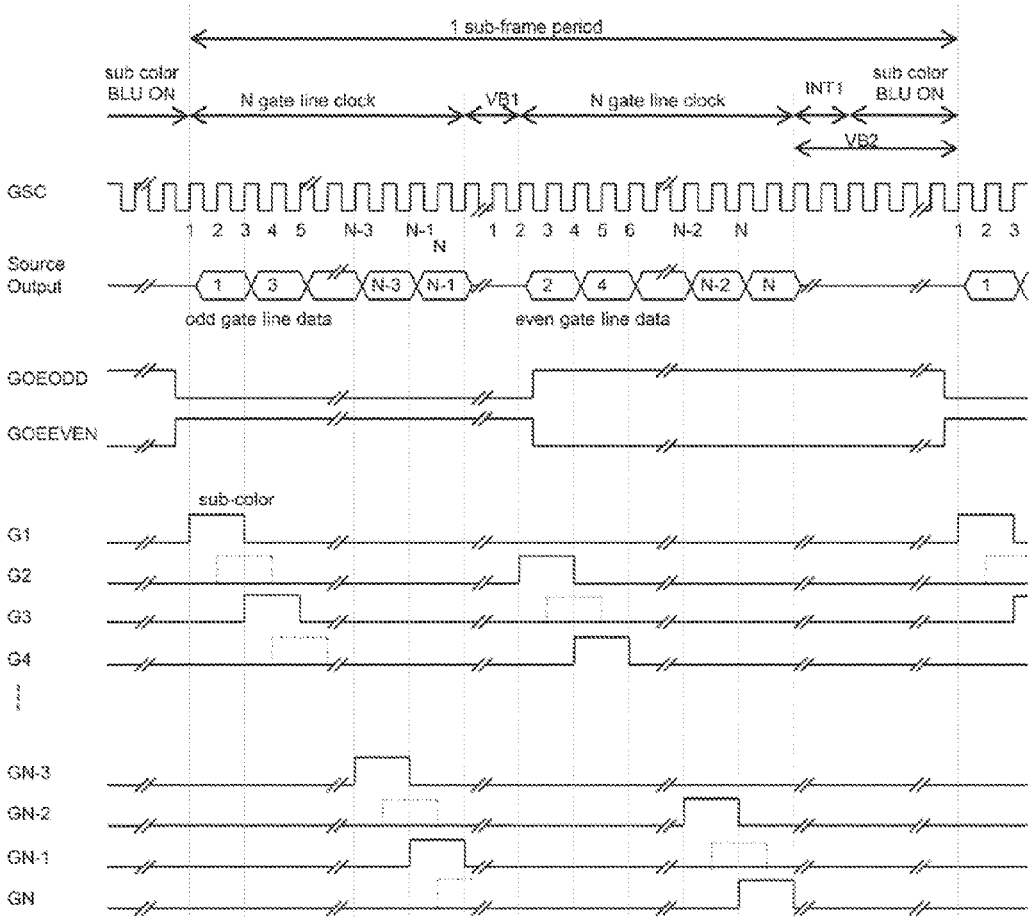
Figure 5E Invented interlaced gate on timing when gate horizontal scanning with single GSP line at FSC-LCD having no color filter

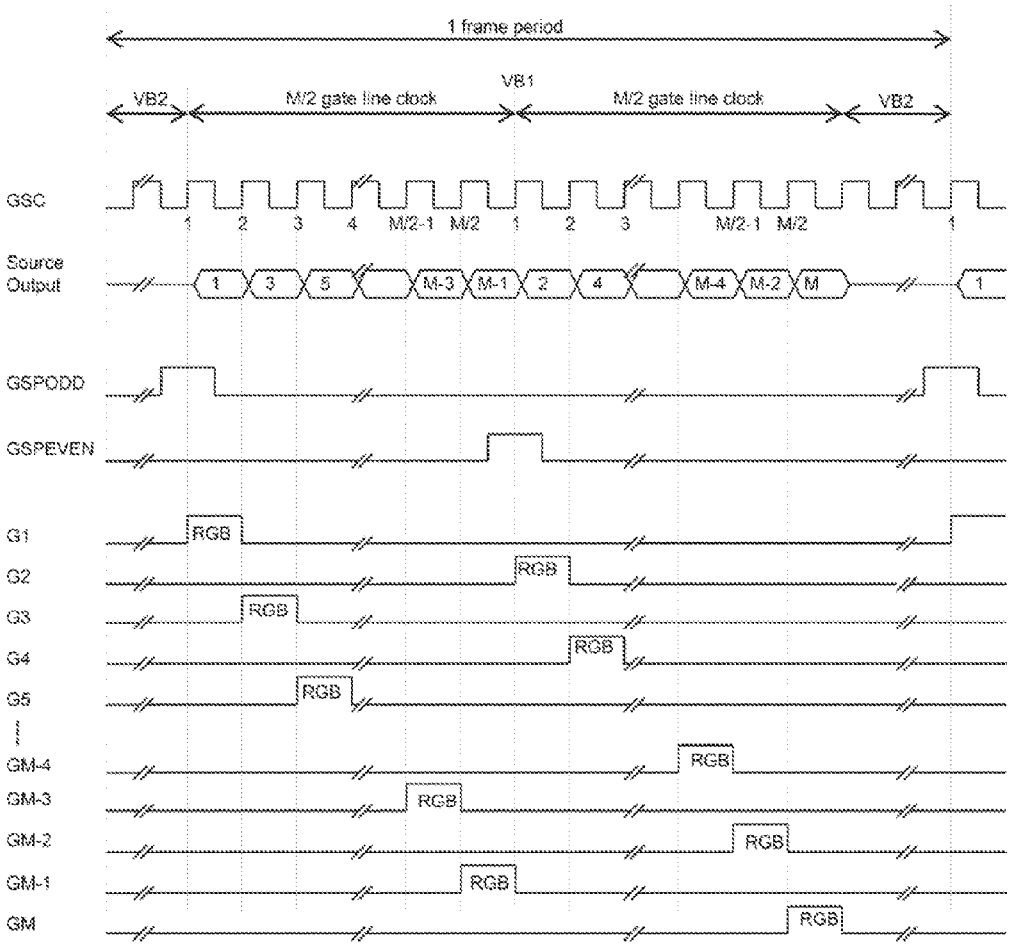
Figure 5F Invented interlaced gate on timing when gate vertical scanning with dual GSP line at CF TFT LCD having RGB vertical stripe pixel color filter

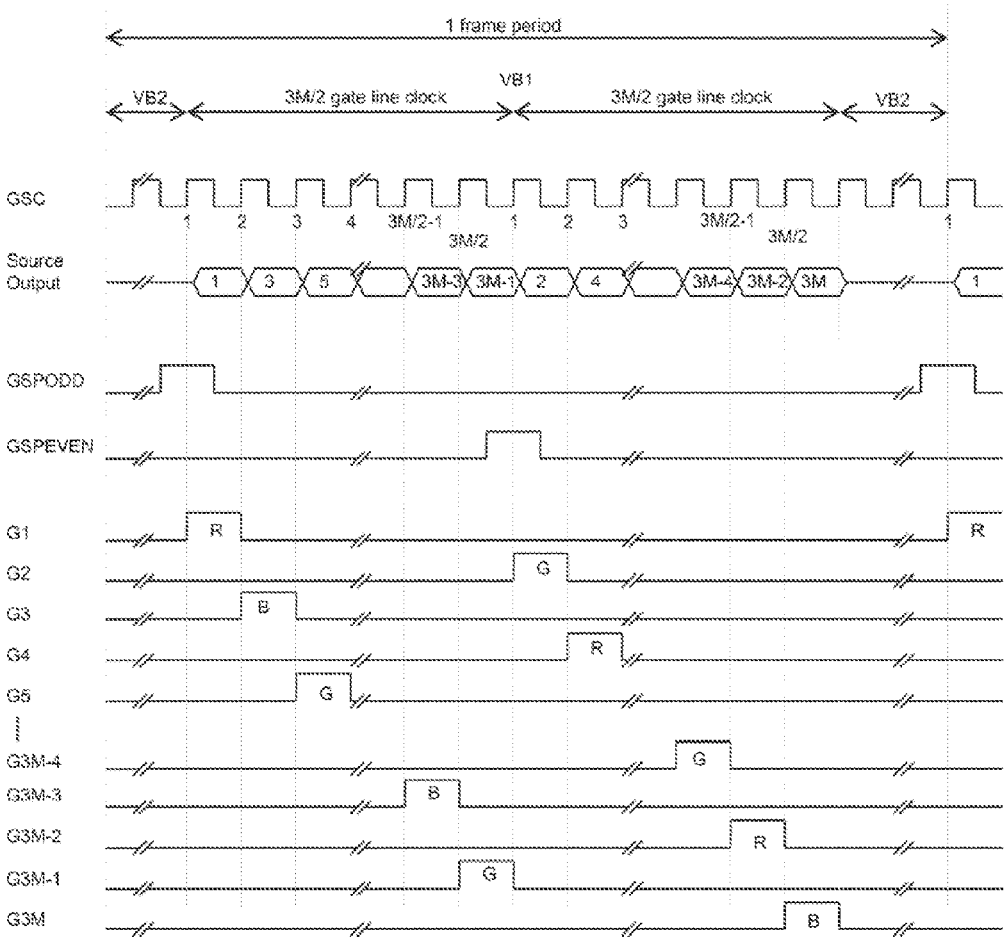
Figure 5G Invented interlaced gate on timing when gate vertical scanning with dual GSP line at CF TFT LCD having RGB horizontal stripe pixel color filter

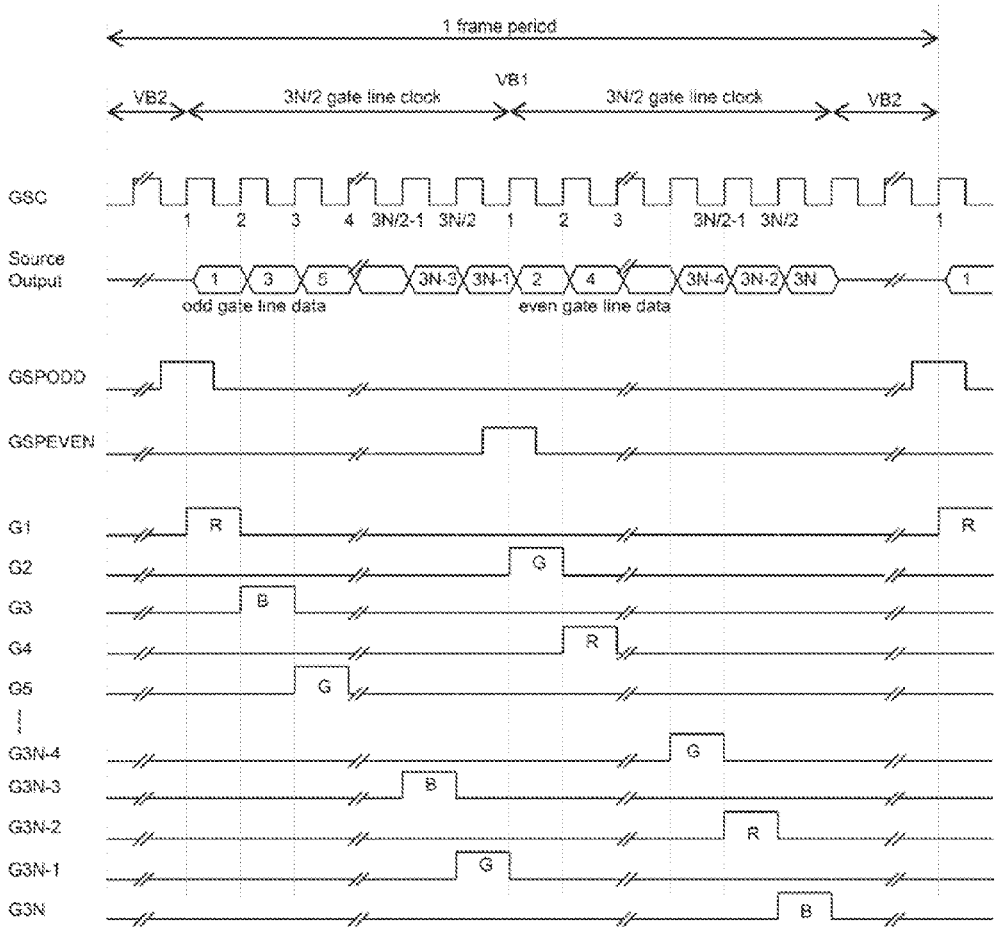
Figure 5H Invented interlaced gate on timing when gate horizontal scanning with dual GSP line at CF TFT LCD having RGB vertical stripe pixel color filter

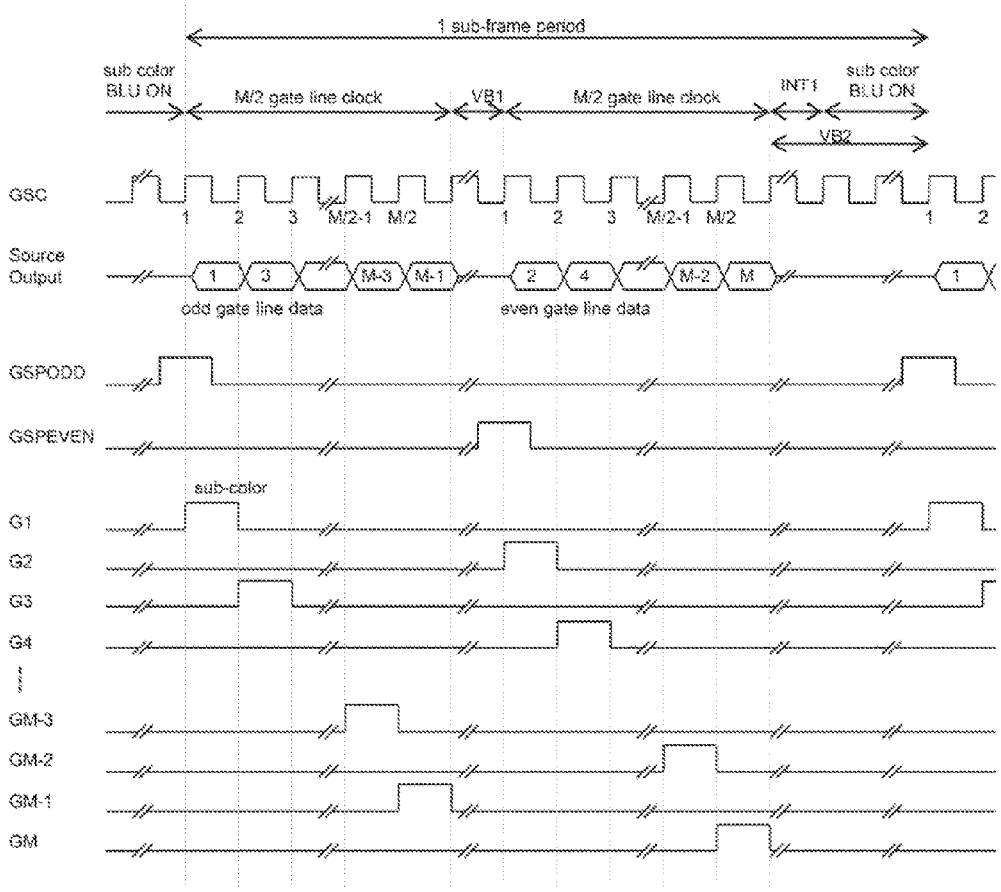
Figure 5J Invented interlaced gate on timing when gate vertical scanning with dual GSP line at FSC-LCD having no color filter

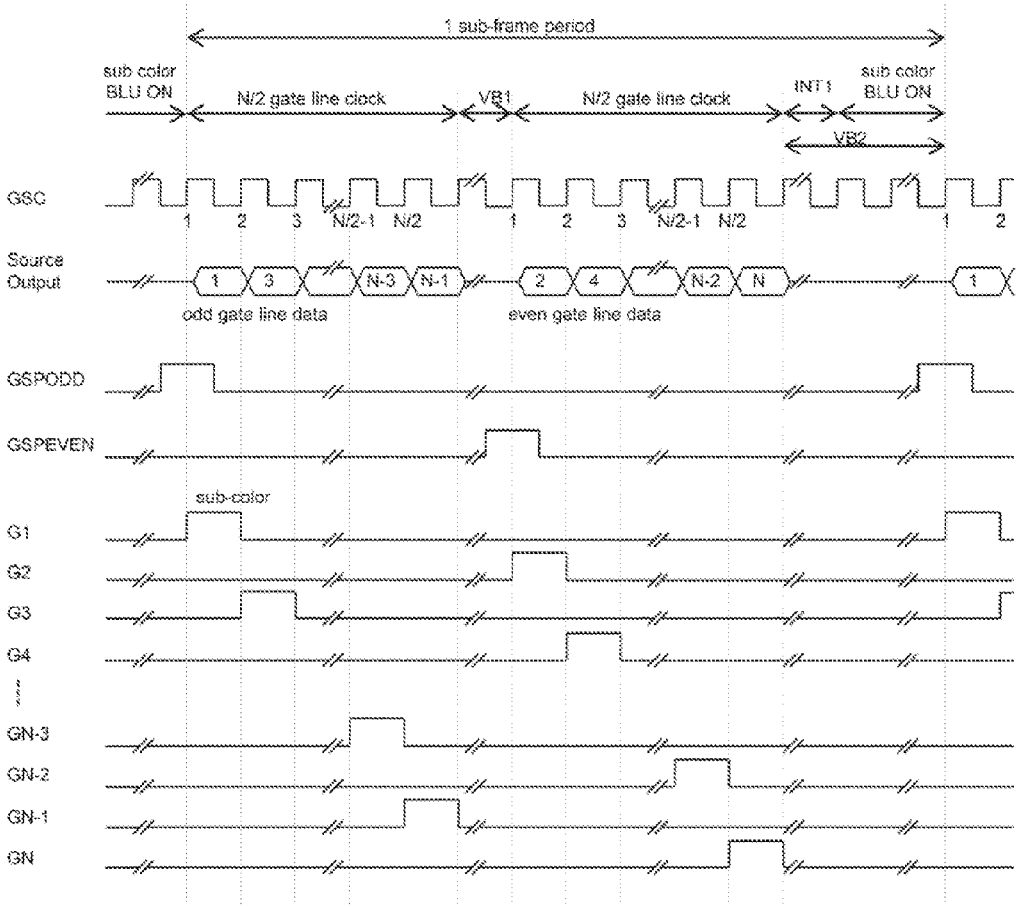
Figure 5K Invented interlaced gate on timing when gate horizontal scanning with dual GSP line at FSC LCD having no color filter

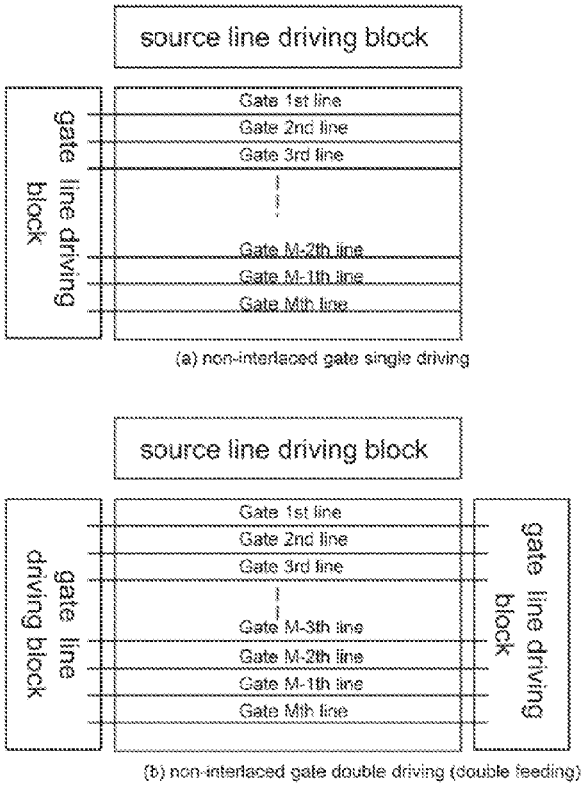
Figure 6A Gate line structure at non interlaced gate vertical scanning

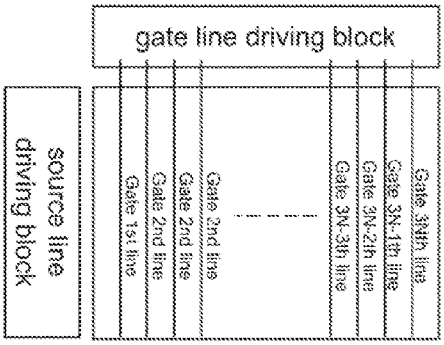
(a) Non-interlaced gate single driving
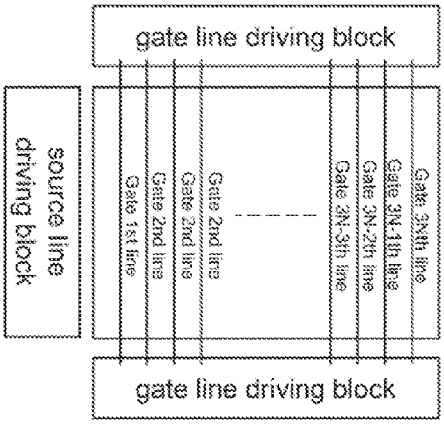
(b) Non-interlaced gate double driving (double feeding)
Figure 6B Gate line structure at non-interlaced gate horizontal scanning

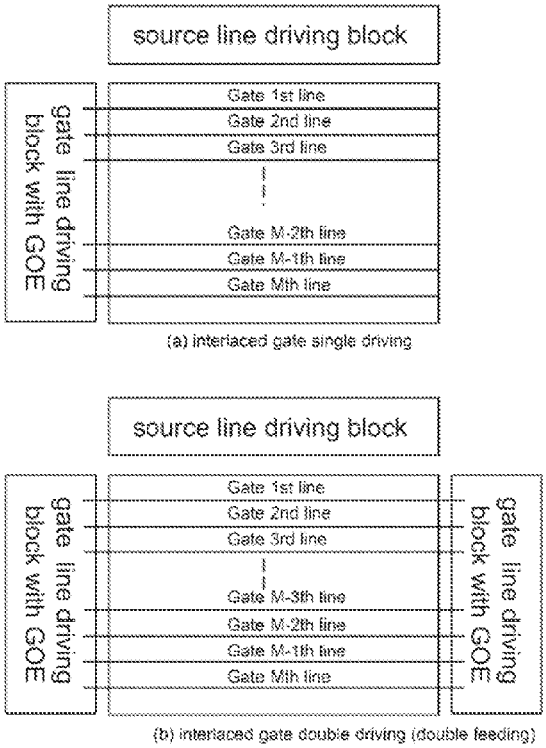
Figure 7A Invented gate structure at interlaced gate vertical scanning with single GSP

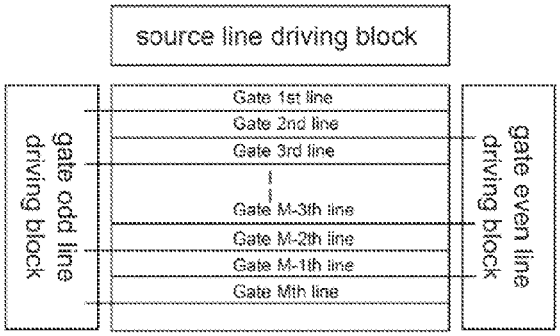
(a) interlaced gate single driving with dual GSP for dot inversion
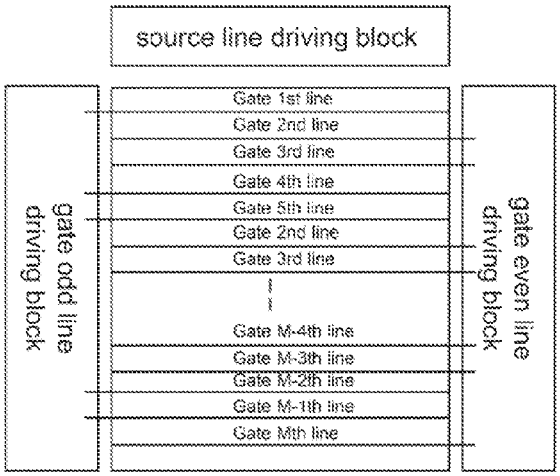
(b) interlaced gate single driving with dual GSP for 1+2V inversion
Figure 7B Invented gate structure at interlaced gate vertical scanning with dual GSP

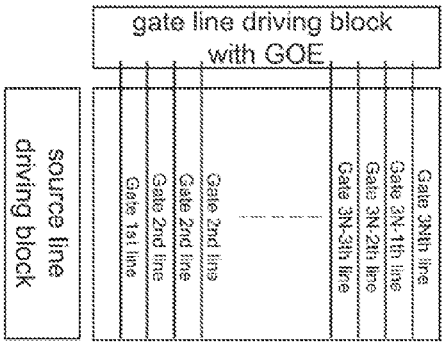
(a) interlaced gate single driving
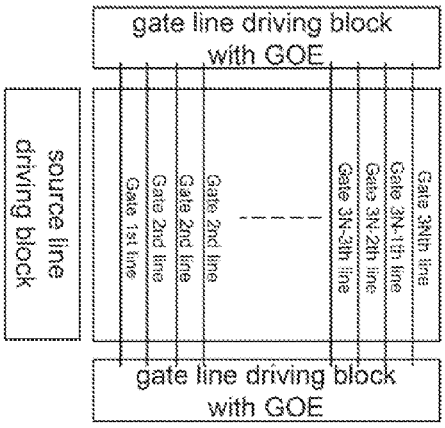
(b) interlaced gate double driving (double feeding)
Figure 7C Invented gate structure at interlaced gate horizontal scanning with single GSP

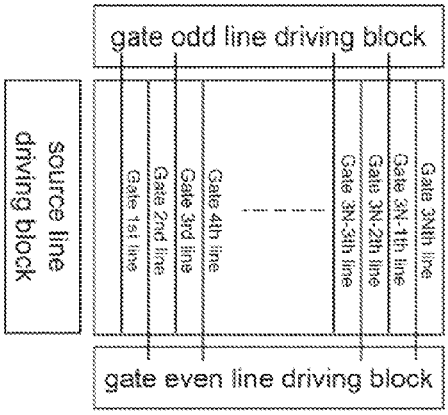
(a) interlaced gate single driving with dual GSP for dot inversion
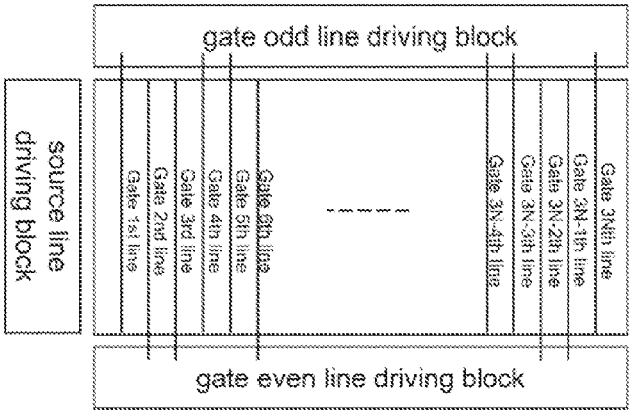
(b) interlaced gate single driving with dual GSP for 1+2H dot inversion
Figure 7D Invented gate structure at interlaced gate horizontal scanning with dual GSP

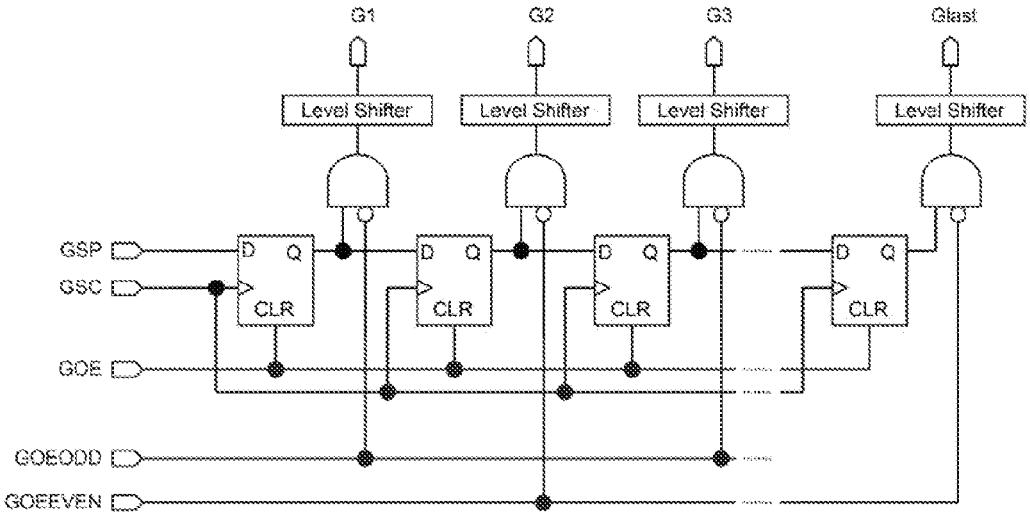
Figure 8A An invented block diagram of gate with single GSP
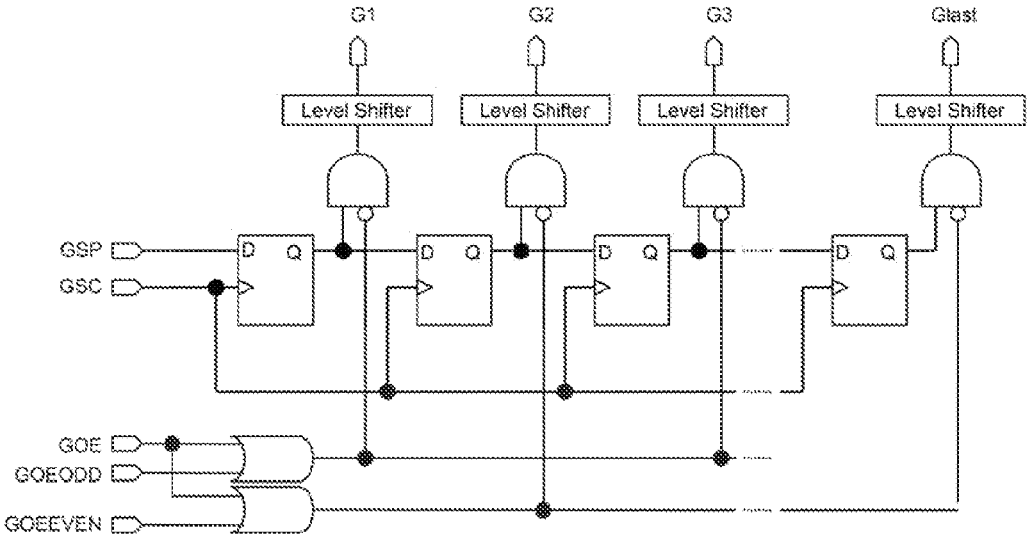
Figure 8B Another invented block diagram of gate with single GSP

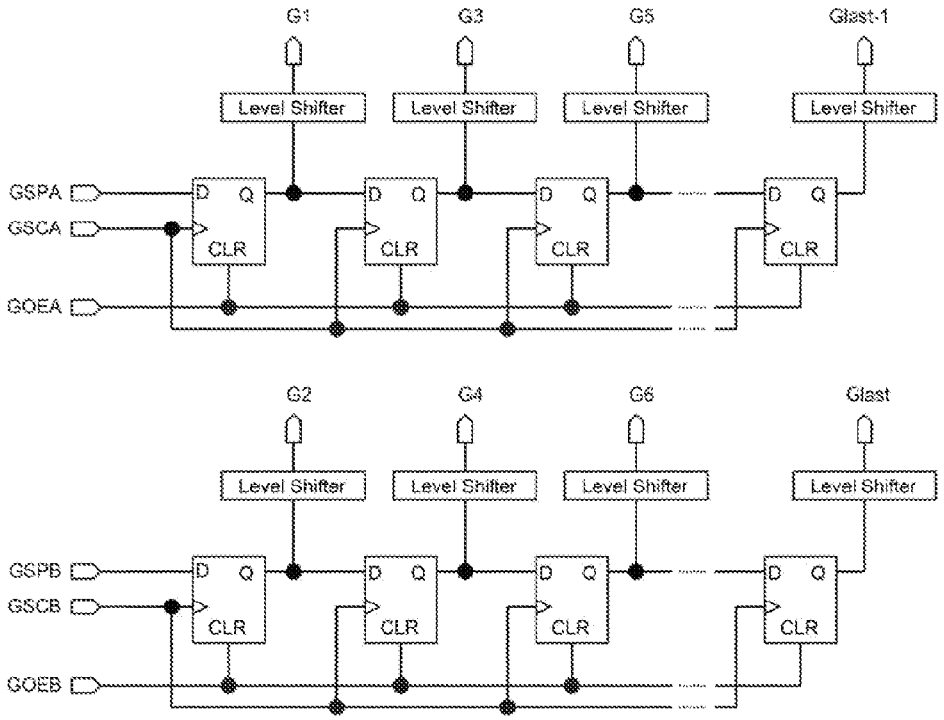
Figure 8C An invented block diagram of gate with dual GSP

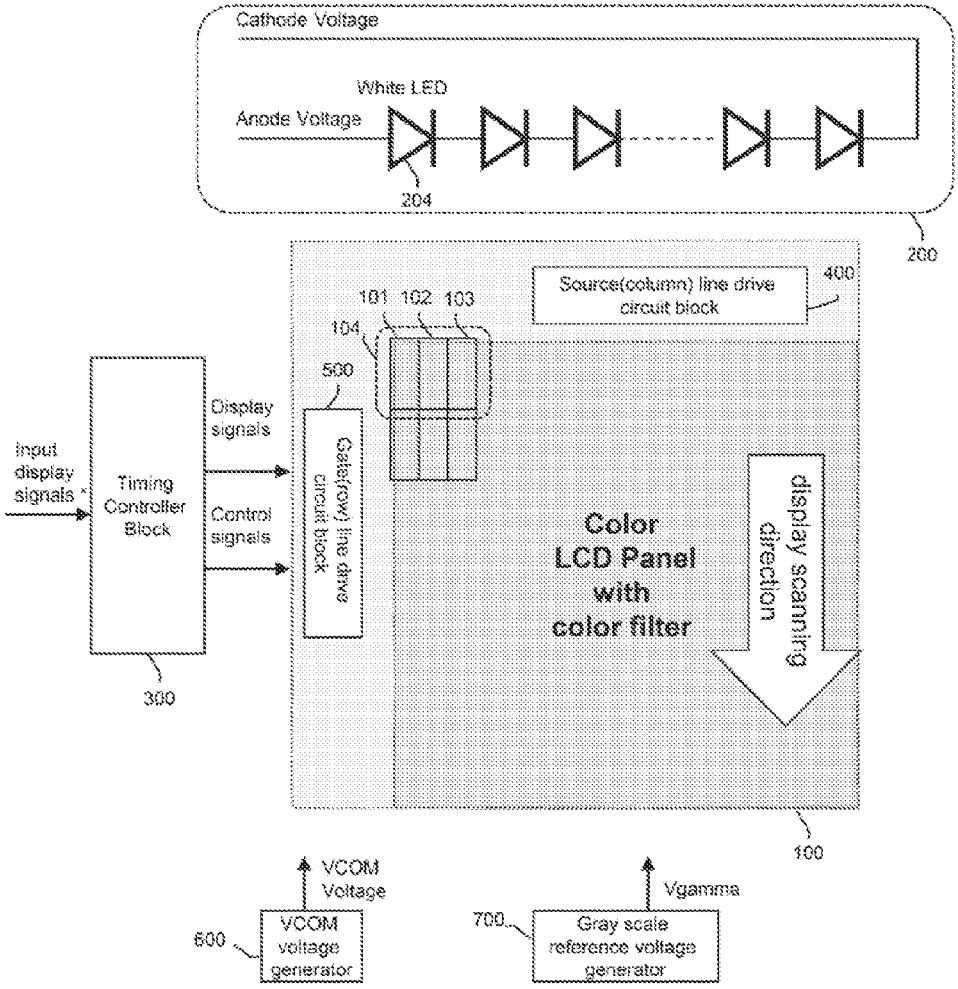
* Input display signals : TTL, LVDS, TMDS, DP, eDP, MIPI, MDDI
Figure 9A Conventional CFLCD having horizontal white LED arrays

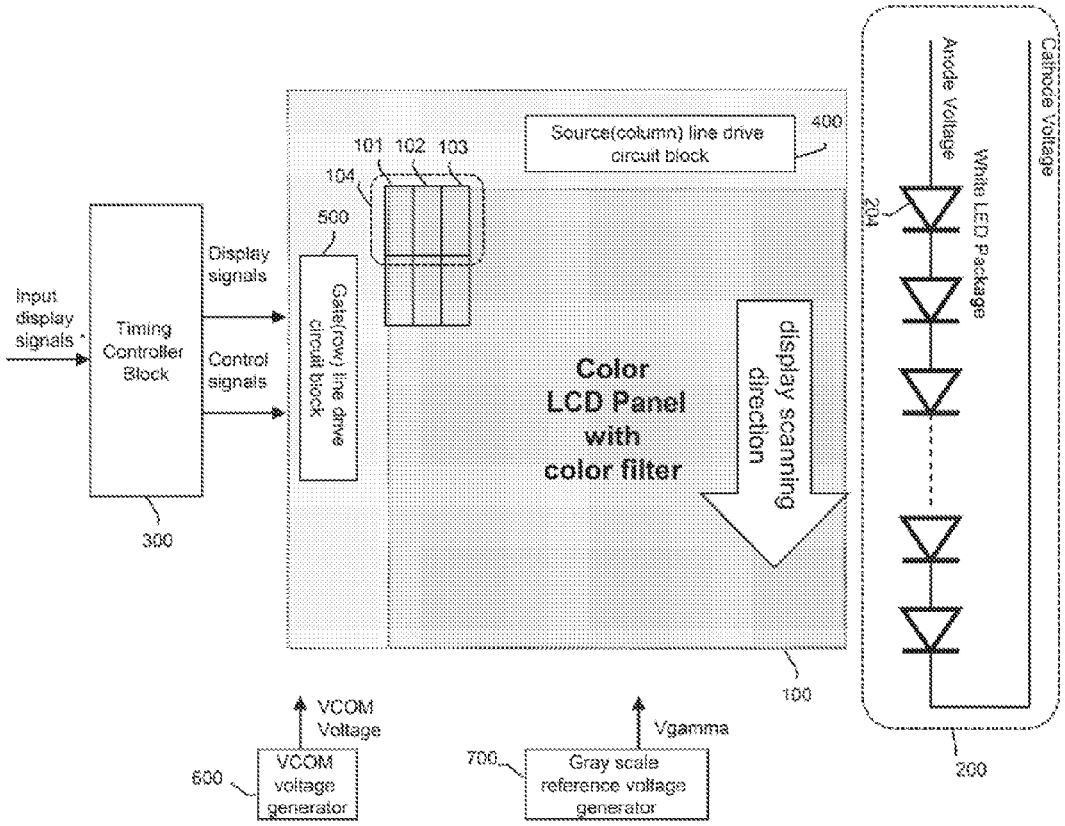
* Input display signals : TTL, LVDS, TMDS, DP, eDP, MIPI, MDDI
Figure 9B Conventional CFLCD having vertical white LED arrays

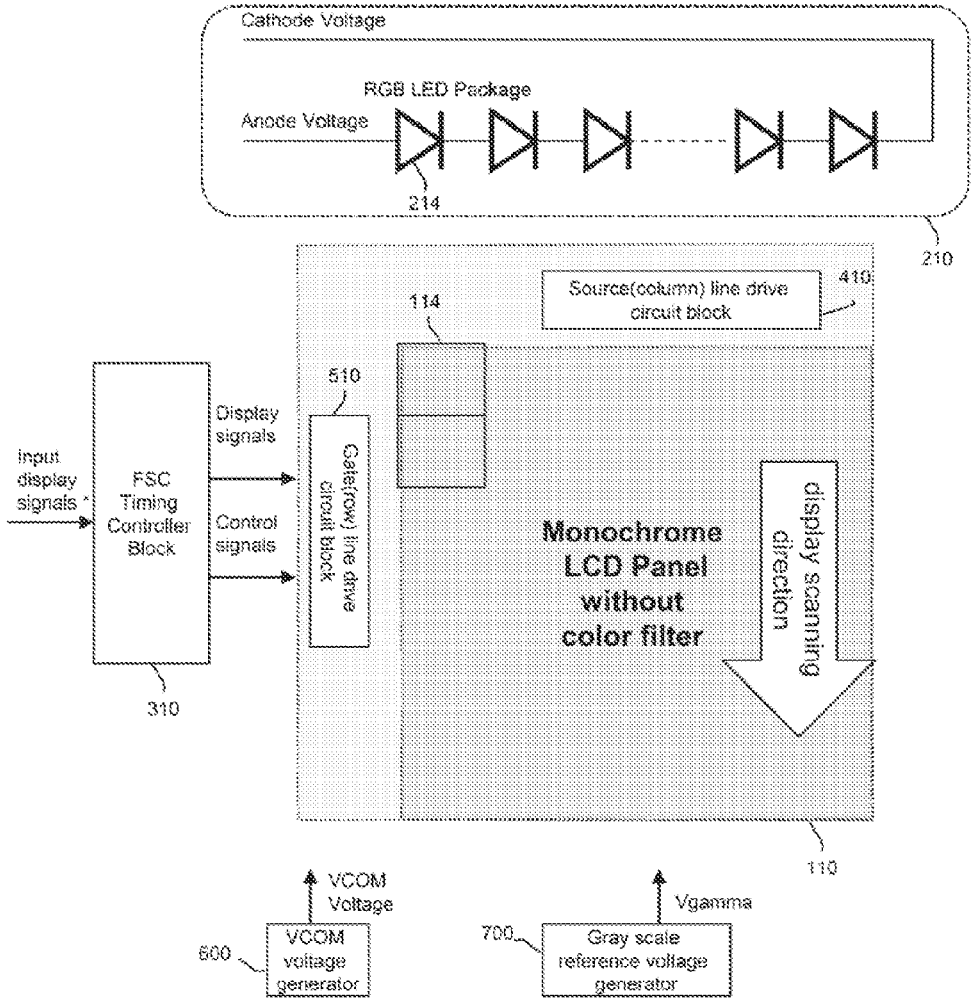
* input display signals : TTL, LVDS, TMDS, DP, eDP, MIPI, MDDI
Figure 9C Conventional FSCLCD having horizontal RGB LED arrays

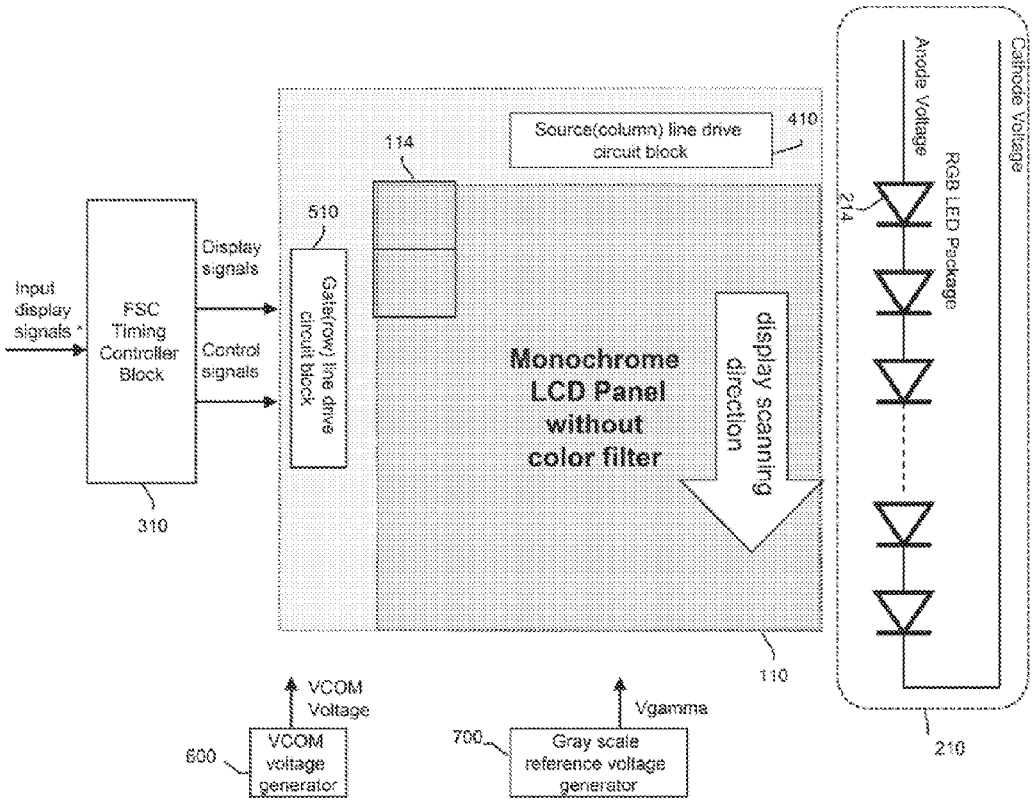
* Input display signals : TTL, LVDS, TMDS, DP, eDP, MIPI, MDDI
Figure 9D Conventional FSCLCD having vertical RGB LED arrays

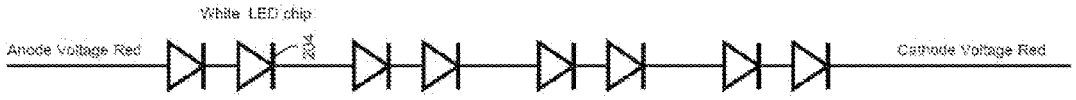
(a) Conventional architecture of White LED BLU
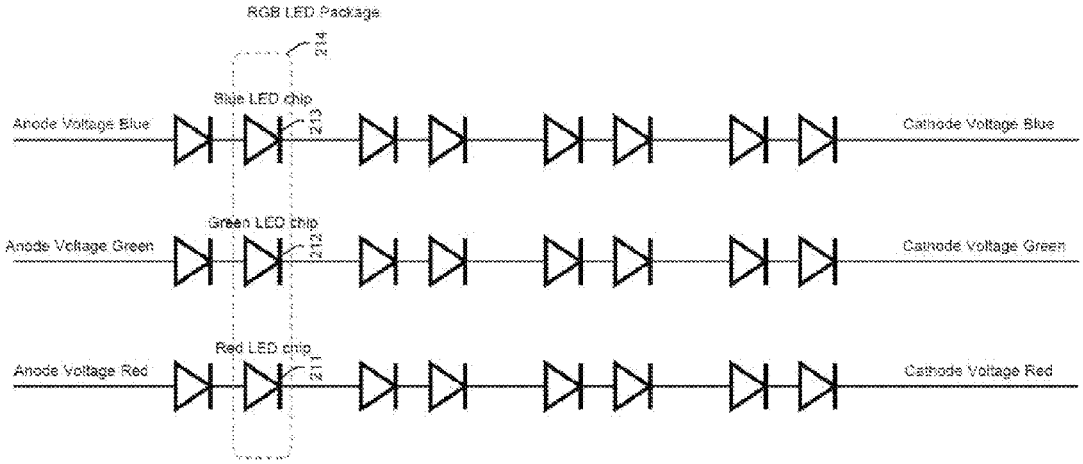
(b) Conventional architecture of RGB LED BLU
Figure 9E Conventional architecture of White LED BLU and RGB LED BLU

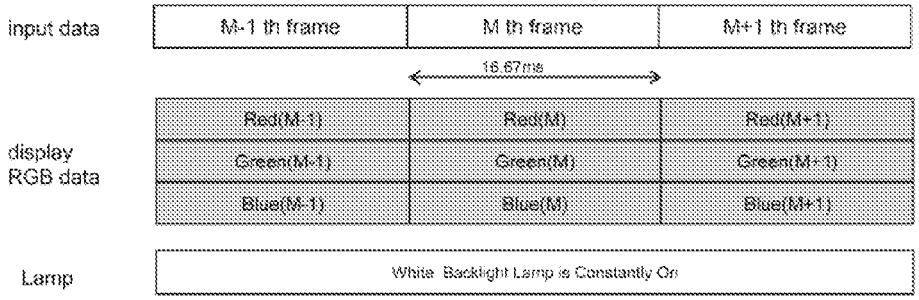
Figure 9F BLU on timing at conventional CFLCD with white LED package
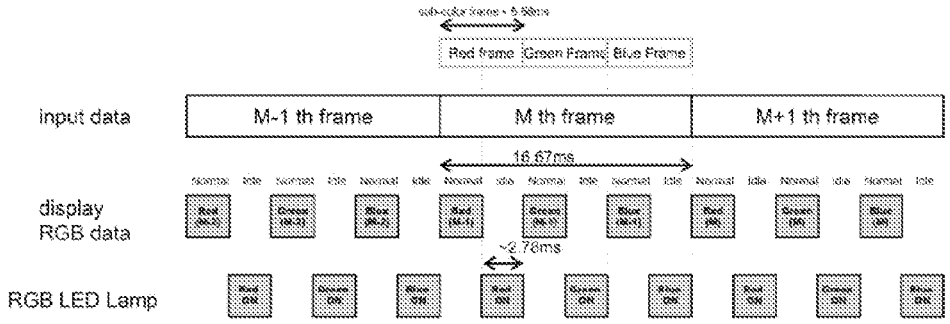
Figure 9G BLU on timing at FSCLCD having fast LC with RGB LED package

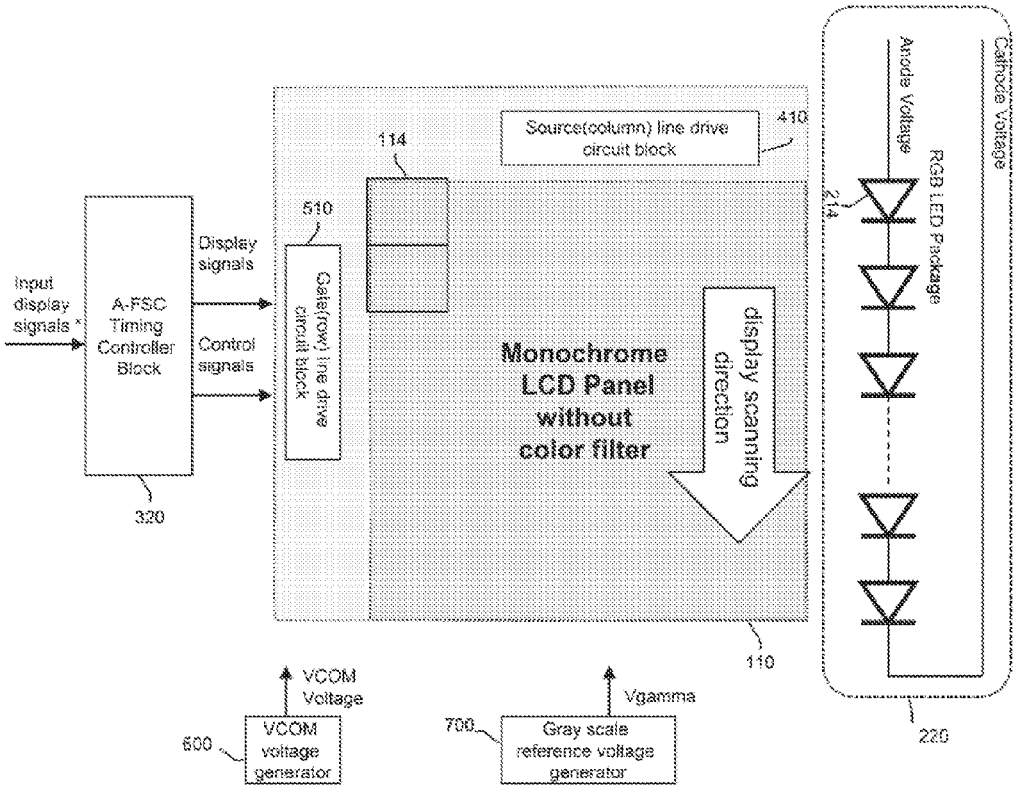
* Input display signals : TTL, LVDS, TMDS, DP, eDP, MIPI, MDDI
Figure 10A Invented FSCLCD architecture having vertical LED arrays

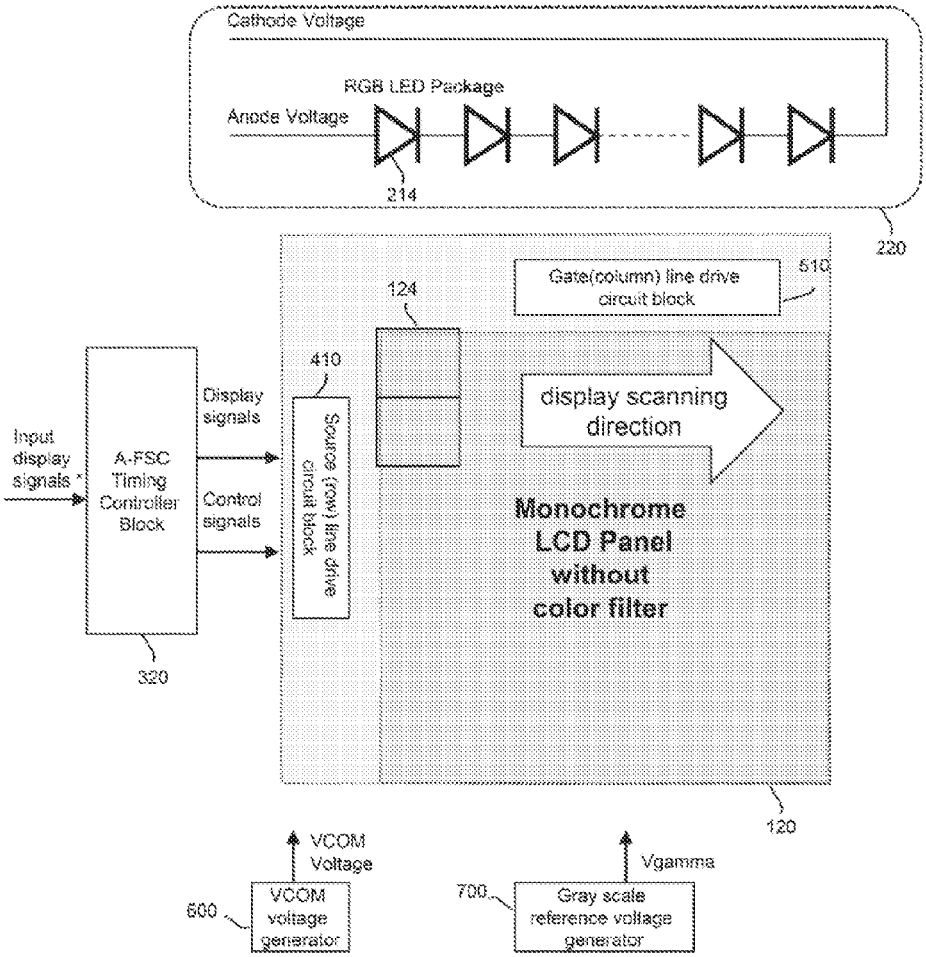
* Input display signals : TTL, LVDS, TMDS, DP, eDP, MIPI, MDDI
Figure 10B Invented FSCLCD architecture having horizontal LED arrays

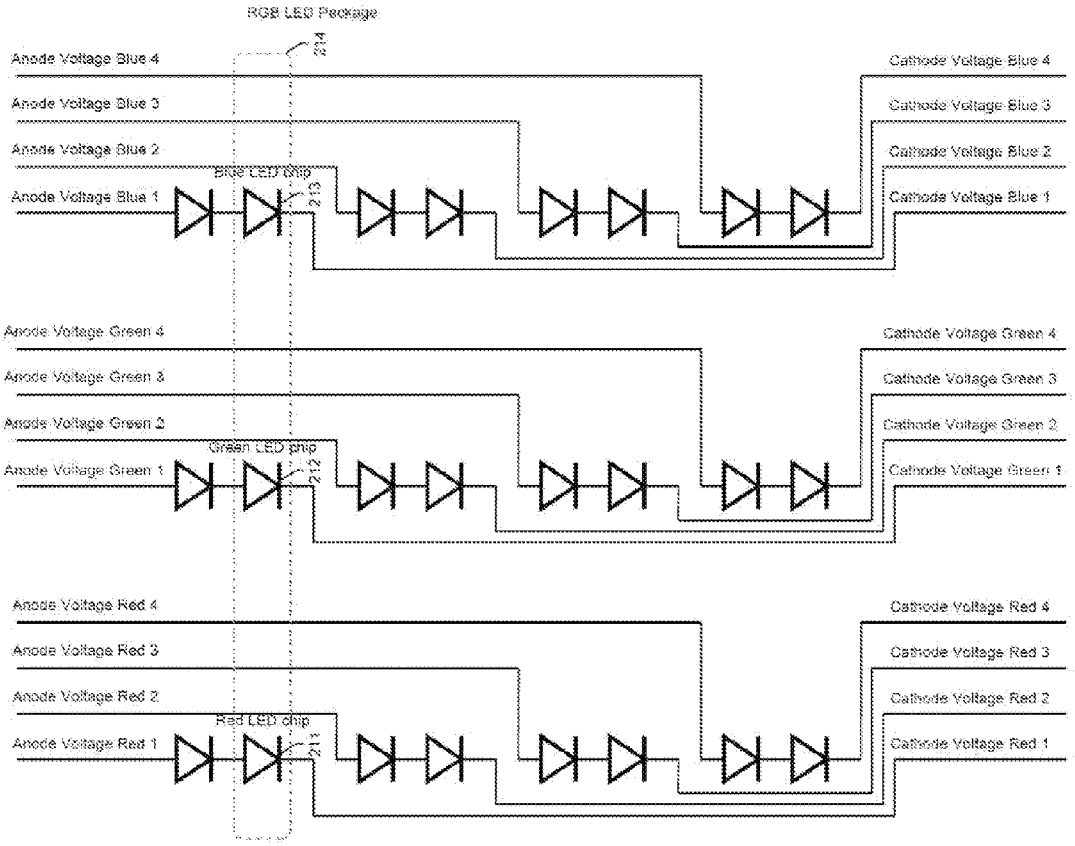
Figure 10C Invented architecture of RGB LED BLU having 4 blocks of RGB LED packages

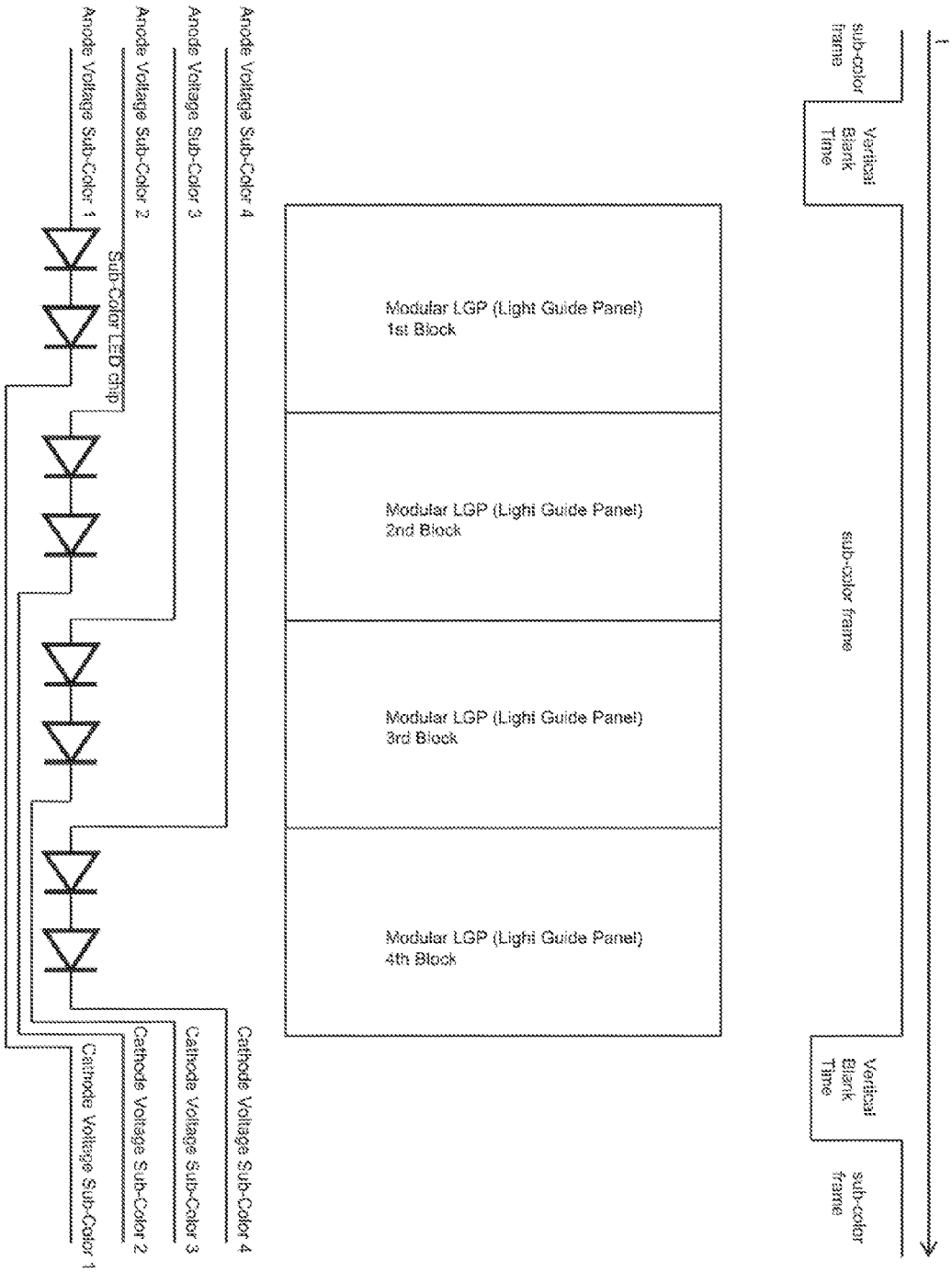
Figure 10D Spatial dimension in an invented RGB LED BLU having 4 blocks of RGB LED packages

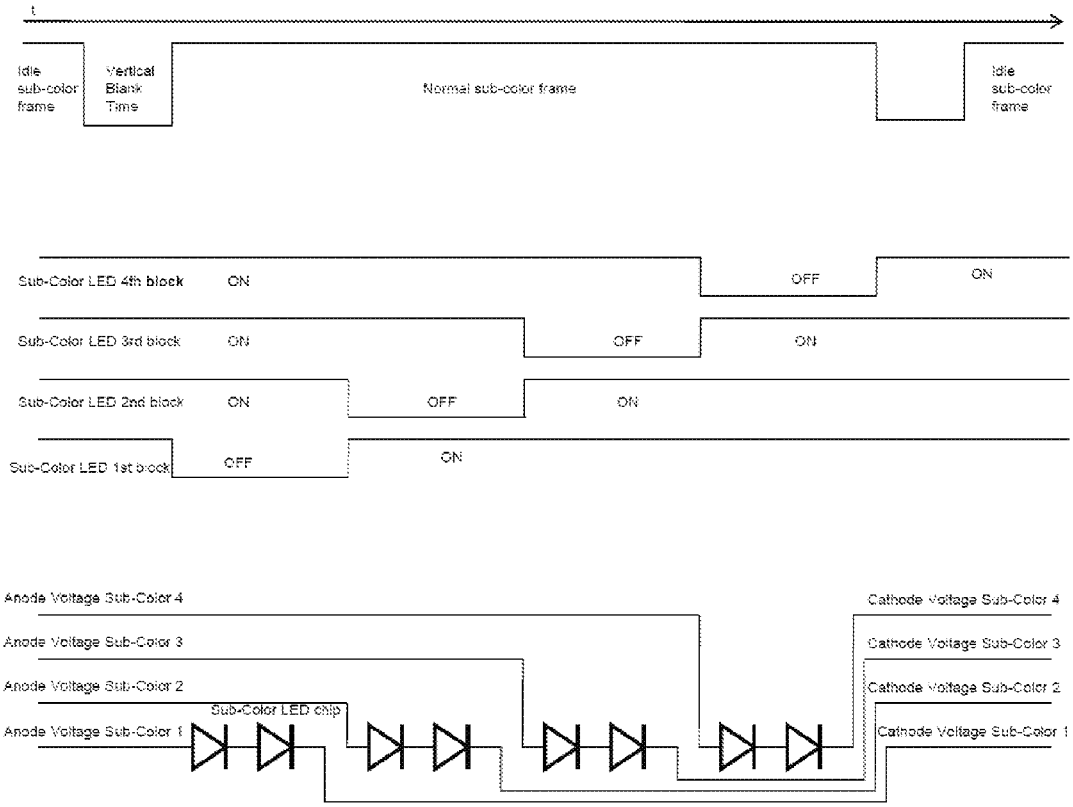
Figure 11A Timing diagram of invented FSCLCD architecture having fast LC with 4 blocks of RGB LED packages during normal sub-color frame

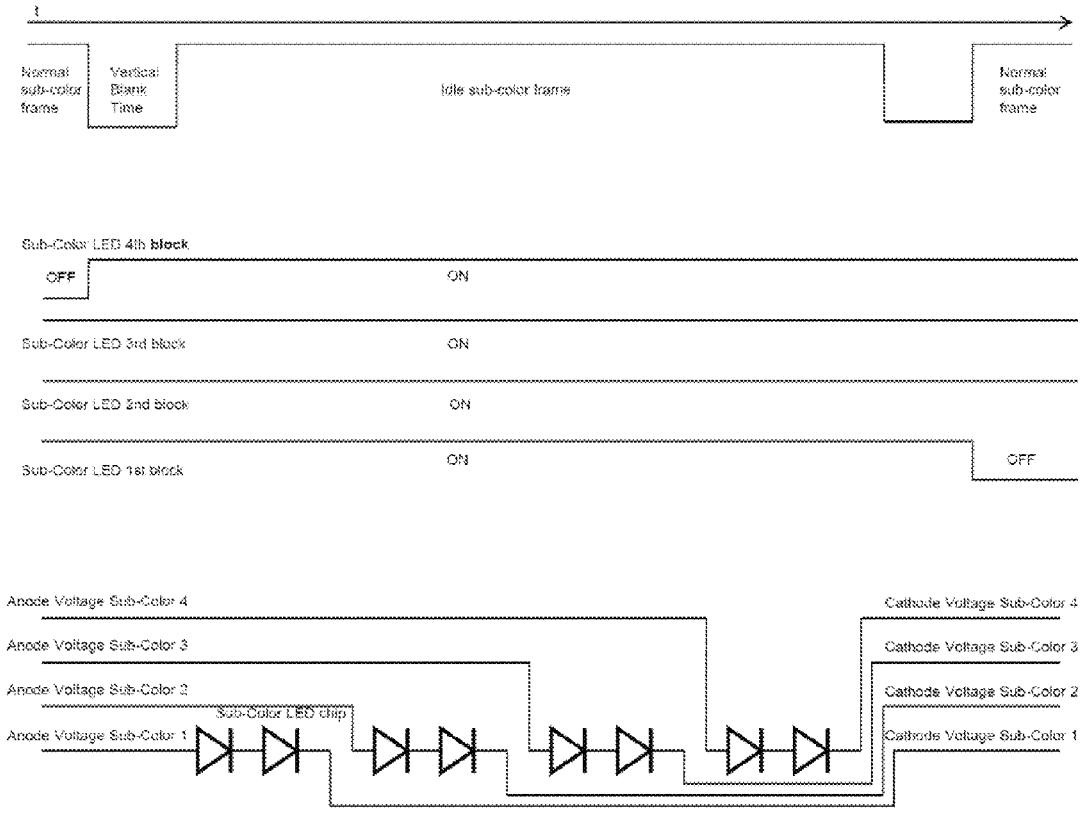
Figure 11B Timing diagram of invented FSCLCD architecture having fast LC with 4 blocks of RGB LED packages during idle sub-color frame

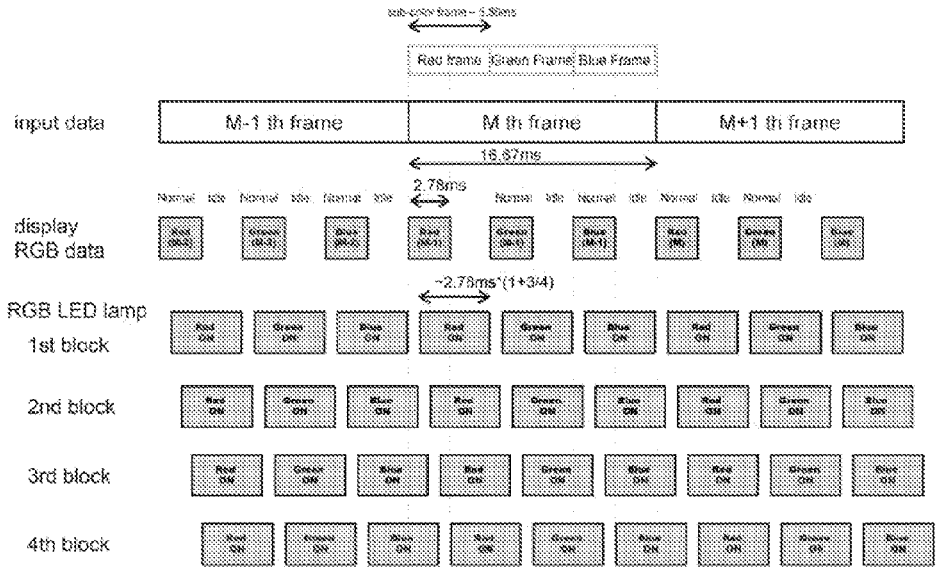
Figure 11C LED on timing at invented FSCLCD architecture having fast LC with RGB LED package

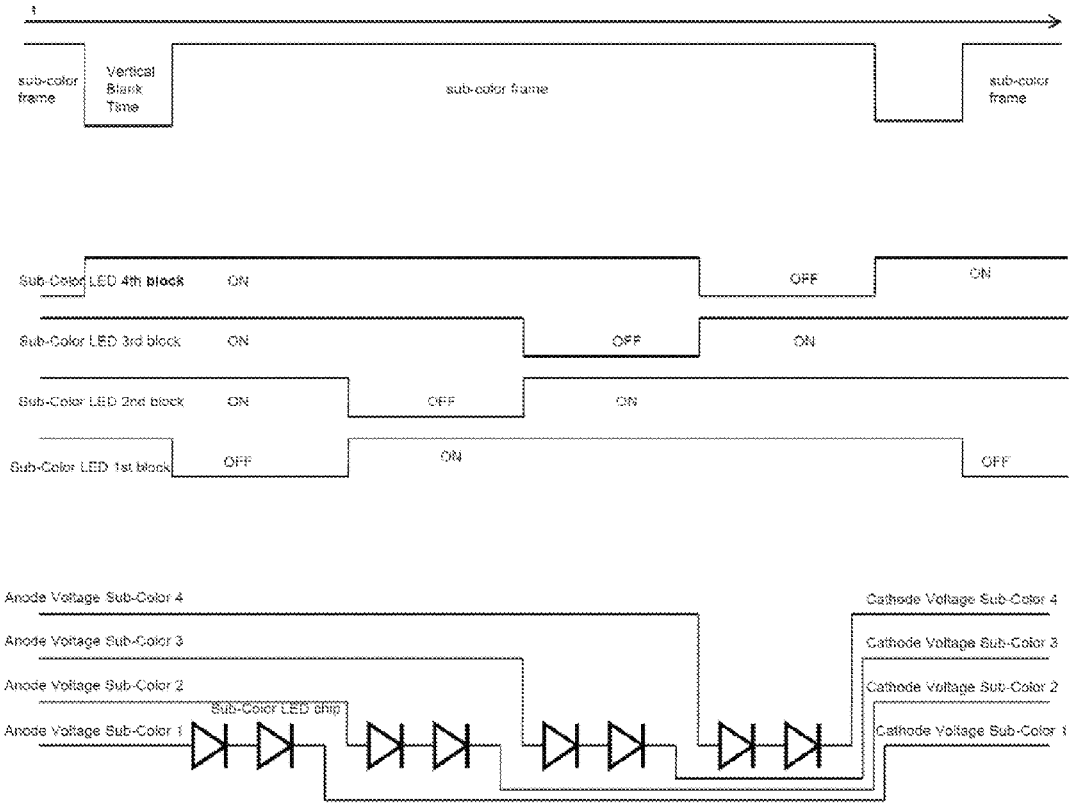
Figure 12A Timing diagram of invented FSCLCD architecture having fast LC with 4 blocks of RGB LED packages during one sub-color frame

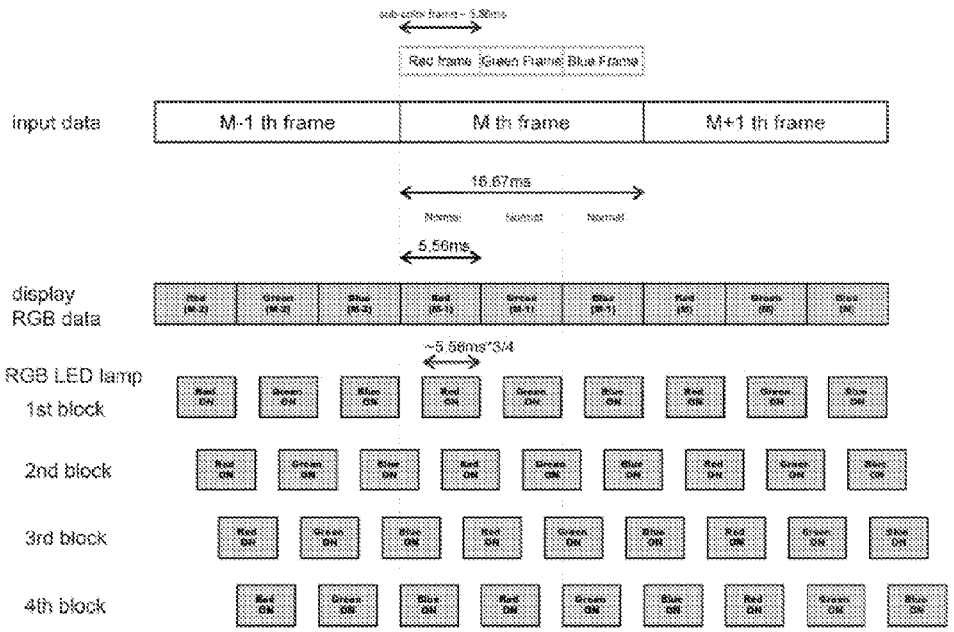
Figure 12B LED on timing at invented FSCLCD having fast LC with RGB LED package when low frequency of source data input

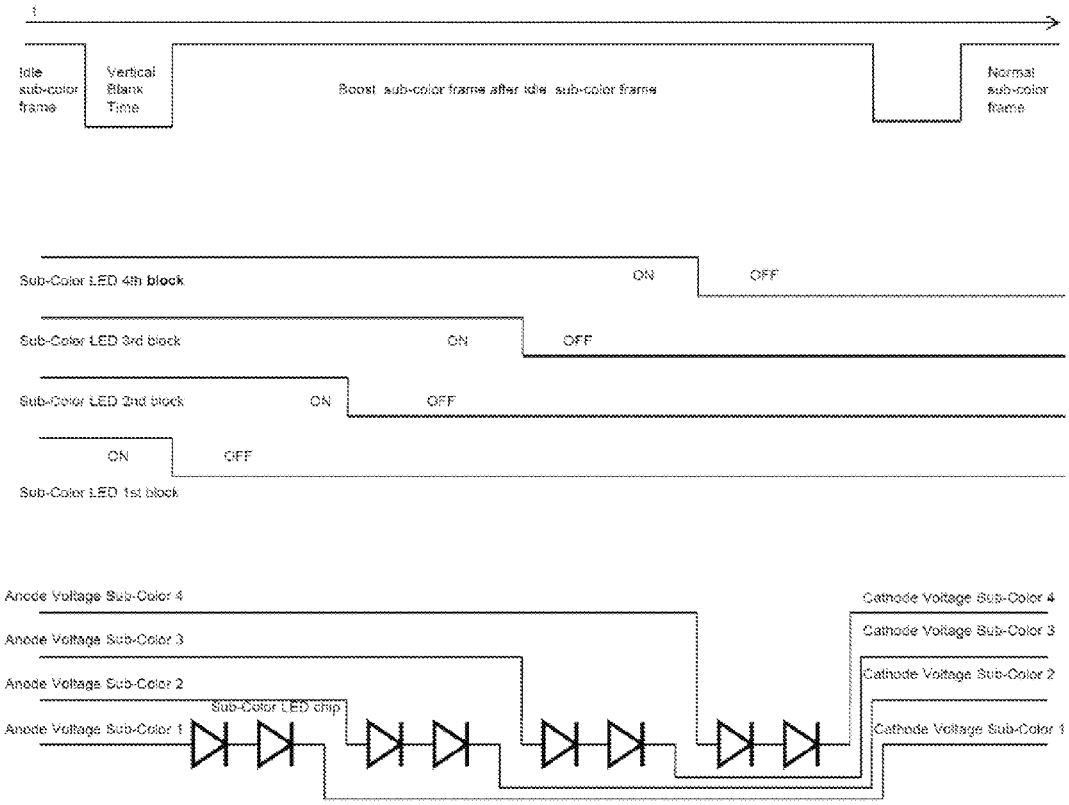
Figure 13A Timing diagram of invented FSCLCD architecture having slow LC with 4 blocks of RGB LED packages during boost sub-color frame

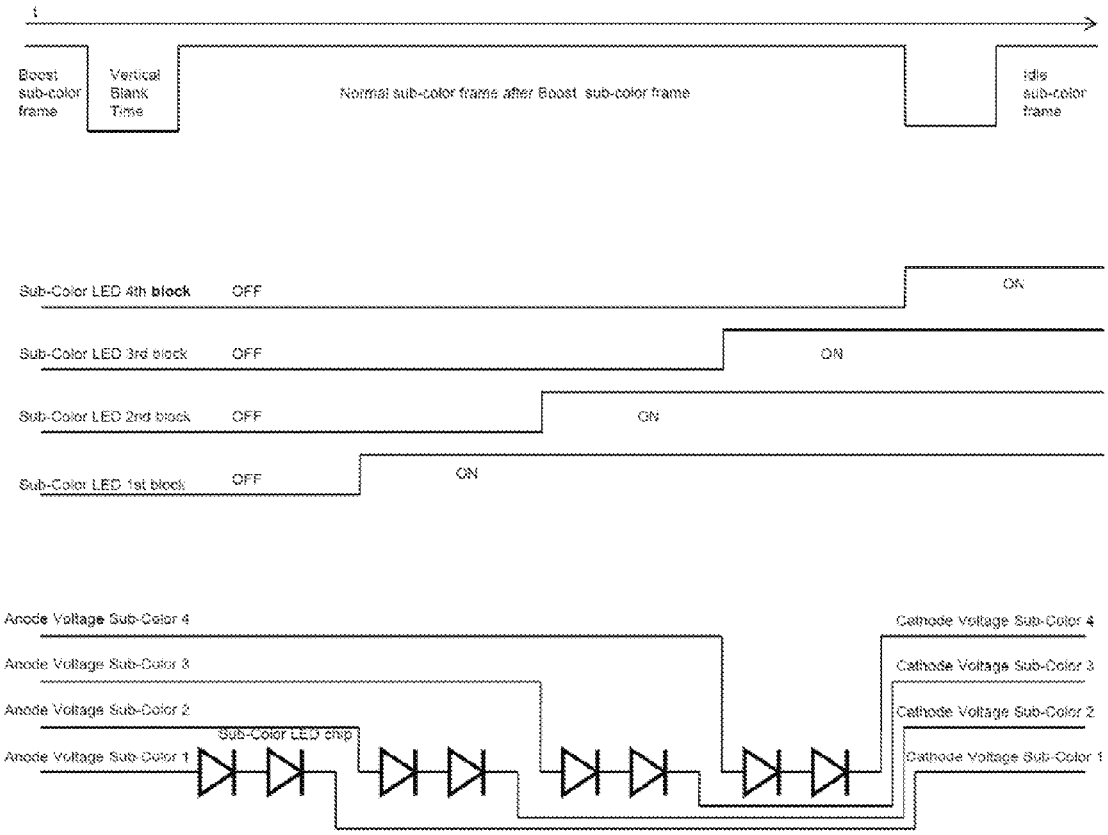
Figure 13B Timing diagram of invented FSCLCD architecture having slow LC with 4 blocks of RGB LED packages during normal sub-color frame

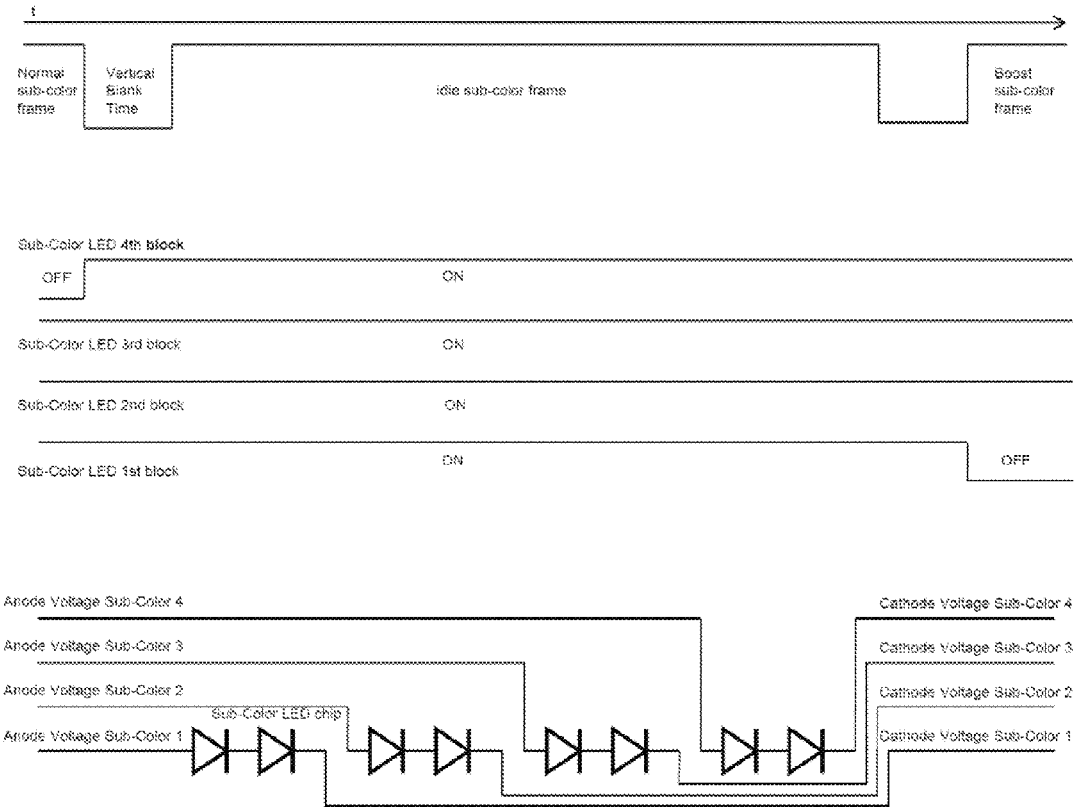
Figure 13C Timing diagram of invented FSCLCD architecture having slow LC with 4 blocks of RGB LED packages during idle sub-color frame

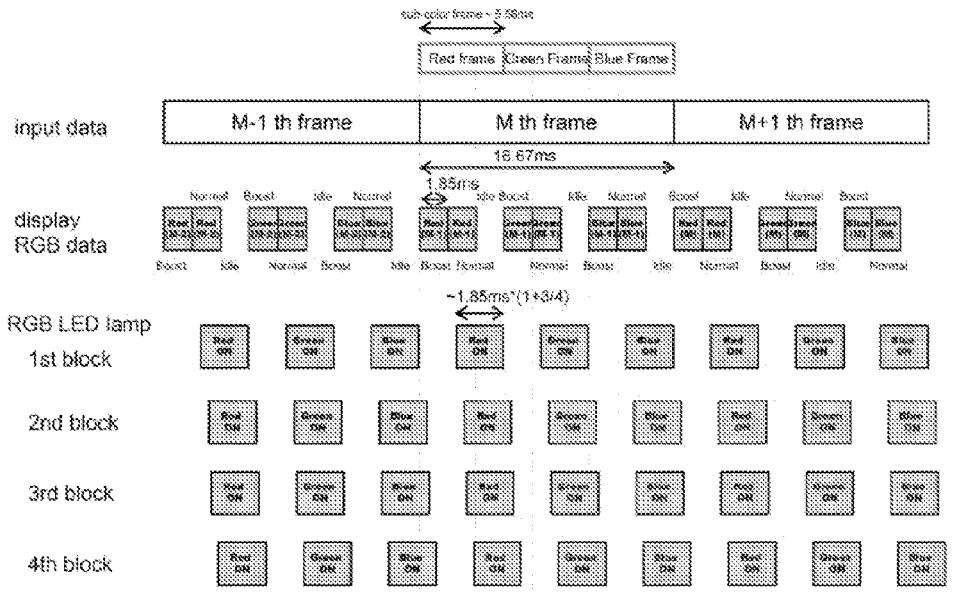
Figure 13D LED on timing at invented FSCLCD architecture having slow LC with 4 blocks of RGB LED package

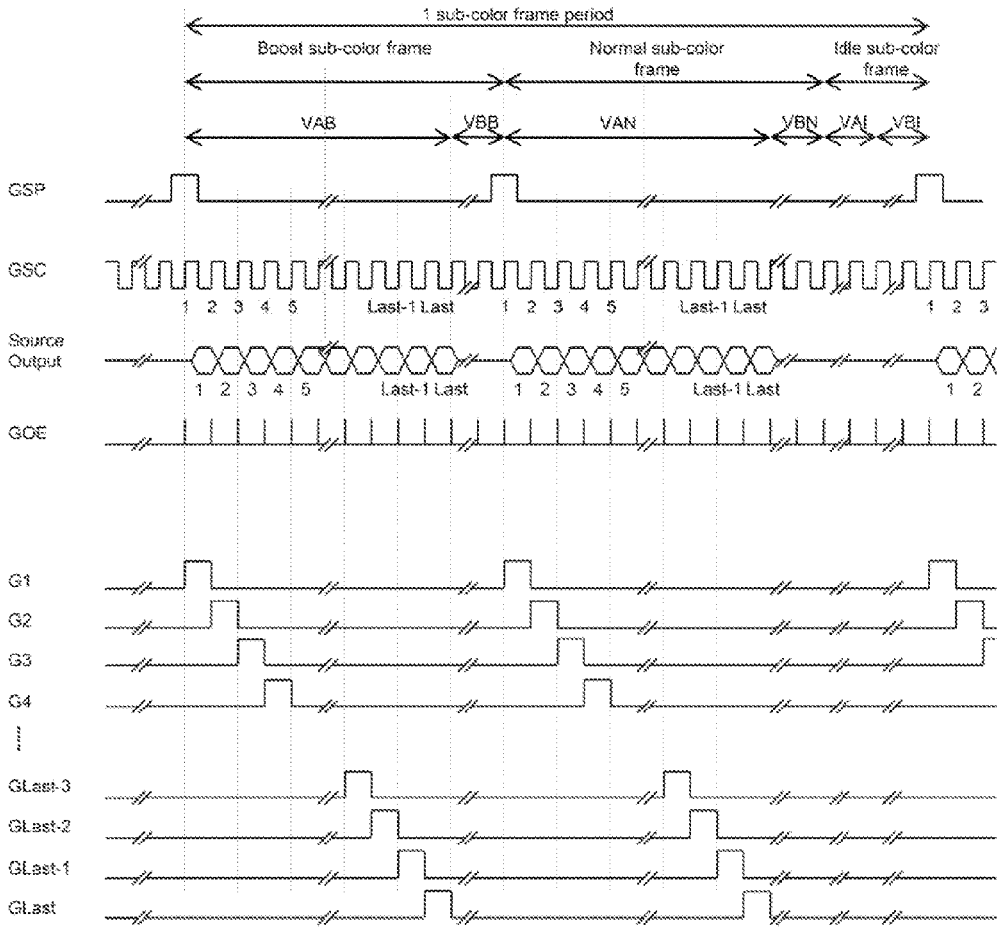
Figure 13E LCD Panel timing at invented FSCLCD architecture having slow LC with RGB LED package

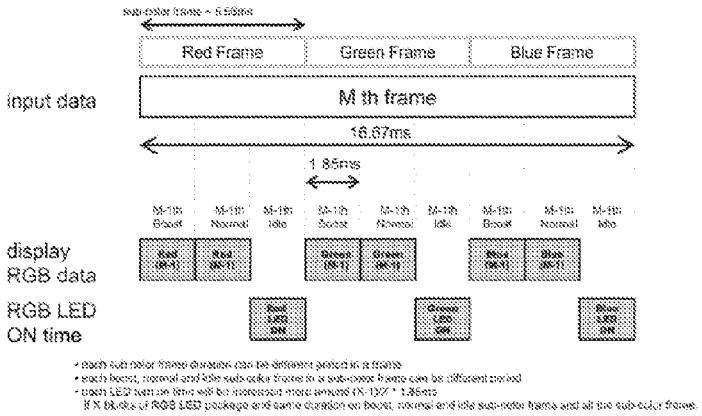
Figure 13F Three sub-color frame at invented FSCLCD architecture with one block RGB LED package
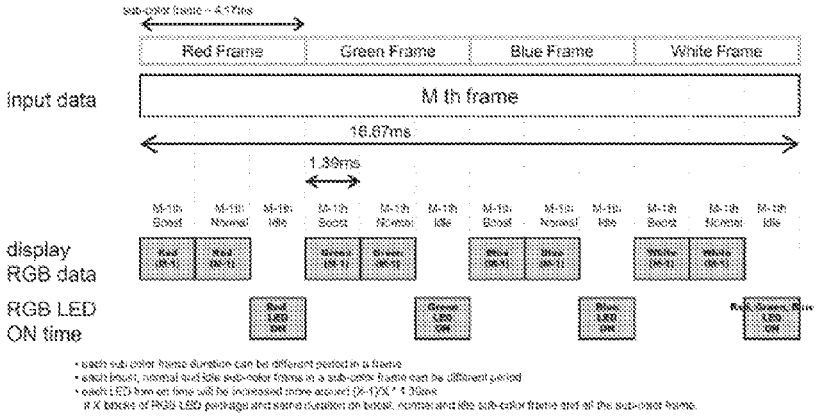
Figure 13G Additional white sub-color frame at invented FSCLCD architecture with one block RGB LED package

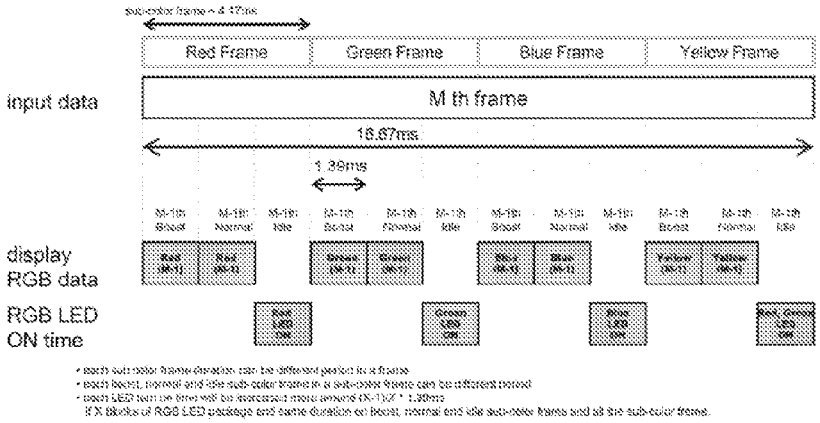
Figure 13H Additional yellow sub-color frame at invented FSCLCD architecture with one block RGB LED package
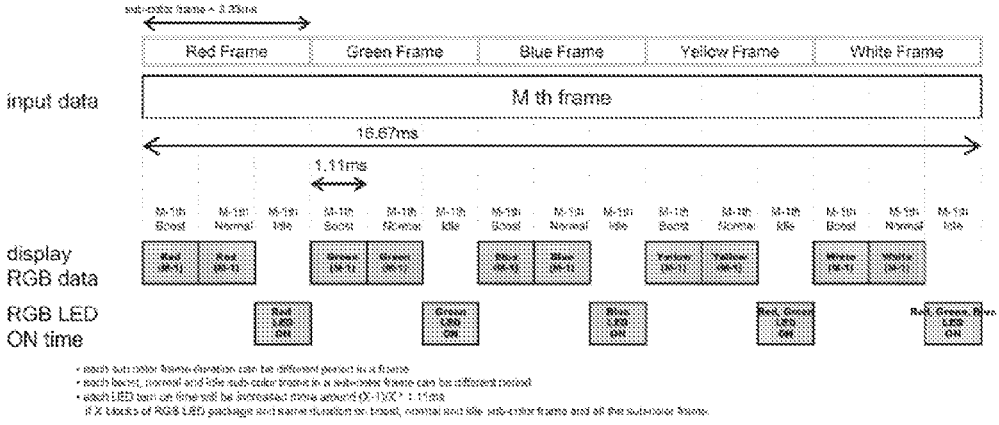
Figure 13J Five sub-color frame at invented FSCLCD architecture with one block RGB LED package

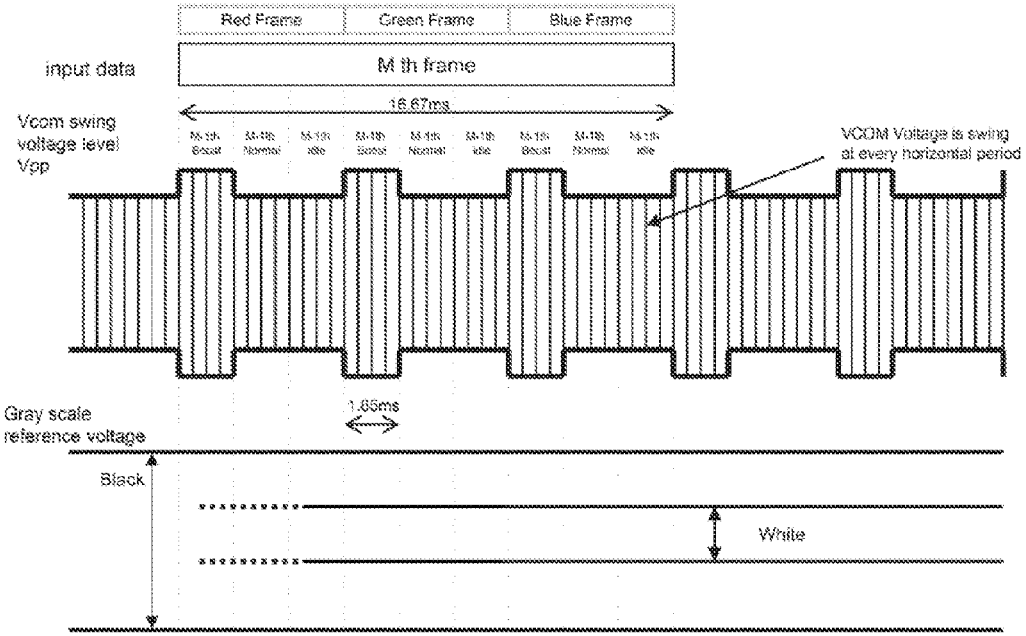
Figure 13K Voltage level at FSCLCD having line inversion mode to make quick white-black transition
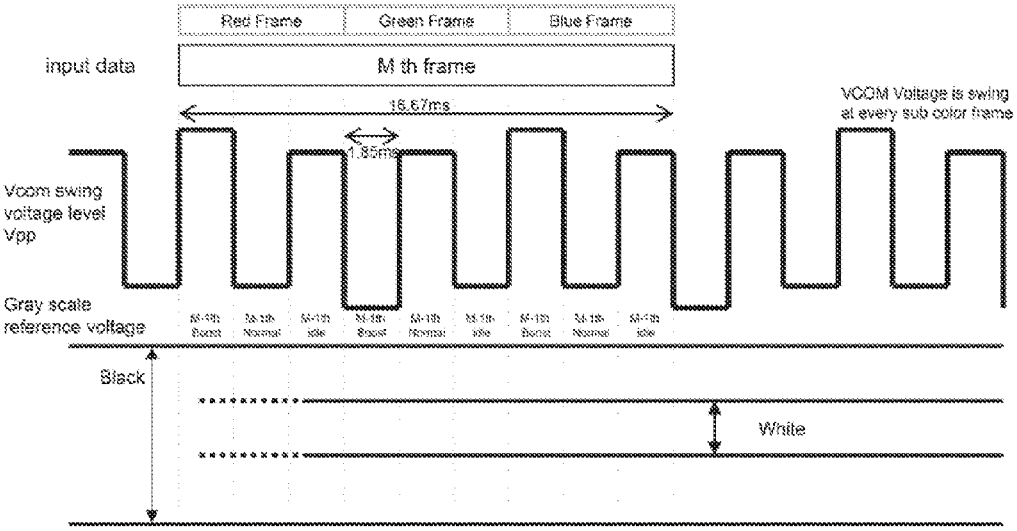
Figure 13L Voltage level at FSCLCD having field inversion mode to make quick white-black transition

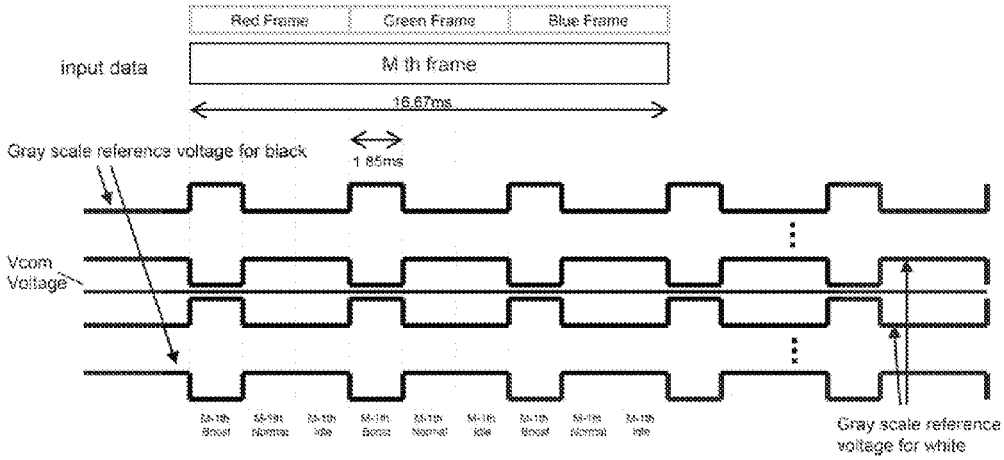
Figure 13M Voltage level at FSCLCD having dot(or column) inversion mode to make quick white-black transition
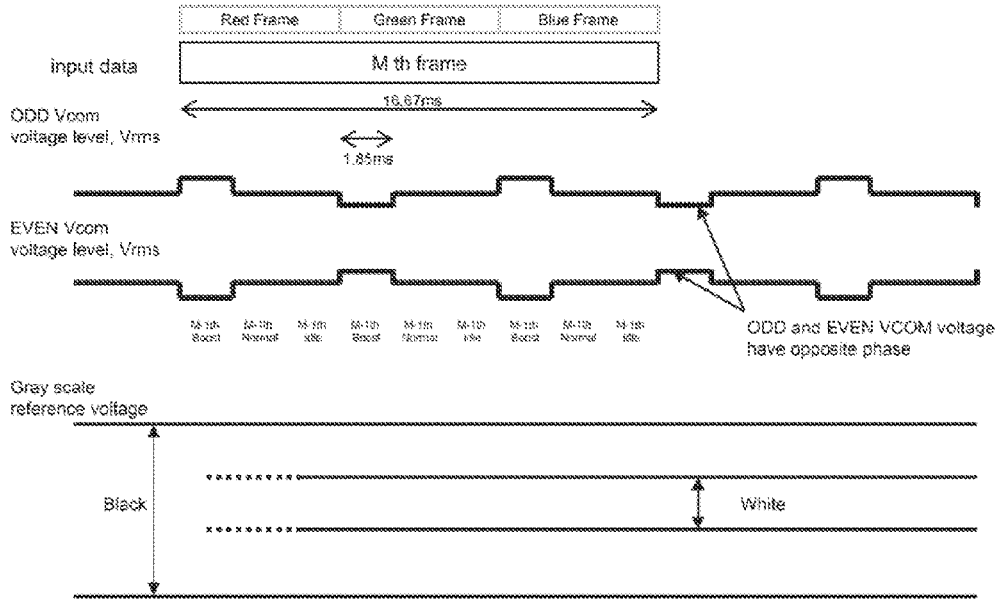
Figure 13N Voltage level at FSCLCD having dot(or column) inversion mode with two Vcom connection to make quick white-black transition

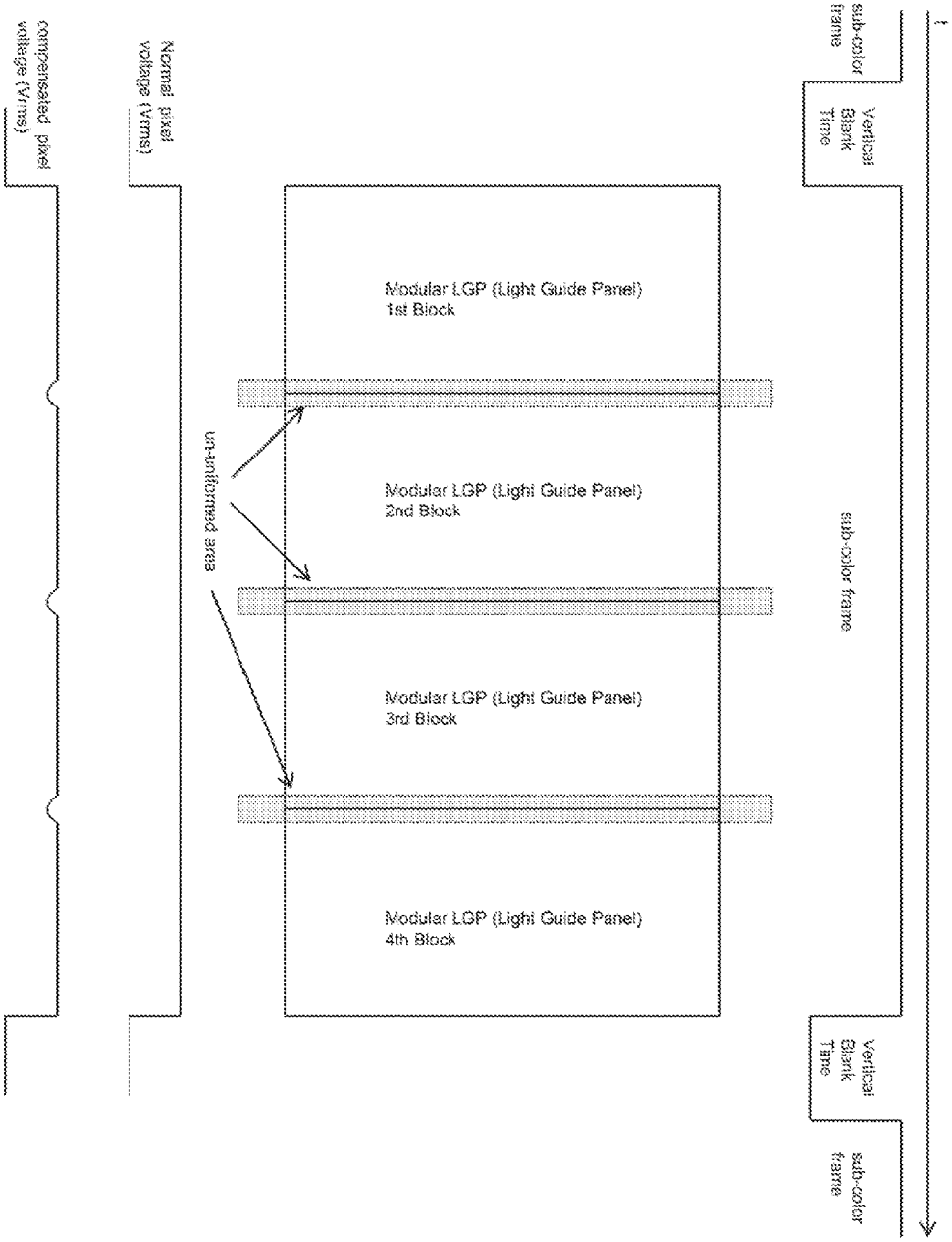
Figure 14 Compensated pixel data for reducing un-uniformity at edge of modular LGP in an invented RGB LED BLU having 4 blocks of RGB LED packages

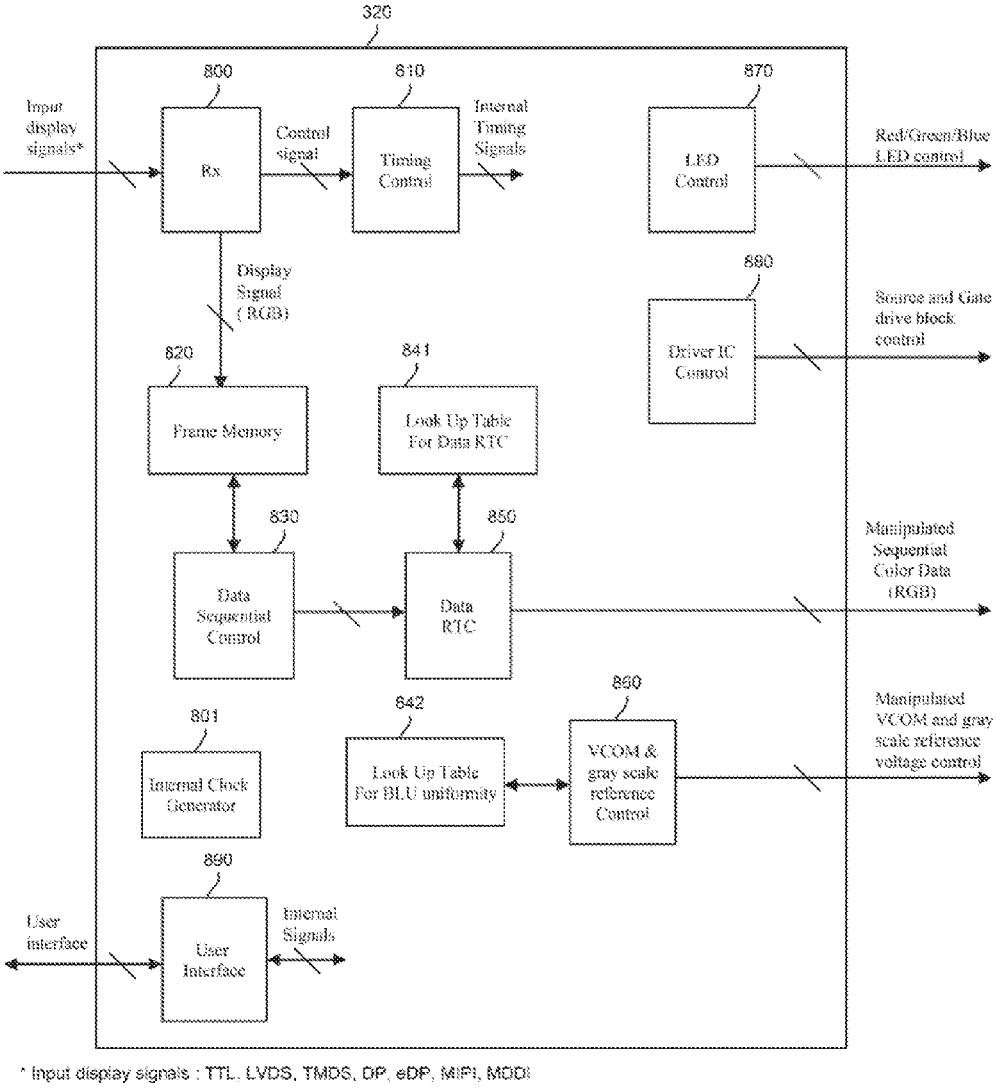
* Input display signals : TTL, LVDS, TMDS, DP, eDP, MIPI, MDDI
Figure 15 A-FSC TCON block diagram for an invented architecture in FSCLCD

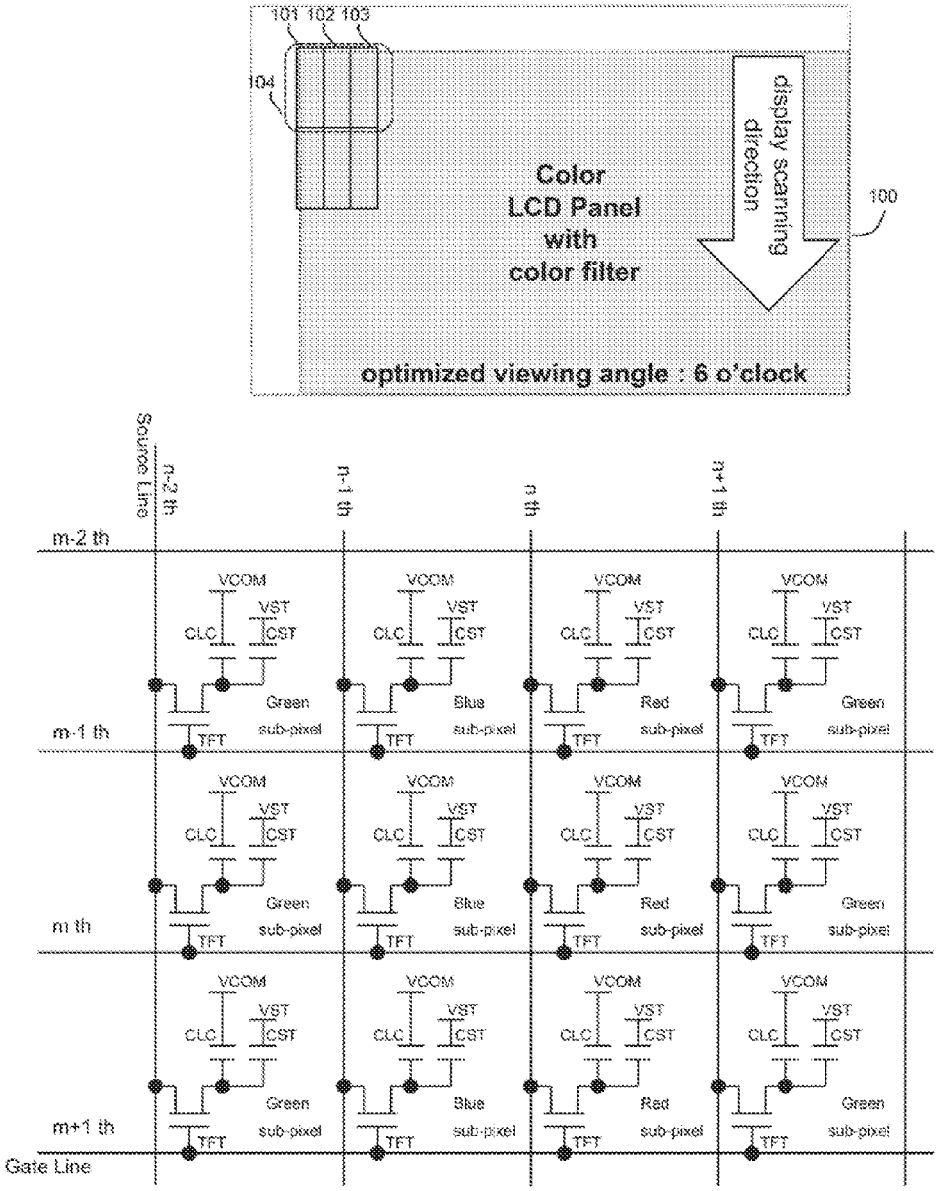
Figure 16A Pixel structure of conventional CF TFTLCD having single VCOM and RGB vertical stripe pixel arrangement for gate vertical scanning

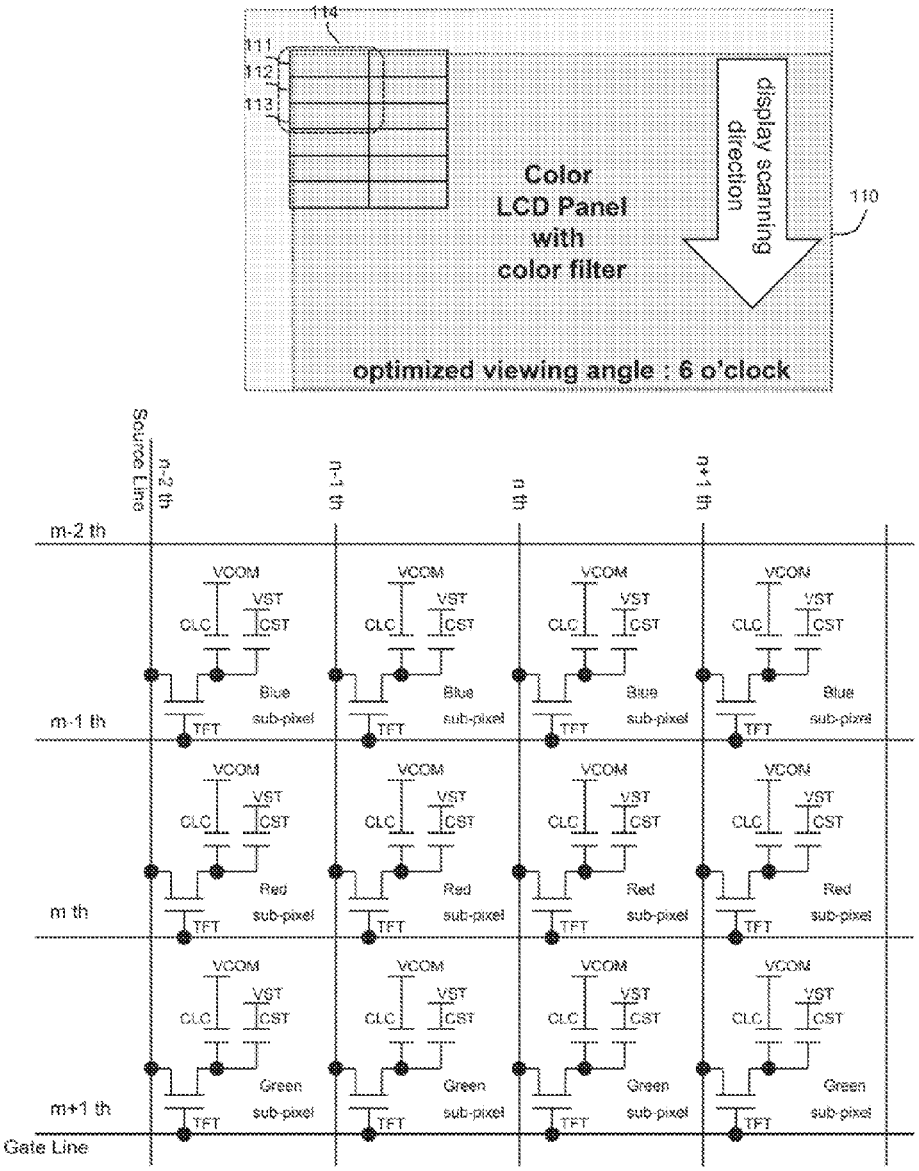
Figure 16B Pixel structure of conventional CF TFT LCD having single VCOM and RGB Horizontal stripe pixel arrangement for gate vertical scanning

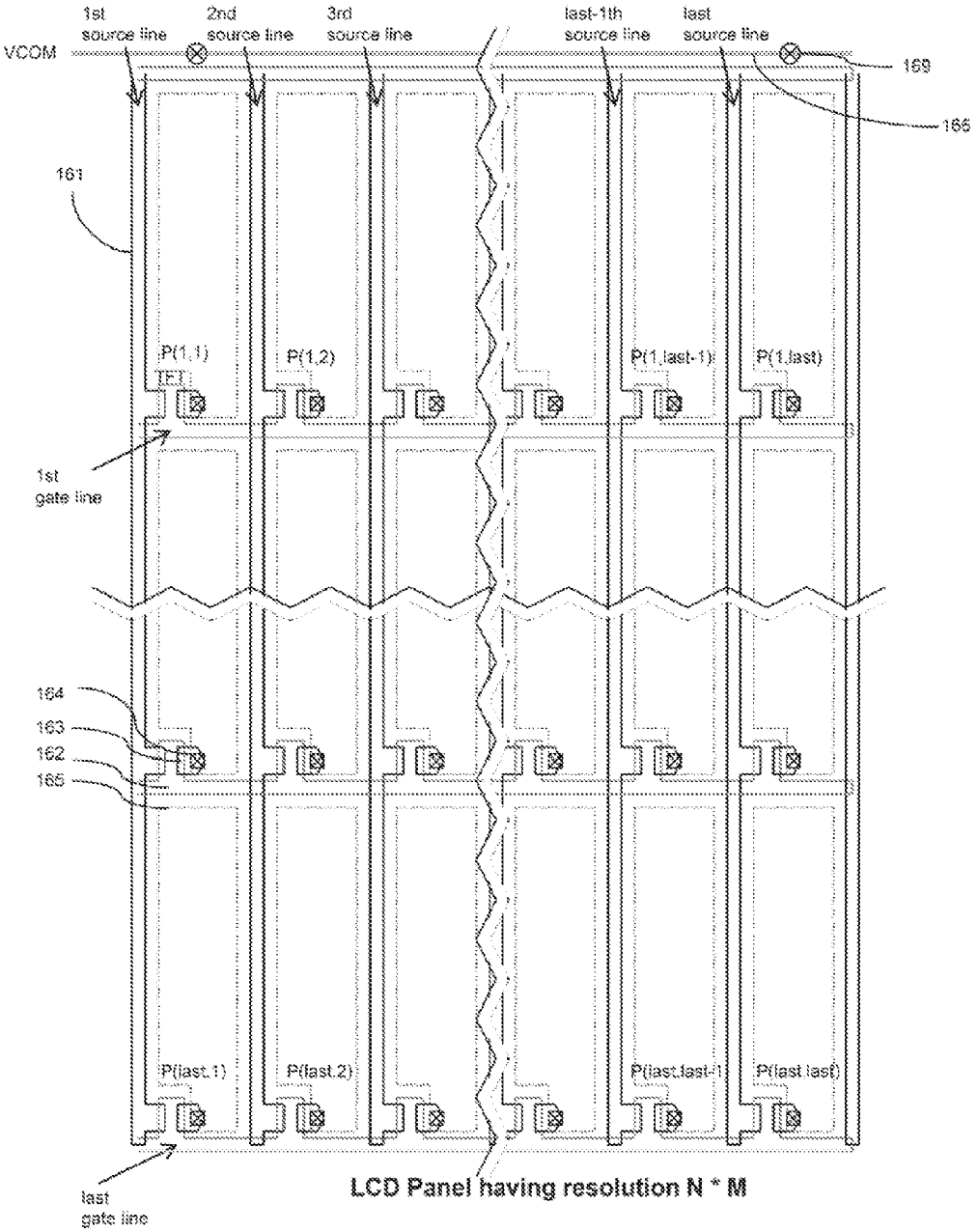
Figure 16C Pixel structure of bottom glass in conventional TN LCD for gate vertical scanning

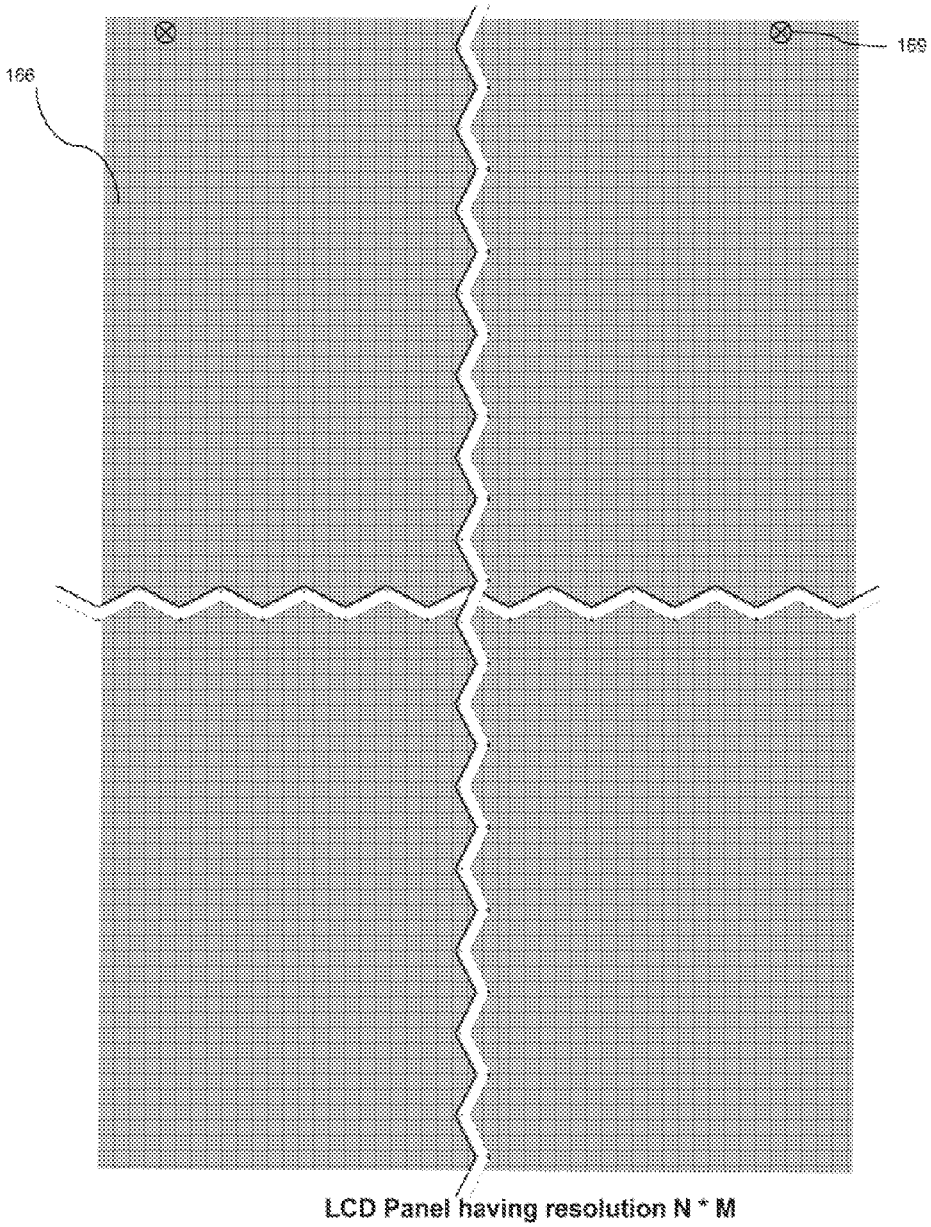
Figure 16D VCOM structure of top glass in conventional TN LCD having single VCOM for gate vertical scanning

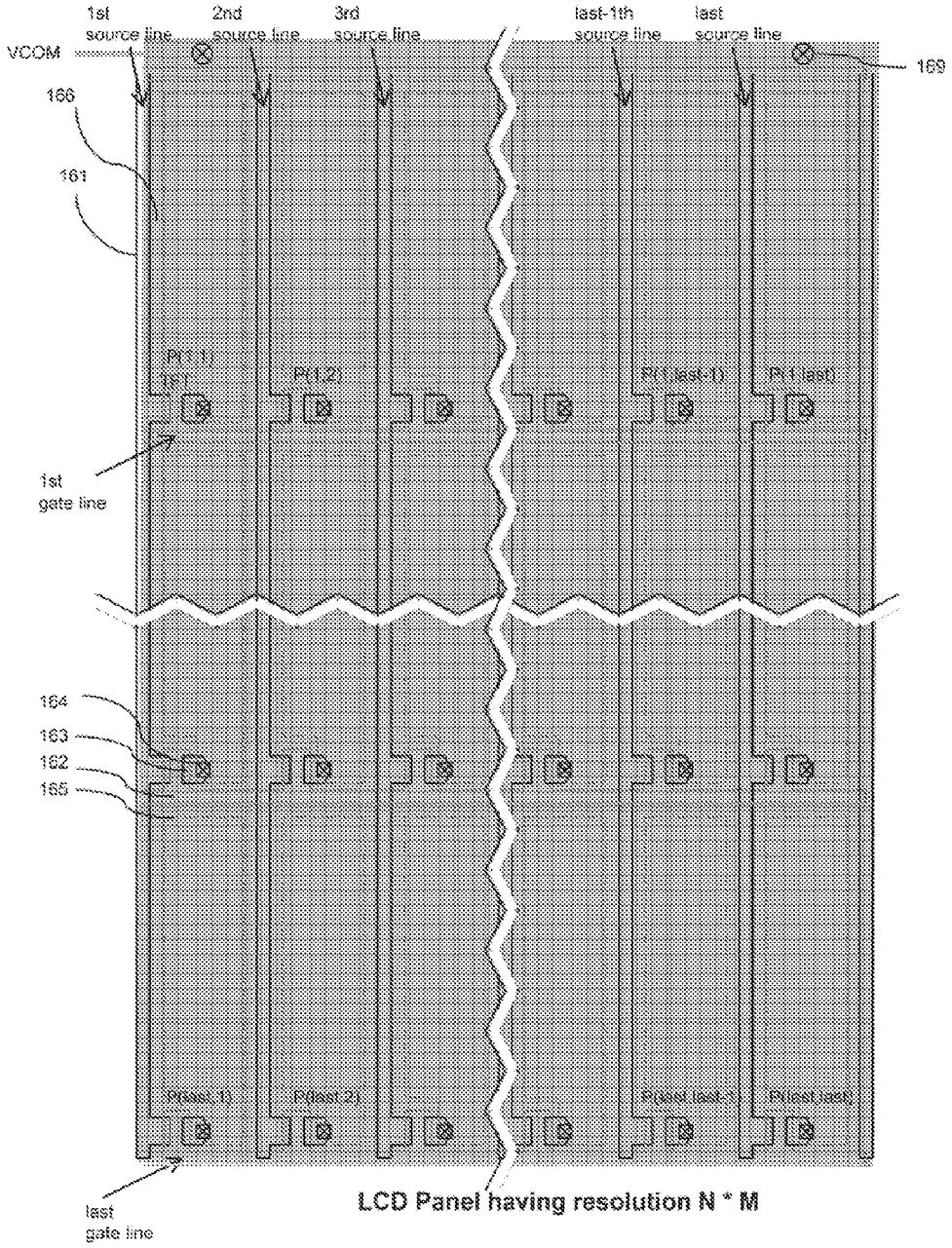
Figure 16E Overall structure of conventional TN LCD having single VCOM for gate vertical scanning

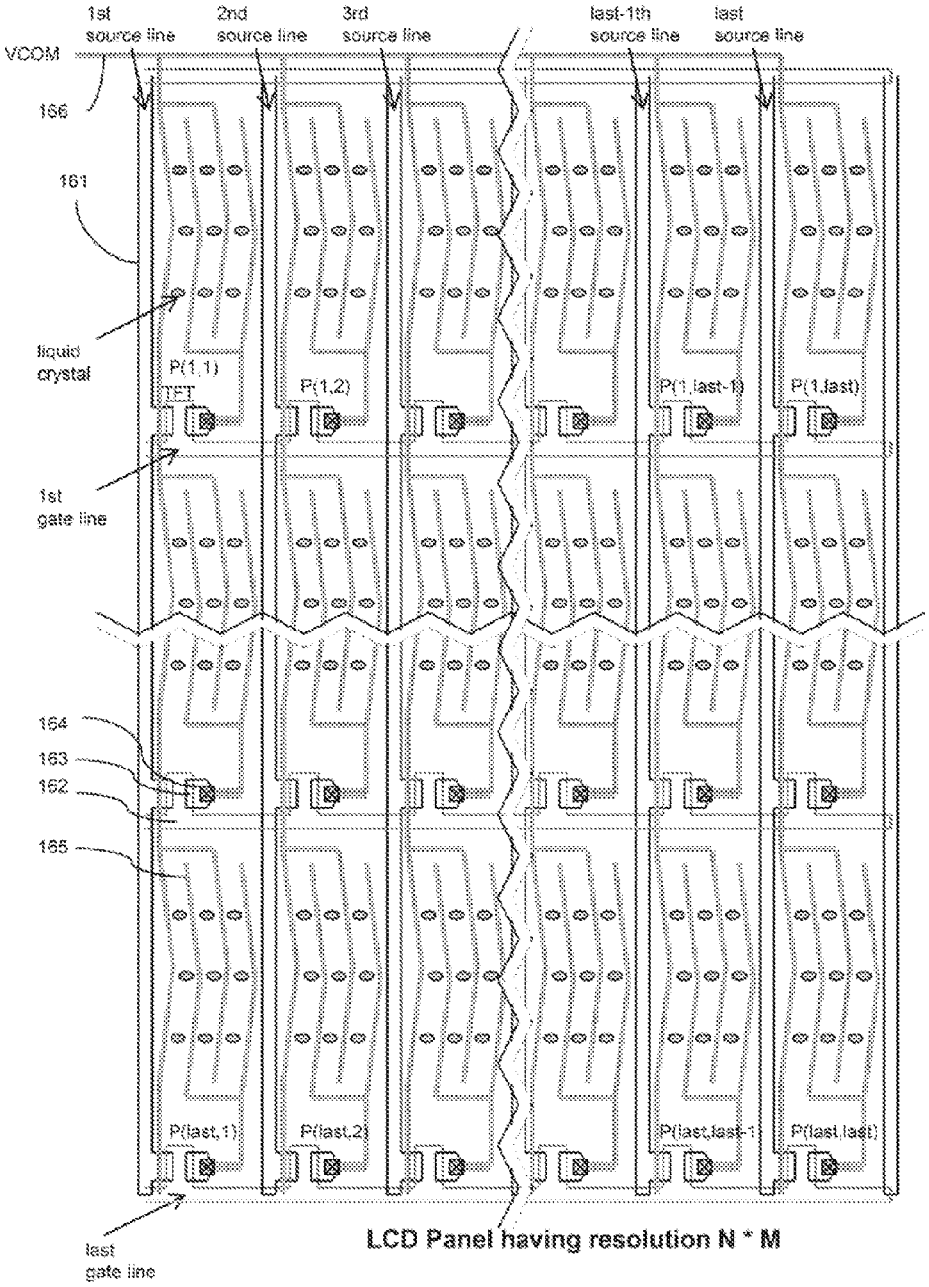
Figure 16F Overall structure of conventional IPS LCD having single VCOM for gate vertical scanning

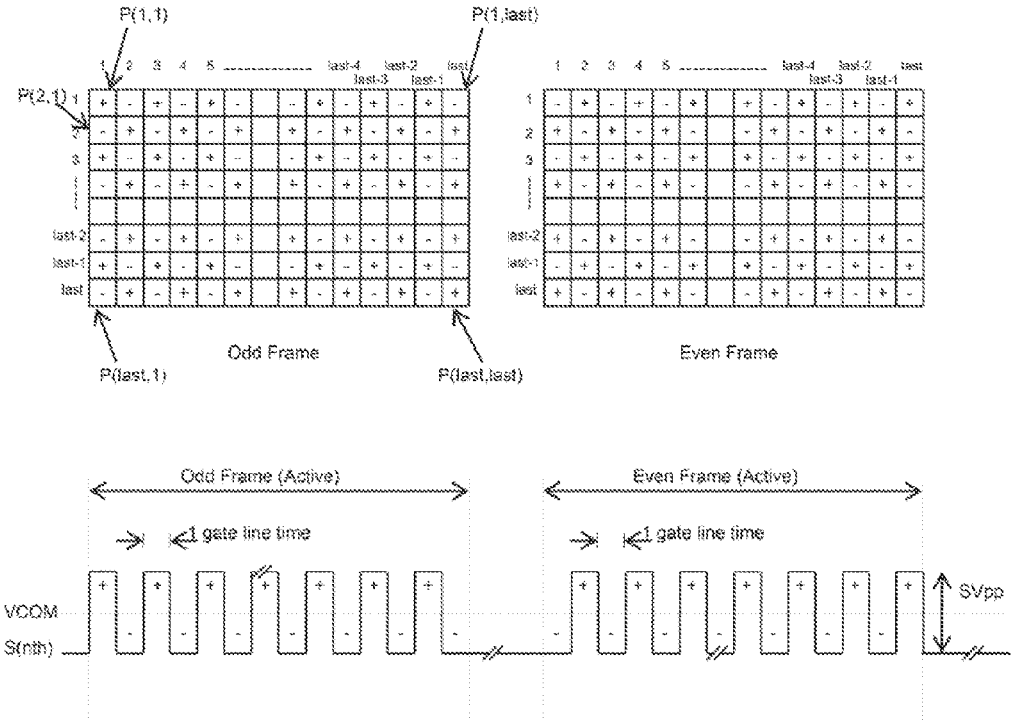
Figure 16G Pixel polarity and source driving voltage when dot (sub-pixel) inversion having conventional single VCOM

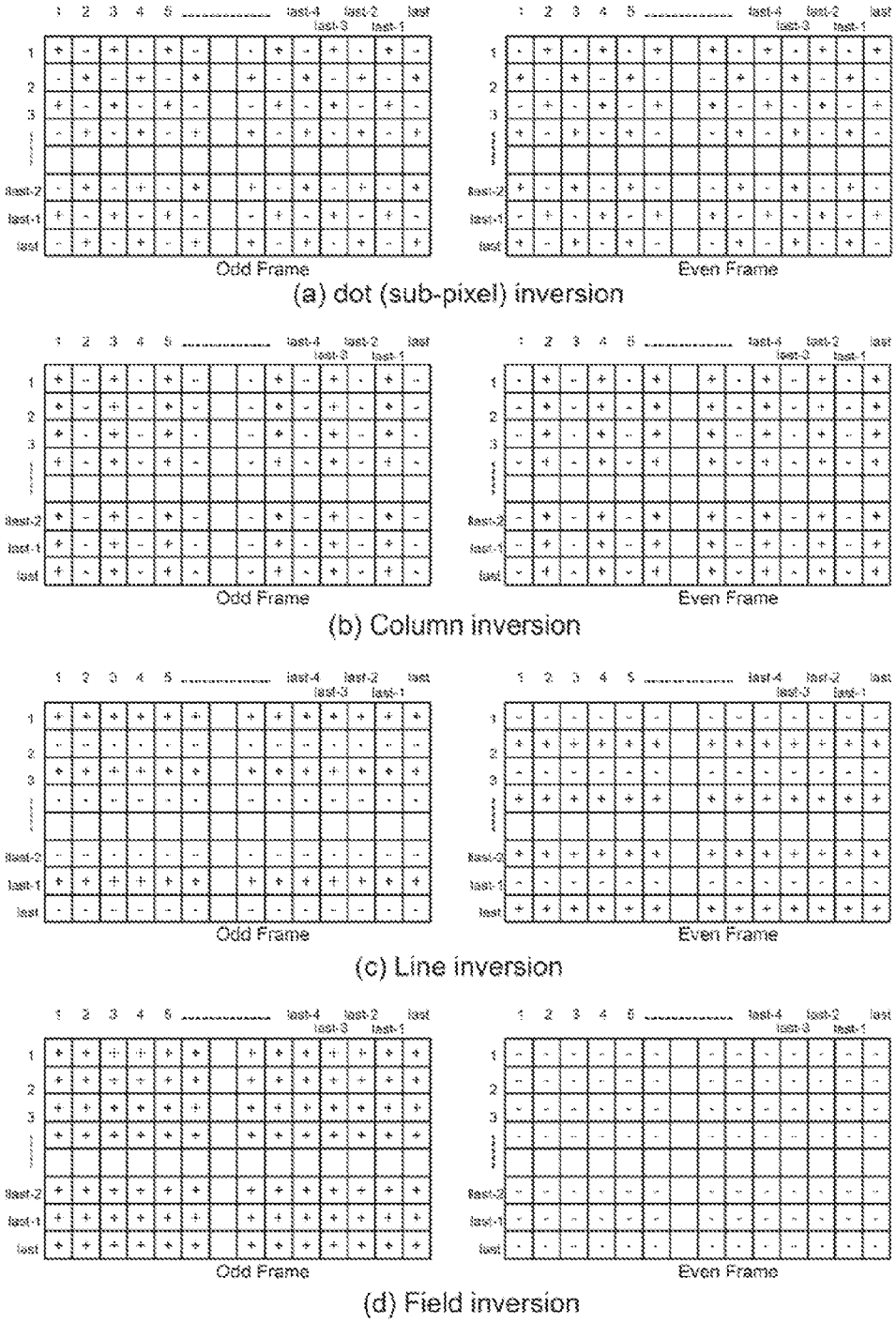
Figure 16H Inversion types in LCD

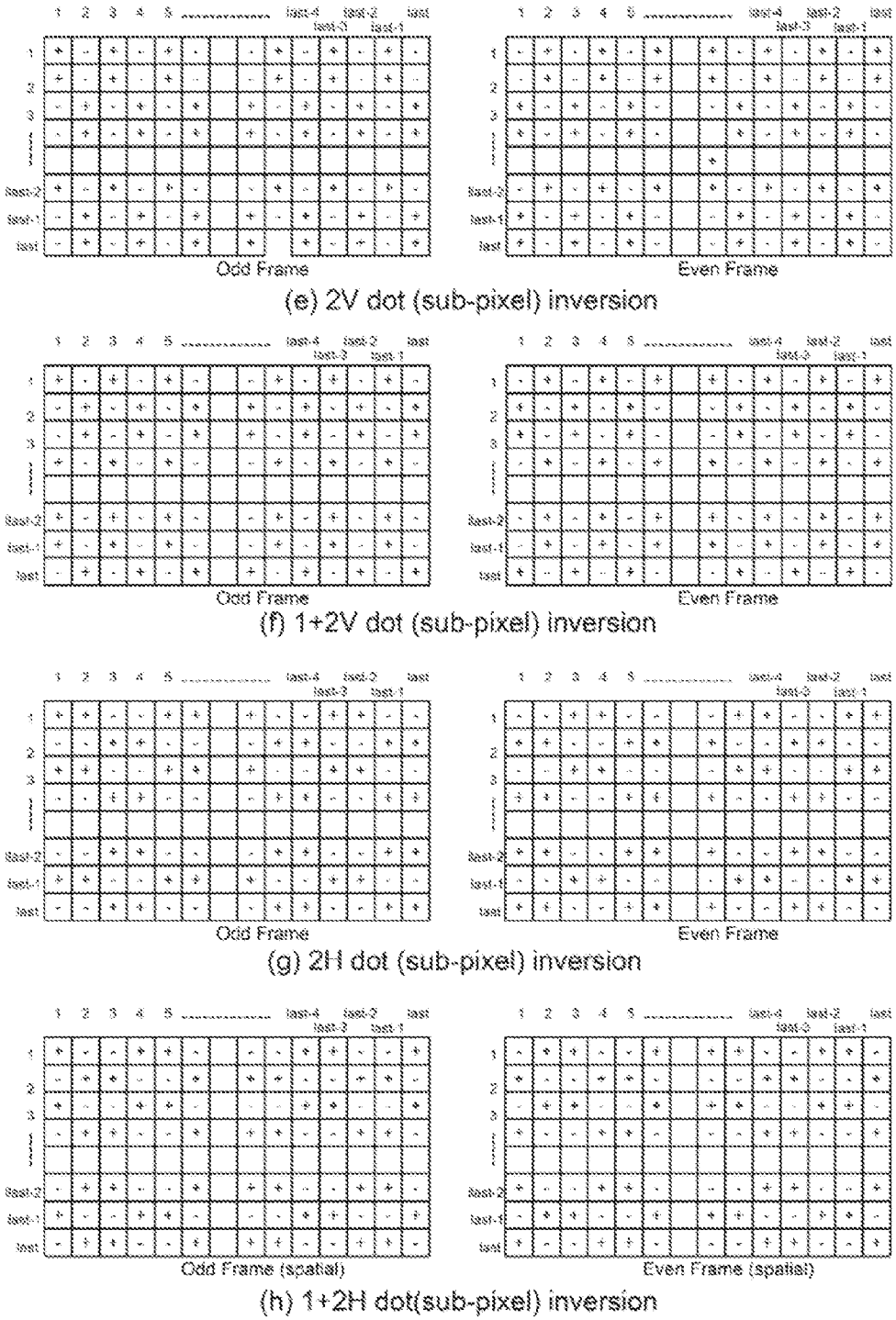
Figure 16I Inversion Types in LCD

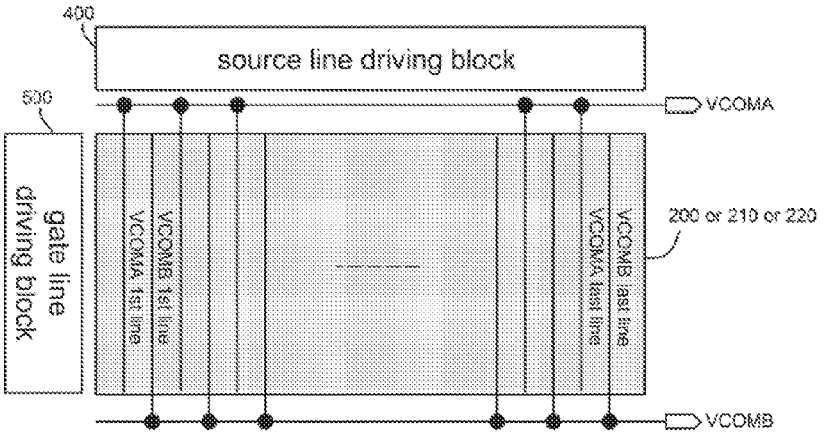
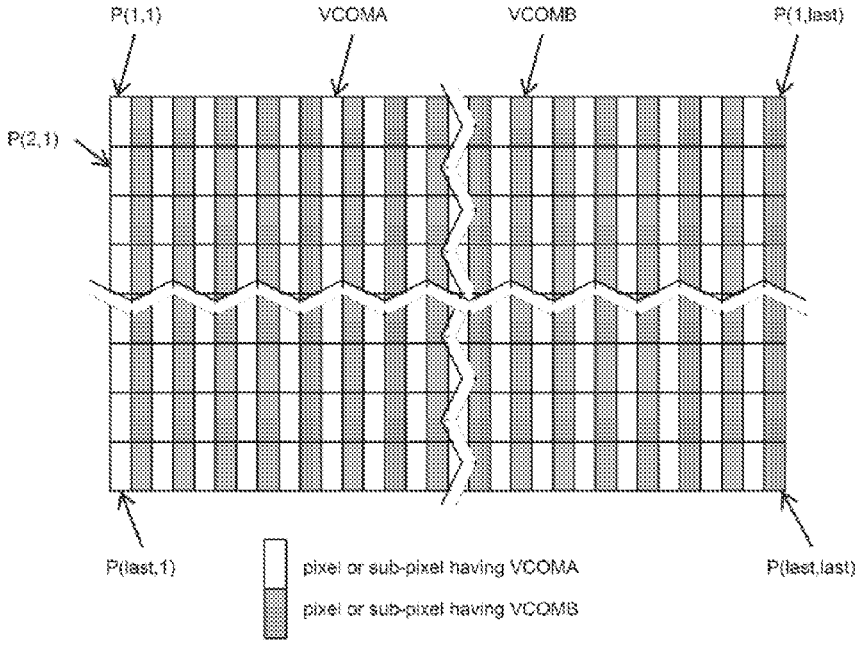
Figure 17A Invented dual VCOM structure at gate vertical scanning for dot inversion or column inversion

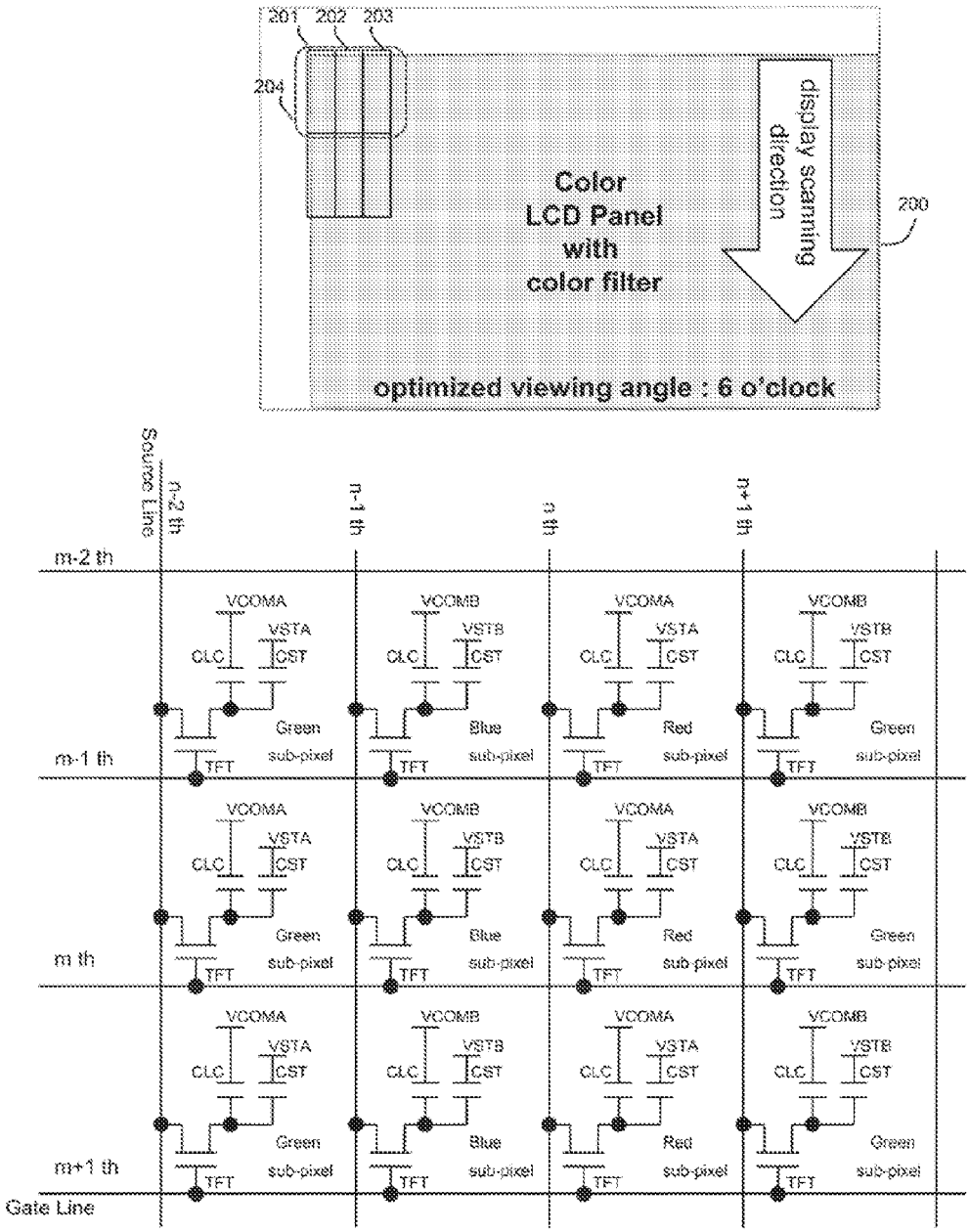
Figure 17B Pixel structure of invented CF TFTLCD having dual VCOM and RGB vertical stripe pixel arrangement for gate vertical scanning

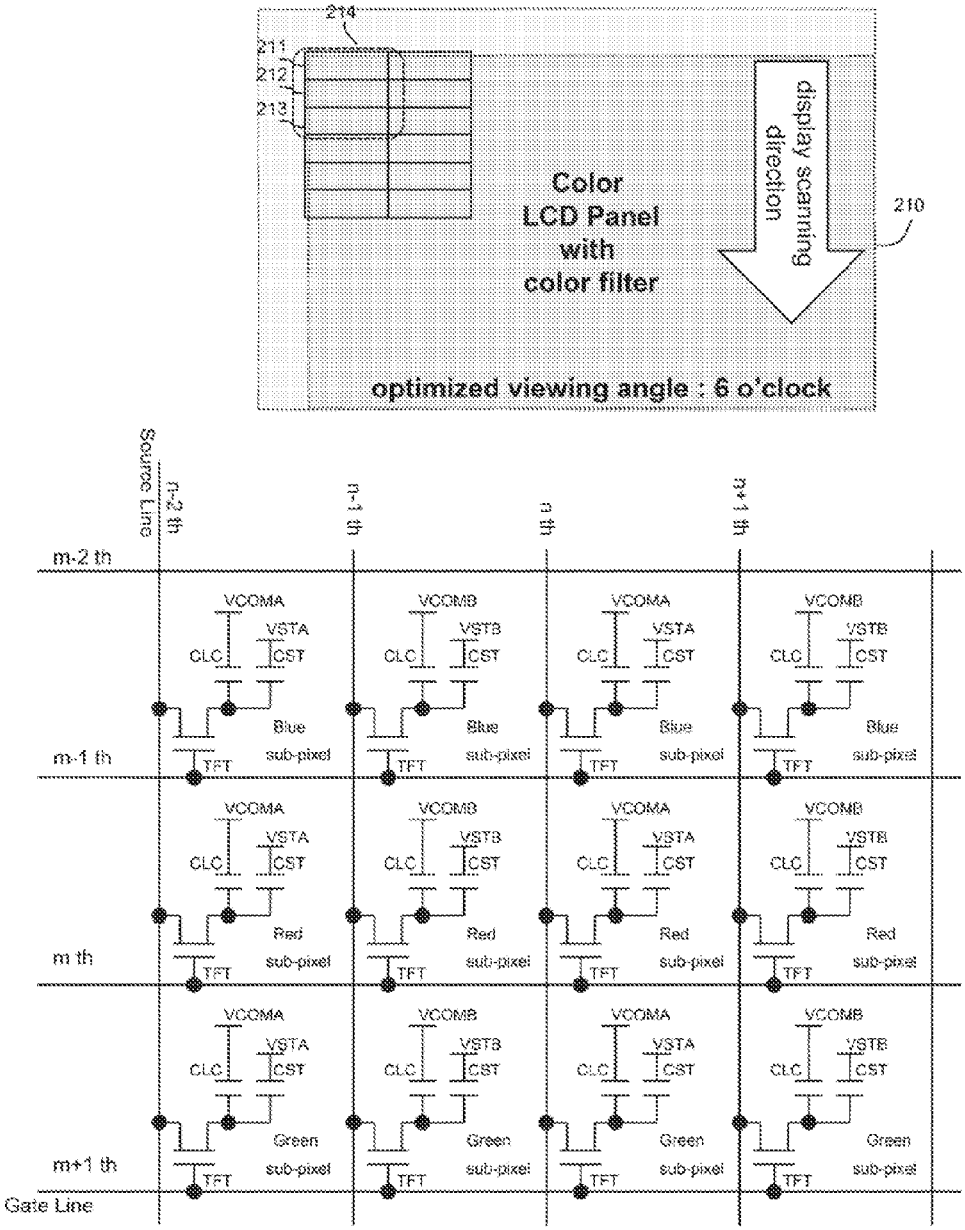
Figure 17C Pixel structure of invented CF TFTLCD having dual VCOM and RGB horizontal stripe pixel arrangement for gate vertical scanning

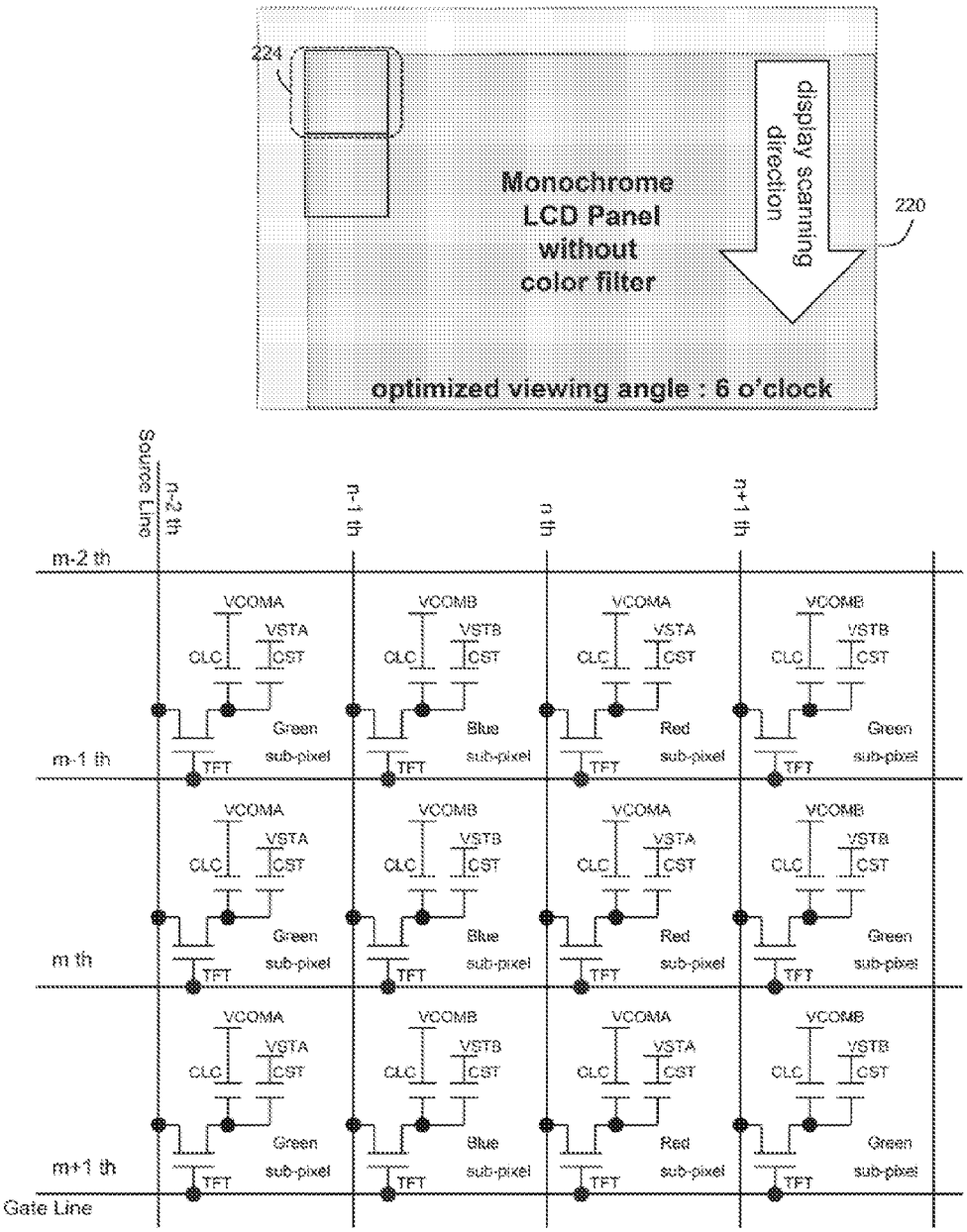
Figure 17D Pixel structure of invented FSCLCD having dual VCOM and no color filter for gate vertical scanning

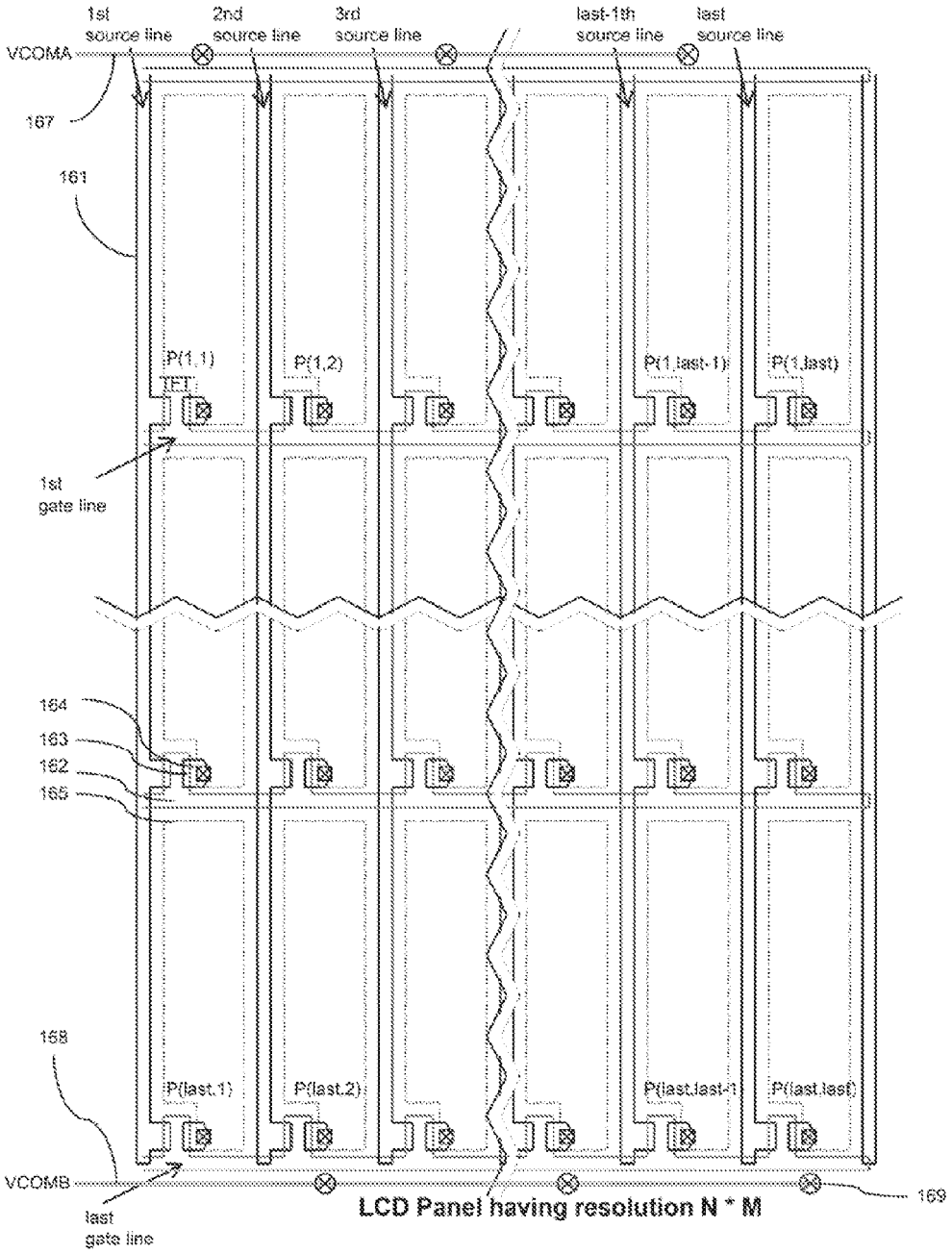
Figure 17E Pixel structure of bottom glass in invented TN LCD having dual VCOM for gate vertical scanning

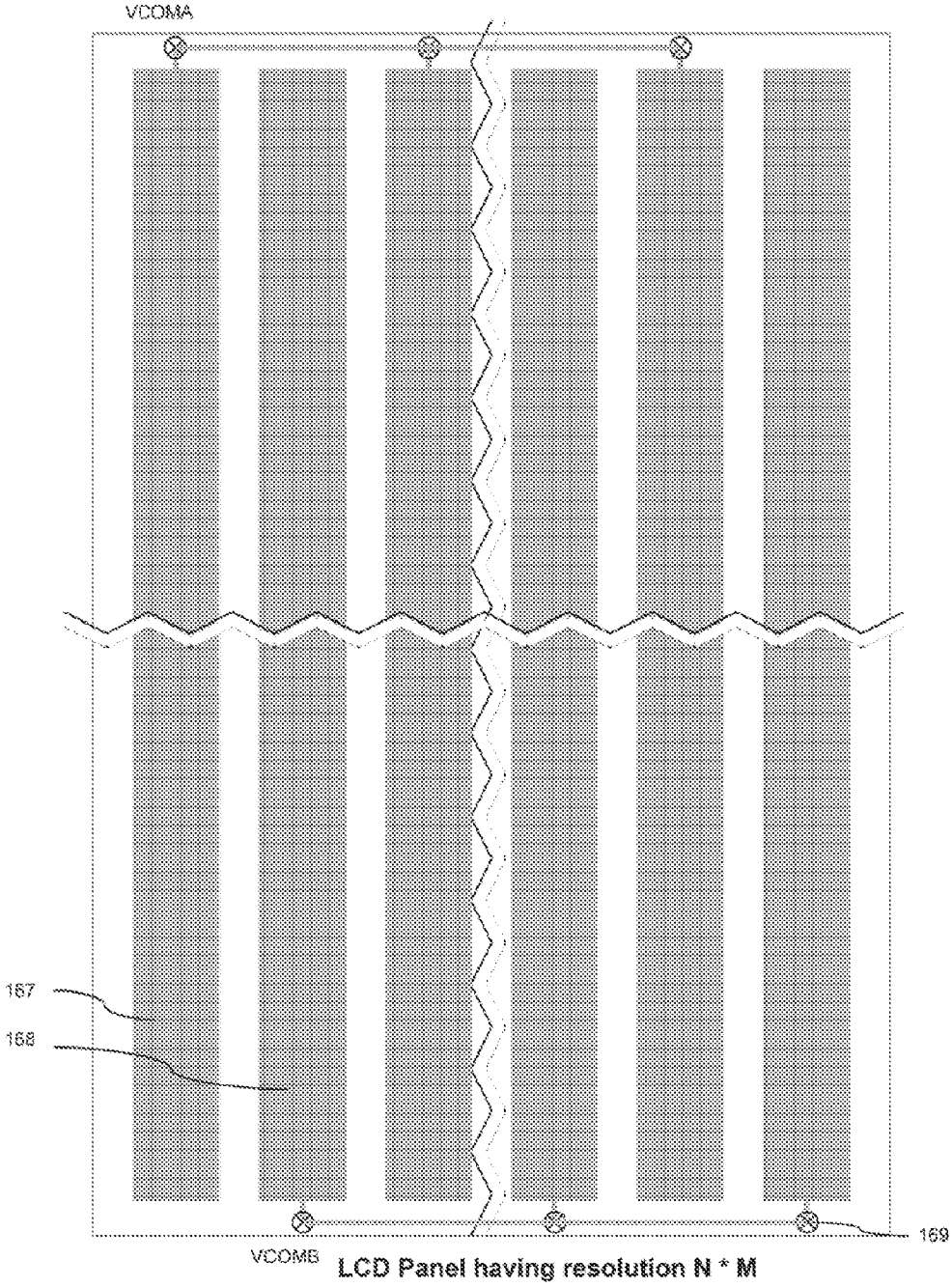
Figure 17F VCOM structure of top glass in invented TN LCD having dual VCOM for gate vertical scanning

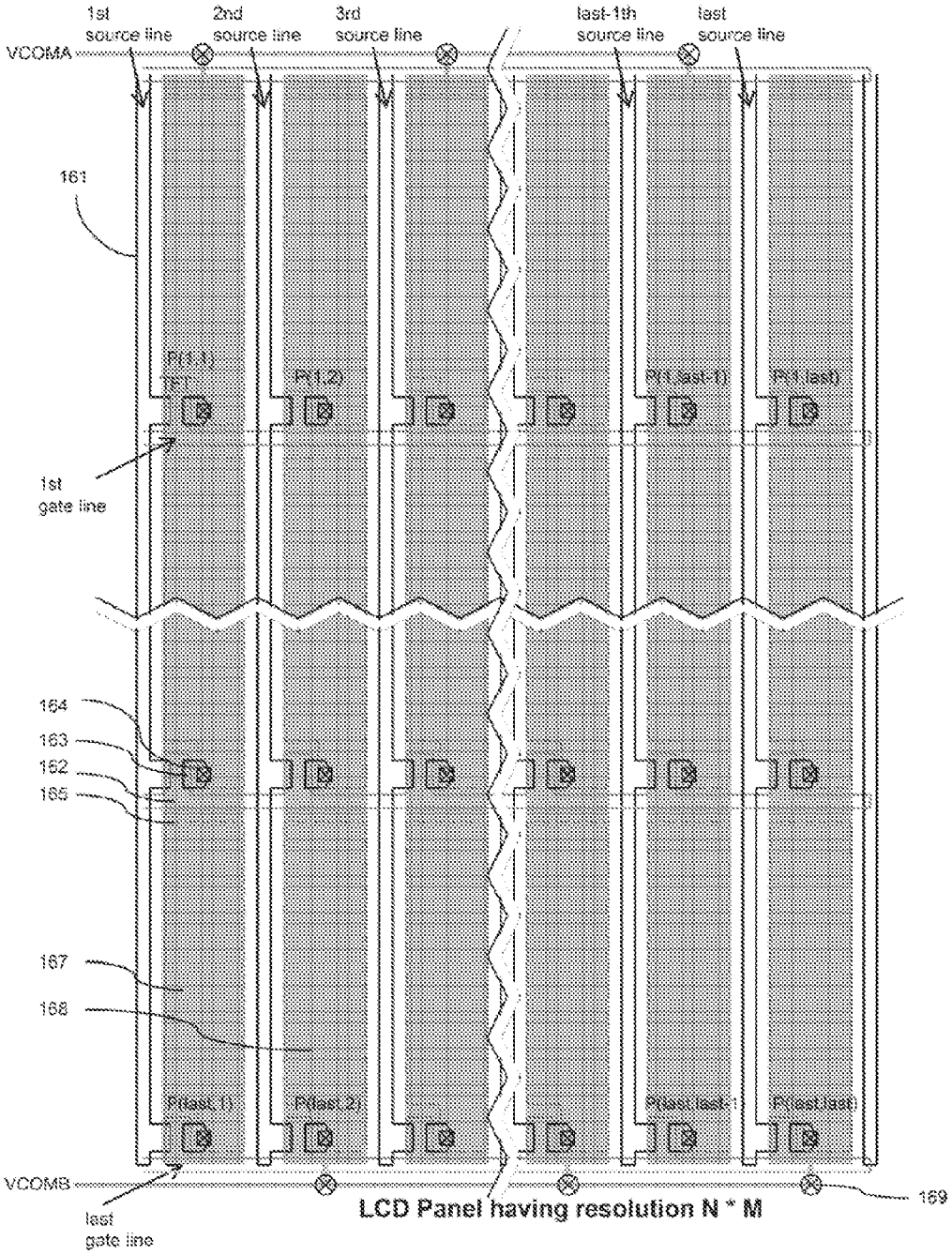
Figure 17G Overall structure of invented TN LCD having dual VCOM for gate vertical scanning

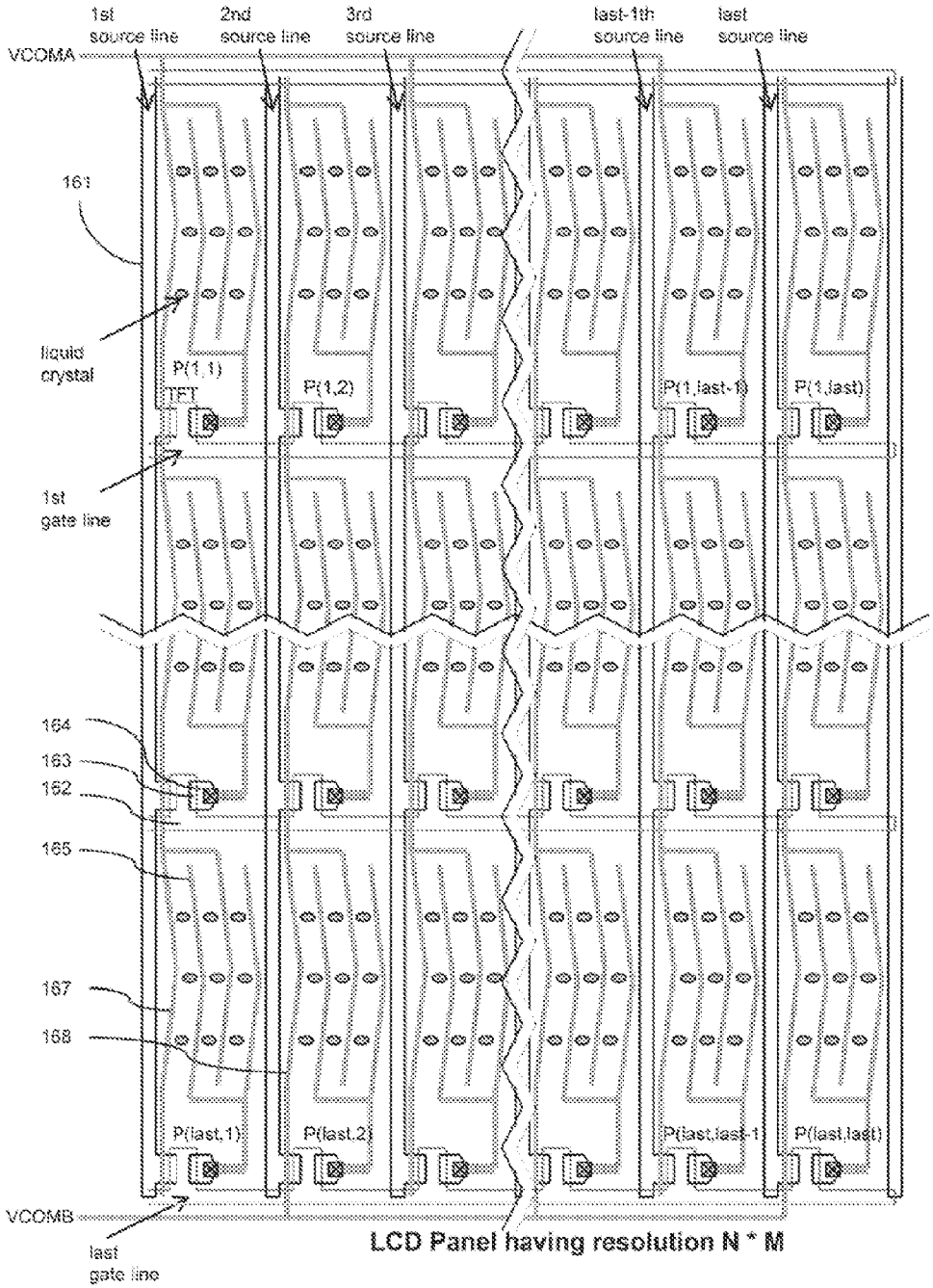
Figure 17H Overall structure of invented IPS LCD having dual VCOM for gate vertical scanning

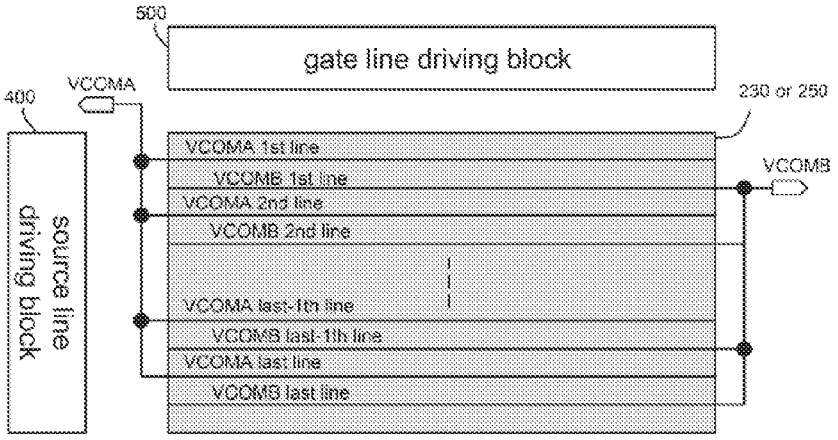
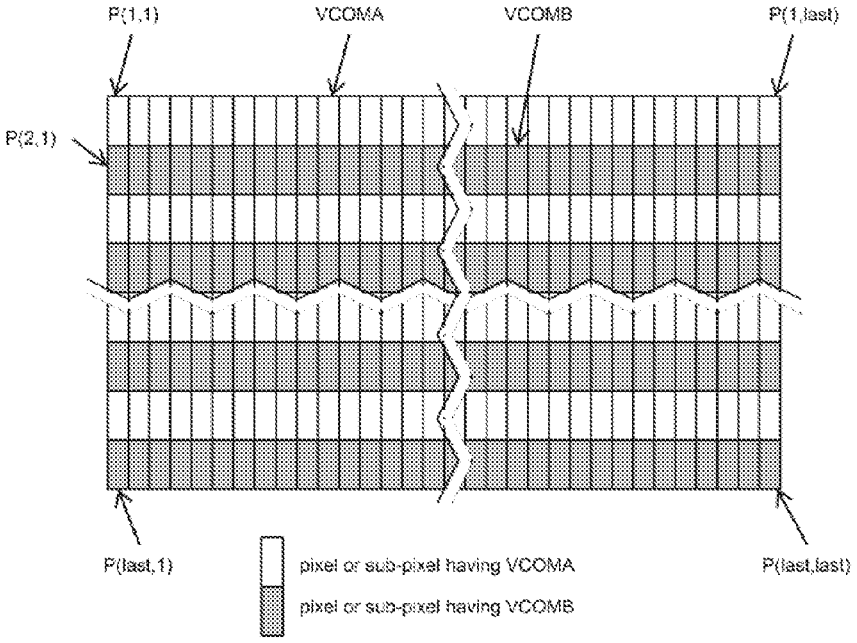
Figure 17J Invented dual VCOM structure at gate horizontal scanning for dot inversion or column inversion

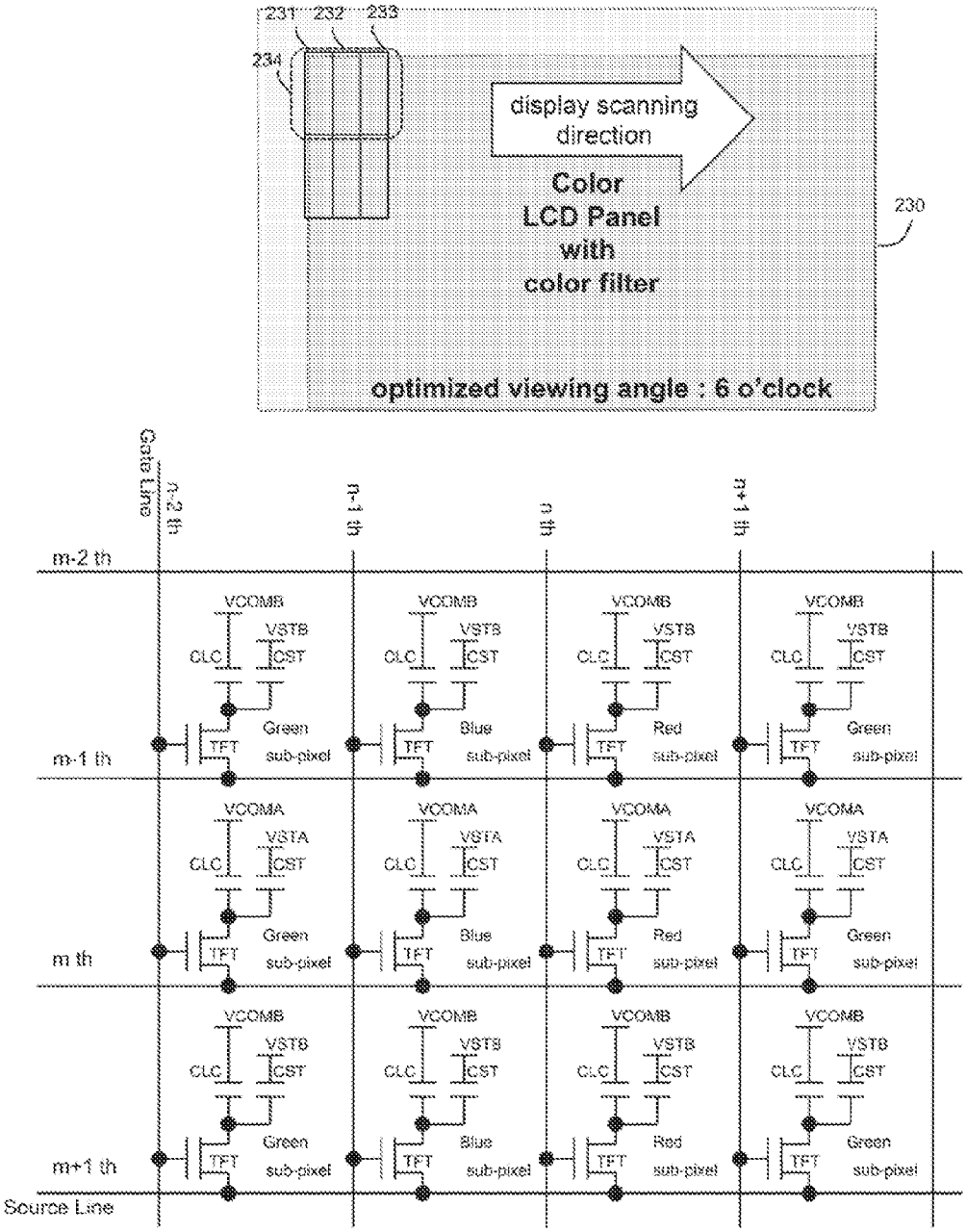
Figure 17K Pixel structure of invented CF TFT LCD having dual VCOM and RGB Vertical stripe pixel arrangement for gate horizontal scanning

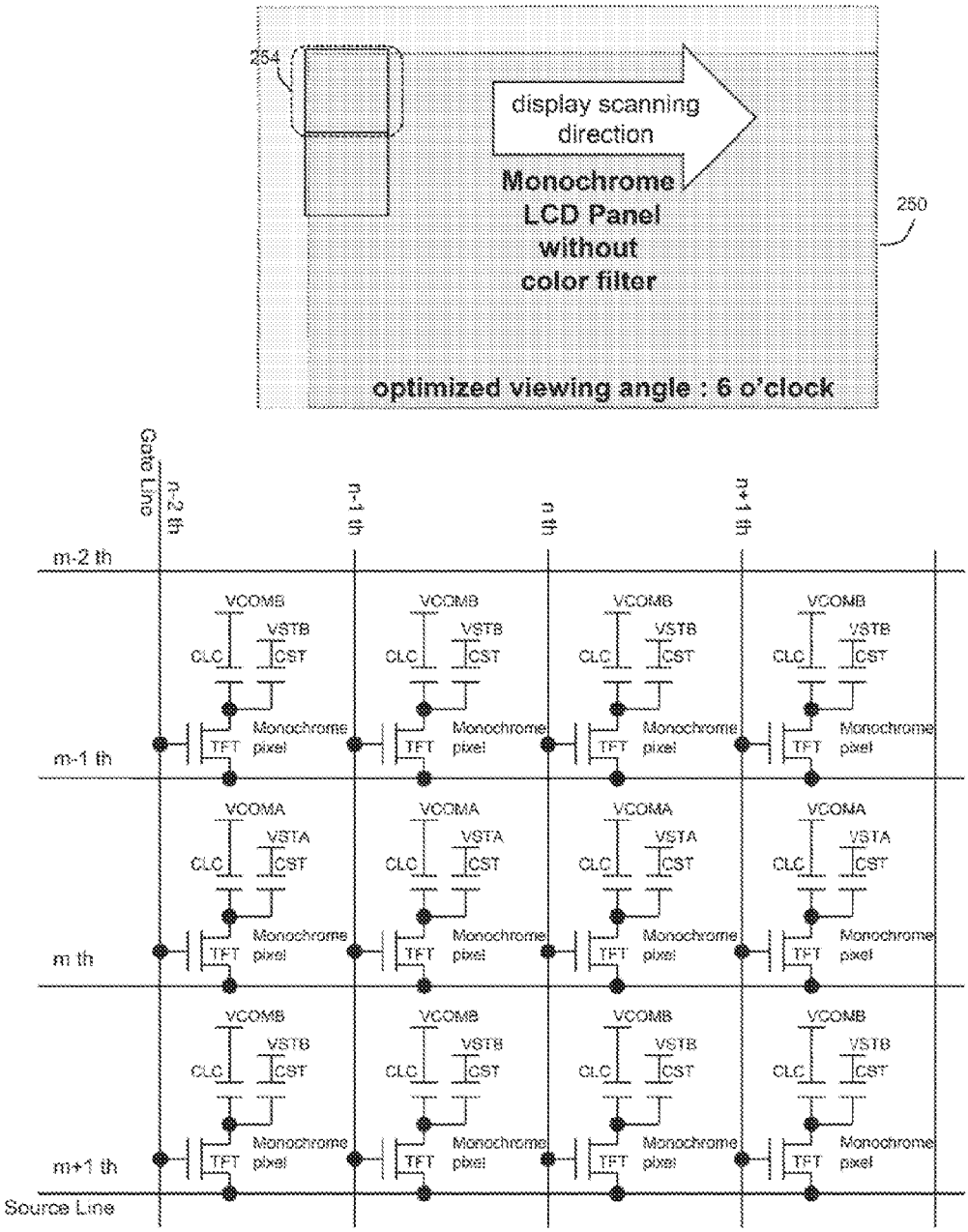
Figure 17L Pixel structure of invented FSCLCD having dual VCOM and no color filter for gate horizontal scanning

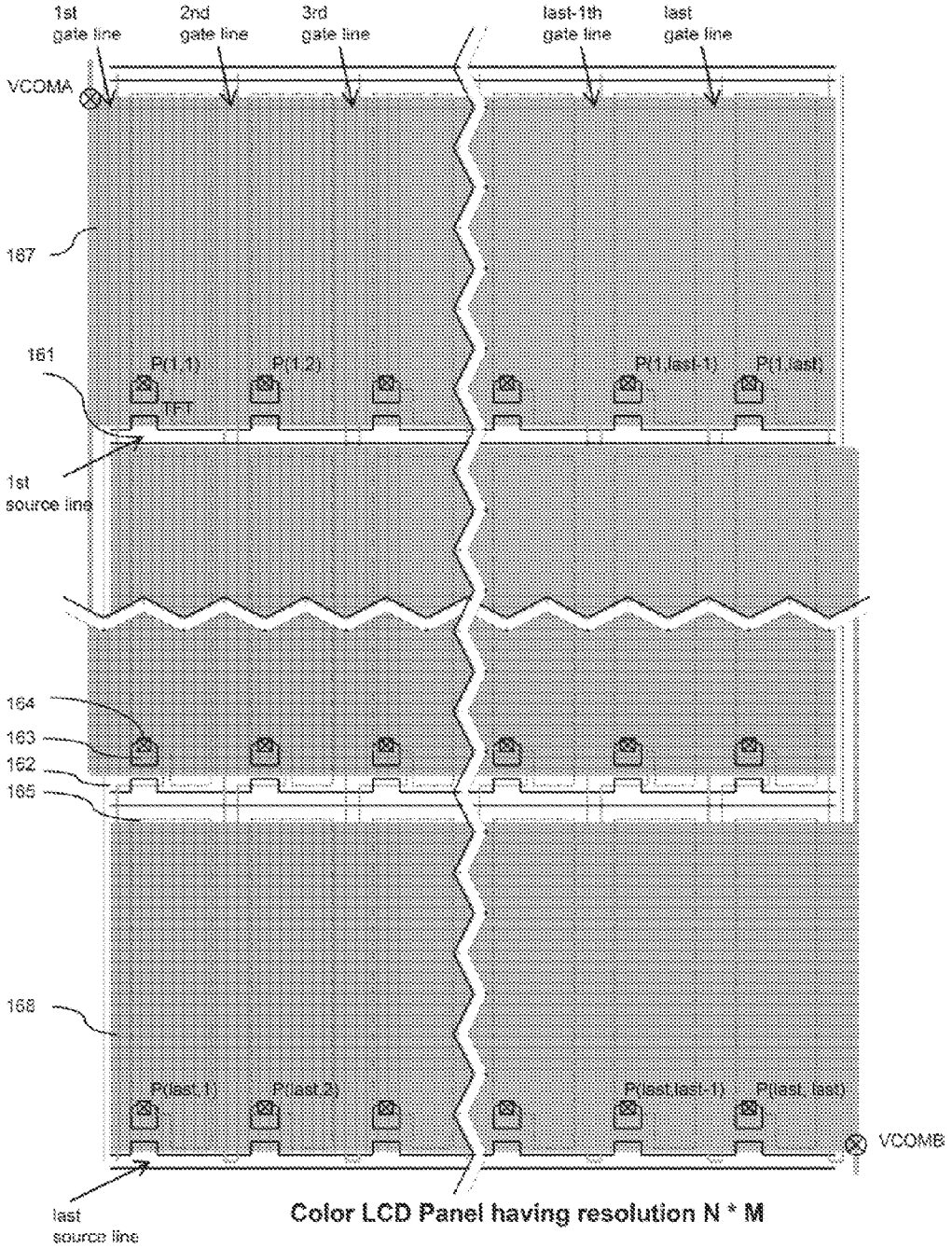
Figure 17M Overall structure of invented TN LCD having dual VCOM for gate horizontal scanning

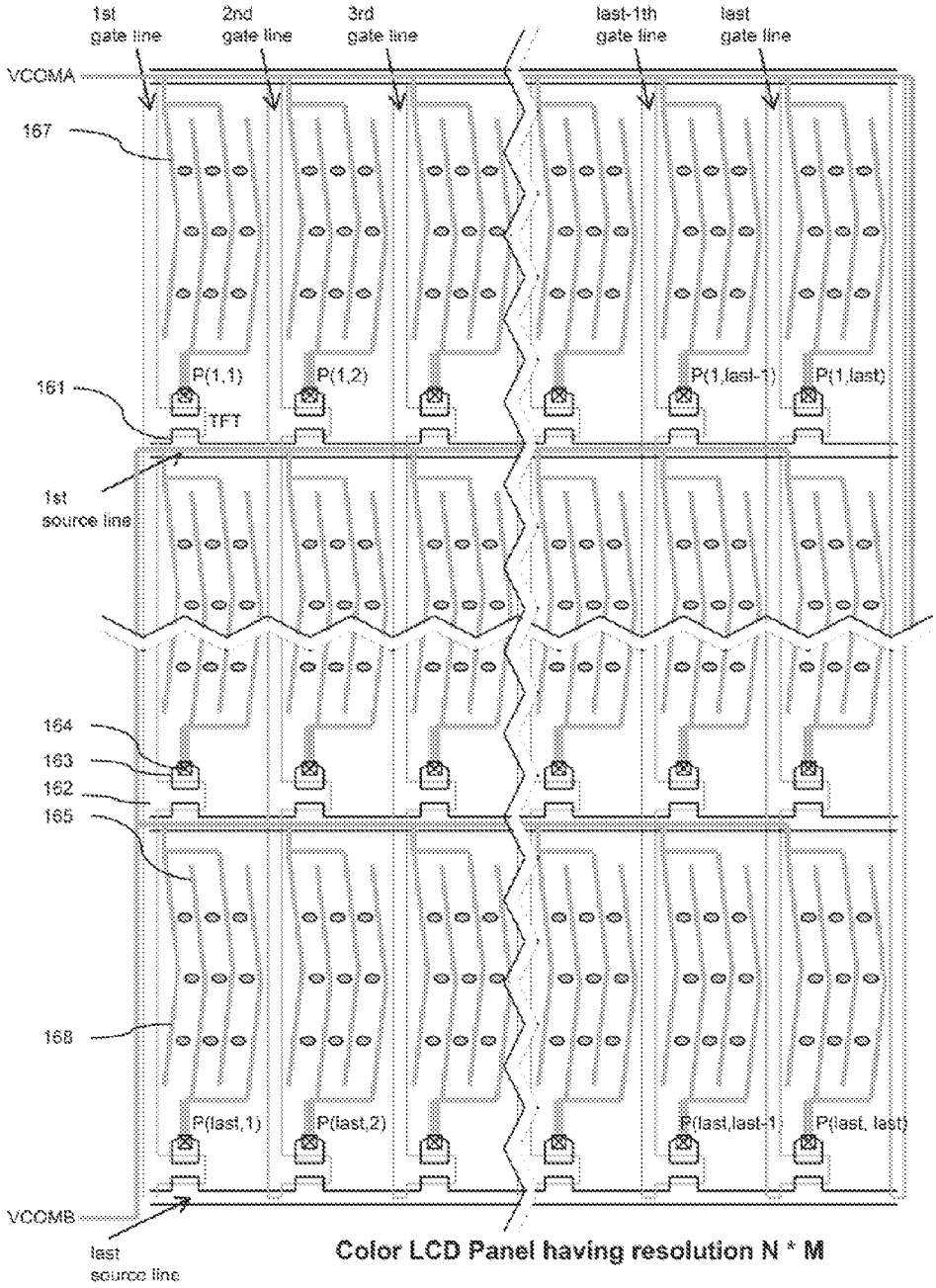
Figure 17N Overall structure of invented IPS LCD having dual VCOM for gate horizontal scanning

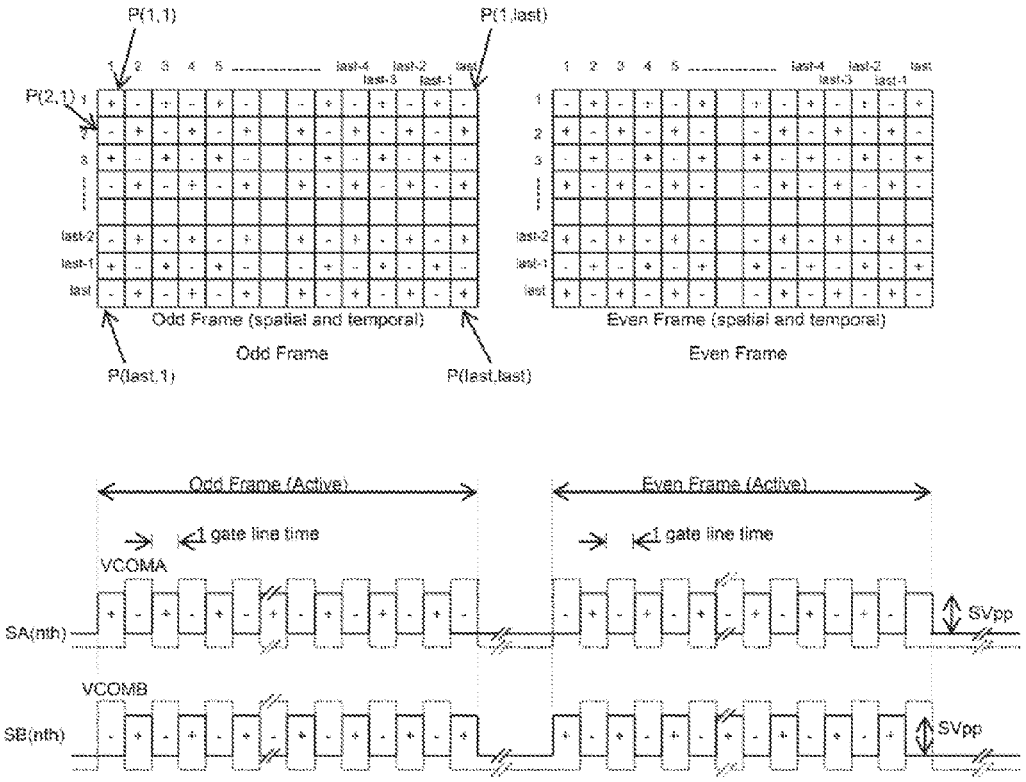
Figure 17P Pixel polarity and source driving voltage when dot (sub-pixel) inversion having dual VCOM and non-interlaced scanning

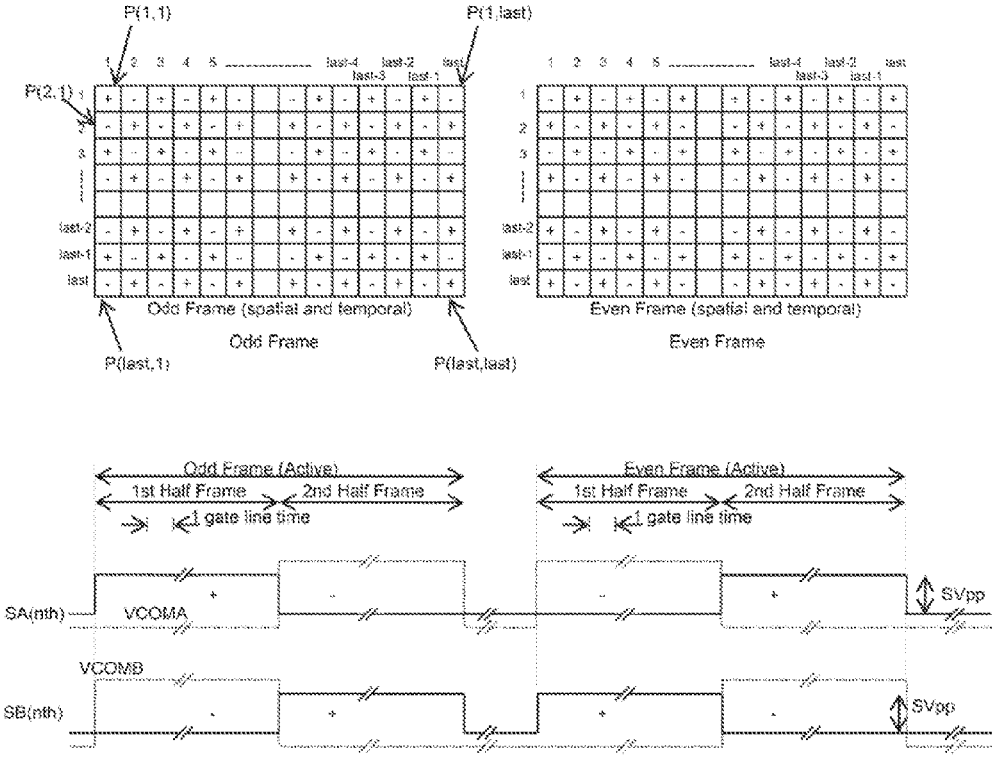
Figure 17Q Pixel polarity and source driving voltage when dot (sub-pixel) inversion having dual VCOM and interlaced scanning

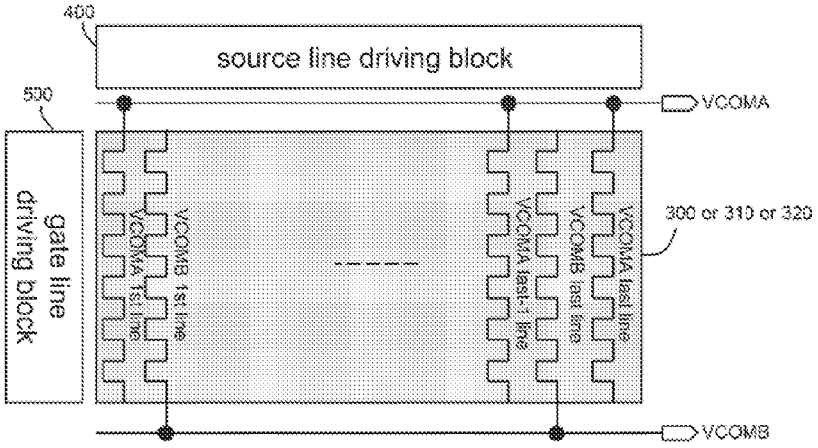
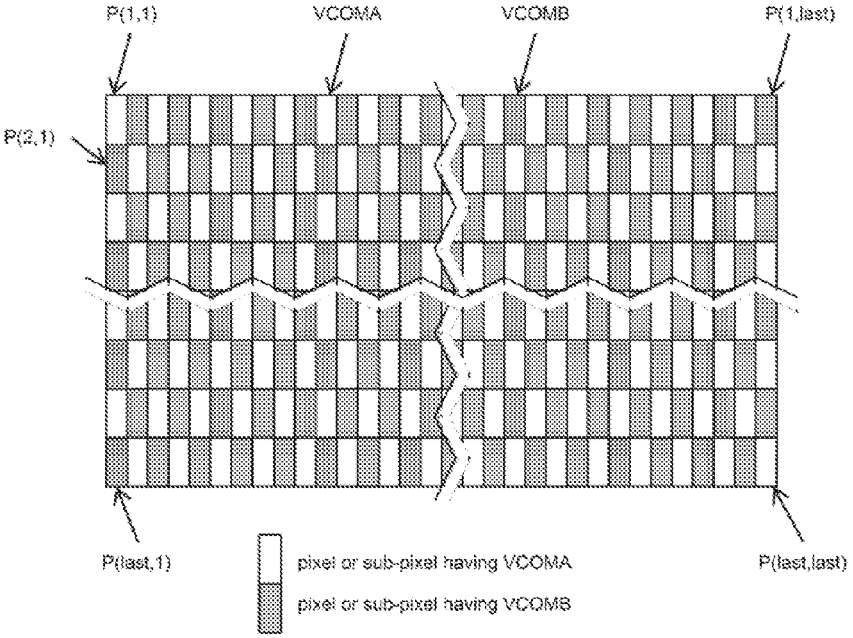
Figure 18A Invented VCOM structure at gate vertical scanning for advanced dot inversion or advanced column inversion

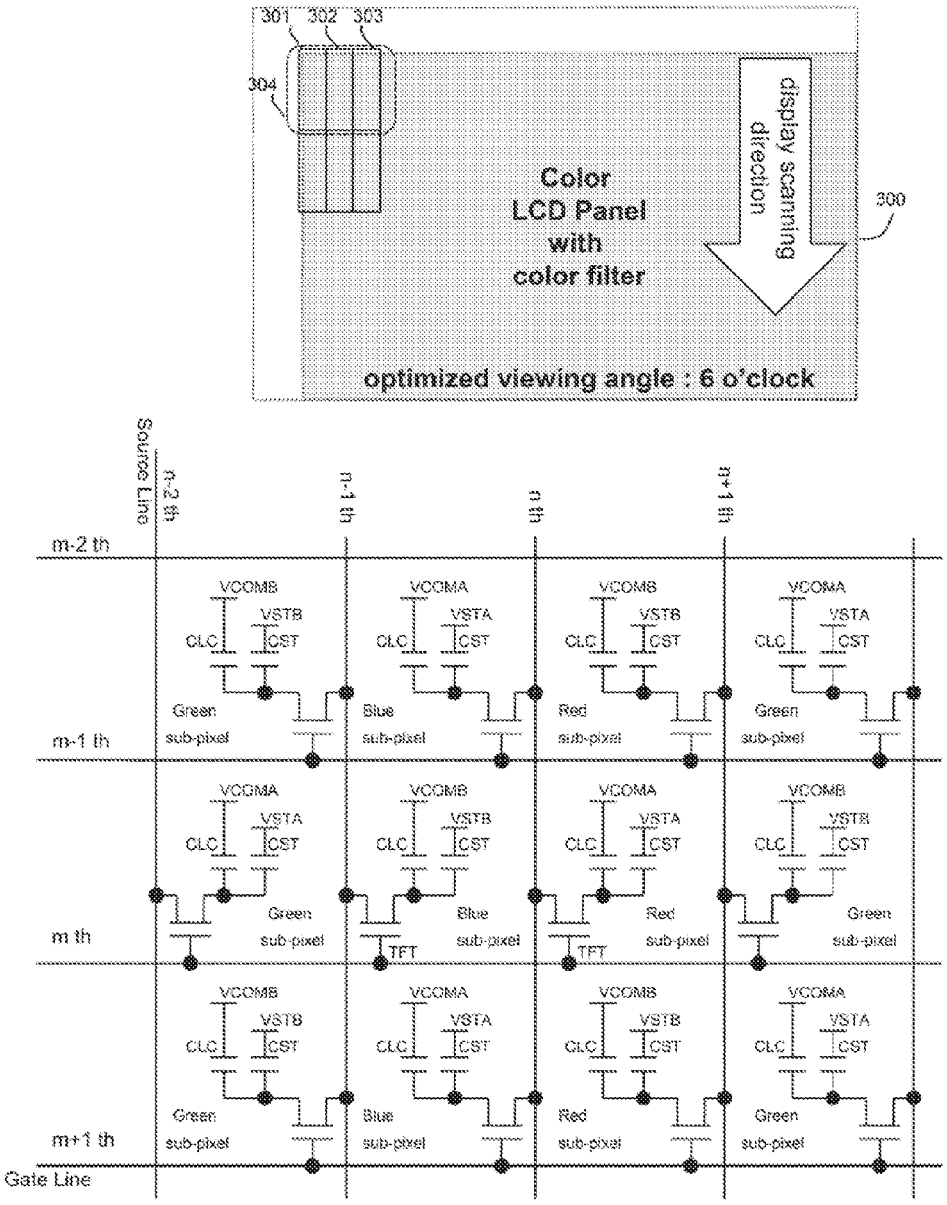
Figure 18B Pixel structure of invented CF TFTLCD having advanced dual VCOM and RGB vertical stripe pixel arrangement for gate vertical scanning

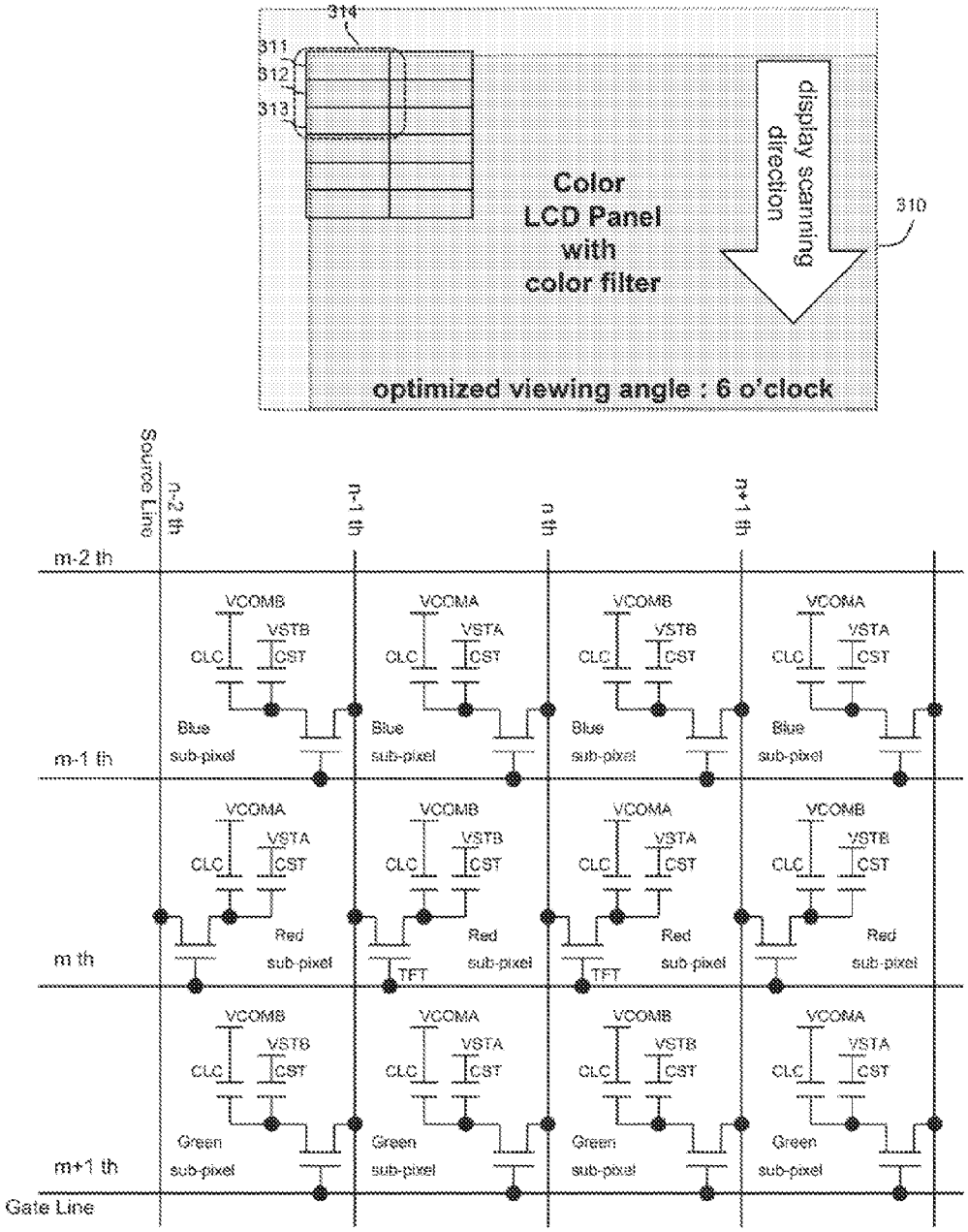
Figure 18C Pixel structure of invented CF TFTLCD having advanced dual VCOM and RGB horizontal stripe pixel arrangement for gate vertical scanning

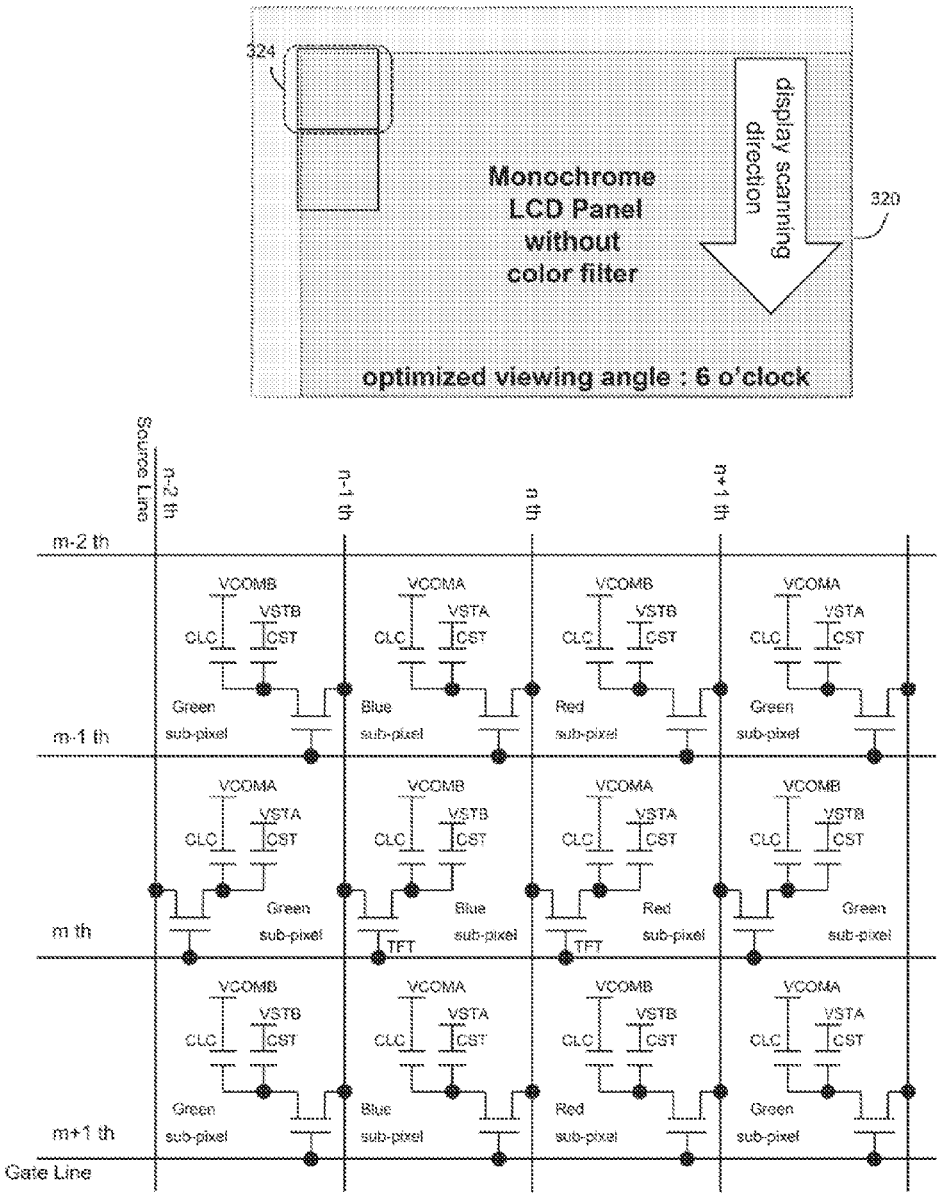
Figure 18D Pixel structure of invented FSCLCD having advanced dual VCOM and no color filter for gate vertical scanning

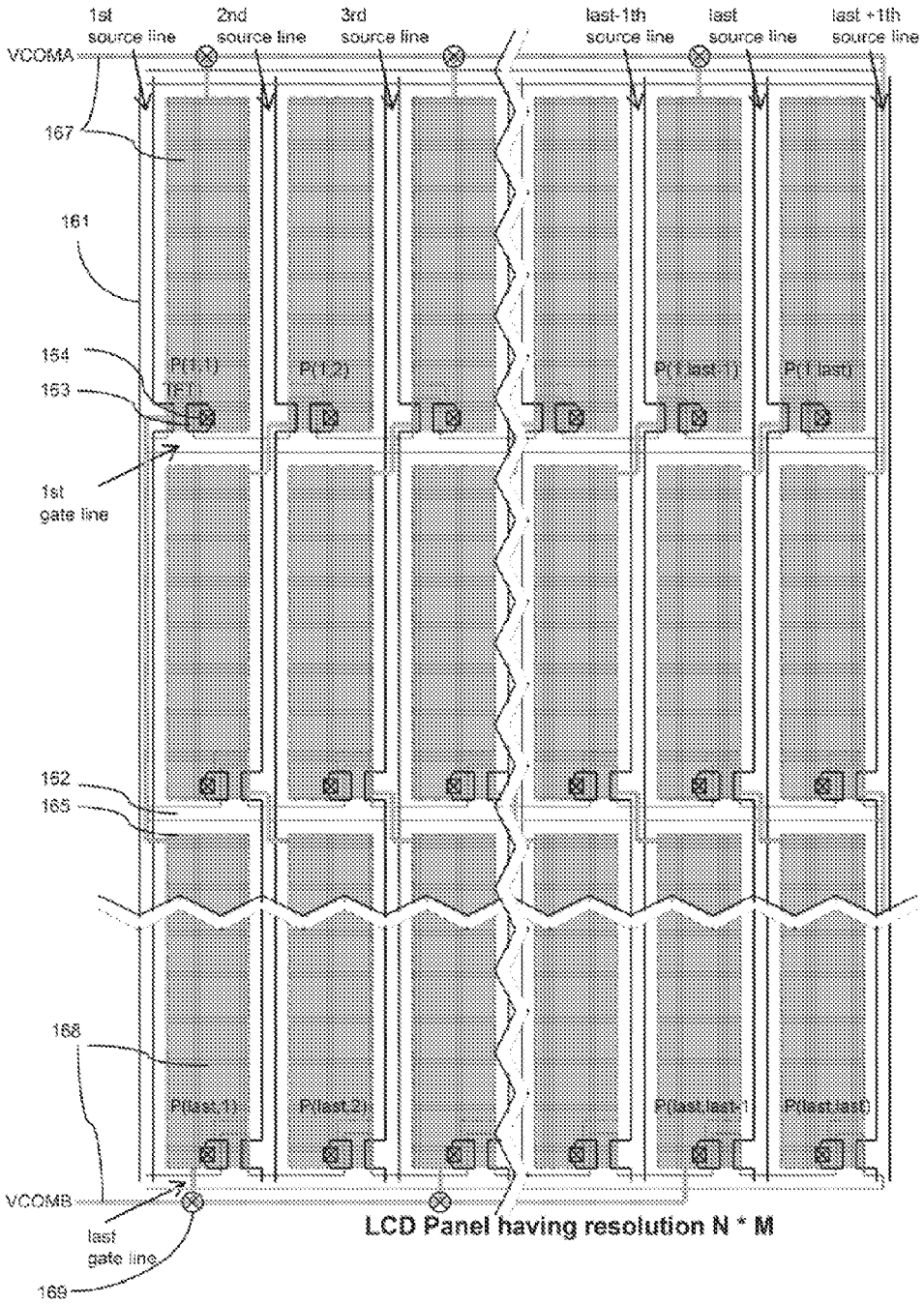
Figure 18E Overall structure of invented TN LCD having advanced dual VCOM for gate vertical scanning

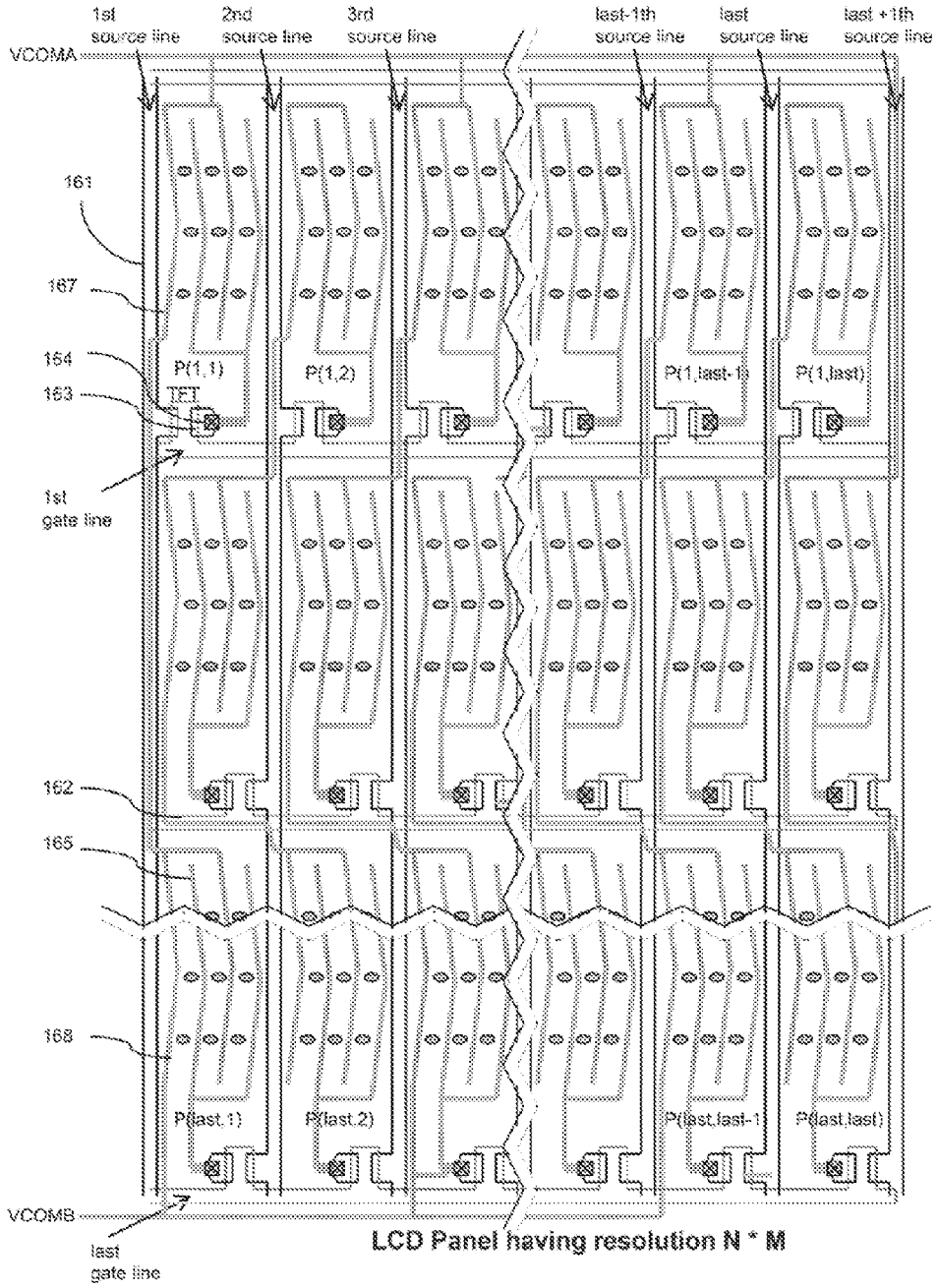
Figure 18F Overall structure of invented IPS LCD having advanced dual VCOM for gate vertical scanning

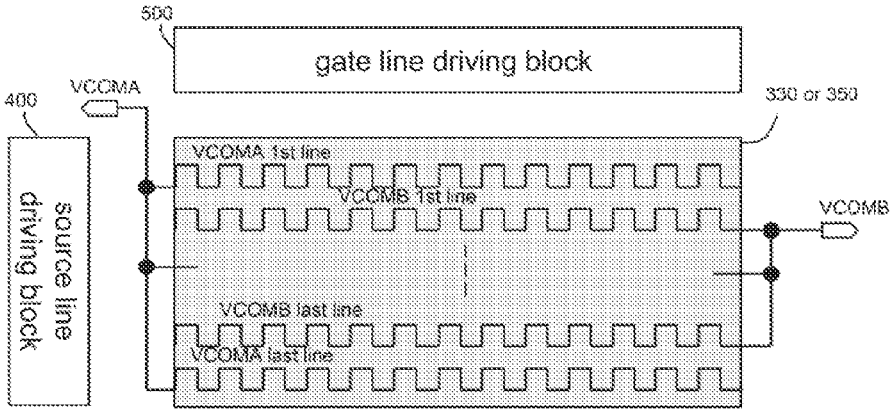
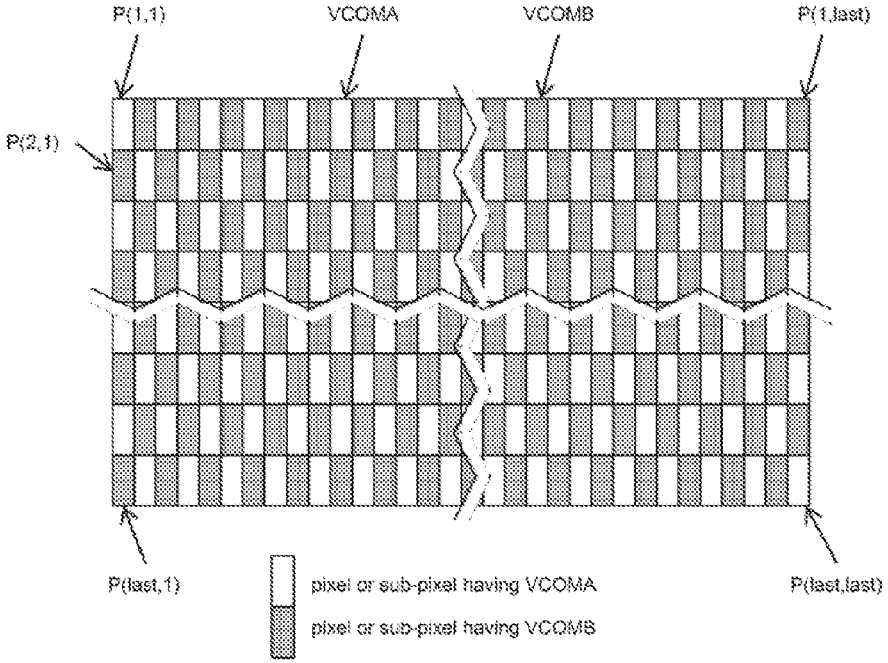
Figure 18G Invented advanced dual VCOM structure at gate horizontal scanning for dot inversion or column inversion

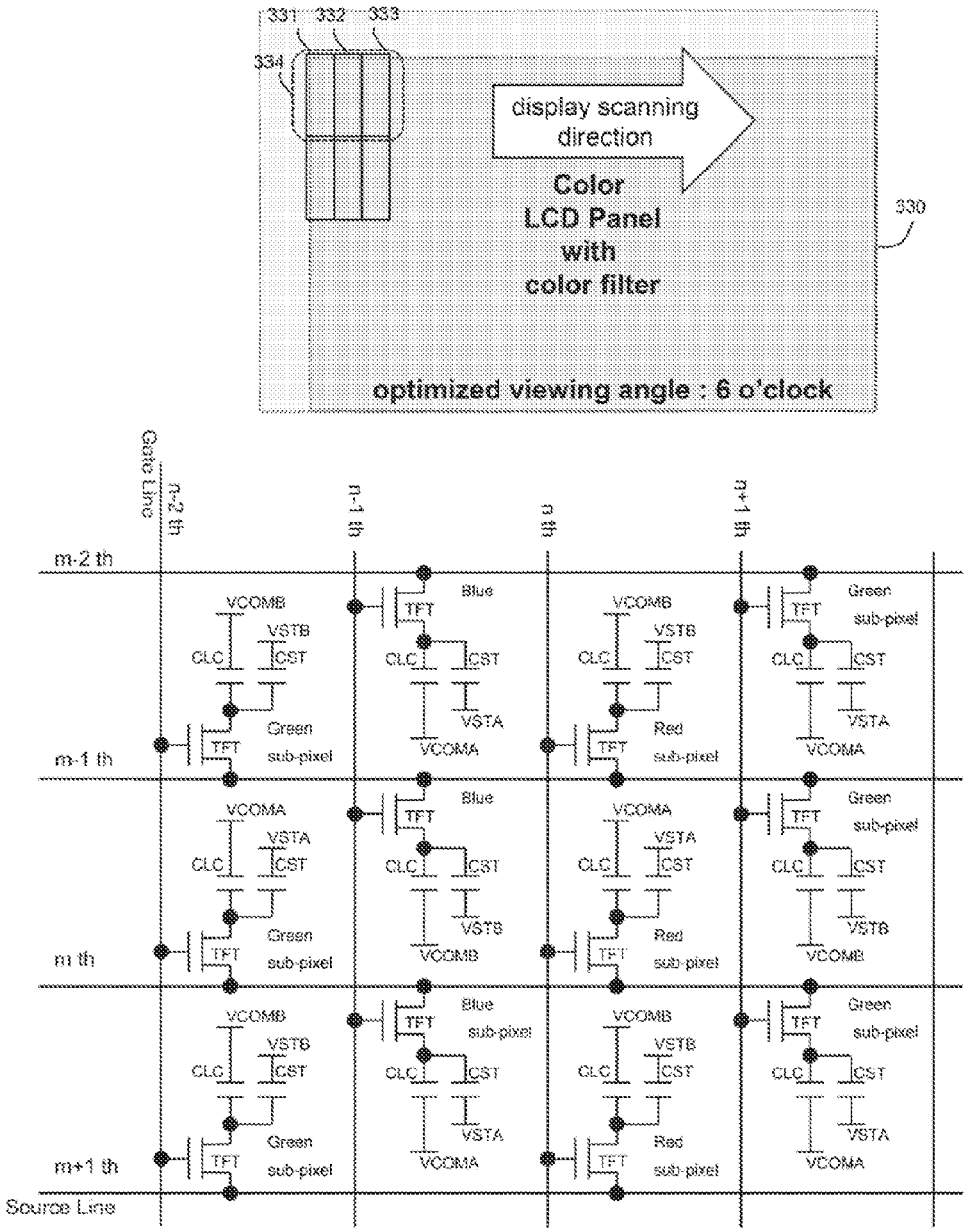
Figure 18H Pixel structure of invented CF TFT LCD having advanced dual VCOM and RGB Vertical stripe pixel arrangement for gate horizontal scanning

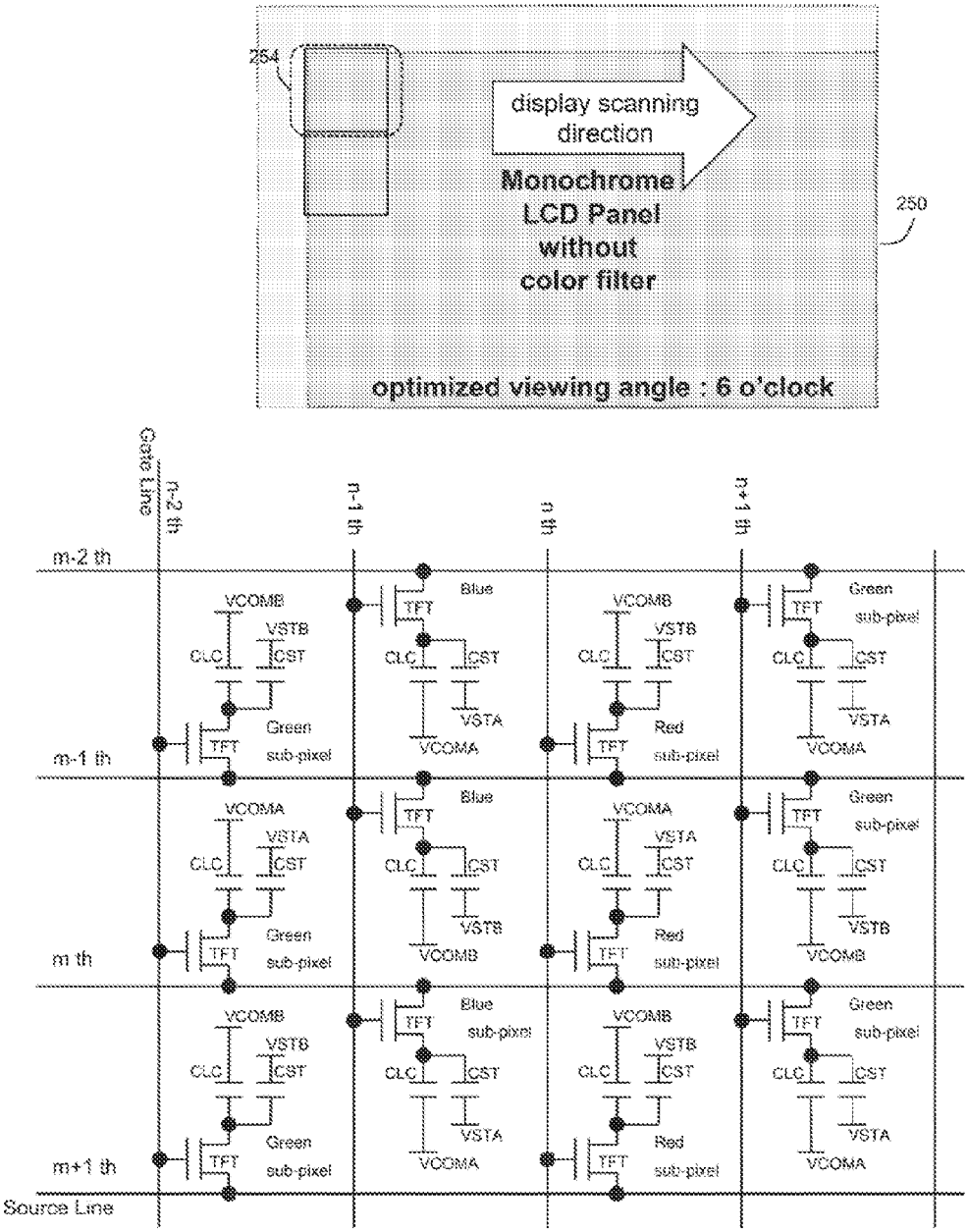
Figure 18J Pixel structure of invented FSCLCD having advanced dual VCOM and no color filter for gate horizontal scanning

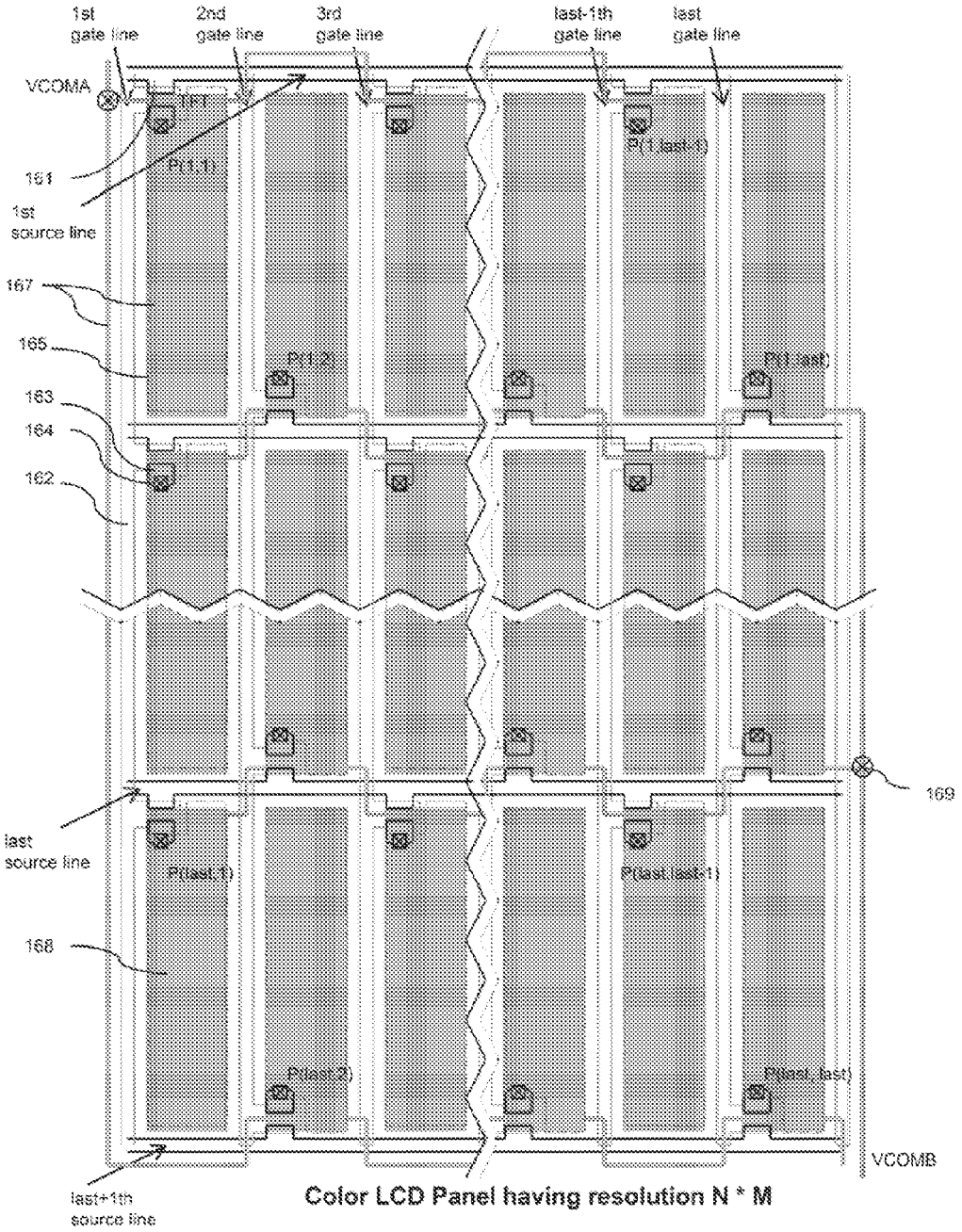
Figure 18K Overall structure of invented TN LCD having advanced dual VCOM for gate horizontal scanning

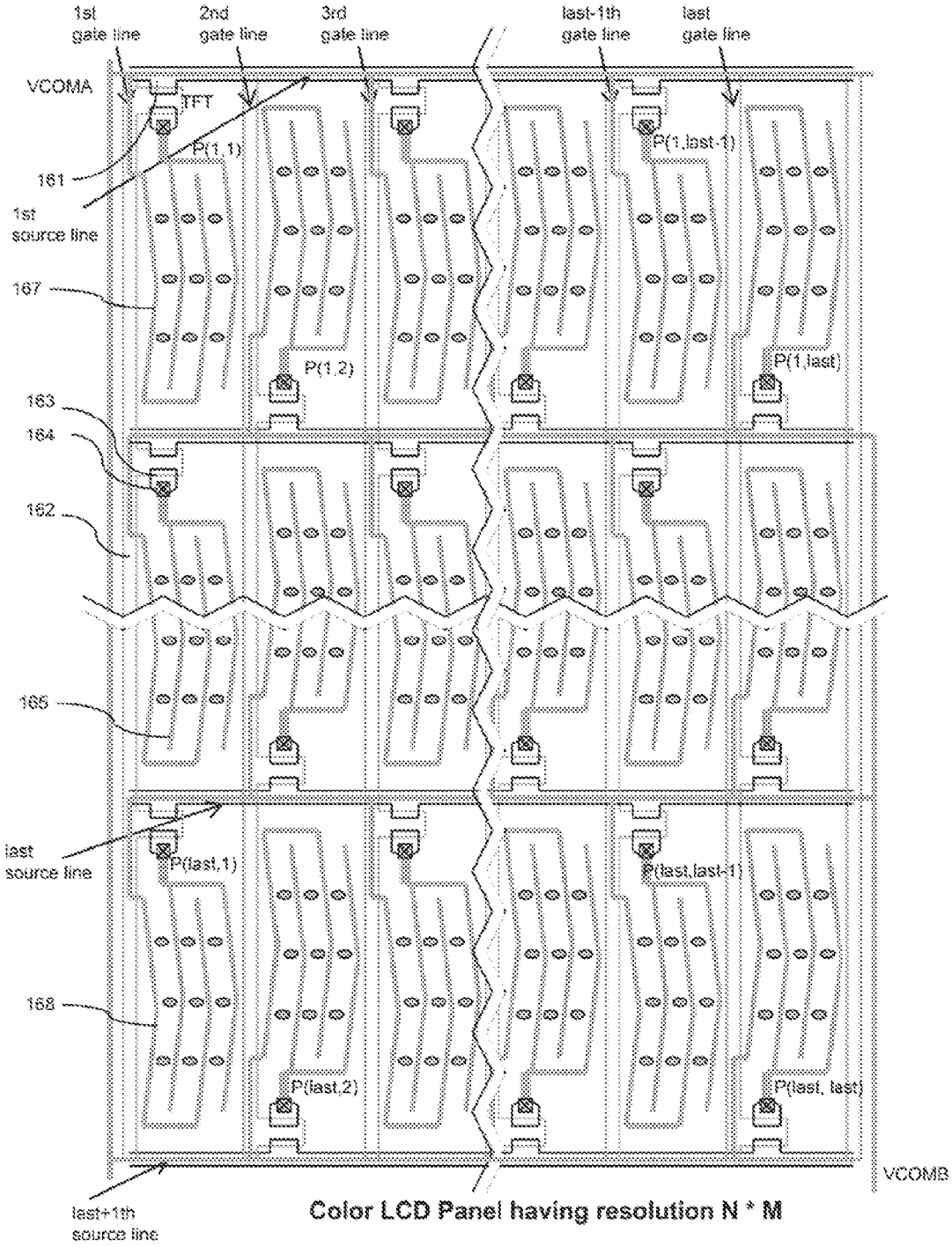
Figure 18L Overall structure of invented IPS LCD having advanced dual VCOM for gate horizontal scanning

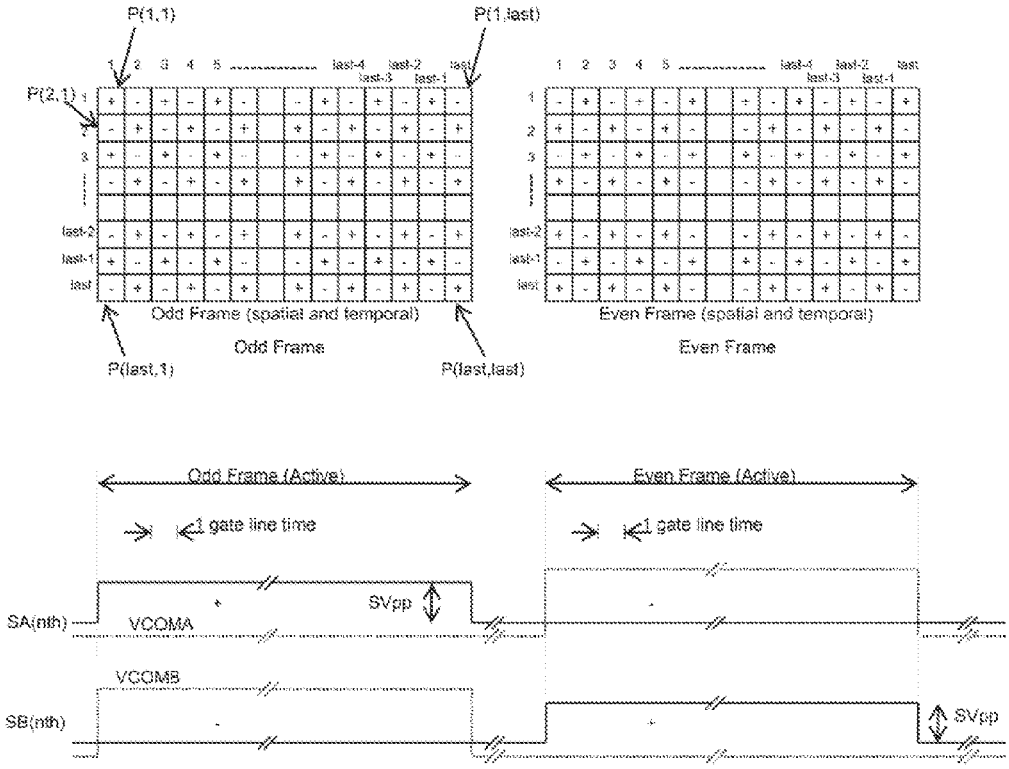
Figure 18M Pixel polarity and source driving voltage when dot (sub-pixel) inversion having advanced dual VCOM and non-interlaced scanning

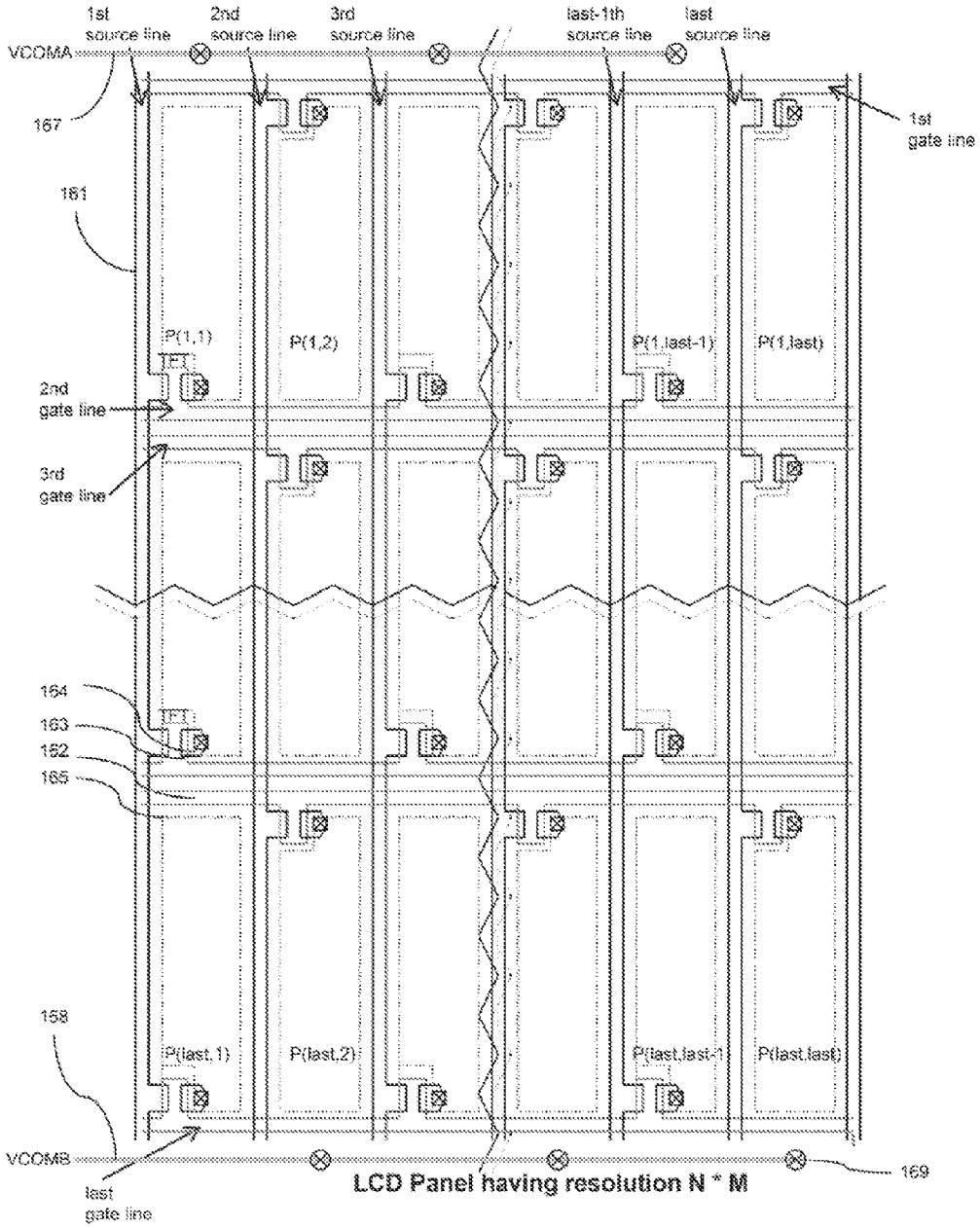
Figure 19A Pixel structure of bottom glass in invented TN LCD having dual VCOM and dual gate line for gate vertical scanning

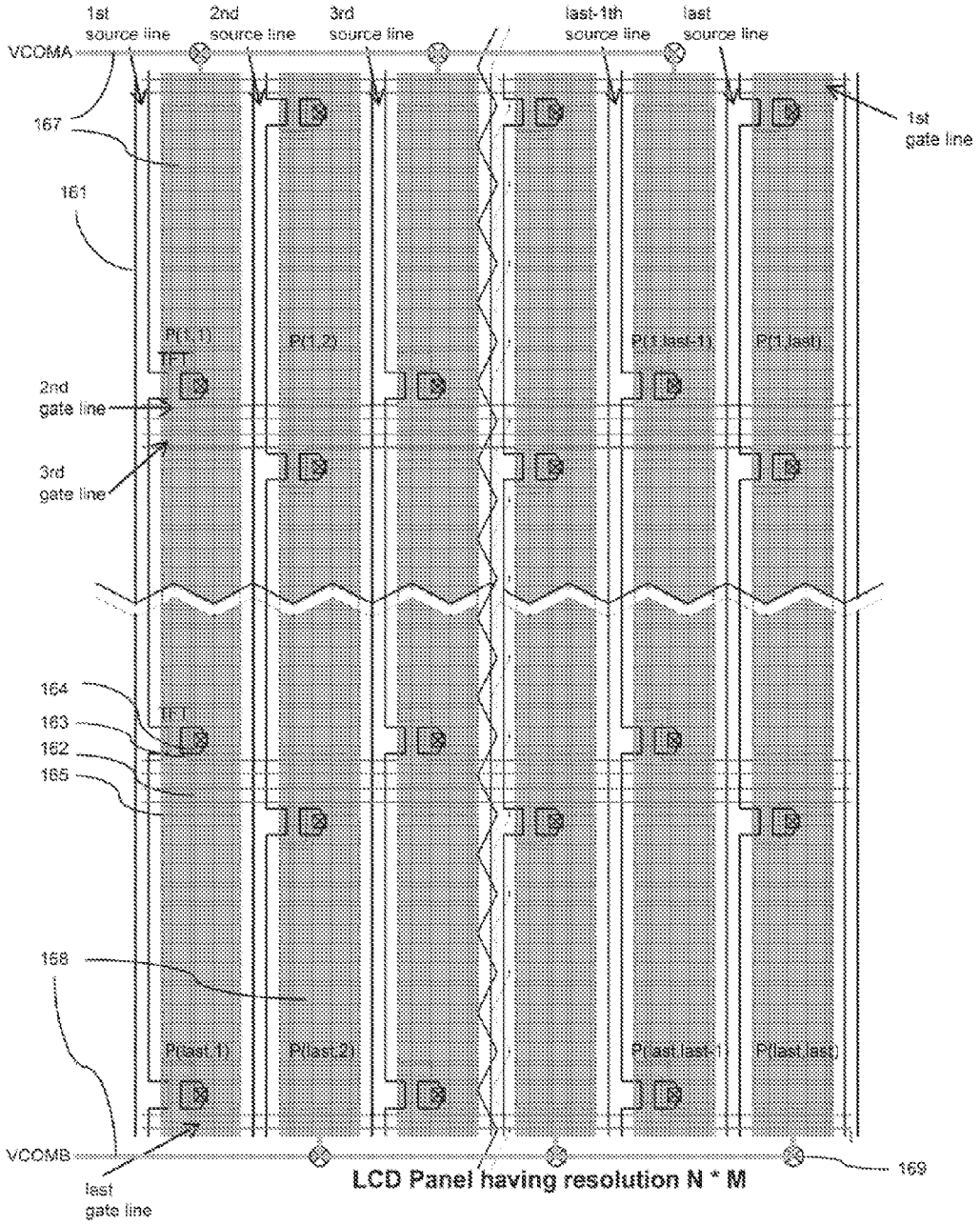
Figure 19B Overall structure of invented TN LCD having dual VCOM and dual gate line for gate vertical scanning

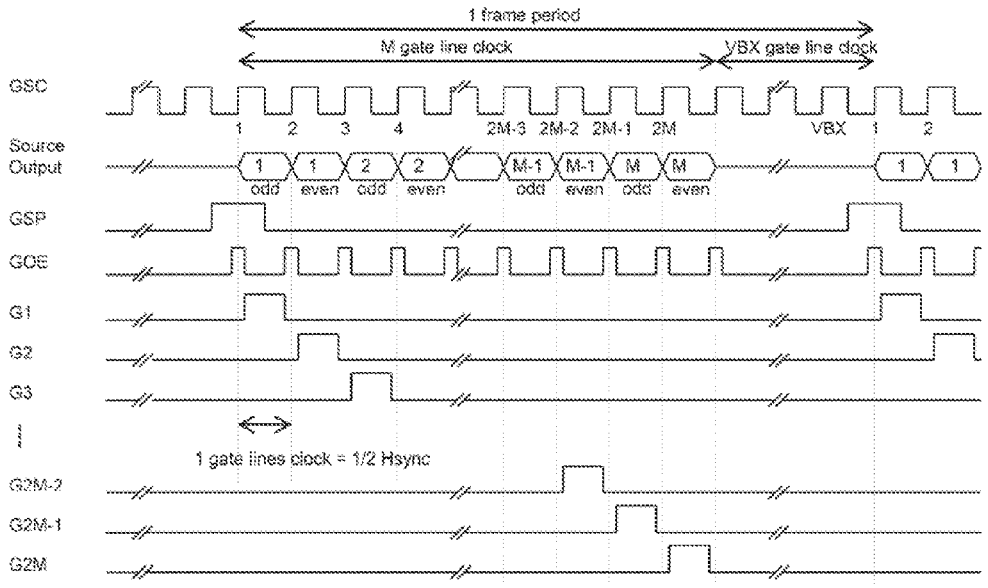
Figure 19C Timing diagram when gate vertical scanning in CF TFT LCD having dual gate line with RGB vertical stripe pixel arrangement

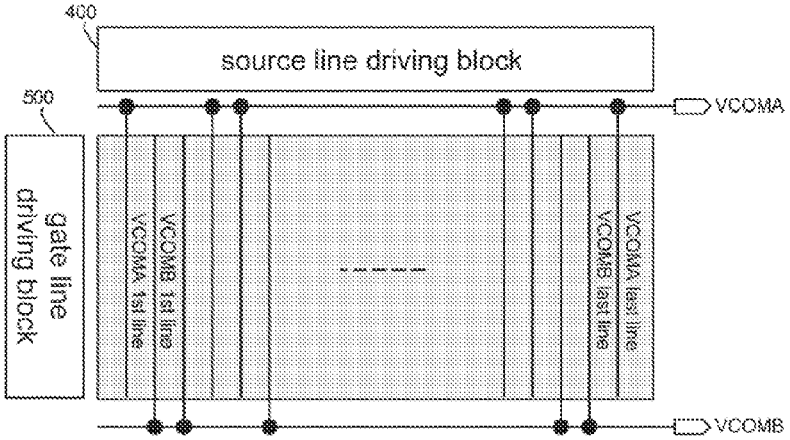
Figure 20A Another embodiment of invented dual VCOM structure at gate vertical scanning for 1+2H dot inversion or 1+2H column inversion
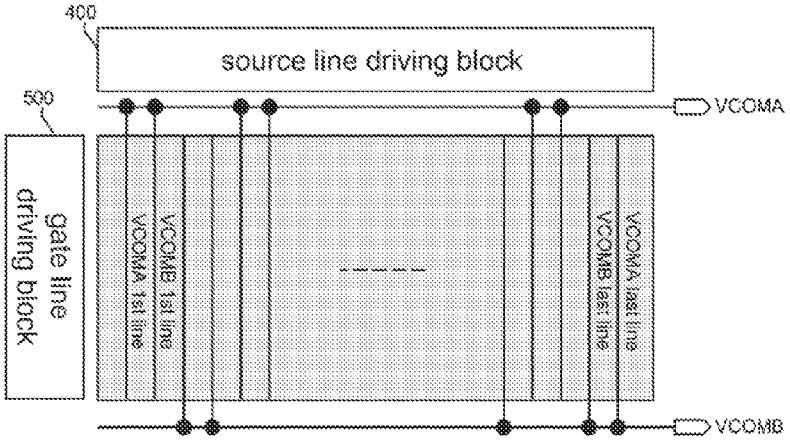
Figure 20B Another embodiment of invented dual VCOM structure at gate vertical scanning for 2H dot inversion or 2H column inversion

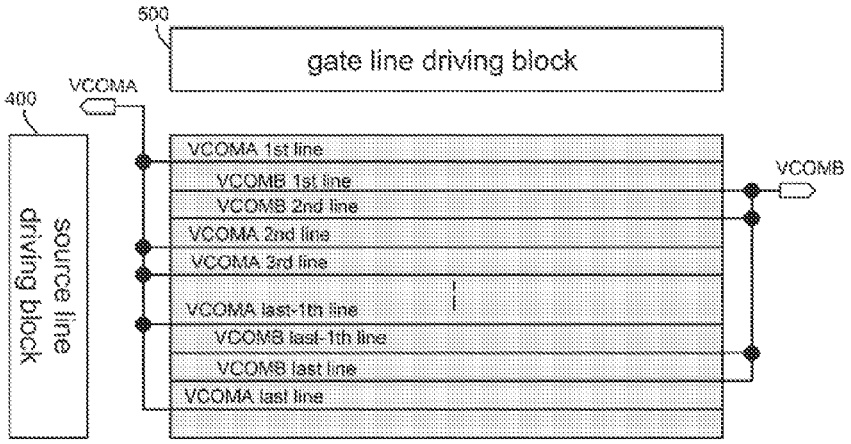
Figure 20C Another embodiment of invented dual VCOM structure at gate horizontal scanning for 1+2V dot inversion or 1+2V column inversion
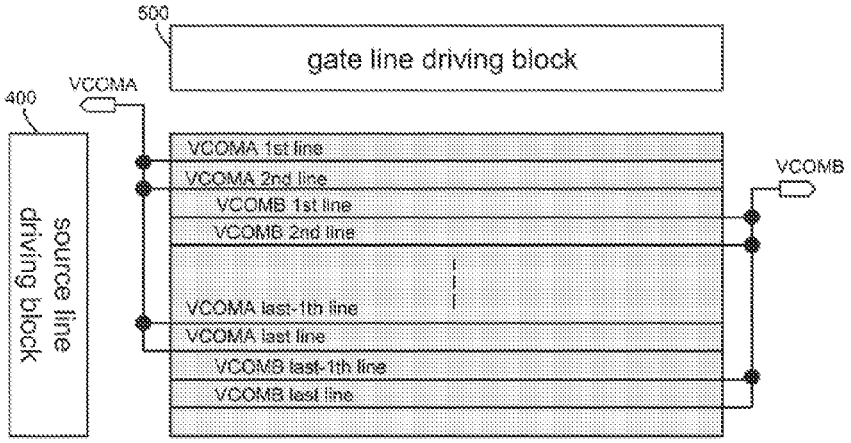
Figure 20D Another embodiment of invented dual VCOM structure at gate horizontal scanning for 2V dot inversion or 2V column inversion

| Inversion |
| --- |
| Dot inversion |
| 1+2H Dot inversion |
| 2H Dot inversion |
| 1+2V Dot inversion |
| 2V Dot inversion |
| Column inversion |
| Row inversion |

•Line inversion
•Field inversion

| Pixel Arrangement |
| --- |
| CF LCD RGB vertical stripe |
| CF LCD RGB horizontal stripe |
| CF LCD RGB delta |
| FSC LCD (no color filter) |

| Gate scanning |
| --- |
| Vertical Non-Interlaced |
| Vertical Interlaced |
| Horizontal Non-Interlaced |
| Horizontal Interlaced |

| Gate Line |
| --- |
| single gate Line |
| dual gate Line |

| VCOM |
| --- |
| single VCOM |
| dual VCOM |

LCD driving method and types

Figure 21

COST-EFFECTIVE DISPLAY METHODS AND APPARATUSES

RELATED APPLICATIONS

The present invention claims priority to three U.S. provisional applications, including U.S. 61/292,527 filed on Jan. 6, 2010, U.S. 61/295,052 filed on Jan. 14, 2010, and U.S. 61/298,379 filed on Jan. 26, 2010.

FIELD OF THE INVENTION

The present invention generally relates to improved and cost-effective display methods and apparatuses. More specifically, a first aspect of the invention relates to apparatuses and methods for interlaced scanning liquid crystal display (LCD) for lower power consumption. This interlaced scanning apparatuses and methods are applicable to both color filter-based (e.g. RGB color filters) LCD's and color filterless LCD's such as FSCLCD (field sequential color liquid crystal display).

Furthermore, a second aspect of the invention relates to methods and apparatuses for optimizaing backlight unit turn-on time in a field sequential liquid crystal display (FSLCD). In particular, the second aspect of the invention relates to RGB (red, green, blue) LED backlight unit scanning for a color version the FSLCD called "FSCLCD". In a preferred embodiment of the invention, the FSCLCD may have gate vetical scanning or gate horizontal scanning, with sub-color frames of red, green, blue, yellow, and/or white colors.

In addition, a third aspect of the invention relates to methods and apparatuses for dual common electrode liquid crystal display (LCD) having lower source driving voltage in a source driver block. The LCD may have a color filter of RGB pixel arrangement or may not have color filter, as in the case of using an FSCLCD. In a preferred embodiment of the invention, the source driver voltage can be under 3.6 volt with dot (sub-pixel) inversion enable integration into a single IC using a lower voltage chip fabrication process for a source driver, TCON IC, and/or frame memory and/or line memory.

BACKGROUND OF THE INVENTION

In recent years, liquid crystal displays (LCD's) have become widely available as computer monitors, television panels, cellular phone screens, and other display applications. Although the price of manufacturing an LCD panel continues to fall, and the energy efficiencies of powering the LCD panel continues to improve, there may be numerous areas of further evolution in energy efficiencies and manufacturing cost reductions for LCD's.

In general, active matrix type liquid crystal display (LCD) devices have an active element (e.g. a thin-film transistor, TFT) on a per-pixel basis for performing switching operations. The LCD controls light transmittance of liquid crystal material in accordance with a video signal so that a picture corresponding to the video signal can be displayed on the LCD panel. The LCD includes an LCD panel having liquid crystal cells arranged in a matrix shape, and driving circuits for driving the LCD panel. In the LCD panel, a plurality of data lines and a plurality of scan lines intersect, and pixel-driving TFT switches are provided at respective intersections. The driving circuits of the LCD include a source driver for supplying signals displaying the picture to the data lines, and a gate driver for supplying signals turning on/off the TFT switches to the scan lines.

One area of design improvement in LCD panels is related to energy inefficiencies arising from inversion methods in LCD's. Dot inversion (i.e. sub-pixel inversion) method has been a pervasive inversion method used in the display industry to provide excellent display qualities for today's LCD panels. Related dot inversion methods used in the industry include, but are not limited to, a dot inversion, a 1+2H dot inversion, 1+alpha*H dot inversion, 1+2V dot inversion, 1+alpha*V dot inversion, alpha*V dot inversion, or alpha*H dot inversion.

However, the dot inversion method consumes substantial amount of power and hampers energy efficiency for a typical LCD panel. If novel scanning and driving methods can be more energy efficient while retaining much of excellent display qualities of the dot inversion method, display manufacturers and consumers may benefit from significant energy efficiency achieved by these novel scanning and driving methods for an LCD panel.

Another area of design improvement in LCD panels is related to backlight unit turn-on time in a field sequential color liquid crystal display (FSCLCD). Field sequential color LCD (FSCLCD) minimizes the power required to produce color images relative to conventional color filter-based LCD's. In one example of an FSCLCD, each 16.67 ms frame is further divided into three equal time intervals, or "sub-frame" of 5.56 ms each.

During each sub-frame, a high-efficiency colored light source is used to backlight the liquid crystal display panel, and different color lights may be turned on per sub-frame. For example, a red light may be turned on for a first sub-frame, a green light may be turned on for a second sub-frame, and a blue light may be turned on for a third sub-frame in sequence.

FSCLCD's may be more efficient than other conventional CF-TFTLCD's because no color filters are used and each color component of the backlight is allowed to pass through the entire pixel area, instead of a mere sub-pixel fraction of each pixel. Because the human eye cannot distinguish these fast changes of colored sequences, it visualizes the colored sequences as integrated colors within each frame. What is perceived is a pixel having the desired composite color and brightness.

In a FSCLCD, access to each cell in the matrix is enabled by a vertical column, with a pulse of such amplitude to produce a desired gray level being applied via a horizontal row. This pulse is used to charge the cell. The charging of cells is performed one gate line (row or column) at a time, from top to bottom or left to right on the matrix at landscape display LCD. The gray levels are set first, followed by the backlighting of the cells that have their gray levels set, using a specific colored LED lamp, then extinguishing of that specific colored LED lamp, followed by resetting of gray levels for the next specific colored LED lamp. Typically, with a three color Red, Green, Blue backlighting system, the light sources or LEDs of one color are interposed with the others as follows: Red, Green, Blue, Red, Green, Blue, Red, etc., resulting in a fairly complex backlighting system.

For the FSCLCD, very fast response time liquid crystal is necessary in general to prevent abnormal color mixing between sub-color sequential periods. The RGB LED turn on time will be very short because LED needs to be turn on after all the pixel data from 1st gate line to last gate line must be written, and transited from one sub-color data to another next sub-color data. The total transition time includes display RGB data writing time which means 2.78 ms when RGB data writing time is ⅙ frame, half of sub-color frame period is the sub-color scanning (writing) time except for LC (liquid crystal)'s transition. Therefore it may be beneficial to increase LED turn on time by reducing the waiting time after sub-color writing time.

Another area of design improvement in LCD panels is related to lowering source driving voltages. In conventional LCD panel designs, a single common electrode in an LCD panel is used for dot (sub-pixel) inversion or similar inversion method to improve optical performance. Because the source driving voltage is around over 6V~15V or more in these inversion methods, it is not easy to use lower voltage semiconductor fabrication process when fabricating source driver IC. Furthermore, it is hard to integrate source driver block to TCON (timing controller) using lower voltage semicondcutor process. Therefore, methods and apparatuses which lower the source driver voltage and enable lower-cost usage of semiconductor processes for lower voltage IC's may be highly beneficial for cost reductions and energy efficiency.

SUMMARY

Summary and Abstract summarize some aspects of the present invention. Simplifications or omissions may have been made to avoid obscuring the purpose of the Summary or the Abstract. These simplifications or omissions are not intended to limit the scope of the present invention.

In one embodiment of the invention, a method for providing an interlaced scan in a liquid crystal display (LCD) is disclosed. This method comprises the steps of: receiving a set of display data comprising N by M, wherein N is the number of columns in the display data and M is the number of rows in the display data; providing electrical power to gates at each odd line while blocking electrical power to gates at each even line for a first period within a display frame; and providing electrical power to the gates at each even line while blocking electrical power to the gates at each odd line for a second period within the display frame, wherein temporal distribution of polarities for a particular inversion method remains unchanged in a first half of the display frame and change to opposite polarities only in a second half of the display frame.

In another embodiment of the invention, an apparatus for optimizing backlight unit turn-on time in a field sequential color liquid crystal display (FSCLCD) is disclosed. This apparatus comprises an advanced field sequential color (A-FSC) timing controller block which receives input display signals and provides red, green and blue display signals sequentially and related control signals to control output timing of a source driver and a gate driver IC operatively connected to sub-color LED lamps, wherein each of the sub-color LED lamps is instructed to stay on during an "idle" sub-color frame period for extended backlight turn-on time of the FSCLCD.

Yet in another embodiment of the invention, an apparatus for a liquid crystal display (LCD) to provide a low source driving voltage is also disclosed. This apparatus comprises a dual VCOM structure operatively connected to a source driver IC, with a first VCOM section (VCOMA) and a second VCOM section (VCOMB), wherein VCOMA is operatively connected to odd column lines for odd column pixels, and VCOMB is operatively connected to even column lines for even column pixels.

BRIEF DESCRIPTION OF DRAWINGS

FIG. 1A shows a pixel structure of conventional CF TFT LCD with RGB (Red, Green, Blue) vertical stripe pixel arrangement for gate vertical scanning.

FIG. 1B shows a pixel structure of conventional CF TFT LCD with RGB (Red, Green, Blue) horizontal stripe pixel arrangement for gate vertical scanning.

FIG. 1C shows a pixel structure of FSC LCD having no color filter for gate vertical scanning.

FIG. 1D shows a pixel structure of CF TFT LCD with RGB (Red, Green, Blue) vertical stripe pixel arrangement for gate horizontal scanning.

FIG. 1E shows a pixel structure of CF TFT LCD having no color for gate horizontal scanning.

FIG. 2A shows a conventional non-interlaced gate on timing when gate vertical scanning in CF TFT LCD with RGB vertical stripe pixel arrangement is used.

FIG. 2B shows a conventional non-interlaced gate on timing when gate vertical scanning in CF TFT LCD with RGB horizontal stripe pixel arrangement is used.

FIG. 2C shows a non-interlaced gate on timing during red color sub frame when gate vertical scanning is used for FSCLCD.

FIG. 2D shows a non-interlaced gate on timing during green color sub frame when gate vertical scanning is used for FSCLCD.

FIG. 2E shows a non-interlaced gate on timing during blue color sub frame when gate vertical scanning is used for FSCLCD.

FIG. 2F shows a non-interlaced gate on timing when gate horizontal scanning with RGB vertical stripe pixel arrangement is used.

FIG. 2G shows a non-interlaced gate on timing during red color sub frame when gate horizontal scanning is used for FSCLCD.

FIG. 2H shows a non-interlaced gate on timing during green color sub frame when gate horizontal scanning is used for FSCLCD.

FIG. 2J shows a non-interlaced gate on timing during blue color sub frame when gate horizontal scanning is used for FSCLCD.

FIG. 3A shows a pixel polarity at non-interlaced gate vertical scanning when dot (sub-pixel) inversion in CF TFT LCD is used.

FIG. 3B shows a pixel polarity at non-interlaced gate vertical scanning when 2H dot (sub-pixel) inversion in CF TFT LCD is used.

FIG. 3C shows a pixel polarity at non-interlaced gate vertical scanning when 1+2H dot (sub-pixel) inversion in CF TFT LCD is used.

FIG. 3D shows a pixel polarity at non-interlaced gate horizontal scanning when dot (sub-pixel) inversion in CF TFT LCD is used.

FIG. 3E shows a pixel polarity at non-interlaced gate horizontal scanning when 2V dot (sub-pixel) inversion in CF TFT LCD is used.

FIG. 3F shows a pixel polarity at non-interlaced gate horizontal scanning when 1+2V dot (sub-pixel) inversion in CF TFT LCD is used.

FIG. 4A shows a pixel polarity at a novel interlaced gate vertical scanning when dot (sub-pixel) inversion in CF TFT LCD is used, in accordance with an embodiment of the invention.

FIG. 4B shows a pixel polarity at a novel interlaced gate vertical scanning when dot (sub-pixel) inversion in FSC LCD (field sequential color liquid crystal display) is used, in accordance with an embodiment of the invention.

FIG. 4C shows a pixel polarity at a novel interlaced gate vertical scanning when 2H dot (sub-pixel) inversion in CF TFT LCD is used, in accordance with an embodiment of the invention.

FIG. 4D shows a pixel polarity at a novel interlaced gate vertical scanning when 1+2H dot (sub-pixel) inversion in CF TFT LCD is used, in accordance with an embodiment of the invention.

FIG. 4E shows a pixel polarity at a novel interlaced gate horizontal scanning when dot (sub-pixel) inversion in CF TFT LCD is used, in accordance with an embodiment of the invention.

FIG. 4F shows a pixel polarity at a novel interlaced gate horizontal scanning when 2V dot (sub-pixel) inversion in CF TFT LCD is used, in accordance with an embodiment of the invention.

FIG. 4G shows a pixel polarity at a novel interlaced gate horizontal scanning when 1+2V dot (sub-pixel) inversion in CF TFT LCD is used, in accordance with an embodiment of the invention.

FIG. 5A shows a novel interlaced gate on timing when gate vertical scanning with single GSP line for CF TFT LCD having RGB vertical stripe pixel color filter is used, in accordance with an embodiment of the invention.

FIG. 5B shows a novel interlaced gate on timing when gate vertical scanning with single GSP line for CF TFT LCD having RGB horizontal stripe pixel color filter is used, in accordance with an embodiment of the invention.

FIG. 5C shows a novel interlaced gate on timing when gate horizontal scanning with single GSP line for CF TFT LCD having RGB vertical stripe pixel color filter is used, in accordance with an embodiment of the invention.

FIG. 5D shows a novel interlaced gate on timing when gate vertical scanning with single GSP line for FSC LCD having no color filter is used, in accordance with an embodiment of the invention.

FIG. 5E shows a novel interlaced gate on timing when gate horizontal scanning with single GSP line for FSC LCD having no color filter is used, in accordance with an embodiment of the invention.

FIG. 5F shows a novel interlaced gate on timing when gate vertical scanning with dual GSP line for CF TFT LCD having RGB vertical stripe pixel color filter is used, in accordance with an embodiment of the invention.

FIG. 5G shows a novel interlaced gate on timing when gate vertical scanning with dual GSP line for CF TFT LCD having RGB horizontal stripe pixel color filter is used, in accordance with an embodiment of the invention.

FIG. 5H shows a novel interlaced gate on timing when gate horizontal scanning with dual GSP line for CF TFT LCD having RGB vertical stripe pixel color filter is used, in accordance with an embodiment of the invention.

FIG. 5J shows a novel interlaced gate on timing when gate vertical scanning with dual GSP line for FSC LCD having no color filter is used, in accordance with an embodiment of the invention.

FIG. 5K shows a novel interlaced gate on timing when gate horizontal scanning with dual GSP line for FSC LCD having no color filter is used, in accordance with an embodiment of the invention.

FIG. 6A shows a conventional gate line structure at non-interlaced gate vertical scanning.

FIG. 6B shows a conventional gate line structure at non-interlaced gate horizontal scanning.

FIG. 7A shows a novel gate structure at interlaced gate vertical scanning with single GSP, in accordance with an embodiment of the invention.

FIG. 7B shows a novel gate structure at interlaced gate vertical scanning with dual GSP, in accordance with an embodiment of the invention.

FIG. 7C shows a novel gate structure at interlaced gate horizontal scanning with single GSP, in accordance with an embodiment of the invention.

FIG. 7D shows a novel gate structure at interlaced gate horizontal scanning with dual GSP, in accordance with an embodiment of the invention.

FIG. 8A shows a novel gate block diagram with single GSP, in accordance with an embodiment of the invention.

FIG. 8B shows another novel gate block diagram with single GSP, in accordance with an embodiment of the invention.

FIG. 8C shows a novel gate block diagram with dual GSP, in accordance with an embodiment of the invention.

FIG. 9A shows a conventional CFLCD (Color Filter Liquid Crystal) having horizontal white LED (Light Emitting Diode) arrays.

FIG. 9B shows a conventional CFLCD (Color Filter Liquid Crystal) having vertical white LED (Light Emitting Diode) arrays.

FIG. 9C shows a conventional FSCLCD (Field Sequential Color Liquid Crystal) having horizontal white LED (Light Emitting Diode) arrays.

FIG. 9D shows a conventional FSCLCD having vertical RGB LED arrays. In this type, the RGB LED arrays are placed vertically at display panel.

FIG. 9E shows a conventional architecture of White LED BLU and RGB LED BLU.

FIG. 9F shows a BLU on timing at conventional CFLCD with white LED package.

FIG. 9G shows a BLU on timing at FSCLCD having fast LC (liquid crystal) with RGB LED package.

FIG. 10A shows a novel FSCLCD architecture having vertical LED arrays, in accordance with an embodiment of the invention.

FIG. 10B shows a novel FSCLCD architecture having horizontal LED arrays, in accordance with an embodiment of the invention.

FIG. 10C shows a novel architecture of RGB LED BLU having 4 blocks of RGB LED packages, in accordance with an embodiment of the invention.

FIG. 10D shows a spatial dimension in a novel RGB LED BLU having 4 blocks of RGB LED packages, in accordance with an embodiment of the invention.

FIG. 11A shows a timing diagram of a novel FSCLCD architecture having fast LC with 4 blocks of RGB LED packages during normal sub-color frame, in accordance with an embodiment of the invention.

FIG. 11B shows a timing diagram of a novel FSCLCD architecture having fast LC with 4 blocks of RGB LED packages during idle sub-color frame, in accordance with an embodiment of the invention.

FIG. 11C shows a LED on timing at a novel FSCLCD architecture having fast LC with RGB LED package, in accordance with an embodiment of the invention.

FIG. 12A shows a timing diagram of a novel FSCLCD architecture having fast LC with 4 blocks of RGB LED packages during one sub-color frame, in accordance with an embodiment of the invention.

FIG. 12B shows a LED on timing at a novel FSCLCD architecture having fast LC with RGB LED package when low frequency of source data input is used, in accordance with an embodiment of the invention.

FIG. 13A shows a timing diagram of a novel FSCLCD architecture having slow LC with 4 blocks of RGB LED packages during boost sub-color frame, in accordance with an embodiment of the invention.

FIG. 13B shows a timing diagram of a novel FSCLCD architecture having slow LC with 4 blocks of RGB LED packages during normal sub-color frame, in accordance with an embodiment of the invention.

FIG. 13C shows a timing diagram of a novel FSCLCD architecture having slow LC with 4 blocks of RGB LED packages during idle sub-color frame, in accordance with an embodiment of the invention.

FIG. 13D shows a LED on timing at a novel FSCLCD architecture having slow LC with 4 blocks of RGB LED package, in accordance with an embodiment of the invention.

FIG. 13E shows a LCD Panel timing at a novel FSCLCD architecture having slow LC with RGB LED package, in accordance with an embodiment of the invention.

FIG. 13F shows a three sub-color frame at a novel FSCLCD architecture with one block RGB LED package, in accordance with an embodiment of the invention.

FIG. 13G shows an additional white sub-color frame at a novel FSCLCD architecture with one block RGB LED package, in accordance with an embodiment of the invention.

FIG. 13H shows an additional yellow sub-color frame at a novel FSCLCD architecture with one block RGB LED package, in accordance with an embodiment of the invention.

FIG. 13J shows a five sub-color frame at a novel FSCLCD architecture with one block RGB LED package, in accordance with an embodiment of the invention.

FIG. 13K shows a voltage level at FSCLCD having line inversion mode to make quick white-black transition FIG. 13L shows a voltage level at FSCLCD having field inversion mode to make quick white-black transition FIG. 13M shows a voltage level at FSCLCD having dot (or column) inversion mode to make quick white-black transition FIG. 13N shows a voltage level at FSCLCD having dot (or column) inversion mode with two Vcom connection to make quick white-black transition FIG. 14 shows a compensated pixel data for reducing ununiformity at edge of modular LGP in a novel RGB LED BLU having 4 blocks of RGB LED packages, in accordance with an embodiment of the invention.

FIG. 15 shows an A-FSC (advanced field sequential color) TCON (timing controller) block diagram for a novel architecture in FSCLCD, in accordance with an embodiment of the invention.

FIG. 16A shows a pixel structure of conventional CF (color filter) TFTLCD (thin film transistor liquid crystal display) having single VCOM (common electrode) and RGB (red, green, blue) vertical stripe pixel arrangement for gate vertical scanning.

FIG. 16B shows a pixel structure of conventional CF TFTLCD having single VCOM and RGB Horizontal stripe pixel arrangement for gate vertical scanning.

FIG. 16C shows a pixel structure of bottom glass in conventional TN (twisted nematic) LCD for gate vertical scanning.

FIG. 16D shows a VCOM structure of top glass in conventional TN LCD having single VCOM for gate vertical scanning.

FIG. 16E shows an overall structure of conventional TN LCD having single VCOM for gate vertical scanning.

FIG. 16F shows an overall structure of conventional IPS (in plane switching) LCD having single VCOM for gate vertical scanning.

FIG. 16G shows a pixel polarity and source driving voltage when dot (sub-pixel) inversion having conventional single VCOM is used. In addition, FIG. 16H and FIG. 16I show the inversion types in current LCD.

FIG. 17A shows a novel dual VCOM structure at gate vertical scanning for dot inversion or column inversion, in accordance with an embodiment of the invention.

FIG. 17B shows a pixel structure of a novel CF TFTLCD having dual VCOM and RGB vertical stripe pixel arrangement for gate vertical scanning, in accordance with an embodiment of the invention.

FIG. 17C shows a pixel structure of a novel CF TFTLCD having dual VCOM and RGB horizontal stripe pixel arrangement for gate vertical scanning, in accordance with an embodiment of the invention.

FIG. 17D shows a pixel structure of a novel FSCLCD (field sequential color LCD) having dual VCOM and no color filter for gate vertical scanning, in accordance with an embodiment of the invention.

FIG. 17E shows a pixel structure of bottom glass in a novel TN LCD having dual VCOM for gate vertical scanning, in accordance with an embodiment of the invention.

FIG. 17F shows a VCOM structure of top glass in a novel TN LCD having single VCOM for gate vertical scanning, in accordance with an embodiment of the invention.

FIG. 17G shows an overall structure of a novel TN LCD having dual VCOM for gate vertical scanning, in accordance with an embodiment of the invention.

FIG. 17H shows an overall structure of a novel IPS LCD having dual VCOM for gate vertical scanning, in accordance with an embodiment of the invention.

FIG. 17J shows a novel dual VCOM structure at gate horizontal scanning for dot inversion or column inversion, in accordance with an embodiment of the invention.

FIG. 17K shows a pixel structure of a novel CF TFT LCD having dual VCOM and RGB Vertical stripe pixel arrangement for gate horizontal scanning, in accordance with an embodiment of the invention.

FIG. 17L shows a pixel structure of a novel FSCLCD having dual VCOM and no color filter for gate horizontal scanning, in accordance with an embodiment of the invention.

FIG. 17M shows an overall structure of a novel TN LCD having dual VCOM for gate horizontal scanning, in accordance with an embodiment of the invention.

FIG. 17N shows an overall structure of a novel IPS LCD having dual VCOM for gate horizontal scanning, in accordance with an embodiment of the invention.

FIG. 17P shows a pixel polarity and source driving voltage when dot (sub-pixel) inversion having dual VCOM is used.

FIG. 17Q shows a pixel polarity and source driving voltage when dot (sub-pixel) inversion having dual VCOM and interlaced scanning is used.

FIG. 18A shows a novel VCOM structure at gate vertical scanning for advanced dot inversion or advanced column inversion, in accordance with an embodiment of the invention.

FIG. 18B shows a pixel structure of a novel CF TFTLCD having advanced dual VCOM and RGB vertical stripe pixel arrangement for gate vertical scanning, in accordance with an embodiment of the invention.

FIG. 18C shows a pixel structure of a novel CF TFTLCD having advanced dual VCOM and RGB horizontal stripe pixel arrangement for gate vertical scanning, in accordance with an embodiment of the invention.

FIG. 18D shows a pixel structure of a novel FSCLCD having advanced dual VCOM and no color filter for gate vertical scanning, in accordance with an embodiment of the invention.

FIG. 18E shows an overall structure of a novel TN LCD having advanced dual VCOM for gate vertical scanning, in accordance with an embodiment of the invention.

FIG. 18F shows an overall structure of a novel IPS LCD having advanced dual VCOM for gate vertical scanning, in accordance with an embodiment of the invention.

FIG. 18G shows a novel advanced dual VCOM structure at gate horizontal scanning for dot inversion or column inversion, in accordance with an embodiment of the invention.

FIG. 18H shows a pixel structure of a novel CF TFT LCD having advanced dual VCOM and RGB Vertical stripe pixel arrangement for gate horizontal scanning, in accordance with an embodiment of the invention.

FIG. 18J shows a pixel structure of a novel FSCLCD having advanced dual VCOM and no color filter for gate horizontal scanning, in accordance with an embodiment of the invention.

FIG. 18K shows an overall structure of a novel TN LCD having advanced dual VCOM for gate horizontal scanning, in accordance with an embodiment of the invention.

FIG. 18L shows an overall structure of a novel IPS LCD having advanced dual VCOM for gate horizontal scanning, in accordance with an embodiment of the invention.

FIG. 18M shows a pixel polarity and source driving voltage when dot (sub-pixel) inversion having advanced dual VCOM and non-interlaced scanning is used, in accordance with an embodiment of the invention.

FIG. 19A shows a pixel structure of bottom glass in a novel TN LCD having dual VCOM and dual gate line for gate vertical scanning, in accordance with an embodiment of the invention.

FIG. 19B shows an overall structure of a novel TN LCD having dual VCOM and dual gate line for gate vertical scanning, in accordance with an embodiment of the invention.

FIG. 19C shows a timing diagram when gate vertical scanning in CF TFT LCD having dual gate line with RGB vertical stripe pixel arrangement is used.

FIG. 20A shows an another embodiment of a novel dual VCOM structure at gate vertical scanning for 1+2H dot inversion or 1+2H column inversion, in accordance with an embodiment of the invention.

FIG. 20B shows an another embodiment of a novel dual VCOM structure at gate vertical scanning for 2H dot inversion or 2H column inversion, in accordance with an embodiment of the invention.

FIG. 20C shows an another embodiment of a novel dual VCOM structure at gate horizontal scanning for 1+2V dot inversion or 1+2V column inversion, in accordance with an embodiment of the invention.

FIG. 20D shows another embodiment of a novel dual VCOM structure at gate horizontal scanning for 2V dot inversion or 2V column inversion, in accordance with an embodiment of the invention.

FIG. 21 shows LCD driving method and types as a reference to an embodiment of the invention.

DETAILED DESCRIPTION

Specific embodiments of the invention will now be described in detail with reference to the accompanying figures. Like elements in the various figures are denoted by like reference numerals for consistency.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

The detailed description is presented largely in terms of procedures, logic blocks, processing, and/or other symbolic representations that directly or indirectly resemble improved and cost-effective display methods and apparatuses.

These process descriptions and representations are the means used by those experienced or skilled in the art to most effectively convey the substance of their work to others skilled in the art.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment. Furthermore, separate or alternative embodiments are not necessarily mutually exclusive of other embodiments. Moreover, the order of blocks in process flowcharts or diagrams representing one or more embodiments of the invention do not inherently indicate any particular order nor imply any limitations in the invention.

One objective of an embodiment of the present invention is to provide gate interlaced scanning driving method to minimize the power consumption on analog data output part on source driver IC having dot inversion performance.

Furthermore, another objective of an embodiment of the present invention is to optimizaing backlight unit turn-on time in a field sequential liquid crystal display (FSLCD). The FSCLCD may have gate vetical scanning or gate horizontal scanning, with sub-color frames of red, green, blue, yellow, and/or white colors.

In addition, another objective of an embodiment of the present invention is to driving an LCD with a dual common electrode to reduce the driving voltage in the source driver block for energy efficiency and reduced production costs.

The display panel in all the drawings has a pixel array having N columns and M rows of pixel units, wherein N and M are positive integers. Furthermore, lines, line widths, and shapes in the drawings are not according to real dimension of a display panel. Furthermore, the display timing may utilize various refresh rates such as 50 Hz, 60 Hz, 72 Hz, 75 Hz, 90 Hz, 120 Hz, 150 Hz, and 180 Hz. In Applicant's disclosure of the invention, 60 Hz embodiments are described. However, one skilled in the art can readily appreciate that other embodiments using other refresh rates are conceptually equivalent to the description pertaining to the 60 Hz embodiments.

A first aspect of the invention, as shown and described in FIGS. 1~9, is related to gate interlaced scanning driving method to minimize the power consumption on analog data output part on source driver IC having dot inversion performance. This first aspect of the invention relates to apparatuses and methods for interlaced scanning liquid crystal display (LCD) for lower power consumption. The interlaced scanning apparatuses and methods are applicable to both color filter-based (e.g. RGB color filters) LCD's and color filterless LCD's such as FSCLCD (field sequential color liquid crystal display).

FIG. 1A shows a pixel structure of conventional CF (color filter) TFT LCD with RGB (Red, Green, Blue) vertical stripe pixel arrangement for gate vertical scanning. A display panel with RGB (Red, Green, Blue) vertical stripe pixel arrangement for gate vertical scanning 100 has pixel arrays and a pixel 104 includes Red sub-pixel 101, Green sub-pixel 102 and Green sub-pixel 103. This kind of LCD structure is popular in the current LCD industry. The display scanning direction is vertical direction from top to bottom or vice-versa from a frontal view. The number of TFT switches in the display panel is 3N*M, when N columns*M rows of color display image are used. The gate scanning line is row line and source data line is column line in the panel. The CLC (capacitor of liquid crystal) is connected to VCOM voltage and pixel electrode. The CST (storage capacitor) is also connected to VCOM voltage and pixel electrode in the drawing as an example. The CST can be connected not VCOM but the other metal line for example, previous gate line.

FIG. 1B shows a pixel structure of conventional CF TFT LCD with RGB (Red, Green, Blue) horizontal stripe pixel arrangement for gate vertical scanning. A display panel 110 has pixel arrays and a pixel 114 includes Red sub-pixel 111, Green sub-pixel 112 and Green sub-pixel 113. This kind of LCD structure will be used to reduce the number of source driver IC. The display scanning direction is vertical direction from top to bottom or vice-versa from a frontal view. The number of TFT switches in the display panel is N*3M, when N columns*M rows of color display image are used. The gate scanning line is the row line and the source data line is the column line in the panel.

FIG. 1C shows a pixel structure of FSC LCD having no color filter for gate vertical scanning. A display panel 120 has a pixel 124 having no color filter and has three color back light unit of red, green and blue instead of white color backlight at conventional CF (color filter) LCD. The display scanning direction is vertical direction from top to bottom or vice-versa from a frontal view. The number of TFT switches in the display panel is N*M, when N columns*M rows of display image are used. The gate scanning line is the row line and the source data line is the column line in the panel.

FIG. 1D shows a pixel structure of CF TFT LCD with RGB (Red, Green, Blue) vertical stripe pixel arrangement for gate horizontal scanning. A display panel with RGB (Red, Green, Blue) vertical stripe pixel arrangement for gate horizontal scanning 130 has pixel arrays and a pixel 134 includes Red sub-pixel 131, Green sub-pixel 132 and Green sub-pixel 133. The optimized viewing angle or main viewing angle of this type is 6 o'clock direction or down direction from a frontal view. The display scanning direction is horizontal direction from left to right or right to left from a frontal view. The number of TFT switches in the display panel is 3N*M, when N columns*M rows of color display image are used. The gate scanning line is column line and source data line is row line in the panel.

FIG. 1E shows a pixel structure of FSC LCD having no color for gate horizontal scanning. A display panel 150 has a pixel 154 having no color filter and has three color back light unit of red, green and blue instead of white color backlight at conventional LCD with color filter. The optimized viewing angle or main viewing angle of this type is 6 o'clock direction or down direction from a frontal view. The display scanning direction is horizontal direction from left to right or right to left from a frontal view. The number of TFT switches in the display panel is N*M, when N columns*M rows of color display image are used. The gate scanning line is the column line and the source data line is the row line in the panel.

FIG. 2A shows a conventional non-interlaced gate on timing when gate vertical scanning in CF TFT LCD with RGB vertical stripe pixel arrangement is used. FIG. 2A (a) GSC phase shift from Source output shows timing diagram when source output phase is shifted from GSC (gate shift clock) rising edge in order to compensate gate line delay because of RC (resistor and capacitor) delay of gate line in the display panel. The gate on pulses will be turned on sequentially after GSP (gate start pulse) and total gate line is M. The G1 (gate1), G2 (gate2), and GM (gateM-last gate line) will be on synchronized to source output which has simultaneous red, green and blue data. The gate turn on period will be same as 1 Hsync (input horizontal sync). The vertical blank period is VBX. FIG. 2A (b) GOE with same phase on both GSC and Source output shows timing diagram when source output phase is same as GSC (gate shift clock) rising edge. GOE (gate output enable) is used, the gate output will be off during GOE is high so that gate on time will be shortened to compensate gate line delay because of RC (resistor and capacitor) delay of gate line in the display panel. The gate on pulses will be turned on sequentially after GSP (gate start pulse). The G1 (gate1), G2 (gate2), and GM (gateM, last gate line) will be on and are synchronized to source output which has red, green and blue data. Timing diagrams with GOE such as FIG. 2A (b) will be omitted in the following drawings because GSC phase shift from source output can be sufficient to explain the timing without describing details of GOE timing.

FIG. 2B shows a conventional non-interlaced gate on timing when gate vertical scanning in CF TFT LCD with RGB horizontal stripe pixel arrangement is used. The gate on pulses will be turned on sequentially after GSP (gate start pulse) and total gate line is 3M. The G1 (gate1), G2 (gate2), and G3M (gate3M–last gate line) will be on sequentially and are synchronized to source output which has an order of red, green and blue data. The gate turn on period will be same as ⅓ Hsync (input horizontal sync).

FIG. 2C shows a non-interlaced gate on timing during red color sub frame when gate vertical scanning at FSC LCD is used. The gate on pulses will be turned on sequentially after GSP (gate start pulse) and total gate line is M. The G1 (gate1), G2 (gate2), and GM (gateM, last gate line) will be on and are synchronized to source output which has red data only. The RED backlight ON duration will be after INT1, which is an interval time for liquid crystal's full response time. The gate turn on period will be 1/M*(1sub-frame period–VBX vertical blank duration:arbitrary value)

FIG. 2D shows a non-interlaced gate on timing during green color sub frame when gate vertical scanning at FSC LCD is used. The gate on pulses will be turned on sequentially after GSP (gate start pulse) and total gate line is M. The G1 (gate1), G2 (gate2), and GM (gateM, last gate line) will be on ad are synchronized to source output which has green data only. The GREEN backlight ON duration will be after INT1, which is an interval time for liquid crystal's full response time. The gate turn on period will be 1/M*(1sub-frame period–VBX vertical blank duration:arbitrary value)

FIG. 2E shows a non-interlaced gate on timing during blue color sub frame when gate vertical scanning is used for FSCLCD. The gate on pulses will be turned on sequentially after GSP (gate start pulse) and total gate line is M. The G1 (gate1), G2 (gate2), and GM (gateM, last gate line) will be on and are synchronized to source output which has blue data only. The BLUE backlight ON duration will be after INT1 timing, which means interval time for liquid crystal's full response time. The gate turn on period will be 1/M*(1sub-frame period–VBX vertical blank duration:arbitrary value).

FIG. 2F shows a non-interlaced gate on timing when gate horizontal scanning in CF TFT LCD with RGB vertical stripe pixel arrangement is used. The gate on pulses will be turned on sequentially after GSP (gate start pulse) and total gate line is 3N. The G1 (gate1), G2 (gate2), and G3N (gate3N, last gate line) will be on and are synchronized to source output which has an order of red, green and blue data. Red data will be output from source driver IC when G1 is ON, and Green data will be output from source driver IC when G2 is ON, and Blue data will be output from source driver IC when G3 is ON. The gate turn on period will be ⅓N*(1frame period−VBX vertical blank duration).

FIG. 2G shows a non-interlaced gate on timing during red color sub frame when gate horizontal scanning is used for FSCLCD. The gate on pulses will be turned on sequentially after GSP (gate start pulse) and total gate line is N. The G1 (gate1), G2 (gate2), and GN (gateN, last gate line) will be on and are synchronized to source output which has red data only. The RED BLU (backlight unit) ON duration will be after INT1 timing, which means interval time for liquid crystal's full response time. The gate turn on period will be 1/N*(1sub-frame period−VBX vertical blank duration: arbitrary value)

FIG. 2H shows a non-interlaced gate on timing during green color sub frame when gate horizontal scanning is used for FSCLCD. The gate on pulses will be turned on sequentially after GSP (gate start pulse) and total gate line is M. The G1 (gate1), G2 (gate2), and GN (gateN, last gate line) will be on and are synchronized to source output which has green data only. The GREEN BLU (backlight unit) ON duration will be after INT1 timing, which means interval time for liquid crystal's full response time. The gate turn on period will be 1/N*(1sub-frame period−VBX vertical blank duration:arbitrary value)

FIG. 2J shows a non-interlaced gate on timing during blue color sub frame when gate horizontal scanning is used for FSCLCD. The gate on pulses will be turned on sequentially after GSP (gate start pulse) and total gate line is M. The G1 (gate1), G2 (gate2), and GN (gateN, last gate line) will be on and are synchronized to source output which has blue data. The BLUE BLU (backlight unit) ON duration will be after INT1 timing, which means interval time for liquid crystal's full response time. The gate turn on period will be 1/N*(1 sub-frame period−VBX vertical blank duration: arbitrary value).

FIG. 3A shows a pixel polarity at non-interlaced gate vertical scanning when dot (sub-pixel) inversion is used in CF TFT LCD with RGB vertical stripe pixel arrangement. All the output data polarities of source driver IC are changing per each gate line. Therefore the power consumption on source driver IC is much higher than the other inversion type (e.g. column inversion)'s. The spatial distribution of polarity is same as temporal distribution of polarity. The FSC LCD has N*M pixel arrangement whereas Color Filter (CF) LCD has 3N*M in case of RGB vertical stripe pixel arrangement or N*3M in case of RGB horizontal stripe pixel arrangement. The concept of pixel polarization of FSC LCD will be same as CF LCD. Therefore FSC LCD inversion description will not be included in the explanation in the following description. The inversion method of CF TFT LCD with RGB horizontal stripe pixel arrangement is almost same as RGB vertical stripe except for the changes 3N*M to N*3M, so the description of inversion on RGB horizontal pixel will not be included in the following explanation.

FIG. 3B shows a pixel polarity at non-interlaced gate vertical scanning when 2H dot (sub-pixel) inversion in CF TFT LCD with RGB vertical stripe pixel arrangement is used. All of the output data polarities of source driver IC are changing per each gate line. Therefore the power consumption on source driver IC is much higher. The spatial distribution of polarity is same as temporal distribution of polarity.

FIG. 3C shows a pixel polarity at non-interlaced gate vertical scanning when 1+2H dot (sub-pixel) inversion is used. All of the output data polarities of source driver IC are changing per each gate line Therefore the power consumption on source driver IC is much higher. The spatial distribution of polarity is same as temporal distribution of polarity.

FIG. 3D shows a pixel polarity at non-interlaced gate horizontal scanning when dot (sub-pixel) inversion is used. All of the output data polarities of source driver IC are changing per each gate line. Therefore the power consumption on source driver IC is much higher. The spatial distribution of polarity is same as temporal distribution of polarity.

FIG. 3E shows a pixel polarity at non-interlaced gate horizontal scanning when 2V dot (sub-pixel) inversion is used. All of the output data polarities of source driver IC are changing per each gate line. Therefore the power consumption on source driver IC is much higher. The spatial distribution of polarity is same as temporal distribution of polarity.

FIG. 3F shows a pixel polarity at non-interlaced gate horizontal scanning when 1+2V dot (sub-pixel) inversion is used. All of the output data polarities of source driver IC are changing per each gate line. Therefore the power consumption on source driver IC is much higher. The spatial distribution of polarity is same as temporal distribution of polarity.

FIG. 4A shows a pixel polarity at a novel interlaced gate vertical scanning when dot (sub-pixel) inversion in CF LCD (color filter liquid crystal display) is used, in accordance with a preferred embodiment of the invention. All of the output data polarities of source driver IC are not changing per each gate line. The polarity is changed per half frame instead of gate line. Therefore the power consumption on source driver IC is much lower than non-interlacing scanning type because of less polarity changes. The spatial distribution of polarity is different from temporal distribution of polarity.

FIG. 4B shows a pixel polarity at a novel interlaced gate vertical scanning when dot (sub-pixel) inversion in FSC LCD (field sequential color liquid crystal display) is used, in accordance with a preferred embodiment of the invention. All of the output data polarities of source driver IC are not changing per each gate line. The polarity is changed per half sub frame instead of gate line. Therefore the power consumption on source driver IC is much lower than non-interlacing scanning type because of less polarity changes. The polarity of specific color pixel will be changed per frame not per sub-frame although physical pixel data will be changed prior to specific color data rewriting. For example the specific red display data will have polarity change per each frame, although there will be polarity change on the same pixel because of green and blue data wring time. The spatial distribution of polarity is different from temporal distribution of polarity. The FSC LCD has N*M pixel arrangement whereas Color Filter (CF) LCD has 3N*M or N*3M pixel arrangement. The concept of pixel polarization of FSC LCD will be same as CF LCD. Therefore the novel interlaced scanning at FSC LCD will not be included in the explanation.

FIG. 4C shows a pixel polarity at a novel interlaced gate vertical scanning when 2H dot (sub-pixel) inversion in CF LCD (color filter liquid crystal display) is used, in accordance with a preferred embodiment of the invention. All of the output data polarities of source driver IC are not changing per each gate line. The polarity is changed per half frame instead of gate line. Therefore the power consumption on source driver IC is much lower than non-interlacing scanning type because of less polarity changes. The spatial distribution of polarity is different from temporal distribution of polarity.

FIG. 4D shows a pixel polarity at a novel interlaced gate vertical scanning when 1+2H dot (sub-pixel) inversion in CF LCD (color filter liquid crystal display) is used, in accordance with a preferred embodiment of the invention. All of the output data polarities of source driver IC are not changing per each gate line. The polarity is changed per half frame instead of gate line. Therefore the power consumption on source driver IC is much lower than non-interlacing scanning type because of less polarity changes. The spatial distribution of polarity is different from temporal distribution of polarity.

FIG. 4E shows a pixel polarity at a novel interlaced gate horizontal scanning when dot (sub-pixel) inversion in CF LCD (color filter liquid crystal display) is used, in accordance with a preferred embodiment of the invention. All of the output data polarities of source driver IC are not changing per each gate line. The polarity is changed per half frame instead of gate line. Therefore the power consumption on source driver IC is much lower than non-interlacing scanning type because of less polarity changes. The spatial distribution of polarity is different from temporal distribution of polarity.

FIG. 4F shows a pixel polarity at a novel interlaced gate horizontal scanning when 2V dot (sub-pixel) inversion in CF LCD (color filter liquid crystal display) is used, in accordance with a preferred embodiment of the invention. All of the output data polarities of source driver IC are not changing per each gate line. The polarity is changed per half frame instead of gate line. Therefore the power consumption on source driver IC is much lower than non-interlacing scanning type because of less polarity changes. The spatial distribution of polarity is different from temporal distribution of polarity.

FIG. 4G shows a pixel polarity at a novel interlaced gate horizontal scanning when 1+2V dot (sub-pixel) inversion in CF LCD (color filter liquid crystal display) is used, in accordance with a preferred embodiment of the invention. All of the output data polarities of source driver IC are not changing per each gate line. The polarity is changed per half frame instead of gate line. Therefore the power consumption on source driver IC is much lower than non-interlacing scanning type because of less polarity changes. The spatial distribution of polarity is different from temporal distribution of polarity.

FIG. 5A shows a novel interlaced gate on timing when gate vertical scanning with single GSP line for CF TFT LCD having RGB vertical stripe pixel color filter is used, in accordance with a preferred embodiment of the invention. Source output phase is shifted from GSC (gate shift clock) rising edge in order to compensate gate line delay because of RC (resistor and capacitor) delay of gate line in the display panel. The gate on pulses of odd lines will be turned on first sequentially after GSP (gate start pulse) whose high level width is two GSC clock whose period is a half of Hsync (input horizontal clock) normally and total number of odd and even gate lines is M/2 respectively. The G1 (gate1), G3 (gate3), and GM−1(gateM−1, last odd gate line) will be on synchronized to source output which has red, green and blue data. To remove even gate line, GOEEVEN (gate output enable even) signal will be high while source drive IC provide the odd gate line data. The G2 (gate2), G4 (gate4), and GM (gateM, last even gate line) will be on synchronized to source output which has red, green and blue data. To remove odd gate line, GOEODD (gate output enable odd) signal will be high while source drive IC provide the even gate line data. The vertical blank period between odd data and even data, VB1, is an arbitrary value and can be zero. The vertical blank period between even data and odd data, VB2, is an arbitrary value and can be zero. However sum of VB1 and VB2 might not be zero value to make proper frame refresh rate (e.g. 60 Hz). The gate turn on period can be same as 1 Hsync (input horizontal sync). The GOE (gate output enable) signal can be used to optimize gate on duration additionally.

FIG. 5B shows a novel interlaced gate on timing when gate vertical scanning with single GSP line for CF TFT LCD having RGB horizontal stripe pixel color filter is used, in accordance with a preferred embodiment of the invention. Source output phase is shifted from GSC (gate shift clock) rising edge in order to compensate gate line delay because of RC (resistor and capacitor) delay of gate line in the display panel. The gate on pulses of odd lines will be turned on first sequentially after GSP (gate start pulse) whose high level width is two GSC clock whose period may be ⅙ Hsync (input horizontal clock) normally and total number of odd and even gate lines is 3M/2 respectively. The G1 (gate1), G3 (gate3), and G3M−1 (gate3M−1, last odd gate line) will be on synchronized to source output which has red, blue and green data. To remove even gate line, GOEEVEN (gate output enable even) signal will be high while source drive IC provide the odd gate line data. The G2 (gate2), G4 (gate4), and G3M (gate3M, last even gate line) will be on synchronized to source output which has green, red and blue data. To remove odd gate line, GOEODD (gate output enable odd) signal will be high while source drive IC provide the even gate line data. The vertical blank period between odd data and even data, VB1, is an arbitrary value and can be zero. The vertical blank period between even data and odd data, VB2, is an arbitrary value and can be zero. However, a sum of VB1 and VB2 might not be zero value to make proper frame refresh rate (e.g. 60 Hz). The gate turn on period can be ⅓ Hsync (input horizontal sync). The GOE (gate output enable) signal can be used to optimize gate on duration additionally.

FIG. 5C shows a novel interlaced gate on timing when gate horizontal scanning with single GSP line for CF TFT LCD having RGB vertical stripe pixel color filter is used, in accordance with a preferred embodiment of the invention. Source output phase is shifted from GSC (gate shift clock) rising edge in order to compensate gate line delay because of RC (resistor and capacitor) delay of gate line in the display panel. The gate on pulses of odd lines will be turned on first sequentially after GSP (gate start pulse) whose high level width is two GSC clock whose period may be 1/(3N*2+VB1+VB2) *Vsync (input vertical sync clock) normally and total number of odd and even gate lines is 3N/2 respectively. The G1 (gate1), G3 (gate3), and G3N−1 (gate3N−1, last odd gate line) will be on synchronized to source output which has red, blue and green data. To remove even gate line, GOEEVEN (gate output enable even) signal will be high while source drive IC provide the odd gate line data. The G2 (gate2), G4 (gate4), and G3N (gate3N, last even gate line) will be on synchronized to source output which has green, red and blue data. To remove odd gate line, GOEODD (gate output enable odd) signal will be high while source drive IC provide the even gate line data. The vertical blank period between odd data and even data, VB1, is an arbitrary value and can be zero. The vertical blank period between even data and odd data, VB2, is an arbitrary value and can be zero. However sum of VB1 and VB2 might not be zero value to make proper frame refresh rate (e.g. 60 Hz). The gate turn on period can be 1/(3N+VB1+VB2)*Vsync (input vertical sync clock) period. The GOE (gate output enable) signal can be used to optimize gate on duration additionally.

FIG. 5D shows a novel interlaced gate on timing when gate vertical scanning with single GSP line is used for FSC LCD having no color filter, in accordance with a preferred embodiment of the invention. Source output phase is shifted from GSC (gate shift clock) rising edge in order to compensate gate line delay because of RC (resistor and capacitor) delay of gate line in the display panel. The gate on pulses of odd lines will be turned on first sequentially after GSP (gate start pulse) whose high level width is two GSC clock whose period may be 1/(3*(M*2+VB1+VB2)*Vsync (input vertical sync clock) period) normally and total number of odd and even gate lines is M/2 respectively. The G1 (gate1), G3 (gate3), and GM−1 (gateM−1, last odd gate line) will be on synchronized to source output which has red, blue and green data sequentially. To remove even gate line, GOEEVEN (gate output enable even) signal will be high while source drive IC provide the odd gate line data. The G2 (gate2), G4 (gate4), and GM (gateM, last even gate line) will be on synchronized to source output which has green, red and blue data. To remove odd gate line, GOEODD (gate output enable odd) signal will be high while source drive IC provide the even gate line data. The vertical blank period between odd data and even data, VB1, is an arbitrary value and can be zero. The vertical blank period between even data and odd data, VB2, is an arbitrary value and it needs to be long enough to turn on BLU (backlight unit). The BLU (backlight unit) ON duration will be after INT1 timing, which means interval time for liquid crystal's full response time. The gate turn on period will be 2/(2M+VB1+VB2)*1sub-frame period, where a sub-frame is a frame of red color, green color and blue color so that its period will be ⅓ of one frame (one Vsync period). The GOE (gate output enable) signal can be used to optimize gate on duration additionally.

FIG. 5E shows a novel interlaced gate on timing when gate horizontal scanning with single GSP line is used for FSCLCD without a color filter, in accordance with a preferred embodiment of the invention. Source output phase is shifted from GSC (gate shift clock) rising edge in order to compensate gate line delay because of RC (resistor and capacitor) delay of gate line in the display panel. The gate on pulses of odd lines will be turned on first sequentially after GSP (gate start pulse) whose high level width is two GSC clock whose period may be 1/(N*2+VB1+VB2)*sub-frame period normally where sub-frame will be ⅓ frame and total number of odd and even gate lines is N/2 respectively. The G1 (gate1), G3 (gate3), and GN−1 (gateN−1, last odd gate line) will be on synchronized to source output which has red, blue and green data sequentially. To remove even gate line, GOEEVEN (gate output enable even) signal will be high while source drive IC provide the odd gate line data. The G2 (gate2), G4 (gate4), and GN (gate3N, last even gate line) will be on synchronized to source output which has red, green and blue data. To remove odd gate line, GOEODD (gate output enable odd) signal will be high while source drive IC provide the even gate line data. The vertical blank period between odd data and even data, VB1, is an arbitrary value and can be zero. The vertical blank period between even data and odd data, VB2, is an arbitrary value and it needs to be long enough to turn on BLU (backlight unit). The BLU (backlight unit) ON duration will be after INT1 timing, which means interval time for liquid crystal's full response time. The gate turn on period will be 2/(2N+VB1+VB2)*1sub-frame period, where a sub-frame is a frame of red color, green color and blue color so that its period will be ⅓ of one frame (one Vsync period). The GOE (gate output enable) signal can be used to optimize gate on duration additionally.

FIG. 5F shows a novel interlaced gate on timing when gate vertical scanning with dual GSP line for CF TFT LCD having RGB vertical stripe pixel color filter is used, in accordance with a preferred embodiment of the invention. Source output phase is shifted from GSC (gate shift clock) rising edge in order to compensate gate line delay because of RC (resistor and capacitor) delay of gate line in the display panel. The gate on pulses will be turned on sequentially after GSPODD (gate start pulse odd) and GSPEVEN (gate start pulse even) whose high level width is one GSC clock whose period is 1 Hsync (input horizontal clock) normally and total number of odd and even gate lines is M/2 respectively. The G1 (gate1), G3 (gate3), and GM−1(gateM−1, last odd gate line) will be on synchronized to source output which has red, green and blue data. The odd gate block only will be active first while source drive IC provide the odd gate line data, and then the even gate block will active while source driver IC provides the even gate line data. The G2 (gate2), G4 (gate4), and GM (gateM, last even gate line) will be on synchronized to source output which has red, green, and blue data. The vertical blank period between odd data and even data, VB1, is an arbitrary value and can be zero, where the picture shows VB1=0 as an example. The vertical blank period between even data and odd data, VB2, is an arbitrary value and can be zero. However sum of VB1 and VB2 might not be zero value to make proper frame refresh rate (e.g. 60 Hz). The gate turn on period can be same as 1 Hsync (input horizontal sync). The GOE (gate output enable) signal can be used to optimize gate on duration additionally.

FIG. 5G shows a novel interlaced gate on timing when gate vertical scanning with dual GSP line for CF TFT LCD having RGB horizontal stripe pixel color filter is used, in accordance with a preferred embodiment of the invention. Source output phase is shifted from GSC (gate shift clock) rising edge in order to compensate gate line delay because of RC (resistor and capacitor) delay of gate line in the display panel. The gate on pulses will be turned on sequentially after GSPODD (gate start pulse odd) and GSPEVEN (gate start pulse even) whose high level width is one GSC clock whose period is ⅓ Hsync (input horizontal clock) normally and total number of odd and even gate lines is 3M/2 respectively. The G1 (gate1), G3 (gate3), and G3M−1 (gate3M−1, last odd gate line) will be on synchronized to source output which has red, blue and green data. The odd gate block only will be active first while source drive IC provide the odd gate line data, and then the even gate block will active while source driver IC provides the even gate line data. The G2 (gate2), G4 (gate4), and G3M (gate3M, last even gate line) will be on synchronized to source output which has green, red and blue data. The vertical blank period between odd data and even data, VB1, is an arbitrary value and can be zero, where the picture shows VB1=0 as an example. The vertical blank period between even data and odd data, VB2, is an arbitrary value and can be zero. However sum of VB1 and VB2 might not be zero value to make proper frame refresh rate (e.g. 60 Hz). The gate turn on period can be almost same as ⅓ Hsync (input horizontal sync). The GOE (gate output enable) signal can be used to optimize gate on duration additionally.

FIG. 5H shows a novel interlaced gate on timing when gate horizontal scanning with dual GSP line for CF TFT LCD having RGB vertical stripe pixel color filter is used, in accordance with a preferred embodiment of the invention. Source output phase is shifted from GSC (gate shift clock) rising edge in order to compensate gate line delay because of RC (resistor and capacitor) delay of gate line in the display panel. The gate on pulses will be turned on sequentially after GSPODD (gate start pulse odd) and GSPEVEN (gate start pulse even) whose high level width is one GSC clock whose period is 1/(3N+VB1+VB2)*Vsync (input vertical sync clock) normally and total number of odd and even gate lines is 3N/2 respectively. The G1 (gate1), G3 (gate3), and G3N−1 (gate3N−1, last odd gate line) will be on synchronized to source output which has red, blue and green data. The odd gate block only will be active first while source drive IC provide the odd gate line data, and then the even gate block will active while source driver IC provides the even gate line data. The G2 (gate2), G4 (gate4), and G3N (gate3N, last even gate line) will be on synchronized to source output which has green, red and blue data. The vertical blank period between odd data and even data, VB1, is an arbitrary value and can be zero, where the picture shows VB1=0 as an example. The vertical blank period between even data and odd data, VB2, is an arbitrary value and can be zero. However sum of VB1 and VB2 might not be zero value to make proper frame refresh rate (e.g. 60 Hz). The gate turn on period can be same as 1/(3N*2+VB1+VB2)*Vsync (input vertical sync clock). The GOE (gate output enable) signal can be used to optimize gate on duration additionally.

FIG. 5J shows a novel interlaced gate on timing when gate vertical scanning with dual GSP line for FSC LCD having no color filter is used, in accordance with a preferred embodiment of the invention. Source output phase is shifted from GSC (gate shift clock) rising edge in order to compensate gate line delay because of RC (resistor and capacitor) delay of gate line in the display panel. The gate on pulses of odd lines will be turned on first sequentially after GSP (gate start pulse) whose high level width is one GSC clock whose period may be 1/(3*(M+VB1+VB2)*Vsync (input vertical sync clock)) period normally and total number of odd and even gate lines is M/2 respectively. The G1 (gate1), G3 (gate3), and GM−1 (gateM−1, last odd gate line) will be on synchronized to source output which has red, blue and green data sequentially. To remove even gate line, GOEEVEN (gate output enable even) signal will be high while source drive IC provide the odd gate line data. The G2 (gate2), G4 (gate4), and GM (gateM, last even gate line) will be on synchronized to source output which has green, red and blue data. To remove odd gate line, GOEODD (gate output enable odd) signal will be high while source drive IC provide the even gate line data. The vertical blank period between odd data and even data, VB1, is an arbitrary value and can be zero. The vertical blank period between even data and odd data, VB2, is an arbitrary value, and it needs to be long enough to turn on BLU (backlight unit). The BLU (backlight unit) ON duration will be after INT1 timing, which means interval time for liquid crystal's full response time. The gate turn on period will be 1/(M+VB1+VB2)*1sub-frame period, where a sub-frame is a frame of red color, green color and blue color so that its period will be ⅓ of one frame (one Vsync period). The GOE (gate output enable) signal can be used to optimize gate on duration additionally.

FIG. 5K shows a novel interlaced gate on timing when gate horizontal scanning with dual GSP line for FSC LCD having no color filter is used, in accordance with a preferred embodiment of the invention. Source output phase is shifted from GSC (gate shift clock) rising edge in order to compensate gate line delay because of RC (resistor and capacitor) delay of gate line in the display panel. The gate on pulses of odd lines will be turned on first sequentially after GSP (gate start pulse) whose high level width is one GSC clock whose period may be 1/(3*(N+VB1+VB2)*Vsync (input vertical sync clock)) period normally and total number of odd and even gate lines is M/2 respectively. The G1 (gate1), G3 (gate3), and GN−1 (gateM−1, last odd gate line) will be on synchronized to source output which has red, blue and green data sequentially. To remove even gate line, GOEEVEN (gate output enable even) signal will be high while source drive IC provide the odd gate line data. The G2 (gate2), G4 (gate4), and GN (gateM, last even gate line) will be on synchronized to source output which has green, red and blue data. To remove odd gate line, GOEODD (gate output enable odd) signal will be high while source drive IC provide the even gate line data. The vertical blank period between odd data and even data, VB1, is an arbitrary value and can be zero. The vertical blank period between even data and odd data, VB2, is an arbitrary value and it needs to be long enough to turn on BLU (backlight unit). The BLU (backlight unit) ON duration will be after INT1 timing, which means interval time for liquid crystal's full response time. The gate turn on period will be 1/(N+VB1+VB2)*1sub-frame period, where a sub-frame is a frame of red color, green color and blue color so that its period will be ⅓ of one frame (one Vsync period). The GOE (gate output enable) signal can be used to optimize gate on duration additionally.

FIG. 6A shows a Gate line structure at non interlaced gate vertical scanning. FIG. 6A (a) non-interlaced gate single driving shows gate line driving block, single feeding type from left side only. All the gate driving voltage will be provided from the left block only. Gate 1st line, Gate 2nd line . . . Gate Mth line (last line) will be turned on sequentially, which are synchronized the source display output data. The gate line driving block may be located in right side instead of left side. FIG. 6A (b) non-interlaced gate double driving (double feeding) shows gate line driving block, double feeding type from both left and right side. All the gate driving voltage will be provided from both the left and right block simultaneously. Gate 1st line, Gate 2nd line . . . Gate Mth line (last line) will be turned on sequentially, and are synchronized the source display output data. The gate line structure will be same on both CF TFT LCD and FSC LCD.

FIG. 6B shows a Gate line structure at non interlaced gate horizontal scanning. FIG. 6B (a) non-interlaced gate single driving shows gate line driving block, single feeding type from top side only. All the gate driving voltage will be provided from the top block only. Gate 1st line, Gate 2nd line . . . Gate 3N-th line (last line) will be turned on sequentially, which are synchronized the source display output data. The gate line driving block may be located in bottom side instead of top side. FIG. 6B (b) non-interlaced gate double driving (double feeding) shows gate line driving block, double feeding type from both top and bottom side. All the gate driving voltage will be provided from both the top and bottom block simultaneously. Gate 1st line, Gate 2nd line . . . Gate 3Nth line (last line) will be turned on sequentially, which are synchronized the source display output data. The gate line structure will be different on FSC LCD. The total gate number is just "N" in FSC LCD.

FIG. 7A shows a novel gate structure at interlaced gate vertical scanning with single GSP, in accordance with a preferred embodiment of the invention. FIG. 7A (a) interlaced gate single driving shows gate line driving block with GOE, single feeding type from left side only. All the gate driving voltage will be provided from the left block only. Gate 1st line, Gate 3rd line . . . Gate M−1th line will be turned on sequentially which is synchronized the source display output data. Then, Gate 2nd line, Gate 4th line . . . Gate Mth line (last line) will be turned on sequentially, and are synchronized the source display output data. The gate line driving block may be located in right side instead of left side. FIG. 7A (b) interlaced gate double driving (double feeding) shows gate line driving block with GOE, double feeding type from both left and right side. All the gate driving voltage will be provided from both the left and right block simultaneously. Gate will be turned on all the odd line first and then all the even line later. The RGB horizontal stripe pixel arrangement LCD will be almost same concept except the total gate line count is not M but 3M. The FSC LCD type will be same gate line number as CF LCD except for fast scanning frequency for sequential driving. Therefore detailed explanation on FSC LCD and RGB horizontal stripe pixel arrangement CF LCD will not be described more in the future.

FIG. 7B shows a novel gate structure at interlaced gate vertical scanning with dual GSP, in accordance with a preferred embodiment of the invention. FIG. 7B (a) interlaced gate single driving with dual GSP for dot inversion shows gate line driving block single feeding type, odd line from left side and even line from right side. All the odd gate lines will be ON sequentially first and then all the even gate line will be ON sequentially. There will be separated GSP line to each left and right gate driving block. The gate lines are placed line by line to drive pixel polarization dot inversion or 2H or 1+2H dot inversion. FIG. 7B (b) interlaced gate single driving with dual GSP for 1+2V inversion shows gate line driving block single feeding type, 1st line and every two lines among four lines from left side and every the other two lines among four lines from right side. All the gate lines from left gate block will be ON sequentially first and then all the gate lines from right gate block will be ON sequentially. There will be separated GSP line to each left and right gate driving block. Any combination of gate lines might be available for the specific inversion method, for example 2V or 3V dot inversion.

FIG. 7C shows a novel gate structure at interlaced gate horizontal scanning with single GSP, in accordance with a preferred embodiment of the invention. FIG. 7C (a) interlaced gate single driving shows gate line driving block with GOE, single feeding type from top side only. All the gate driving voltage will be provided from the top gate block only. Gate 1st line, Gate 3rd line . . . Gate 3N−1 th line will be turned on sequentially first, and are synchronized the source display output data. Then, Gate 2nd line, Gate 4th line, and . . . Gate 3N-th line (last line) will be turned on sequentially which are synchronized the source display output data. The gate line driving block may be located in bottom side instead of top side. FIG. 7C (b) interlaced gate double driving (double feeding) shows gate line driving block with GOE, double feeding type from both top and bottom side. All the gate driving voltage will be provided from both the top and bottom block simultaneously later. Gate will be turned on all the odd line first and then all the even line later.

FIG. 7D shows a novel gate structure at interlaced gate horizontal scanning with dual GSP, in accordance with a preferred embodiment of the invention. FIG. 7D (a) interlaced gate single driving with dual GSP for dot inversion shows gate line driving block single feeding type, odd line from top side and even line from bottom side. All the odd gate lines will be ON sequentially first and then all the even gate line will be ON sequentially. There will be separated GSP line to each top and bottom gate driving block. The gate lines are placed line by line to drive pixel polarization dot inversion or 2V or 1+2V dot inversion. FIG. 7D (b) interlaced gate single driving with dual GSP for 1+2H inversion shows gate line driving block single feeding type, 1st line and every two lines among four lines from top side and every the other two lines among four lines from bottom side. All the gate lines from top gate block will be ON sequentially first and then all the gate lines from bottom gate block will be ON sequentially later. There will be separated GSP line to each top and bottom gate driving block. Any combination of gate lines might be available for the specific inversion method, for example 2H or 3H dot inversion.

FIG. 8A shows a novel gate block diagram with single GSP, in accordance with a preferred embodiment of the invention. GOE (gate output enable) is a redundant in case, the gate output, G1, G3 and Glast−1 will be ON sequentially during GOEODD is low and GOEEVEN is high, and then gate output G2, G4 and Glast will ON sequentially during GOEODD is high and GOEEVEN is low. The shift register has asynchronous clear function in this case.

FIG. 8B shows another novel gate block diagram with single GSP, in accordance with a preferred embodiment of the invention. GOE (gate output enable) is a redundant in case, the gate output, G1, G3 and Glast−1 will be ON sequentially during GOEODD is low and GOEEVEN is high, and then gate output G2, G4 and Glast will ON sequentially during GOEODD is high and GOEEVEN is low. GOE is tied to OR circuitry with GOEODD and GOEEVEN so that all the gate output can be adjusted by GOE pulse width.

FIG. 8C shows a novel gate block diagram with dual GSP, in accordance with a preferred embodiment of the invention. The gate output, G1, G3 and Glast−1 will be ON sequentially during odd period, and then gate output G2, G4 and Glast will ON sequentially during even period. The GSP (gate start pulse), GSC (gate shift clock), GOE (gate output enable) are separated to two gate block. The GSCA and GSCB might be same signal in case. Furthermore, GOEA and GOEB also can be same signal in case.

A second aspect of the invention, as shown and described in FIGS. 9~15, is related to methods and apparatuses for optimizaing backlight unit turn-on time in a field sequential liquid crystal display (FSLCD). In particular, the second aspect of the invention relates to RGB (red, green, blue) LED backlight unit scanning for a color version the FSLCD called "FSCLCD". In a preferred embodiment of the invention, the FSCLCD may have gate vetical scanning or gate horizontal scanning, with sub-color frames of red, green, blue, yellow, and/or white colors.

FIG. 9A shows a conventional CFLCD (Color Filter Liquid Crystal) having horizontal white LED (Light Emitting Diode) arrays. A display panel with RGB (Red, Green, Blue) vertical stripe pixel arrangement for gate vertical scanning 100 has pixel arrays and a pixel 104 includes Red sub-pixel 101, Green sub-pixel 102 and Green sub-pixel 103. This kind of LCD structure is popular in the current LCD industry. The display scanning direction is vertical direction from top to bottom or vice-versa from a frontal view. The number of TFT switches in the display panel is 3N*M, when N columns*M rows of color display image are used. The gate scanning line is row line and source data line is column line in the panel. The timing controller block 300 receives input display signals whose format can be TTL (Transistor-transistor logic), LVDS (low voltage differential signaling), TMDS (Transition Minimized Differential Signaling), DP (Display Port), eDP (embedded Display Port), MIPI (Mobile Industry Processor Interface), MDDI (Mobile Display Digital Interface) and so on, and provides display signals whose format can be differential signal as like mini-LVDS, RSDS(Reduced Swing Differential Signaling) or TTL signal or analog signal and provides control signals to control all the output timing of source driver IC 400 and gate driver IC 500. The gate driver IC 500 can be replaced with GIP (gate in panel) or ASG (a-Si Gate) block. VCOM voltage generator 600 provides Vcom voltage to the display panel 100 and gray scale reference voltage generator provides gamma reference voltage to source driver IC 400. White backlight 200 is used in conventional LCD and has white LED package 204 which has yellow phosphor at blue LED chip usually. The anode voltage and cathode voltage will be connected to array string of white LED 204 to turn on the light. The white LED arrays are placed horizontally at display panel.

FIG. 9B shows a conventional CFLCD (Color Filter Liquid Crystal) having vertical white LED (Light Emitting Diode) arrays. In this type, the white LED arrays are placed vertically at display panel. The other functions are same as FIG. 9A.

FIG. 9C shows a conventional FSCLCD (Field Sequential Color Liquid Crystal) having horizontal white LED (Light Emitting Diode) arrays. A display panel without color filter for gate vertical scanning 110 has pixel arrays of a pixel 104.

The display scanning direction is vertical direction from top to bottom or vice-versa from a frontal view. The number of TFT switches in the display panel is N*M, when N columns*M rows of color display image are used. The gate scanning line is row line and source data line is column line in the panel. The FSC (field sequential color) timing controller block 310 receives input display signals and provides display signals, red, green and blue sequentially, and provides control signals to control all the output timing of source driver IC 410 and gate driver IC 510.

The gate driver IC 510 can be replaced with GIP (gate in panel) or ASG (a-Si Gate) block. VCOM voltage generator 600 provides Vcom voltage to the display panel 110 and gray scale reference voltage generator 700 provides gamma reference voltage to source driver IC 410. RGB backlight 210 is used in FSCLCD to make color display instead of color filter. The anode voltage and cathode voltage will be connected to each color's array string of RGB LED 214 to turn on the red, green, blue light respectively. The RGB LED arrays are placed horizontally at display panel.

FIG. 9D shows a conventional FSCLCD having vertical RGB LED arrays. In this type, the RGB LED arrays are placed vertically at display panel. The other functions are same as FIG. 9C.

FIG. 9E shows a conventional architecture of White LED BLU (back light unit) and RGB LED BLU. FIG. 9E (a) conventional architecture of White LED BLU shows general one string white LED BLU architecture. White LED package 204 is arrayed in one string. This white LED array can be not only one string but also two and more strings for satisfying optical performance. FIG. 9E (b) conventional architecture of RGB LED BLU shows general one string RGB LED BLU architecture. RGB LED package 214 has red LED chip 211, green LED chip and blue 212 LED chip 213 in one package and has different anode, cathode lines at each color LED. For convenience, only 8 LED packages are shown in the FIG. 9E, the LED package count will be changeable to each LCD size.

FIG. 9F shows a BLU on timing at conventional CFLCD with white LED package. All the RGB display data are provided to source driver block simultaneously with frame frequency 60 Hz in general, and white LED BLU are on always. All of the Mth frame's display data are displayed during Mth input display frame.

FIG. 9G shows a BLU on timing at FSCLCD having fast LC (liquid crystal) with RGB LED package. All the RGB display data are provided to source driver block sequentially, each sub color every ⅓ of frame period in general, which means 5.56 ms in 60 Hz frame frequency. The sub-color frame has normal sub-color frame and idle sub-color frame period. During normal sub-color frame, all the sub-color data will be written on the display panel and then during idle sub-color frame periods each sub color LED BLU will turn on according to each sub color displayed in the panel, which means that red LED lamp on during red data display and green LED lamp on during green data display and blue LED lamp on during blue data display. The normal sub-color frame will be around 2.78 ms and idle sub-color frame will be around 2.78 ms too. During the idle sub-color frame the display RGB date can be written again in case. All of the Mth frame's display data are displayed during M+1th input display frame period usually. The sub color BLU on time will be almost ⅙ of frame period which means around 2.78 ms in 60 Hz display refresh rate if LC is fast enough. There might be shortened normal sub-color frame period and longer idle sub-color frame period to increase RGB LED turn on time in case. The sub-color frame can be not only three but six or nine or twelve and so on to improve optical performance.

FIG. 10A shows a novel FSCLCD architecture having vertical LED arrays, in accordance with a preferred embodiment of the invention. A display panel without color filter for gate vertical scanning 110 has pixel arrays of a pixel 104. The display scanning direction is vertical direction from top to bottom or vice-versa for a frontal view. The number of TFT switches in the display panel is N*M, when N columns*M rows of color display image are used. The gate scanning line is row line and source data line is column line in the panel. The A-FSC (advanced field sequential color) timing controller block 320 receives input display signals and provides display signals, red, green and blue sequentially, and provides control signals to control all the output timing of source driver IC 410 and gate driver IC 510. The gate driver IC 510 can be replaced with GIP (gate in panel) or ASG (a-Si Gate) block. VCOM voltage generator 600 provides Vcom voltage to the display panel 110 and gray scale reference voltage generator 700 provides gamma reference voltage to source driver IC 410. RGB (red, green, blue) backlight 210 is used in FSCLCD to make color display instead of color filter. The anode voltage and cathode voltage will be connected to each color's array string of RGB LED 214 to turn on the red, green, blue light respectively. The RGB LED arrays are placed vertically at display panel which is same direction as gate scanning direction.

FIG. 10B shows a novel FSCLCD architecture having horizontal LED arrays, in accordance with a preferred embodiment of the invention. A display panel without color filter for gate horizontal scanning 120 has pixel arrays of a pixel 104. The display scanning direction is horizontal direction from left to right or vice-versa from a frontal view. The number of TFT switches in the display panel is N*M, when N columns*M rows of color display image are used. The gate scanning line is column line and source data line is the row line in the panel. The timing controller block 320 receives input display signals and provides display signals, red, green and blue sequentially, and provides control signals to control all the output timing of source driver IC 410 and gate driver IC 510. The gate driver IC 510 can be replaced with GIP (gate in panel) or ASG (a-Si Gate) block. VCOM voltage generator 600 provides Vcom voltage to the display panel 110 and gray scale reference voltage generator 700 provides gamma reference voltage to source driver IC 410. RGB (red green blue) backlight 210 is used in FSCLCD to make color display instead of color filter. The anode voltage and cathode voltage will be connected to each color's array string of RGB LED 214 to turn on red, green, and blue lights respectively. The RGB LED arrays are placed horizontally at display panel which is same direction as gate scanning direction.

FIG. 10C shows a novel architecture of RGB LED BLU having 4 blocks of RGB LED packages, in accordance with a preferred embodiment of the invention. RGB LED package 214 has red LED chip 211, green LED chip and blue 212 LED chip 213 in one package and has different 4 anode and cathode lines at each color LED in this embodiment. The number of block can be from 2 to Z where Z is integer, and the number of LED package in a block can be optimized to the display' brightness value. Each anode and cathode voltage at each color will be connected to separated individual supply voltage to control each LED strings, there are 12 strings in FIG. 10C. All of the LED strings will be turn on and turn off according to the display sub-color frame period. The direction of LED string will be parallel with gate scanning direction to synchronize the each sub-color LED on time with scanned display data. The string will be vertically located on display panel if gate vertical scanning driving LCD and will be horizontally located on display panel if gate horizontal scanning driving LCD.

FIG. 10D shows a spatial dimension in a novel RGB LED BLU having 4 blocks of RGB LED packages, in accordance with a preferred embodiment of the invention. RGB LED package 214 and sub-color chip will be located within each display block as shown in FIG. 10D which is same size as active display area. For example, in the display of 1280×800 resolution, the modular LGP 1st block will cover 1280×1 to 1280×200 display area, and 2nd modular LGP block will cover 1280×201 to 1280×400 area, and 3rd modular LGP block will cover 1280×401 to 1280×600 area, and 4th modular LGP block will cover 1280×601 to 1280×800 area. Each modular LGP block will be covered by each LED package string; there are 4 strings in the picture as an example. The number of block can be from 2 to Z where Z is integer, and the number of LED package in a block can be optimized to the display' brightness value. The modular LGP may have reflector at each side edge to prevent light dispersion to other modular LGP block. The LED string can be edge lit type or direct type. The string will be vertically located on display panel if gate vertical scanning driving LCD and will be horizontally located on display panel if gate horizontal scanning driving LCD.

FIG. 11A shows a timing diagram of a novel FSCLCD architecture having fast LC with 4 blocks of RGB LED packages during normal sub-color frame, in accordance with a preferred embodiment of the invention. The number of block can be from 2 to Z where Z is integer, and the number of LED package in a block can be optimized to the display's brightness value. This explanation shows only 4 block however any number of block can be available to optimize brightness and material cost. The anode voltage sub-color 1 and cathode voltage sub-color 1 are turn off during the 1st sub-color data writing period in the display panel, and then will be turn on after writing 1st quarter display block in the display panel. The anode voltage sub-color 2 and cathode voltage sub-color 2 are turn off during the 2nd sub-color data writing period in the display panel, and then will be turn on after writing 2nd quarter display block in the display panel. The anode voltage sub-color 3 and cathode voltage sub-color 3 are turn off during the 3rd sub-color data writing period in the display panel, and then will be turn on after writing 3rd quarter display block in the display panel. The anode voltage sub-color 4 and cathode voltage sub-color 4 are turn off during the 4th sub-color data writing period in the display panel, and then will be turn on after writing 4th quarter display block in the display panel. The turn on time of each sub-color LED block will be around 4/3 of sub-color frame period during normal sub-color frame period 2.78 ms.

FIG. 11B shows a timing diagram of a novel FSCLCD architecture having fast LC with 4 blocks of RGB LED packages during idle sub-color frame, in accordance with a preferred embodiment of the invention. All the sub-color LED's keep on status during idle sub-color frame period 2.78 ms. Therefore the total turn on time of each sub-color LED lamp will be around (1+¾)*2.78 ms in case of 4 block. The novel LED scanning driving methods shows 75% additional LED turn on time in case of 4 block scanning, in accordance with a preferred embodiment of the invention.

FIG. 11C shows a LED on timing at a novel FSCLCD architecture having fast LC with RGB LED package, in accordance with a preferred embodiment of the invention. M-th frame data will be displayed during M+1th input data frame and the writing time of RGB display data which means input display data timing of source driver IC is around 2.78 ms. The RGB LED lamp turn on time at each RGB LED block is around 2.78*(1+¾) ms=4.86 ms. There might be shortened normal sub-color frame period and longer idle sub-color frame period to increase RGB LED turn on time in case. The LED turn on time will be proportional to the longer idle sub-color frame period. The sub-color frame can be not only three but six or nine or twelve and so on to improve optical performance.

FIG. 12A shows a timing diagram of a novel FSCLCD architecture having fast LC with 4 blocks of RGB LED packages during one sub-color frame, in accordance with a preferred embodiment of the invention. The anode voltage sub-color 1 and cathode voltage sub-color 1 are turn off during the 1st sub-color data writing period in the display panel, and then will be turn on after writing 1st quarter display block in the display panel. The anode voltage sub-color 2 and cathode voltage sub-color 2 are turn off during the 2nd sub-color data writing period in the display panel, and then will be turn on after writing 2nd quarter display block in the display panel. The anode voltage sub-color 3 and cathode voltage sub-color 3 are turn off during the 3rd sub-color data writing period in the display panel, and then will be turn on after writing 3rd quarter display block in the display panel. The anode voltage sub-color 4 and cathode voltage sub-color 4 are turn off during the 4th sub-color data writing period in the display panel, and then will be turn on after writing 4th quarter display block in the display panel. The turn on time of each sub-color LED block will be around 4/3 of sub-color frame period during one sub-color frame period 5.56 ms.

FIG. 12B shows a LED on timing at a novel FSCLCD architecture having fast LC with RGB LED package when low frequency of source data input is used, in accordance with a preferred embodiment of the invention. There is no divided normal and idle sub-color frame, and there is only one sub-color frame. Mth frame data will be displayed during M+1th input data frame and the writing time of RGB display data which means input display data timing of source driver IC is around 5.56 ms during one sub-color frame. The RGB LED lamp turn on time at each RGB LED block is around 5.56*¾ ms=4.17 ms. There might be shortened display writing time and longer vertical blank period to increase RGB LED turn on time in case. The sub-color frame can be not only three but six or nine or twelve and so on to improve optical performance.

FIG. 13A shows a timing diagram of a novel FSCLCD architecture having slow LC with 4 blocks of RGB LED packages during boost sub-color frame, in accordance with a preferred embodiment of the invention. The anode voltage sub-color 1 and cathode voltage sub-color 1 are turn off from the 1st sub-color data writing period in the display panel, and then will be turn on after writing 1st quarter display block at next normal sub-color frame period. The anode voltage sub-color 2 and cathode voltage sub-color 2 are turn off from the 2nd sub-color data writing period in the display panel, and then will be turn on after writing 2nd quarter display block in the display panel at next normal sub-color frame period. The anode voltage sub-color 3 and cathode voltage sub-color 3 are turn off from the 3rd sub-color data writing period in the display panel, and then will be turn on after writing 3rd quarter display block in the display panel at next normal sub-color frame period. The anode voltage sub-color 4 and cathode voltage sub-color 4 are turn off from the 4th sub-color data writing period in the display panel, and then will be turn on after writing 4th quarter display block in the display panel at next normal sub-color frame period. The turn on time of each sub-color LED block during boost sub-color frame period will be different on each LED block because of different boost data writing time.

FIG. 13B shows a timing diagram of a novel FSCLCD architecture having slow LC with 4 blocks of RGB LED packages during normal sub-color frame, in accordance with a preferred embodiment of the invention. The anode voltage sub-color 1 and cathode voltage sub-color 1 are turn on after writing 1st quarter display block at next normal sub-color frame period. The anode voltage sub-color 2 and cathode voltage sub-color 2 are turn on after writing 2nd quarter display block in the display panel at next normal sub-color frame period. The anode voltage sub-color 3 and cathode voltage sub-color 3 are turn on after writing 3rd quarter display block in the display panel at next normal sub-color frame period. The anode voltage sub-color 4 and cathode voltage sub-color 4 are turn on after writing 4th quarter display block in the display panel at next normal sub-color frame period. The turn on time of each sub-color LED block during normal sub-color frame period will be different on each LED block because of different normal data writing time.

FIG. 13C shows a timing diagram of a novel FSCLCD architecture having slow LC with 4 blocks of RGB LED packages during idle sub-color frame, in accordance with a preferred embodiment of the invention. All of the sub-color LED keeps on status during idle sub-color frame period 1.85 ms. Therefore the total turn on time of each sub-color LED lamp will be around (1+¾)*1.85 ms in case of 4 block. The novel LED scanning driving methods shows 75% additional LED turn on time in case of 4 block scanning, in accordance with a preferred embodiment of the invention.

FIG. 13D shows a LED on timing at a novel FSCLCD architecture having slow LC with 4 blocks of RGB LED package, in accordance with a preferred embodiment of the invention. All the RGB display data are provided to source driver block sequentially, each sub color every ⅓ of frame period in general, which means 5.56 ms in 60 Hz frame frequency. The sub-color frame has boost sub-color frame, normal sub-color frame and idle sub-color frame period. During boost sub-color frame, the boosted display pixel voltage will be provided to compensate slow LC's response time. The boosted pixel voltage is made by boosted display data, boosted VCOM, and/or Gray scale reference voltage. Boosted display data made by RTC (response time compensation) or ODC (over drive compensation) and analog boosted voltage of VCOM voltage or gray scale reference voltage in case will be provided from TCON (timing controller) or any data processing block to source driver IC (integrated circuit) block and VCOM line. The RTC data will be calculated current sub-color frame data value and previous sub-color frame data vale at sample pixel location. During normal sub-color frame, all the sub-color data will be written on the display panel without any manipulated value and sub-color LED BLU win turn on sequentially according to the display scanning period. During idle sub-color frame periods each sub-color LED BLU will turn on according to each sub color displayed in the panel. For example, the red LED lamp is on during red data display, the green LED lamp is on during green data display, and the blue LED lamp is on during blue data display. The boost, normal, idle sub-color frame will be around 1.85 ms respectively. During the idle sub-color frame the display, RGB data can be written again in case. All of the Mth frame data will be displayed during M+1th input data frame and the writing time of RGB display data which means input display data timing of source driver IC is around 1.85 ms during boost sub-color frame and 1.85 ms during normal sub-color frame period. The RGB LED lamp turn on time at each RGB LED block is around 1.85*(1+¾) ms=3.24 ms. There might be shortened boost sub-color period and/or shortened normal sub-color frame period and longer idle sub-color frame period to increase RGB LED turn on time in case. Furthermore, depending on a particular implementation as a preferred embodiment of the invention, the sub-color frame may not just be three, but six, nine, twelve, or any other desired sub-color frame numbers to improve optical performance.

FIG. 13E shows a LCD Panel timing at a novel FSCLCD architecture having slow LC with RGB LED package, in accordance with a preferred embodiment of the invention. In the gate vertical scanning method, the number of TFT switches in the display panel is N*M, when N columns*M rows of color display image are used, and the gate scanning line is the row line and the source data line is the column line in the panel. In the gate horizontal scanning method, the number of TFT switches in the display panel is N*M, when N columns*M rows of color display image are used, and the gate scanning line is the column line and the source data line is the row line in the panel. One frame has three sub-color frames which are red, green and blue sub-color frame. Each 1 sub-color frame has boost sub-color frame, normal sub-color frame and idle sub-color frame. Boost sub-color frame has VAB (vertical active boost) period and VBB (vertical blank at boost) period. VAB period means total gate line count and it can be M in gate vertical scanning FSCLCD or N in gate horizontal scanning FSCLCD. During VAB period, source output data is a boosted data using RTC concept and VCOM & gray scale reference voltage are boosted too in case to reduce the response time of liquid crystal. VBB period is blank period between boost sub-color frame and normal sub-color frame and can be short enough to increase idle sub-color frame period and can be zero value. Normal sub-color frame has VAN (vertical active normal) period and VBN (vertical blank normal) period. VAN period means total gate line count and it can be M in gate vertical scanning FSCLCD or N in gate horizontal scanning FSCLCD. During VAN period, source output data is a normal data having no manipulation and VCOM & gray scale reference voltage are also normal value to display regular data in the display panel. VBN period is a blank period between normal sub-color frame and idle sub-color frame and can be flexible value to increase idle sub-color frame period. Idle sub-color frame has VAI (vertical active idle) period and VBI (vertical blank idle) period. VAI period means total gate line count and it can be arbitrary value including zero. During VAI period, source output data can be normal data or high-Z output which mean infinite impedance and VCOM & gray scale reference voltage are regular voltage, and there might be GSP (gate start pulse) if source output is valid during VAI period. VBI period is blank period between idle sub-color frame and boost sub-color frame and can be arbitrary value including zero to optimize idle sub-color frame period. Therefore 1 sub-color frame period is (VAB+VBB+VAN+VBN+VAI+VBI)*GSC period, where GSC is a gate shift clock.

Except for the VAB and VAN, the other four values of VBB, VBN, VAI, VBI can be arbitrary to optimize the optical performance in FSCLCD. The sub-color LED BLU can be turn on at VBN start time if RGB LED BLU has just one block, or at ½*VAN time before VBN stat if RGB LED BLU has two block divided, or at ¾*VAN time before VBN stat if RGB LED BLU has 4 block divided. The more divided RGB LED block, the longer RGB LED BLU time, however more cost. Therefore the number of RGB LED divided block must be optimized considering performance and cost. Furthermore sub-color frame period at each sub-color (i.e. red, green and blue) can be adjustable. All three sub-color frame periods need not to be same period. The green color sub-frame period can be longer than blue and red color sub-frame in case. GSC (gate shift clock) frequency will be determined by total number of (VAB+VBB+VAN+VBN+VAI+VBI) in a sub-color frame, and sub-color frame period will be determined by number of sub-color frame in a frame period. There can be not only three sub-color frame but also additional sub-color frame as like white color sub-frame. The GSC (gate shift clock) shifts GSP (gate start pulse) to each gate lines in the LCD panel with GOE (gate output enable), which can enable low-level gate output voltage in the picture. The source output voltage will be synchronized to the each gate line on time. All the gate lines are turned on sequentially from G1 (gate1) to GLast (gate last).

FIG. 13F shows a three sub-color frame at a novel FSCLCD architecture with one block RGB LED package, in accordance with a preferred embodiment of the invention. The sub-color frame period is 5.56 ms. The boost, normal and idle sub-color frame period is 1.85 ms which is a ⅓ of sub-color frame, the total number of gate clock is VAB+VBB+VAN+VBN+VAI+VBI in a boost, normal, and idle sub-color frame. Sub-color LED turns on time is 1.85 ms which is same as idle sub-color frame at only one block RGB LED package. By the way, each sub color frame duration can be different period in a frame, which means that each color can have different VBB, VBN, VBI values and also can have VAI in case of no source output during idle sub-color frame time. Each boost, normal and idle sub-color frame in a sub-color frame can be different period which means that VBB, VBN, VBI can be different in a specific sub-color frame. Each LED turn on time will be increased more around (X−1)/X*1.85 ms if X blocks of RGB LED package are used and the duration on boost, normal and idle sub-color frame is same and all the sub-color frame has same period. The one frame can have several times of all the sub-color frame, which means not only just one time of red, green, blue but also double, triple or K times where K is a integer so that FSCLCD can have the best optical performance.

FIG. 13G shows an additional white sub-color frame at a novel FSCLCD architecture with one block RGB LED package, in accordance with a preferred embodiment of the invention. There can be not only three sub-color frame but also additional sub-color frame as like white color sub-frame. The total sub-color frame will be four including white sub-color frame. The white color data can be calculated to using red, green and blue data, and during white sub-color frame all the RGB LED lamps will be turn on after liquid crystal transition completed. The timing concept is similar as three RGB sub-color frame except for four sub-color frame and reduced sub-color frame period.

FIG. 13H shows an additional yellow sub-color frame at a novel FSCLCD architecture with one block RGB LED package, in accordance with a preferred embodiment of the invention. There can be additional yellow sub-color frame. The total sub-color frame will be four including yellow sub-color frame. The yellow color data can be calculated to using red and green data, and during yellow sub-color frame, red and green LED lamps will be turn on after liquid crystal transition completed. The timing concept is similar as three RGB sub-color frame except for four sub-color frame and reduced sub-color frame period.

FIG. 13J shows a five sub-color frame at a novel FSCLCD architecture with one block RGB LED package, in accordance with a preferred embodiment of the invention. There can be additional yellow and white sub-color frame. The total sub-color frame will be five. The yellow color data can be calculated to using red and green data, and during yellow sub-color frame, red and green LED lamps will be turn on after liquid crystal transition completed. The white color data can be calculated to using red, green and blue data, and during white sub-color frame all the RGB LED lamps will be turn on after liquid crystal transition completed. The timing concept is similar as three RGB sub-color frame except for four sub-color frame and reduced sub-color frame period. Furthermore, one frame can have several times of all the sub-color frame, which means not only just one time of red, green, blue, yellow, white sub-color frame but also double, triple or K times where K is a integer so that FSCLCD can have the best optical performance.

FIG. 13K shows a voltage level at FSCLCD having line inversion mode to make quick white-black transition. The display data will be manipulated by interpolating current sub-color frame data and previous sub-color frame data by using RTC concept. The VCOM voltage can be overshoot or undershoot at every gate line scanning (horizontal or vertical line) period during boost sub-color frame period only and will keep normal voltage level during normal sub-color frame and idle sub-color frame period. The gray scale reference voltage will keep same voltage level among boost, normal and idle sub-color frame periods.

FIG. 13L shows a voltage level at FSCLCD having field inversion mode to make quick white-black transition. The display data will be manipulated by interpolating current sub-color frame data and previous sub-color frame data by using RTC concept. The VCOM voltage can be overshoot or undershoot at every boost sub-color frame period only among each sub-color frame, and will keep normal voltage level during normal sub-color frame and idle sub-color frame period. The gray scale reference voltage will keep same voltage level among boost, normal and idle sub-color frame periods.

FIG. 13M shows a voltage level at FSCLCD having dot (or column) inversion mode to make quick white-black transition. The display data will be manipulated by interpolating current sub-color frame data and previous sub-color frame data by using RTC concept. The gray scale reference voltage can be overshoot or undershoot during boost sub-color frame period only and will keep normal voltage level during normal sub-color frame and idle sub-color frame period. The VCOM voltage will keep same voltage level among all of boost, normal, and idle sub-color frame periods.

FIG. 13N shows a voltage level at FSCLCD having dot (or column) inversion mode with two Vcom connections to make quick white-black transition. The display data will be manipulated by interpolating current sub-color frame data and previous sub-color frame data by using RTC concept. The ODD VCOM voltage and EVEN VCOM voltage can be overshoot or undershoot during boost sub-color frame period only and will keep normal voltage level during normal sub-color frame and idle sub-color frame period. The gray scale reference voltage will keep same voltage level among boost, normal and idle sub-color frame period, or the gray scale reference voltage can be boosted.

FIG. 14 shows a compensated pixel data for reducing ununiformity at edge of modular LGP in a novel RGB LED BLU having 4 blocks of RGB LED packages, in accordance with a preferred embodiment of the invention. Although the modular LGP may have reflector at each side edge to prevent light dispersion to other modular LGP block, the brightness near each modular LGD's edge can be different. To improve the brightness uniformity at scanning BLU type as like FIG. 10D, the pixel voltage which means rms (root mean square) value of pixel and the voltage between VCOM and pixel electrode need to be adjusted compared to the uniformed area far from modular LGD edge. The compensated pixel voltage (Vrms) can be made by manipulated gray scale reference voltage during that gate scanning time only using voltage calculation from LUT (look up table). The LUT can be made by measurement of the difference on the modular LGP edge area. The LUT data can be written on memory as like EEPROM inside TCON or outside TCON. The display data voltage of sub-color during certain gate lines will be manipulated using the modified gray scale reference voltage. The modified gray scale voltage during certain gate line is made by interpolating the reference voltage and delta value of LUT for uniformity.

FIG. 15 shows an A-FSC (advanced field sequential color) TCON (timing controller) block diagram for a novel architecture in FSCLCD. The A-FSC TCON 320 includes Rx (receiver) block 800, Internal Clock Generator 801, Timing Control block 810, User Interface block 890, Frame Memory 820, Data Sequential Control block 830, LUT (look up table) for Data RTC 841, LUT for BLU uniformity 842, Data RTC block 850, VCOM & gray scale reference control block 860, LED control block 870, Driver IC Control block 880. Rx block 800 receives input display signals whose format can be TTL (Transistor-transistor logic), LVDS (low voltage differential signaling), TMDS (Transition Minimized Differential Signaling), DP (Display Port), eDP (embedded Display Port), MIPI (Mobile Industry Processor Interfac), MDDI (Mobile Display Digital Interface) and so on. Then, Rx block 800 provides decoded RGB (red, green, blue) display data to Frame Memory 820 and provides decoded control signals to Timing control block 810. Internal Clock Generator 801 generates internal main clock to be used in Rx block and at least some internal processing blocks. Timing control block 810 receives clock and sync signal and control signals, and makes all the internal timing control signals and provides the signals to internal blocks. Data Sequential Control block 830 controls Frame memory 820 and provides sequenced RGB display data to the Data RTC block 850. Data RTC block 850 calculate the output display data using LUT for RTC table 841 and provides manipulated sequential color data (RGB) to the source driver IC block 410. The VCOM & gray scale reference control block 860 generate manipulated VCOM and gray scale reference control signals during boost sub-color frame period. The VCOM & gray scale reference control block 860 can provides additional manipulated control signals using LUT for BLU uniformity 842 in case. Then, the VCOM & gray scale reference control block 860 provides control signals to VCOM voltage generator block 600 and Gray scale reference voltage generator block 700. LED control block 870 provide all the control signals on anode and cathode voltage of each RGB LED strings in the display panel, the control signals are for synchronization of the RGB LED turn on timing according to RGB display data. The LED control block 870 provides scanning RGB BLU timing to the each RGB LED string. Driver IC Control block 880 provides all the control signals to the source driver IC block 410 and gate driver IC block 510. User Interface block 890 communicate user interface signals including I2C (Inter-Integrated Circuit) bus and/or SPI (Serial Peripheral Interface) bus for the LUT for Data RTC 841 and LUT for BLU uniformity 842 and for other internal block configuration.

A third aspect of the invention, as shown and described in FIGS. 16~20, is related to methods and apparatuses driving an LCD with a dual common electrode to reduce the driving voltage in the source driver block for energy efficiency and reduced production costs. The LCD incorporating the third aspect of the invention may have a color filter of RGB pixel arrangement, or may not have a color filter at all, as in the case of FSCLCD. The source driver voltage can be under 3.6V with dot (sub-pixel) inversion so that it is able to make integrated single IC (source driver and TCON IC and/or frame memory and/or line memory) with lower voltage semiconductor fabrication process.

FIG. 16A shows a pixel structure of conventional CF (color filter) TFTLCD (thin film transistor liquid crystal display) having single VCOM (common electrode voltage) and RGB (red, green, blue) vertical stripe pixel arrangement for gate vertical scanning. A display panel with RGB (Red, Green, Blue) vertical stripe pixel arrangement for gate vertical scanning 100 has pixel arrays and a pixel 104 includes Red sub-pixel 101, Green sub-pixel 102 and Green sub-pixel 103. Each sub-pixel has single common electrode voltage (VCOM). This kind of LCD structure is popular in the present LCD industry. The display scanning direction is vertical direction from top to bottom or vice-versa from a frontal view. The number of TFT (thin film transistor) switches in the display panel is 3N*M, when N columns*M rows of color display image are used. The gate scanning line is row line and source data line is column line in the panel. The CLC (capacitor of liquid crystal) is connected to common electrode voltage (VCOM) and pixel electrode. The CST (storage capacitor) is connected to storage line voltage (VST) and pixel electrode in the drawing as an example. The CST can be connected to VCOM or the other metal line for example, previous gate line.

FIG. 16B shows a pixel structure of conventional CF TFT LCD having single VCOM and RGB Horizontal stripe pixel arrangement for gate vertical scanning. A display panel 110 has pixel arrays and a pixel 114 includes Red sub-pixel 111, Green sub-pixel 112 and Green sub-pixel 113. All the sub-pixel have single common electrode voltage (VCOM). This kind of LCD structure will be used to reduce the number of source driver IC. The display scanning direction is vertical direction from top to bottom or vice-versa from a frontal view. The number of TFT switches in the display panel is N*3M, when N columns*M rows of color display image are used. The gate scanning line is row line and source data line is column line in the panel.

FIG. 16C shows a pixel structure of bottom glass in conventional TN (twisted nematic) LCD for gate vertical scanning. The source line 161 provides analog voltage to the pixel electrode 165 from drain electrode 163 through pixel contact hole 164, and the TFT (thin film transistor) has active semiconductor layer (not shown in the picture) as like a-Si (amorphous silicon) or p-Si (poly silicon) in TFT LCD, source electrode 161, drain electrode 163, gate electrode 162. Common electrode voltage (VCOM) will be provided from VCOM electrode 166 in bottom glass to VCOM plate 166 in top glass through VCOM contact 169 as like Ag (silver) paste. Pixel or sub-pixel P (1, 1) means the pixel of sub-pixel of 1st row, 1st column in the display panel. P (1, last) is the pixel of sub-pixel of 1st row, last column, where the last column is 3N, when RGB vertical stripe pixel arrangement is used for CFLCD. The last column may be N, when RGB horizontal stripe pixel arrangement is used for CFLCD or FSCLCD. P (last, last) is the pixel of sub-pixel of last row, last column, where the last row is M when RGB vertical stripe pixel arrangement is used for CFLCD or FSCLCD. The last row may be 3M when RGB horizontal stripe pixel arrangement is used for CFLCD.

FIG. 16D shows a VCOM structure of top glass in conventional TN LCD having single VCOM for gate vertical scanning. The common electrode 166 is shown in gray in the top glass. VCOM (common electrode) 166 is a single plate of transparent conductor called Indium Tin Oxide (ITO) in general TN LCD.

FIG. 16E shows a overall structure of conventional TN LCD having single VCOM for gate vertical scanning. The VCOM plate 166 in the top glass is connected to VCOM line 166 through VCOM contact 169.

FIG. 16F shows an overall structure of conventional IPS LCD having single VCOM for gate vertical scanning. The source line 161 provides analog voltage to the pixel electrode 165 through the TFT which has active semiconductor layer (not shown in the picture), source electrode 161, drain electrode 163, gate line 162. Pixel or sub-pixel P (1, 1) means the pixel of sub-pixel of 1st row, 1st column in the display panel. P (1, last) is the pixel of sub-pixel of 1st row, last column, where the last column is 3N when RGB vertical stripe pixel arrangement is used for CFLCD. The last column may be N when RGB horizontal stripe pixel arrangement CFLCD or FSCLCD is used. P (last, last) is the pixel of sub-pixel of last row, last column, where the last row is M when RGB vertical stripe pixel arrangement is used for CFLCD or FSCLCD. The last row may be 3M when RGB horizontal stripe pixel arrangement is used for CFLCD. The common electrode 166 in bottom glass is shown in gray color.

FIG. 16G shows a pixel polarity and source driving voltage when dot (sub-pixel) inversion having conventional single VCOM is used. The LCD has N columns and M rows of pixel units. The voltage polarity of source driver output must be opposite polarity of previous frame's polarity based on VCOM voltage. The driving voltage range of source SVpp with single VCOM is over 6V to 15V or more in case of dot inversion or column inversion driving LCD usually. The VCOM voltage is a center voltage of source driving voltage if neglecting offset voltage of pixel voltage. The last column sub-pixel or pixel is 3N when RGB vertical stripe pixel arrangement is used for CFLCD. The last column may be N when RGB horizontal stripe pixel arrangement for CFLCD or FSCLCD is used. The last row sub-pixel or pixel is M when RGB vertical stripe pixel arrangement is used for CFLCD or FSCLCD. The last row may be 3M when RGB horizontal stripe pixel arrangement is used for CFLCD.

FIG. 16H and FIG. 16I show the inversion types in current LCD. Dot inversion, 1+2H, or 1+2V dot inversions are pervasively used algorithms. The line inversion has alternating VCOM voltage and pixel voltage per gate scanning line time and all the pixel voltage polarities are the same during a specific gate scanning period. The line inversion for vertical scanning will be row inversion for horizontal scanning method.

FIG. 17A shows an invented dual VCOM structure at gate vertical scanning for dot inversion or column inversion. Source line driving block 400 and gate line driving block 500 provides source driving voltage and gate scanning voltage to the display panel. The common electrode (VCOM) is separated to two sections, VCOMA and VCOMB. Odd column lines have VCOMA and even column lines have VCOMB. The display panel for these driving are CF TFTLCD panel having dual (or multi) VCOM and RGB vertical stripe pixels for gate vertical scanning 200, CF TFTLCD panel having dual (or multi) VCOM and RGB horizontal stripe pixels for gate vertical scanning 210, FSCLCD panel having dual (or multi) VCOM and no color filter for gate vertical scanning 220. The display panel in the invention can be TN, IPS, VA (vertical alignment), or FFS (Fringe field switching) LCD.

FIG. 17B shows a pixel structure of invented CF TFTLCD having dual VCOM and RGB vertical stripe pixel arrangement for gate vertical scanning. A display panel with RGB (Red, Green, Blue) vertical stripe pixel arrangement for gate vertical scanning 200 has pixel arrays and a pixel 204 includes Red sub-pixel 201, Green sub-pixel 202 and Green sub-pixel 203. The display scanning direction is vertical direction from top to bottom or vice-versa from a frontal view. The number of TFT (thin film transistor) switches in the display panel is 3N*M, when N columns*M rows of color display image are used. The gate scanning line is row line and source data line is column line in the panel.

The odd column pixel or sub-pixel is connected to common electrode voltage A (VCOMA) through CLC. The even column pixel or sub-pixel is connected to common electrode voltage B (VCOMB) through CLC. The CST (storage capacitor) is connected to storage line voltage A (VSTA) if odd column or storage line voltage B (VSTB) if even column. The VSTA or VSTB can be connected to VCOMA or VCOMB or the other metal line for example, previous gate line.

FIG. 17C shows a pixel structure of invented CF TFTLCD having dual VCOM and RGB horizontal stripe pixel arrangement for gate vertical scanning. A display panel with RGB (Red, Green, Blue) horizontal stripe pixel arrangement for gate vertical scanning 210 has pixel arrays and a pixel 214 includes Red sub-pixel 211, Green sub-pixel 212 and Green sub-pixel 213. The display scanning direction is vertical direction from top to bottom or vice-versa from a frontal view. The number of TFT (thin film transistor) switches in the display panel is N*3M, when N columns*M rows of color display image are used. The gate scanning line is row line and source data line is column line in the panel. The odd column pixel or sub-pixel is connected to common electrode voltage A (VCOMA) through CLC. The even column pixel or sub-pixel is connected to common electrode voltage B (VCOMB) through CLC. The CST (storage capacitor) is connected to storage line voltage A (VSTA) if odd column or storage line voltage B (VSTB) if even column. The VSTA or VSTB can be connected to VCOMA or VCOMB or the other metal line for example, previous gate line.

FIG. 17D shows a pixel structure of invented FSCLCD having dual VCOM and no color filter for gate vertical scanning. A display panel 220 has a pixel 224 having no color filter and has three color back light unit of red, green and blue instead of white color backlight at conventional CF (color filter) LCD. The display scanning direction is vertical direction from top to bottom or vice-versa from a frontal view. The number of TFT (thin film transistor) switches in the display panel is N*M, when N columns*M rows of color display image are used. The gate scanning line is row line and source data line is column line in the panel. The odd column pixel or sub-pixel is connected to common electrode voltage A (VCOMA) through CLC. The even column pixel or sub-pixel is connected to common electrode voltage B (VCOMB) through CLC. The CST (storage capacitor) is connected to storage line voltage A (VSTA) if odd column or storage line voltage B (VSTB) if even column. The VSTA or VSTB can be connected to VCOMA or VCOMB or the other metal line for example, previous gate line.

FIG. 17E shows a pixel structure of bottom glass in invented TN LCD having dual VCOM for gate vertical scanning. The source line 161 provides analog voltage to the pixel electrode 165 through the TFT which has active semiconductor layer (not shown in the picture), source electrode, drain electrode 163, gate line 162. Pixel or sub-pixel P (1, 1) means the pixel of sub-pixel of 1st row, 1st column in the display panel. P (1, last) is the pixel of sub-pixel of 1st row, last column, where the last column is 3N, when RGB vertical stripe pixel arrangement is used for CFLCD. The last column may be N when RGB horizontal stripe pixel arrangement is used for CFLCD or FSCLCD. P (last, last) is the pixel of sub-pixel of last row, last column, where the last row is M, when RGB vertical stripe pixel arrangement is used for CFLCD or FSCLCD. The last row may be 3M when RGB horizontal stripe pixel arrangement is used for CFLCD. The common electrode A 167 and common electrode B 168 in bottom glass are shown in gray. The number of last row and last column can be variable if 3D (three dimensional) stereoscopic display is used. A 3D display may have the double the number of rows or columns of a 2D display. This type with non-interlaced gate scanning method can support better power consumption at column inversion because of lowest source voltage polarity change. This type with interlaced gate scanning method can support better power consumption at dot inversion because of lowest source voltage polarity change.

FIG. 17F shows a VCOM structure of top glass in invented TN LCD having single VCOM for gate vertical scanning. The common electrode A 167 and common electrode B 168 in top glass are shown in gray.

FIG. 17G shows an overall structure of invented TN LCD having dual VCOM for gate vertical scanning. VCOM (common electrode) has two split ITO electrodes.

FIG. 17H shows an overall structure of invented IPS LCD having dual VCOM for gate vertical scanning. The source line 161 provides analog voltage to the pixel electrode 165 through the TFT which has active semiconductor layer (not shown in the picture), source electrode, drain electrode 163, gate line 162. Pixel or sub-pixel P (1, 1) means the pixel of sub-pixel of 1st row, 1st column in the display panel. P (1, last) is the pixel of sub-pixel of 1st row, last column where the last column is 3N, when RGB vertical stripe pixel arrangement is used for CFLCD. The last column may be N when RGB horizontal stripe pixel arrangement is used for CFLCD or FSCLCD. P (last, last) is the pixel of sub-pixel of last row, last column, where the last row is M when RGB vertical stripe pixel arrangement is used for CFLCD or FSCLCD. The last row 3M when RGB horizontal stripe pixel arrangement is used for CFLCD. The common electrode A 167 and common electrode B 168 in bottom glass are shown in gray. The number of last row and last column can be variable if 3D (three dimensional) stereoscopic display is used. A 3D display may have double the number of rows and columns typically present in a 2D display. This type with non-interlaced gate scanning method can support better power consumption at column inversion because of lowest source voltage polarity change. This type with gate interlaced scanning method can support better power consumption at dot inversion because of less source voltage polarity change. The common electrode A 167 and common electrode B 168 in bottom glass are shown in gray. VCOM (common electrode) has two split electrodes.

FIG. 17J shows an invented dual VCOM structure at gate horizontal scanning for dot inversion or column inversion. Source line driving block 400 and gate line driving block 500 provides source driving voltage and gate scanning voltage to the display panel. The common electrodes (VCOM) are separated to two sections, VCOMA and VCOMB. Odd column lines have VCOMA and even column lines have VCOMB. The display panel for these driving are CF TFTLCD panel having dual (or multi) VCOM and RGB vertical stripe pixels for gate vertical scanning 230, FSCLCD panel having dual (or multi) VCOM and no color filter for gate vertical scanning 250. The display panel in the invention can be TN, IPS, VA, or FFS LCD.

FIG. 17K shows a pixel structure of invented CF TFT LCD having dual VCOM and RGB Vertical stripe pixel arrangement for gate horizontal scanning. A display panel with RGB (Red, Green, Blue) vertical stripe pixel arrangement for gate vertical scanning 230 has pixel arrays and a pixel 234 includes Red sub-pixel 231, Green sub-pixel 232 and Green sub-pixel 233. The display scanning direction is horizontal direction from left to right or vice-versa from a frontal view. The number of TFT (thin film transistor) switches in the display panel is N*3M, when N columns*M rows of color display image are used. The gate scanning line is column line and source data line is row line in the panel. The odd row pixel or sub-pixel is connected to common electrode voltage A (VCOMA) through CLC. The even row pixel or sub-pixel is connected to common electrode voltage B (VCOMB) through CLC. The CST (storage capacitor) is connected to storage line voltage A (VSTA) if odd row or storage line voltage B (VSTB) if even row. The VSTA or VSTB can be connected to VCOMA or VCOMB or the other metal line for example, previous gate line.

FIG. 17L shows a pixel structure of invented FSCLCD having dual VCOM and no color filter for gate horizontal scanning. A display panel 250 has a pixel 254 having no color filter and has three color back light unit of red, green and blue instead of white color backlight at conventional CF (color filter) LCD. The display scanning direction is horizontal direction from left to right or vice-versa from a frontal view. The number of TFT (thin film transistor) switches in the display panel is N*M, when N columns*M rows of color display image are used. The gate scanning line is column line and source data line is row line in the panel. The odd row pixel or sub-pixel is connected to common electrode voltage A (VCOMA) through CLC. The even row pixel or sub-pixel is connected to common electrode voltage B (VCOMB) through CLC. The CST (storage capacitor) is connected to storage line voltage A (VSTA) if odd column or storage line voltage B (VSTB) if even column. The VSTA or VSTB can be connected to VCOMA or VCOMB or the other metal line for example, previous gate line.

FIG. 17M shows an overall structure of invented TN LCD having dual VCOM for gate horizontal scanning. The source line 161 provides analog voltage to the pixel electrode 165 through the TFT which has active semiconductor layer (not shown in the picture), source electrode, drain electrode 163, gate line 162. Pixel or sub-pixel P (1, 1) means the pixel of sub-pixel of 1st row, 1st column in the display panel. P (1, last) is the pixel of sub-pixel of 1st row, last column, where the last column is 3N, when RGB vertical stripe pixel arrangement is used for CFLCD. The last column may be N when FSCLCD is used. P (last, last) is the pixel of sub-pixel of last row, last column, where the last row is M when RGB vertical stripe pixel arrangement is used for CFLCD or FSCLCD. The common electrode A 167 and common electrode B 168 in bottom glass are shown in gray. The number of last row and last column can be variable if 3D (three dimensional) stereoscopic display is used. A 3D display may have double the number of rows and columns typically present in a 2D display, if the 3D display has the same resolution as the 2D display. This type with non-interlaced gate scanning method can support better power consumption at row inversion because of lowest source voltage polarity change, where row inversion has an alternative polarity at each neighboring pixel or sub-pixel in a specific gate scanning time period. Furthermore, this type with gate interlaced scanning method can support better power consumption at dot inversion because of lowest source voltage polarity change.

FIG. 17N shows an overall structure of invented IPS LCD having dual VCOM for gate horizontal scanning. The source line 161 provides analog voltage to the pixel electrode 165 through the TFT which has active semiconductor layer (not shown in the picture), source electrode, drain electrode 163, gate line 162. Pixel or sub-pixel P (1, 1) means the pixel of sub-pixel of 1st row, 1st column in the display panel. P (1, last) is the pixel of sub-pixel of 1st row, last column where the last column is 3N when RGB vertical stripe pixel arrangement for CFLCD is used, or N when FSCLCD is used. P (last, last) is the pixel of sub-pixel of last row, last column, where the last row is M when RGB vertical stripe pixel arrangement CFLCD or FSCLCD is used. The common electrode A 167 and common electrode B 168 in bottom glass are shown in gray. The number of last row and last column can be variable if 3D (three dimensional) stereoscopic display is used. A 3D display may have double the number of rows and columns typically present in a 2D display. This type with non-interlaced gate scanning method can support better power consumption at row inversion because of lowest source voltage polarity change, where row inversion has a alternative polarity at each neighboring pixel or sub-pixel in a specific gate scanning time period. This type with gate interlaced scanning method can support better power consumption at dot inversion because of less source voltage polarity change. The common electrode A 167 and common electrode B 168 in bottom glass are shown in gray. VCOM (common electrode) has two split electrodes.

FIG. 17P shows a pixel polarity and source driving voltage when dot (sub-pixel) inversion having dual VCOM is used. The VCOMA is alternating with opposite phase of source output SA (nth) and the VCOMB is alternating with opposite phase of source output SB (nth). The SVpp value at dual VCOM structure will be less than a half of SVpp value at single VCOM structure. The output of source is also changing per each gate line to make dot inversion. The last column sub-pixel or pixel is 3N when RGB vertical stripe pixel arrangement is used for CFLCD. The last column sub-pixel or pixel may be N when RGB horizontal stripe pixel arrangement is used for CFLCD or FSCLCD. The last row sub-pixel or pixel is M when RGB vertical stripe pixel arrangement is used for CFLCD or FSCLCD. The last row sub-pixel or pixel may be 3M when RGB horizontal stripe pixel arrangement is used for CFLCD.

FIG. 17Q shows a pixel polarity and source driving voltage when dot (sub-pixel) inversion having dual VCOM and interlaced scanning is used. The VCOMA is alternating with opposite phase of source output SA (nth) and the VCOMB is alternating with opposite phase of source output SB (nth). The SVpp value at dual VCOM structure will be less than a half of SVpp value at single VCOM structure. The output of source is changing per each half frame period to make lower polarity transition at dot inversion for lower power consumption. The interlaced gate scanning method needs one frame memory and specific gate scanning structure. So its driving method is more efficient if the LCD has to have one frame buffer for response time compensation as like RTC (response time compensation) block or OD (over drive) block for G to G (gray to gray) response time reduction.

FIG. 18A shows an invented VCOM structure at gate vertical scanning for advanced dot inversion or advanced column inversion. Source line driving block 400 and gate line driving block 500 provides source driving voltage and gate scanning voltage to the display panel. The common electrode (VCOM) is separated to two, VCOMA and VCOMB. Odd column lines have VCOMA and even column lines have VCOMB. The TFT (thin film transistor) switch is connected to source data line or electrode with zigzag (delta) structure. All the pixels are connected to VCOMA and VCOMB as like zigzag (delta) line. The display panel for these driving are CF TFTLCD panel having advanced dual (or multi) VCOM and RGB vertical stripe pixels for gate vertical scanning 300, CF TFTLCD panel having advanced dual (or multi) VCOM and RGB horizontal stripe pixels for gate vertical scanning 310, FSCLCD panel having advanced dual (or multi) VCOM and no color filter for gate vertical scanning 320. The number of source output in advanced dot inversion structure is one line more than the number of normal dot inversion structure. The display panel in the invention can be TN, IPS, VA, or FFS LCD.

FIG. 18B shows a pixel structure of invented CF TFTLCD having advanced dual VCOM and RGB vertical stripe pixel arrangement for gate vertical scanning. An advanced display panel with RGB (Red, Green, Blue) vertical stripe pixel arrangement for gate vertical scanning 300 has pixel arrays and a pixel 304 includes Red sub-pixel 301, Green sub-pixel 302 and Green sub-pixel 303. The display scanning direction is vertical direction from top to bottom or vice-versa from a frontal view. The number of TFT (thin film transistor) switches in the display panel is 3N*M, when N columns*M rows of color display image are used. The gate scanning line is row line and source data line is column line in the panel. The odd column pixel or sub-pixel is connected to common electrode voltage A (VCOMA) or common electrode voltage B (VCOMB) through CLC. The even column pixel or sub-pixel is connected to common electrode voltage B (VCOMB) or common electrode voltage A (VCOMA) through CLC. The CST (storage capacitor) is connected to storage line voltage A (VSTA) if odd column or storage line voltage B (VSTB) if even column. The VSTA or VSTB can be connected to VCOMA or VCOMB or the other metal line for example, previous gate line.

FIG. 18C shows a pixel structure of invented CF TFTLCD having advanced dual VCOM and RGB horizontal stripe pixel arrangement for gate vertical scanning. An advanced display panel with RGB (Red, Green, Blue) horizontal stripe pixel arrangement for gate vertical scanning 310 has pixel arrays and a pixel 314 includes Red sub-pixel 311, Green sub-pixel 312 and Green sub-pixel 313. The display scanning direction is vertical direction from top to bottom or vice-versa from a frontal view. The number of TFT (thin film transistor) switches in the display panel is N*3M, when N columns*M rows of color display image are used. The gate scanning line is row line and source data line is column line in the panel. The odd column pixel or sub-pixel is connected to common electrode voltage A (VCOMA) or common electrode voltage B (VCOMB) through CLC. The even column pixel or sub-pixel is connected to common electrode voltage B (VCOMB) or common electrode voltage A (VCOMA) through CLC. The CST (storage capacitor) is connected to storage line voltage A (VSTA) if odd column or storage line voltage B (VSTB) if even column. The VSTA or VSTB can be connected to VCOMA or VCOMB or the other metal line for example, previous gate line.

FIG. 18D shows a pixel structure of invented FSCLCD having advanced dual VCOM and no color filter for gate vertical scanning. An advanced display panel 320 has a pixel 324 having no color filter and has three color back light unit of red, green and blue instead of white color backlight at conventional CF (color filter) LCD. The display scanning direction is vertical direction from top to bottom or vice-versa from a frontal view. The number of TFT (thin film transistor) switches in the display panel is N*M, when N columns*M rows of color display image are used. The gate scanning line is row line and source data line is column line in the panel. The odd column pixel or sub-pixel is connected to common electrode voltage A (VCOMA) or common electrode voltage B (VCOMB) through CLC. The even column pixel or sub-pixel is connected to common electrode voltage B (VCOMB) or common electrode voltage A (VCOMA) through CLC. The CST (storage capacitor) is connected to storage line voltage A (VSTA) if odd column or storage line voltage B (VSTB) if even column. The VSTA or VSTB can be connected to VCOMA or VCOMB or the other metal line for example, previous gate line.

FIG. 18E shows a overall structure of invented TN LCD having advanced dual VCOM for gate vertical scanning. The source line 161 provides analog voltage to the pixel electrode 165 through the TFT which has active semiconductor layer (not shown in the picture), source electrode, drain electrode 163, gate line 162. Pixel or sub-pixel P (1, 1) means the pixel of sub-pixel of 1st row, 1st column in the display panel. P (1, last) is the pixel of sub-pixel of 1st row, last column, where the last column is 3N, when RGB vertical stripe pixel arrangement is used for CFLCD, or N when RGB horizontal stripe pixel arrangement is used for CFLCD and FSCLCD. P (last, last) is the pixel of sub-pixel of last row, last column where the last row is M, when RGB vertical stripe pixel arrangement is used for CFLCD or FSCLCD. The law row may be 3M when RGB horizontal stripe pixel arrangement is used for CFLCD. The common electrode A 167 and common electrode B 168 in top glass are connected through VCOM contact 169 from VCOMA and VCOMB in bottom glass and shown in gray. The number of last row and last column can be variable if 3D (three dimensional) stereoscopic display is used. A 3D display may have double the number of rows and columns typically present in a 2D display. This type with non-interlaced gate scanning method can support better power consumption at dot inversion because of lowest source voltage polarity change.

FIG. 18F shows an overall structure of invented IPS LCD having advanced dual VCOM for gate vertical scanning. The source line 161 provides analog voltage to the pixel electrode 165 through the TFT which has active semiconductor layer (not shown in the picture), source electrode, drain electrode 163, gate line 162. Pixel or sub-pixel P (1, 1) means the pixel of sub-pixel of 1st row, 1st column in the display panel. P (1, last) is the pixel of sub-pixel of 1st row, last column where the last column is 3N when RGB vertical stripe pixel arrangement is used for CFLCD, or N when RGB horizontal stripe pixel arrangement is used for CFLCD or FSCLCD. P (last, last) is the pixel of sub-pixel of last row, last column, where the last row is M, when RGB vertical stripe pixel arrangement is used for CFLCD or FSCLCD. The last row may be 3M when RGB horizontal stripe pixel arrangement is used for CFLCD. The common electrode A 167 and common electrode B 168 in bottom glass are shown in gray. The number of last row and last column can be variable if 3D (three dimensional, stereoscopic display). A 3D display may have double the number of rows and columns typically present in a 2D display. This type with non-interlaced gate scanning method can support better power consumption at dot inversion because of lowest source voltage polarity change.

FIG. 18G shows an invented advanced dual VCOM structure at gate horizontal scanning for dot inversion or column inversion. Source line driving block 400 and gate line driving block 500 provides source driving voltage and gate scanning voltage to the display panel. The common electrode (VCOM) is separated to two lines, VCOMA and VCOMB. Odd column lines have VCOMA and even column lines have VCOMB. The TFT (thin film transistor) switch is connected to source data line or electrode with zigzag (delta) structure. All the pixels are connected to VCOMA and VCOMB as like zigzag (delta) line. The display panel for these driving are CF TFTLCD panel having advanced dual (or multi) VCOM and RGB vertical stripe pixels for gate horizontal scanning 330, FSCLCD panel having advanced dual (or multi) VCOM and no color filter for gate horizontal scanning 350. The number of source output in advanced dot inversion structure is one line more than the number of normal dot inversion structure. The display panel in the invention can be TN, IPS, VA, FFS or LCD.

FIG. 18H shows a pixel structure of invented CF TFT LCD having advanced dual VCOM and RGB Vertical stripe pixel arrangement for gate horizontal scanning. An advanced display panel with RGB (Red, Green, Blue) vertical stripe pixel arrangement for gate vertical scanning 330 has pixel arrays and a pixel 334 includes Red sub-pixel 331, Green sub-pixel 332 and Green sub-pixel 333. The display scanning direction is horizontal direction from left to right or vice-versa from a frontal view. The number of TFT (thin film transistor) switches in the display panel is N*3M, when N columns*M rows of color display image are used. The gate scanning line is column line and source data line is row line in the panel. The odd row pixel or sub-pixel is connected to common electrode voltage A (VCOMA) or common electrode voltage B (VCOMB) through CLC. The even row pixel or sub-pixel is connected to common electrode voltage B (VCOMB) or common electrode voltage A (VCOMA) through CLC. The CST (storage capacitor) is connected to storage line voltage A (VSTA) if odd row or storage line voltage B (VSTB) if even row. The VSTA or VSTB can be connected to VCOMA or VCOMB or the other metal line for example, previous gate line.

FIG. 18J shows a pixel structure of invented FSCLCD having advanced dual VCOM and no color filter for gate horizontal scanning. An advanced display panel 350 has a pixel 354 having no color filter and has three color back light unit of red, green and blue instead of white color backlight at conventional CF (color filter) LCD. The display scanning direction is horizontal direction from left to right or vice-versa from a frontal view. The number of TFT (thin film transistor) switches in the display panel is N*M, when N columns*M rows of color display image are used. The gate scanning line is column line and source data line is row line in the panel. The odd row pixel or sub-pixel is connected to common electrode voltage A (VCOMA) or common electrode voltage B (VCOMB) through CLC. The even row pixel or sub-pixel is connected to common electrode voltage B (VCOMB) or common electrode voltage A (VCOMA) through CLC. The CST (storage capacitor) is connected to storage line voltage A (VSTA) if odd column or storage line voltage B (VSTB) if even column. The VSTA or VSTB can be connected to VCOMA or VCOMB or the other metal line for example, previous gate line.

FIG. 18K shows a overall structure of invented TN LCD having advanced dual VCOM for gate horizontal scanning. The source line 161 provides analog voltage to the pixel electrode 165 through the TFT which has active semiconductor layer (not shown in the picture), source electrode, drain electrode 163, gate line 162. Pixel or sub-pixel P (1, 1) means the pixel of sub-pixel of 1st row, 1st column in the display panel. P (1, last) is the pixel of sub-pixel of 1st row, last column, where the last column is 3N when RGB vertical stripe pixel arrangement is used for CFLCD, or N for FSCLCD. P (last, last) is the pixel of sub-pixel of last row, last column, where the last row is M when RGB vertical stripe pixel arrangement is used for CFLCD or FSCLCD. The common electrode A 167 and common electrode B 168 in bottom glass and top glass are shown in gray. The number of last row and last column can be variable if 3D (three dimensional) stereoscopic display is used. A 3D display may have double the number of rows and columns typically present in a 2D display having the same resolution as the 3D display. This type with non-interlaced gate scanning method can support better power consumption at dot inversion because of lowest source voltage polarity change.

FIG. 18L shows an overall structure of invented IPS LCD having advanced dual VCOM for gate horizontal scanning. The source line 161 provides analog voltage to the pixel electrode 165 through the TFT which has active semiconductor layer (not shown in the picture), source electrode, drain electrode 163, gate line 162. Pixel or sub-pixel P (1, 1) means the pixel of sub-pixel of 1st row, 1st column in the display panel. P (1, last) is the pixel of sub-pixel of 1st row, last column, where the last column is 3N when RGB vertical stripe pixel arrangement is used for CFLCD, or N for FSCLCD. P (last, last) is the pixel of sub-pixel of last row, last column where the last row is M when RGB vertical stripe pixel arrangement is used for CFLCD or FSCLCD. The common electrode A 167 and common electrode B 168 in bottom glass are shown in gray. The number of last row and last column can be variable if 3D (three dimensional) stereoscopic display is used. A 3D display may have double the number of rows and columns of a 2D display. This type with non-interlaced gate scanning method can support better power consumption at dot inversion because of lowest source voltage polarity change. The common electrode A 167 and common electrode B 168 in bottom glass are shown in gray. VCOM (common electrode) has two split electrodes.

FIG. 18M shows a pixel polarity and source driving voltage if dot (sub-pixel) inversion having advanced dual VCOM and non-interlaced scanning is used. The VCOMA is alternating with opposite phase of source output SA (nth) and the VCOMB is alternating with opposite phase of source output SB (nth). The SVpp value at dual VCOM structure will be less than a half of SVpp value at single VCOM structure. The output of source is also changing per each frame to make dot inversion which is a lowest polarity change and lowest power consumption in the source driver output block.

FIG. 19A shows a pixel structure of bottom glass in invented TN LCD having dual VCOM and dual gate line for gate vertical scanning. The source line 161 provides analog voltage to the pixel electrode 165 through the TFT which has active semiconductor layer (not shown in the picture), source electrode, drain electrode 163, gate line 162. Pixel or sub-pixel P (1, 1) means the pixel of sub-pixel of 1st row, 1st column in the display panel. P (1, last) is the pixel of sub-pixel of 1st row, last column, where the last column is 3N when RGB vertical stripe pixel arrangement is used for CFLCD, or N when RGB horizontal stripe pixel arrangement is used for CFLCD or FSCLCD. P (last, last) is the pixel of sub-pixel of last row, last column, where the last row is M when RGB vertical stripe pixel arrangement is used for CFLCD or FSCLCD. The last row may be 3M when RGB horizontal stripe pixel arrangement is used for CFLCD. The common electrode A 167 and common electrode B 168 in bottom glass are shown in gray. The number of gate scanning line is double of normal LCD in order to reduce the chip size of source driver IC. If the display is a not landscape mode but portrait mode then the dual gate line structure will be very helpful to the single integrated chip application of both source driver and TCON to the display panel with shrink source driver IC. The number of last row and last column can be variable if 3D stereoscopic display is used. A 3D display may have double the number of rows and columns of a 2D display. The display panel in the invention can be VA (vertical alignment) LCD as well.

FIG. 19B shows an overall structure of invented TN LCD having dual VCOM and dual gate line for gate vertical scanning. The common electrode A 167 and common electrode B 168 in top glass are connected through VCOM contact 169 from VCOMA and VCOMB in bottom glass and shown in gray. The IPS or any other type of LCD having dual gate line can have similar structure as TN's, therefore no further explanation on it.

FIG. 19C shows a timing diagram when gate vertical scanning in CF TFT LCD having dual gate line with RGB vertical stripe pixel arrangement is used. The gate output signals from gate line driving block 500 are turn on sequentially, G1 (1st gate pulse at 1st row pixel), G2 (2nd gate line pulse at 1st row pixel), . . . G2M−1 (last−1th gate pulse at Mth row pixel), G2M (last gate pulse at Mth row pixel) in the N (column)*M (row) display. GSP (gate start pulse) will initiate gate shift block (not shown in drawing) with GSC (gate shift clock), and the each gate pulse width will be decided by GOE (gate output enable, gate pulse will be high only during GOE low duration). The gate pulse width will be almost half of one of normal single gate line structure. The source output signal from source line driving block 400 will be synchronized to each gate pulse of G1, G2 . . . GM.

FIG. 20A shows an another embodiment of invented dual VCOM structure at gate vertical scanning for 1+2H dot inversion or 1+2H column inversion. The dual VCOM structure can be variable to the inversion method. The display panel in the invention can be TN, IPS, VA, or FFS LCD.

FIG. 20B shows an another embodiment of invented dual VCOM structure at gate vertical scanning for 2H dot inversion or 2H column inversion. The dual VCOM structure can be variable to the inversion method. The display panel in the invention can be TN, IPS, VA, or FFS LCD.

FIG. 20C shows an another embodiment of invented dual VCOM structure at gate horizontal scanning for 1+2V dot inversion or 1+2V column inversion. The dual VCOM structure can be variable to the inversion method. The display panel in the invention can be TN, IPS, VA, or FFS LCD.

FIG. 20D shows another embodiment of invented dual VCOM structure at gate horizontal scanning for 2V dot inversion or 2V column inversion. The dual VCOM structure can be variable to the inversion method. The display panel in the invention can be TN, IPS, VA, or FFS LCD.

FIG. 21 shows a LCD driving method and types. A LCD has several inversion methods. Dot inversion is a popular method in TFTLCD, which has a different pixel voltage polarity with all the neighboring pixels. The dot inversion is not much good at dot pattern and the dot pattern is a common pattern in the common software. Therefore 1+2H or 2H or 1+2V or 2V dot inversion are using instead of simple dot inversion. The column inversion is a inversion having different pixel polarity in a specific gate scanning line period at conventional gate vertical scanning method, and keeps the same polarity of pixel voltage during one frame period while the dot inversion changes polarity of pixel voltage per every gate scanning period during one frame. The row inversion is a inversion having different pixel polarity in a specific gate scanning line period at gate horizontal scanning method, and keeps the same polarity of pixel voltage during one frame period as like column inversion, while line inversion has same polarity of pixel voltage during a specific gate scanning period. The VCOM voltage of all the dot inversion method with a single VCOM structure will be almost at the center of the pixel voltage if the pixel offset voltage is neglected. The line inversion has a same polarity of pixel voltage in specific gate scanning period and change the polarity of pixel voltage at next gate scanning period at gate vertical scanning method. The VCOM voltage is changing synchronized to changes of polarity of pixel voltage. The field inversion has same pixel voltage polarity at all the pixels in one frame and has different pixel voltage polarity at next frame. The display performance at line inversion and field inversion is not good enough therefore these two inversion method of line and field are not used in large size LCD as like notebook or monitor or television application. The high end small size LCD may needs dot inversion-like method. A LCD has two types of pixel structure, CFLCD and FSCLCD. CFLCD has RGB vertical stripe, RGB horizontal stripe and RGB delta structure. A LCD has four types of scanning. Gate vertical, non-interlaced scanning is a most popular method. Gate horizontal non-interlaced scanning, Gate vertical interlaced scanning, Gate horizontal interlaced driving method is not popular. Gate interlaced scanning is helpful to reduce power consumption at source driver while it needs one frame memory. Gate horizontal scanning will be helpful to make simple driving structure in display panel because of reduced source output while it needs dual frame memory. Therefore gate interlaced scanning with gate horizontal scanning has a merit on power consumption and simple driving structure, for example single IC chip integrated source driver and TCON having no more source driver IC, it may have gate driver in case. A LCD has two types on gate line structure. Single gate line structure is a common design implementation. Dual gate structure is helpful to reduce the size of source driver chip. A LCD may have single VCOM or dual VCOM. Single VCOM is conventional one. Dual VCOM structure will be helpful to make source driver IC having frame memory or line memory because of lower driving voltage. The voltage of source analog output can be less than 3.6V which is a common digital voltage, which means that it does not necessary high voltage semiconductor process when fabricating the chip, and the gamma reference voltage block needs two separated gamma reference voltage string having positive voltage range from VSS+0.1 to VDD−0.1 and negative voltage range VDD−0.1 to VSS+0.1 where VDD is driver analog supply voltage, typical voltage can be 3.3V or less and VSS is ground voltage, while conventional single VCOM driver IC has positive voltage range from 0.5 VDD to VDD−0.1 and negative voltage range from VSS+0.1 to 0.5 VDD where VDD voltage is a range of 6 to 15V or more in general. In case of landscape mode LCD, the LCD structure of gate horizontal scanning, gate interlaced scanning and dual VCOM can be available with single source row driver TCON IC, only single chip with lower driving voltage can operate LCD. In case of portrait LCD, the LCD structure of gate vertical scanning, gate non-interlaced scanning, dual gate line and dual VCOM can be available with single source column driver TCON IC, only single chip with lower driving voltage can operate LCD.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for providing an interlaced scan in a liquid crystal display (LCD), the method comprising:

receiving a set of display data comprising N by M, wherein N is the number of columns in the display data and M is the number of rows in the display data;

providing electrical power to odd-numbered rows with positive polarities to each pixel located at the odd-numbered rows and a first consecutive pair of columns, and with negative polarities to each pixel located at the odd-numbered rows and a second consecutive pair of columns adjacent to the first consecutive pair of columns in a first temporal subframe;

providing the electrical power to even-numbered rows with negative polarities to each pixel located at the even-numbered rows and a third consecutive pair of columns, and with positive polarities to each pixel located at the even numbered rows and a fourth consecutive pair of columns adjacent to the third consecutive pair of columns in a second temporal subframe, wherein the first temporal subframe and the second temporal subframe comprise an odd frame;

providing the electrical power to the odd-numbered rows with the negative polarities to each pixel located at the odd-numbered rows and a fifith consecutive pair of columns, and with the positive polarities to each pixel located at the odd-numbered rows a sixth consecutive pair columns adjacent to the fifth consecutive pair of columns in a third temporal subframe; and providing the electrical power to the even-numbered rows with the positive polarities to each pixel located at the even-numbered rows and a seventh consecutive pair of columns, and with the negative polarities to each pixel located at the even numbered rows and an eighth consecutive pair of columns adjacent to the seventh consecutive pair of columns in a fourth temporal subframe, wherein the third temporal subframe and the fourth temporal subframe comprise an even frame.

2. The method of claim 1, wherein each step of providing electrical power to each pixel utilizes electrical power provided by a source driver IC.

3. The method of claim 1, wherein the interlaced scan further comprises a repeated sequence of the first temporal subframe, the second temporal subframe, the third temporal subframe, and the fourth temporal subframe in each complete interlaced scan cycle, and one or more vertical blank periods.

4. The method of claim 1, wherein the interlaced scan utilizes a frame memory to store at least some display data for use during the first period or the second period.

5. The method of claim 1, further comprising a blocking of electrical power to one set of gates during the odd frame utilizes a "gate output enable even" (GOEEVEN), and wherein the blocking of electrical power to another set of gates during the even frame utilizes a "gate output enable odd" (GOEODD).

6. The method of claim 1, wherein the interlaced scan is used for a color filter liquid crystal display (CFLCD), or a field sequential color liquid crystal display (FSCLCD) without a color filter.

7. The method of claim 1, wherein the LCD uses an RGB vertical stripe pixel arrangement with a gate vertical scanning or a gate horizontal scanning.

8. The method of claim 1, wherein the LCD uses an RGB horizontal stripe pixel arrangement with a gate vertical scanning or a gate horizontal scanning.

9. The method of claim 1, wherein the LCD uses a field sequential display method and a gate vertical or gate horizontal scanning.

10. A method for providing an interlaced scan in a liquid crystal display (LCD), the method comprising:

receiving a set of display data comprising N by M, wherein N is the number of columns in the display data and M is the number of rows in the display data;

providing electrical power to odd-numbered rows with positive polarities to each pixel located at the odd-numbered rows and a leftmost column, and also to each pixel located at the odd-numbered rows and a rightmost column in a first temporal subframe;

providing the electrical power to the odd-numbered rows with negative polarities to each pixel located at the odd-numbered rows and a first consecutive pair of columns adjacent to the leftmost column in the first temporal subframe;

providing the electrical power to the odd-numbered rows with the positive polarities to each pixel located at the odd-numbered rows and a second consecutive pair of columns adjacent to the first consecutive pair of columns in the first temporal subframe;

providing the electrical power to even-numbered rows with the negative polarities to each pixel located at the even-numbered rows and the leftmost column, and also to each pixel located at the even-numbered rows and the rightmost column in a second temporal subframe;

providing the electrical power to the even-numbered rows with the positive polarities to each pixel located at the even-numbered rows and a third consecutive pair of columns adjacent to the leftmost column in a second temporal subframe;

providing the electrical power to the even-numbered rows with the negative polarities to each pixel located at the even-numbered rows and a fourth consecutive pair of columns adjacent to the third consecutive pair of columns in the second temporal subframe, wherein the first temporal subframe and the second temporal subframe comprise an odd frame;

providing the electrical power to the odd-numbered rows with the negative polarities to each pixel located at the odd-numbered rows and the leftmost column, and also to each pixel located at the odd-numbered rows and the rightmost column in a third temporal subframe;

providing the electrical power to the odd-numbered rows with the positive polarities to each pixel located at the odd-numbered rows and a fifth consecutive pair of columns adjacent to the leftmost column in the third temporal subframe;

providing the electrical power to the odd-numbered rows with the negative polarities to each pixel located at the odd-numbered rows and a sixth consecutive pair of columns adjacent to the fifth consecutive pair of columns in the third temporal subframe;

providing the electrical power to the even-numbered rows with the positive polarities to each pixel located at the even-numbered rows and the leftmost column, and also to each pixel located at the even-numbered rows and the rightmost column in a fourth temporal subframe;

providing the electrical power to the even-numbered rows with the negative polarities to each pixel located at the even-numbered rows and a seventh consecutive pair of columns adjacent to the leftmost column in the fourth temporal subframe; and providing the electrical power to the even-numbered rows with the positive polarities to each pixel located at the even-numbered rows and an eighth consecutive pair of columns adjacent to the seventh consecutive pair of columns in the fourth temporal subframe, wherein the third temporal subframe and the fourth temporal subframe comprise an even frame.

11. The method of claim 10, wherein the each step of providing electrical power to each pixel utilizes electrical power provided by a source driver IC.

12. The method of claim 10, wherein the interlaced scan further comprises a repeated sequence of the first temporal subframe, the second temporal subframe, the third temporal subframe, and the fourth temporal subframe in each complete interlaced scan cycle, and one or more vertical blank periods.

13. The method of claim 10, wherein the interlaced scan utilizes a frame memory to store at least some display data for use during the first period or the second period.

14. The method of claim 10, further comprising a blocking of electrical power to one set of gates during the odd frame utilizes a "gate output enable even" (GOEEVEN), and wherein the blocking of electrical power to another set of gates during the even frame utilizes a "gate output enable odd" (GOEODD).

15. The method of claim 10, wherein the interlaced scan is used for a color filter liquid crystal display (CFLCD), or a field sequential color liquid crystal display (FSCLCD) without a color filter.

16. The method of claim 10, wherein the LCD uses an RGB vertical stripe pixel arrangement with a gate vertical scanning or a gate horizontal scanning.

17. The method of claim 10, wherein the LCD uses an RGB horizontal stripe pixel arrangement with a gate vertical scanning or a gate horizontal scanning.

18. The method of claim 10, wherein the LCD uses a field sequential display method and a gate vertical or gate horizontal scanning.

* * * * *